US010932631B2

(12) United States Patent
Conrad et al.

(10) Patent No.: US 10,932,631 B2
(45) Date of Patent: Mar. 2, 2021

(54) ROTATABLE BRUSH FOR SURFACE CLEANING APPARATUS

(71) Applicant: Omachron Intellectual Property Inc., Hampton (CA)

(72) Inventors: Wayne Ernest Conrad, Hampton (CA); Dave Petersen, Bowmanville (CA)

(73) Assignee: Omachron Intellectual Property Inc., Hampton (CA)

( * ) Notice: Subject to any disclaimer, the term of this patent is extended or adjusted under 35 U.S.C. 154(b) by 358 days.

(21) Appl. No.: 15/939,592

(22) Filed: Mar. 29, 2018

(65) Prior Publication Data

US 2019/0298123 A1 Oct. 3, 2019

(51) Int. Cl.

| | |
|---|---|
| ***A47L 7/00*** | (2006.01) |
| ***A47L 11/40*** | (2006.01) |
| ***A46B 13/00*** | (2006.01) |
| ***A46B 13/02*** | (2006.01) |
| ***A46B 9/12*** | (2006.01) |
| ***A47L 11/24*** | (2006.01) |

(52) U.S. Cl.

CPC ..... *A47L 7/0066* (2013.01); *A46B 9/12* (2013.01); *A46B 13/006* (2013.01); *A47L 11/24* (2013.01); *A47L 11/4041* (2013.01); *A46B 13/02* (2013.01)

(58) Field of Classification Search

CPC .... A47L 7/0066; A47L 11/4041; A47L 11/24; A47L 9/0494; A47L 9/0477; A47L 5/26; A47L 7/00; A47L 9/04; A46B 9/12; A46B 13/006; A46B 13/02; A46B 3/16

See application file for complete search history.

(56) References Cited

U.S. PATENT DOCUMENTS

| | | | |
|---|---|---|---|
| 2,251,899 | A | 8/1941 | Smellie |
| 3,225,374 | A | 12/1965 | Daley et al. |
| 3,649,984 | A | 3/1972 | Kershaw et al. |
| 4,426,751 | A | 1/1984 | Nordeen |
| 5,452,490 | A | 9/1995 | Brundula et al. |
| 6,108,853 | A | 8/2000 | Dittus |
| 7,159,276 | B2 | 1/2007 | Omoto et al. |
| D747,052 | S | 1/2016 | Therrien |
| 9,314,140 | B2 | 4/2016 | Eriksson |
| 9,326,654 | B2 | 5/2016 | Doughty |
| 9,763,549 | B2 | 9/2017 | Hyun et al. |
| 10,117,554 | B2 | 11/2018 | Williamson et al. |

(Continued)

FOREIGN PATENT DOCUMENTS

| | | |
|---|---|---|
| CN | 102240191 A | 11/2011 |
| EP | 0992211 A2 | 4/2000 |

(Continued)

OTHER PUBLICATIONS

Total Patent: English machine translation of the Abstract of CN102240191, published on Nov. 16, 2011.

(Continued)

*Primary Examiner* — David Redding

(74) *Attorney, Agent, or Firm* — Philip C. Mendes da Costa; Bereskin & Parr LLP/S.E.N.C.R.L., s.r.l.

(57) ABSTRACT

A surface cleaning apparatus includes a rotatably mounted brush associated with a dirty air inlet. A plurality of bristles extend outwardly from a radial outer surface of the rotatably mounted brush. At least some of the bristles are encased in a sheath.

12 Claims, 98 Drawing Sheets

(56) References Cited

U.S. PATENT DOCUMENTS

| | | | |
|---|---|---|---|
| 2003/0066150 | A1 | 4/2003 | Stegens et al. |
| 2005/0125941 | A1 | 6/2005 | Joung |
| 2008/0086837 | A1 | 4/2008 | Son et al. |
| 2009/0229075 | A1 | 9/2009 | Eriksson |
| 2010/0037418 | A1 | 2/2010 | Hussey et al. |
| 2010/0306958 | A1 | 12/2010 | Follows et al. |
| 2012/0311813 | A1 | 12/2012 | Gilbert, Jr. et al. |
| 2013/0212831 | A1 | 8/2013 | Follows et al. |
| 2014/0053351 | A1 | 2/2014 | Kapoor et al. |
| 2014/0259475 | A1 | 9/2014 | Doughty |
| 2014/0259522 | A1 | 9/2014 | Kasper et al. |
| 2016/0100726 | A1 | 4/2016 | Downey et al. |
| 2016/0166052 | A1 | 6/2016 | Kasper et al. |
| 2016/0166127 | A1 | 6/2016 | Lewis |
| 2016/0213217 | A1 | 7/2016 | Doughty |
| 2017/0296010 | A1 | 10/2017 | Li et al. |
| 2017/0296021 | A1 | 10/2017 | Li et al. |
| 2017/0296023 | A1 | 10/2017 | Qiao et al. |
| 2018/0338655 | A1* | 11/2018 | Schregardus ..... A47L 9/0477 |

FOREIGN PATENT DOCUMENTS

| | | | |
|---|---|---|---|
| GB | 2425715 | A | 11/2006 |
| WO | 99/27834 | A1 | 6/1999 |
| WO | 2005/020779 | A1 | 3/2005 |
| WO | 2009/149722 | A1 | 12/2009 |
| WO | 2010/142971 | A1 | 12/2010 |
| WO | 2012/149572 | A2 | 11/2012 |
| WO | 2015/015166 | A1 | 2/2015 |
| WO | 2015/015167 | A2 | 2/2015 |

OTHER PUBLICATIONS

Total Patent: English machine translation of the Abstract of EP0992211, published on Apr. 12, 2000.

U.S. Appl. No. 60/747,791, filed May 19, 2006, in the name of Deepak Kapoor.

U.S. Appl. No. 15/939,569.

U.S. Appl. No. 15/939,660.

U.S. Appl. No. 15/939,607.

U.S. Appl. No. 15/939,696.

* cited by examiner

ROTATABLE BRUSH FOR SURFACE CLEANING APPARATUS

FIELD

This disclosure relates generally to rotary brushes for use with surface cleaning apparatus. More specifically, this disclosure relates to brushes (which may also be referred to as brush rolls) with one or more features for inhibiting or preventing hair, string, or other strand-like debris from becoming embedded or lodged within bristles mounted on the brush roll, and/or from becoming wound about the brush roll.

INTRODUCTION

The following is not an admission that anything discussed below is part of the prior art or part of the common general knowledge of a person skilled in the art.

A cleaning head of a vacuum cleaner or other surface cleaning apparatus may be provided with one or more rotating agitators to assist in dislodging debris from a surface being cleaned, and/or to assist in conveying debris towards a dirty air inlet of the vacuum cleaner. For example, a brush roll having a number of tufts and/or rows of bristles extending radially outwardly from the brush roll may be provided in a cleaning head. In use, the brush roll may be rotated so that the bristles are brought into and out of contact with the surface being cleaned, thereby agitating debris on the surface.

Brush rolls are often effective at dislodging dust and other particulate debris from a surface, and/or at directing such particulate debris towards a dirty air inlet. However, debris such as hair, string, or other strand-like material may become embedded or otherwise entangled in the bristles of a typical brush roll. If a significant quantity of hair, string, or other strand-like material becomes embedded in the bristles, the performance of the brush roll may be impaired. Once such debris becomes embedded in the bristles, it may be difficult to dislodge from the brush roll. For example, a user may have to manually cut and/or otherwise manipulate such debris in order to dislodge it from the bristles, which may be considered a time consuming and/or otherwise undesirable task.

SUMMARY

The following introduction is provided to introduce the reader to the more detailed discussion to follow. The introduction is not intended to limit or define any claimed or as yet unclaimed invention. One or more inventions may reside in any combination or sub-combination of the elements or process steps disclosed in any part of this document including its claims and figures.

In accordance with one aspect of this disclosure, which may be used alone or in combination with any other aspect, a surface cleaning apparatus may be provided with a rotatable brush roll that has a plurality of bristles extending outwardly from its radial outer surface, along with leading and trailing hair blocking members, such as flexible elastomeric strips or segments, that are provided to inhibit or prevent hair, string, or other strand-like material from becoming embedded in the bristles. The hair blocking members are provided on opposite sides of the bristles, so that when the brush roll is rotated the forward hair blocking member precedes the bristles, and the trailing hair blocking member follows the bristles.

An advantage of this design is that the radial outer ends of the leading and trailing hair blocking members define a plane that may extend adjacent to or through the outer ends of the bristles. In this way, if a hair or other piece of strand-like debris contacts the ends of both the leading and trailing hair blocking members, the hair may extend and remain taut between the hair blocking members, and thereby be inhibited or prevented from becoming embedded deep in the bristles. For example, if the plane defined by the end of the hair blocking members extends through the outer end of the bristles, hair or other strand-like debris may be inhibited or prevented from migrating into the bristles beyond the intersection of the plane and the bristle ends.

Optionally, the hair blocking member is flexible. For example, it may be made from an elastomeric material. Accordingly, it may be resiliently deformable.

Optionally, the leading and trailing hair blocking members and the bristles may have similar heights or, alternatively, one may have a similar height and one may be shorter (e.g. the radial length of the trailing blocking member and the radial length of the bristles may be about the same, and the leading hair blocking member may be shorter than the bristles). An advantage of this design is that, when the ends of the bristles and the ends of the leading and trailing hair blocking members are in contact with a surface being cleaned, the outer ends of the leading and trailing hair blocking members may deform to essentially lie in the same plane as the ends of the bristles (i.e., they may all lie in the plane of the floor being cleaned). When the brush rolls continues to rotate such that the bristles and the leading and trailing hair blocking members are no longer in contact with the floor, then the leading and trailing hair blocking members may rebound to their non-deformed shape. If one, e.g., the trailing hair blocking member, is about the same height as the bristles, then once rebounded the leading and trailing hair blocking members may define a plane that extends adjacent to or through the outer ends of the bristles. In this way, if hair or other strand-like debris has migrated or otherwise become embedded into the bristles, when the bristle ends contacts the surface being cleaned, some or all of the embedded hair may be drawn taut between the hair blocking members, and thereby be partially or completely dislodged from the bristles, or at least migrated outwardly towards the ends of the bristles. Further, the action of the trailing hair blocking member rebounding to its non-deformed shape may not only pull hair out of the bristles but may possibly cause the hair to snap if the action of rebounding applies a tensile force greater than the yield strength of the hair.

In accordance with this broad aspect, there is provided a surface cleaning apparatus comprising:

a) an air flow path extending from a dirty air inlet to a clean air outlet with an air treatment member and a suction motor provided in the air flow path;

b) a rotatably mounted brush associated with the dirty air inlet, the rotatably mounted brush having an axis of rotation, a length in the axial direction, a radial outer surface, and first and second axially spaced apart sides;

c) a plurality of bristles extending outwardly from the radial outer surface, the bristles having a bristle length from the radial outer surface to an outer end of the bristles;

d) a leading hair blocking member provided adjacent a forward rotational side of the bristles, the leading hair blocking member having a length from the radial outer surface to an outer end of the leading hair blocking member; and, e) a trailing hair blocking member provided adjacent a rearward rotational side of the bristles, the trailing hair blocking member having a length from the radial outer surface to an outer end of the trailing hair blocking member.

In any embodiment, the leading hair blocking member may abut the forward rotational side of the bristles.

In any embodiment, the trailing hair blocking member may abut the rearward rotational side of the bristles.

In any embodiment, the leading hair blocking member may be spaced from 1 to 5 mm, optionally from 2 to 4 mm, forward of the forward rotational side of the bristles.

In any embodiment, the trailing hair blocking member may be spaced from 1 to 5 mm, optionally from 2 to 4 mm, the rearward rotational side of the bristles.

In any embodiment, the length of the leading hair blocking member may be smaller than the length of the bristles.

In any embodiment, the length of the trailing hair blocking member may be proximate the length of the bristles.

In any embodiment, the length of the trailing hair blocking member may be proximate the length of the bristles.

In any embodiment, the length of the trailing hair blocking member may be at least 80% the length of the bristles but may not extend outward of the outer end of the bristles.

In any embodiment, when the bristles and the trailing hair blocking member each contact a floor, the outer ends of the leading and trailing hair blocking members may define a plane that is adjacent the outer ends of the bristles.

In any embodiment, when the bristles and the trailing hair blocking member each contact a floor, the outer ends of the leading and trailing hair blocking members may define a plane that is adjacent the outer ends of the bristles.

In any embodiment, the leading and trailing hair blocking members may each comprise a flexible member that extends between the first and second axially spaced apart sides.

In any embodiment, at least one of the leading and trailing hair blocking members may comprise a plurality of abutting segments positioned axially along the rotatably mounted brush.

In any embodiment, at least one of the leading and trailing hair blocking members may extend continuously between the first and second axially spaced apart sides.

In any embodiment, the leading and trailing hair blocking members may be less flexible than the bristles.

In any embodiment, the trailing hair blocking member may be less flexible than the leading hair blocking member.

Also in accordance with this broad aspect, there is also provided a surface cleaning apparatus comprising:

a) an air flow path extending from a dirty air inlet to a clean air outlet with an air treatment member and a suction motor provided in the air flow path;

b) a rotatably mounted brush associated with the dirty air inlet, the rotatably mounted brush having an axis of rotation, a length in the axial direction, a radial outer surface, and first and second axially spaced apart sides;

c) a plurality of bristles extending outwardly from the radial outer surface, the bristles having a bristle length from the radial outer surface to an outer end of the bristles;

d) a leading hair blocking member provided forward of a forward rotational side of the bristles, the leading hair blocking member having a length from the radial outer surface to an outer end of the leading hair blocking member; and, e) a trailing hair blocking member provided rearward of a rearward rotational side of the bristles, the trailing hair blocking member having a length from the radial outer surface to an outer end of the trailing hair blocking member, wherein, when the bristles and the trailing hair blocking member each contact a floor, the outer ends of the leading and trailing hair blocking members define a plane that is adjacent the outer ends of the bristles, and wherein the length of the leading hair blocking member is smaller than the length of the bristles.

In any embodiment, the length of the trailing hair blocking member may be at least 80% the length of the bristles but may not extend outward of the outer end of the bristles.

In any embodiment, the leading and trailing hair blocking members may be less flexible than the bristles.

In any embodiment, the trailing hair blocking member may be less flexible than the leading hair blocking member.

In accordance with a second aspect of this disclosure, which may be used alone or in combination with any other aspect, a surface cleaning apparatus may be provided with a rotatable brush roll that has a plurality of bristles extending outwardly from its radial outer surface, and at least one, optionally a plurality, and optionally all of the bristles are encased in a sheath to inhibit or prevent hair, string, or other strand-like material from becoming deeply embedded in the bristles encased by the sheath.

An advantage of this design is that as a piece of hair, string, or another piece of strand-like material migrates inwardly between sheathed bristles, once it contacts the radial outer end of the bristle sheath, the hair may be inhibited or prevented from further inward migration, and thereby prevented from becoming deeply embedded in the bristles. For example, where some or all of the bristles are provided in the form of bristle tufts, some or all of the bristle tufts may be individually sheathed to inhibit or prevent hair, string, or other strand-like material from becoming embedded in the sheathed bristle tufts.

Optionally, the sheath is flexible. For example, it may be made from an elastomeric material. An advantage of providing a flexible sheath is that the sheath may have a limited or negligible impact on the ability of the sheathed bristles to bend or flex, e.g. when they contact a floor surface. For example, a bristle sheath may have a radial length of at least 50%, at least 75%, or at least 90% of the length of the bristles encased by the sheath. By providing a flexible sheath, the entire length of the bristles may be able to flex, even though only about 50%, 25%, or about 10% of the length of the bristles may protrude radially outwardly from the sheath.

In accordance with this second aspect, there is provided a surface cleaning apparatus comprising:

a) an air flow path extending from a dirty air inlet to a clean air outlet with an air treatment member and a suction motor provided in the air flow path;

b) a rotatably mounted brush associated with the dirty air inlet, the rotatably mounted brush having an axis of rotation, a length in the axial direction and a radial outer surface; and, c) a plurality of bristles extending outwardly from the radial outer surface, the bristles having a bristle length from the radial outer surface to an outer end of the bristles, wherein at least some of the bristles are encased in a sheath which extends at least 50% of the length of the bristles and terminate prior to the outer end.

In any embodiment, the rotatable brush may comprise a plurality of tufts wherein each tuft may comprise a plurality of bristles wherein at least some of the tufts are encased in a sheath.

In any embodiment, the tufts may be spaced apart from each other and extend along the length of the rotatably mounted brush.

In any embodiment, the sheath may be flexible.

In any embodiment, the sheath may be comprised of an elastomeric material.

In any embodiment, the sheath may extend along at least 75% of the length of the bristles.

In any embodiment, the sheath may extend along at least 90% of the length of the bristles.

In any embodiment, the sheath may be generally circular in cross-section in a direction transverse to a radial length of the tufts.

Also in accordance with this second aspect, there is also provided a surface cleaning apparatus comprising:

a) an air flow path extending from a dirty air inlet to a clean air outlet with an air treatment member and a suction motor provided in the air flow path; and, b) a rotatably mounted brush associated with the dirty air inlet, the rotatably mounted brush having an axis of rotation, a length in the axial direction and a radial outer surface, a plurality of tufts extending outwardly from the radial outer surface, each tuft comprising a plurality of bristles, wherein at least some of the tufts are encased in a flexible sheath.

In any embodiment, the tufts may be spaced apart from each other and may extend along the length of the rotatably mounted brush.

In any embodiment, the sheath may be flexible.

In any embodiment, the sheath may be comprised of an elastomeric material.

In any embodiment, the sheath may be generally circular in cross-section in a direction transverse to a radial length of the tufts.

In any embodiment, the bristles have a bristle length from the radial outer surface to an outer end of the bristles, wherein at least some of the sheaths may extend at least 50% of the length of the bristles and may terminate prior to the outer end.

Also in accordance with this second aspect, there is also provided a surface cleaning apparatus comprising:

a) an air flow path extending from a dirty air inlet to a clean air outlet with an air treatment member and a suction motor provided in the air flow path; and, b) a rotatably mounted brush associated with the dirty air inlet, the rotatably mounted brush having an axis of rotation, a length in the axial direction and a radial outer surface, a plurality of tufts extending outwardly from the radial outer surface, each tuft comprising a plurality of bristles, wherein a radial inner portion of the bristles of at least some of the tufts, which radial inner portion is located outwardly from the radial outer surface of the rotatably mounted brush, are secured together to inhibit ingress of hairs.

In any embodiment, the radial inner portion may be at least 50% of a length of the bristles from the radial outer surface to an outer end of the bristles, wherein the radial inner portion terminates prior to the outer end.

In any embodiment, the radial inner portion may be at least 75% of the length of the bristles.

In any embodiment, the radial inner portion may be flexible.

In accordance with a third aspect of this disclosure, which may be used alone or in combination with any other aspect, a surface cleaning apparatus may be provided with a rotatable brush roll that has a plurality of bristle tufts, and a hair blocking member is provided within at least one of the tufts to inhibit or prevent hair, string, or other strand-like material from becoming deeply embedded in the bristles of that tuft. The hair blocking member is provided within the tuft so that when the brush roll is rotated, a portion of the bristles in the tuft precede the hair blocking member, and a portion of the bristles in the tuft follow the hair blocking member. Preferably, the outer end of the hair blocking member is at least as wide as the tuft.

Optionally, the radial length of the hair blocking member may be about the same as (i.e. proximate) the length of the bristles within the tuft. An advantage of this design is that the outer end of the hair blocking member may inhibit or prevent hair, string, or other strand-like material from becoming embedded in the bristles of the tuft in which it is positioned.

Optionally, the hair blocking member is flexible. For example, it may be made from an elastomeric material. Accordingly, it may be resiliently deformable. Accordingly, the hair blocking member may enable the tufts to flex the same as if the hair blocking member were not present.

Alternatively, the length of the hair blocking member may be less than the length of the bristles within the tuft, e.g. within about 80% to 99% of the length of the bristles. An advantage of this design is that as a piece of hair, string, or another piece of strand-like material migrates inwardly between the bristles of the tuft, if it contacts the radial outer end of the hair blocking member, the hair may be inhibited or prevented from further inward migration, and thereby prevented from becoming deeply embedded in the bristle tuft.

In accordance with this third aspect, there is provided a surface cleaning apparatus comprising:

a) an air flow path extending from a dirty air inlet to a clean air outlet with an air treatment member and a suction motor provided in the air flow path;

b) a rotatably mounted brush associated with the dirty air inlet, the rotatably mounted brush having an axis of rotation, a length in the axial direction, a radial outer surface, and first and second axially spaced apart sides; and, c) the rotatably mounted brush comprises a plurality of tufts wherein each tuft comprises a plurality of bristles extending outwardly from the radial outer surface, the bristles having a bristle length from the radial outer surface to an outer end of the bristles; and, d) a hair blocking member provided proximate at least one tuft of the plurality of tufts and between a forward rotational side of the at least one tuft and a rearward rotational side of the at least one tuft, the hair blocking member having a length from the radial outer surface to an outer end of the hair blocking member and the outer end of the hair blocking member has a width in an axial direction of the rotatably mounted brush which is at least as wide as the at least one tuft.

In any embodiment, the hair blocking member may comprise a plurality of segments positioned axially along the rotatable brush.

In any embodiment, each segment may comprise a support column extending outwardly from the radial outer surface and an outer end, and the outer end of each segment may be wider than at least a portion of the support column.

In any embodiment, the outer end of each segment may extend in a direction that is at an angle to the axial direction.

In any embodiment, the outer end of each segment may comprise a generally T-shaped member.

In any embodiment, the tufts may extend in at least one row between the first and second axially spaced apart sides and the hair blocking member may comprise a plurality of generally T-shaped member extending along the at least one row.

In any embodiment, the tufts may extend in at least one row between the first and second axially spaced apart sides and the outer end of each segment may extend generally parallel to the row of bristles.

In any embodiment, the hair blocking member may comprise a support column extending away from the radial outer surface and an outer end wherein at least a portion of the support column may be narrower than the outer end of the hair blocking member whereby the flexibility of the hair blocking member may be increased.

In any embodiment, the hair blocking member may extend continuously between the first and second axially spaced apart sides.

In any embodiment, the tufts may extend in at least one row between the first and second axially spaced apart sides and the hair blocking member may extend continuously between the first and second axially spaced apart sides.

In any embodiment, the tufts may extend in at least one row between the first and second axially spaced apart sides and the hair blocking member may comprise a flexible strip extending between the first and second axially spaced apart sides wherein the flexible strip is subdivided into a plurality of segments by a plurality of axially spaced apart breaks extending at least part way towards the radial outer surface from an outer end of the flexible strip.

In any embodiment, the length of the hair blocking member may be smaller than the length of the bristles.

In any embodiment, the length of the hair blocking member may be proximate the length of the bristles.

In any embodiment, the length of the hair blocking member may be at least 80% the length of the bristles but may not extend outward of the outer end of the bristles.

In any embodiment, the hair blocking member may be less flexible than the bristles.

Also in accordance with this third aspect, there is provided a surface cleaning apparatus comprising:

a) an air flow path extending from a dirty air inlet to a clean air outlet with an air treatment member and a suction motor provided in the air flow path;

b) a rotatably mounted brush associated with the dirty air inlet, the rotatably mounted brush having an axis of rotation, a length in the axial direction, a radial outer surface and first and second axially spaced apart sides; and, c) a plurality of bristles extending outwardly from the radial outer surface, the bristles having a bristle length from the radial outer surface to an outer end of the bristles; and, d) a hair blocking member between a forward rotational side of the bristles and a rearward rotational side of the bristles, the hair blocking member having a length from the radial outer surface to an outer end of the hair blocking member and a width in an axial direction of the rotatably mounted brush which is at least which is at least 50% of a width of the bristles.

In any embodiment, the length of the hair blocking member may be smaller than the length of the bristles.

In any embodiment, the length of the hair blocking member may be proximate the length of the bristles.

In any embodiment, the length of the hair blocking member may be at least 80% the length of the bristles but may not extend outward of the outer end of the bristles.

In any embodiment, the hair blocking member may be less flexible than the bristles.

In any embodiment, the bristles may be provided as a plurality of tufts and the hair blocking member may have a width that is at least 50% of a width of one of the tufts.

In accordance with a fourth aspect of this disclosure, which may be used alone or in combination with any other aspect, a surface cleaning apparatus may be provided with a rotatable brush roll that has a plurality of bristles extending outwardly from the brush core, and a heating element, such as a resistive heating element, is also provided exterior to the brush core. The heating element may be used to thermally degrade or break hair, string, or other strand-like material that has become wound about the brush roll.

An advantage of this design is that hair or other strand-like debris may be broken into smaller pieces without requiring the use of e.g. a knife, scissors, or other mechanical means. For example, instead of requiring a user to remove or otherwise access the brush roll and manually cut and/or dislodge the wound debris, a user may simply activate the resistive heating element. This may be considered more convenient and/or less laborious by a user.

Preferably, the heating element is operable at a temperature above a temperature at which hair burns and below a degradation temperature of the bristles. That is, the bristles may be unaffected (or at least only negligibly affected) by heat emitted by the heating element. An advantage of this design is that the heating element may be operated for longer periods of time without risk of damaging the bristles, which may lead to greater degradation of wound hair, string, or other strand-like material.

It will be appreciated that thermally degrading or burning hair may result in the emission of undesirable odors. Optionally, the suction motor of the surface cleaning apparatus may be operated when the heating element is actuated. Thus, some or all of the odorous particles released during the thermal degradation of the hair may be drawn into air treatment member of the surface cleaning apparatus, which may reduce or otherwise mitigate odors resulting from the thermal degradation.

Optionally a debriding member may be provided. The debriding member may be engaged after the heating element is actuated. The debriding member may be a rib or the like that extends past the outer end of the bristles. The debriding member may therefore dislodge truncated pieces of elongate material such as hair, which are formed by the use of the heating element.

In accordance with this fourth aspect, there is provided a surface cleaning apparatus comprising:

a) an air flow path extending from a dirty air inlet to a clean air outlet with an air treatment member and a suction motor provided in the air flow path;

b) a rotatably mounted brush associated with the dirty air inlet, the rotatably mounted brush having a brush core, an axis of rotation, a length in the axial direction, and first and second axially spaced apart sides; and, c) a plurality of bristles extending outwardly from the brush core, the bristles having a bristle length from the brush core to an outer end of the bristles;

wherein the rotatably mounted brush has a heating element that is positioned exterior to the brush core.

In any embodiment, the heating element may be operable at a temperature above a temperature at which hair burns and below a degradation temperature of the bristles.

In any embodiment, the heating element may comprise a resistive heating element.

In any embodiment, the heating element may extend between the first and second axially spaced apart sides.

In any embodiment, the heating element may extend continuously between the first and second axially spaced apart sides.

In any embodiment, bristles may be provided in at least one row extending between the first and second axially spaced apart sides and the heating element may be provided in the row of bristles.

In any embodiment, the heating element may be provided spaced from the brush core.

In any embodiment, the heating element may be provided radially outwardly from the brush core towards the outer end of the bristles.

In any embodiment, the bristles may have a radial outer portion located from a position 75% along the length of the bristles and the outer end of the bristles and the heating element may be located in the outer portion.

In any embodiment, the heating element may be provided on the brush core.

In any embodiment, the heating element may be provided adjacent at least one of a forward rotational side of the bristles and a rearward rotational side of the bristles.

In any embodiment, the heating element may be provided spaced from the brush core and the surface cleaning apparatus may further comprise more than two heating element support members spaced axially along the length of the brush.

In any embodiment, the heating element support members may be flexible.

In any embodiment, the heating element may only be operable when the suction motor is actuated.

In any embodiment, the heating element may be manually actuatable.

In any embodiment, the heating element may be automatically actuated when the suction motor is actuated.

In any embodiment, the heating element may be operable only when the rotatably mounted brush is positioned above a floor on which the surface cleaning apparatus is positioned.

In any embodiment, the surface cleaning apparatus may be an upright surface cleaning apparatus having a surface cleaning head which has the dirty air inlet and an upright section moveably mounted to the surface cleaning head between an upright storage position and a reclined floor cleaning position, the upright surface cleaning apparatus having a lift off mechanism operable between a floor cleaning position in which the rotatably mounted brush is positioned to clean a floor on which the surface cleaning head is positioned and a raised position in which the rotatably mounted brush is spaced from the floor, and the heating element may be operable when the lift off mechanism is in the raised position.

In any embodiment, the lift off mechanism may be automatically moved to the raised position when the upright section is moved into the upright storage position and the surface cleaning apparatus may have a sensor operable to determine when the upright section is in the upright storage position and the heating element may be actuated when the sensor issues a signal indicative that the upright section is in the upright storage position.

In any embodiment, the heating element may be automatically actuated when the lift off mechanism is moved to the raised position.

In any embodiment, the suction motor may be operable at a first speed when the surface cleaning apparatus is operated to clean a floor and a second speed, which is lower than the first speed, when the heating element is actuated.

In accordance with a fifth aspect of this disclosure, which may be used alone or in combination with any other aspect, a surface cleaning apparatus may be provided with a rotatable brush roll that has at least one hard floor cleaning pad and a flexible protective pad member (e.g. bristles and/or bristle tufts). The protective pad member is spaced from the hard floor cleaning pad, so that the protective pad member can flex when engaging a surface to be cleaned without being limited by engagement with the hard floor cleaning pad.

An advantage of this design is that, even though the hard floor cleaning pad may be recessed radially from the outer end of the flexible protective pad member, when the end of the protective pad member has flexed due to contact with a surface being cleaned, the outer surface of the hard floor cleaning pad may also contact the floor surface. When the hard floor cleaning pad and the flexible protective pad member are both in contact with the floor surface, hair or other strand-like debris that has migrated or otherwise become embedded into the flexible protective pad member may be partially or completely dislodged from the protective pad member, or at least migrated outwardly towards the ends of the protective pad member.

Optionally, a second protective pad member may be provided on the other side of the hard floor cleaning pad from the second protective pad member. An advantage of this design is that the outer surface of the hard floor cleaning pad may inhibit or prevent hair, string, or other strand-like material from becoming embedded in the one or both of the first and second protective pad members. Also, hair or other strand-like debris that has migrated or otherwise become embedded into the first and/or second flexible protective pad members may be partially or completely dislodged from that protective pad member, or at least migrated outwardly towards the ends of that protective pad member, when the hard floor cleaning pad and that flexible protective pad member are both in contact with the floor surface.

In accordance with this fifth aspect, there is provided a surface cleaning apparatus comprising:

a) an air flow path extending from a dirty air inlet to a clean air outlet with an air treatment member and a suction motor provided in the air flow path;

b) a rotatably mounted brush associated with the dirty air inlet, the rotatably mounted brush having an axis of rotation, a length in the axial direction, a radial outer surface and first and second axially spaced apart sides;

c) at least one hard floor cleaning pad provided on the radial outer surface, the hard floor cleaning pad having a radial outer floor cleaning surface; and, d) a flexible first protective pad member having a length from the radial outer surface of the rotatably mounted brush to an outer end of the first protective pad member such that the outer end of the first protective pad member engages a floor as the rotatably mounted brush rotates, wherein the first protective pad member is positioned in one of the following positions:

i) spaced forwardly from a forward rotational side of the hard floor cleaning pad by a distance such that the first protective pad member can flex when the outer end of the first protective pad member engages the floor without being limited by engagement with the hard floor cleaning pad, and ii) spaced rearwardly from a rearward rotational side of the hard floor cleaning pad by a distance such that the first protective pad member can flex when the outer end of the first protective pad member engages the floor without being limited by engagement with the hard floor cleaning pad.

In any embodiment, the first protective pad member may be positioned spaced forwardly from a forward rotational side of the hard floor cleaning pad by a distance such that the first protective pad member can flex when the outer end of the first protective pad member engages the floor without being limited by engagement with the hard floor cleaning pad, and a flexible second protective pad member may be positioned spaced rearwardly from a rearward rotational side of the hard floor cleaning pad by a distance such that the second protective pad member can flex when the outer end of the second protective pad member engages the floor without being limited by engagement with the hard floor cleaning pad.

In any embodiment, the hard floor cleaning pad may be provided on a rigid support member.

In any embodiment, the hard floor cleaning pad may comprise a microfiber pad.

In any embodiment, the outer end of the first protective pad member may be positioned spaced ±1, 2, 3 mm radially inwardly or radially outwardly of the radial outer end of the floor cleaning pad. Optionally, the front protective pad member may be shorter than the rear protective pad member and/or the radial outer end of the floor cleaning pad.

In any embodiment, the outer end of the first protective pad member may be positioned spaced 1-12, 1-8, 1-4 or 1-2 mm forward from the forward rotational side of the hard floor cleaning pad.

In any embodiment, the outer end of the first protective pad member may be positioned spaced 1-12, 1-8, 1-4 or 1-2 mm rearward from the rearward rotational side of the hard floor cleaning pad.

In any embodiment, when the radial outer floor cleaning surface of the hard floor cleaning pad, the first protective pad member and the second protective pad member each contact the floor, the outer ends of the first and second protective pad members may define a plane that is outward of the radial outer floor cleaning surface of the hard floor cleaning pad.

In any embodiment, the first protective pad member may comprise a row of bristles positioned generally parallel to the hard floor cleaning pad.

In any embodiment, the bristles may be grouped into tufts and a radial inner portion of the tufts may be secured together to inhibit ingress of hairs.

In any embodiment, the radial inner portion of the tufts may be encased in a sheath.

In any embodiment, the first protective pad member may comprise a flexible strip that extends between the first and second axially spaced apart sides.

In any embodiment, the first protective pad member may comprise a plurality of abutting segments positioned axially along the rotatably mounted brush.

In any embodiment, the first protective pad member may extend continuously between the first and second axially spaced apart sides.

In any embodiment, the first protective pad member may comprise a flexible strip extending between the first and second axially spaced apart sides wherein the flexible strip is subdivided into a plurality of segments by a plurality of axially spaced apart breaks extending at least part way towards the radial outer surface from the outer end of the first protective pad member.

In any embodiment, the second protective pad member may be less flexible than the first protective pad member.

In any embodiment, the hard floor cleaning pad may be provided on a compressible support member and the compressible support member may be less flexible than the first protective pad member.

It will be appreciated by a person skilled in the art that an apparatus or method disclosed herein may embody any one or more of the features contained herein and that the features may be used in any particular combination or sub-combination.

These and other aspects and features of various embodiments will be described in greater detail below.

BRIEF DESCRIPTION OF THE DRAWINGS

For a better understanding of the described embodiments and to show more clearly how they may be carried into effect, reference will now be made, by way of example, to the accompanying drawings in which.

Figure 1:
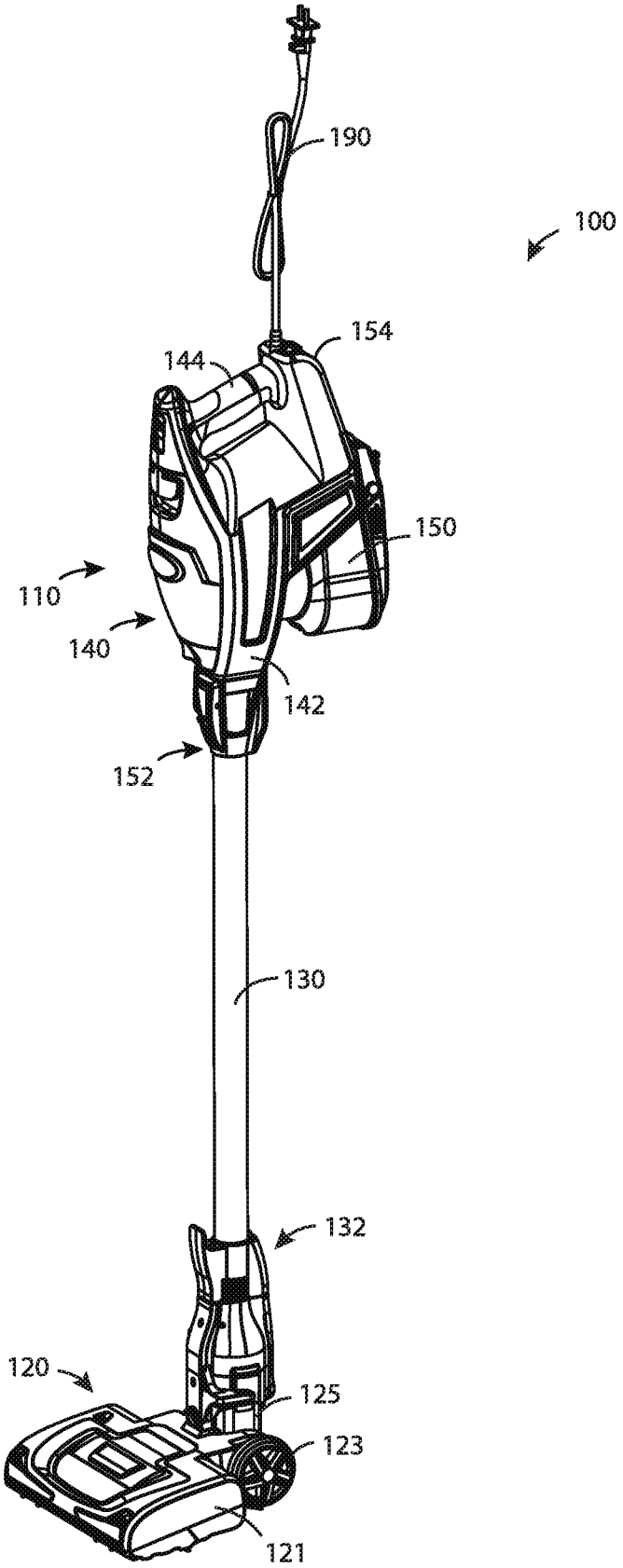
FIG. 1 is a perspective view of a surface cleaning apparatus in accordance with one embodiment.

The drawings included herewith are for illustrating various examples of articles, methods, and apparatuses of the teaching of the present specification and are not intended to limit the scope of what is taught in any way.

DESCRIPTION OF EXAMPLE EMBODIMENTS

Various apparatuses, methods and compositions are described below to provide an example of an embodiment of each claimed invention. No embodiment described below limits any claimed invention and any claimed invention may cover apparatuses and methods that differ from those described below. The claimed inventions are not limited to apparatuses, methods and compositions having all of the features of any one apparatus, method or composition described below or to features common to multiple or all of the apparatuses, methods or compositions described below. It is possible that an apparatus, method or composition described below is not an embodiment of any claimed invention. Any invention disclosed in an apparatus, method or composition described below that is not claimed in this document may be the subject matter of another protective instrument, for example, a continuing patent application, and the applicant(s), inventor(s) and/or owner(s) do not intend to abandon, disclaim, or dedicate to the public any such invention by its disclosure in this document.

The terms "an embodiment," "embodiment," "embodiments," "the embodiment," "the embodiments," "one or more embodiments," "some embodiments," and "one embodiment" mean "one or more (but not all) embodiments of the present invention(s)," unless expressly specified otherwise.

The terms "including," "comprising" and variations thereof mean "including but not limited to," unless expressly specified otherwise. A listing of items does not imply that any or all of the items are mutually exclusive, unless expressly specified otherwise. The terms "a," "an" and "the" mean "one or more," unless expressly specified otherwise.

As used herein and in the claims, two or more parts are said to be "coupled", "connected", "attached", or "fastened" where the parts are joined or operate together either directly or indirectly (i.e., through one or more intermediate parts), so long as a link occurs. As used herein and in the claims, two or more parts are said to be "directly coupled", "directly connected", "directly attached", or "directly fastened" where the parts are connected in physical contact with each other. None of the terms "coupled", "connected", "attached", and "fastened" distinguish the manner in which two or more parts are joined together.

Furthermore, it will be appreciated that for simplicity and clarity of illustration, where considered appropriate, reference numerals may be repeated among the figures to indicate corresponding or analogous elements. In addition, numerous specific details are set forth in order to provide a thorough understanding of the example embodiments described herein. However, it will be understood by those of ordinary skill in the art that the example embodiments described herein may be practiced without these specific details. In other instances, well-known methods, procedures, and components have not been described in detail so as not to obscure the example embodiments described herein. Also, the description is not to be considered as limiting the scope of the example embodiments described herein.

General Description of a Surface Cleaning Apparatus

Figure 2:
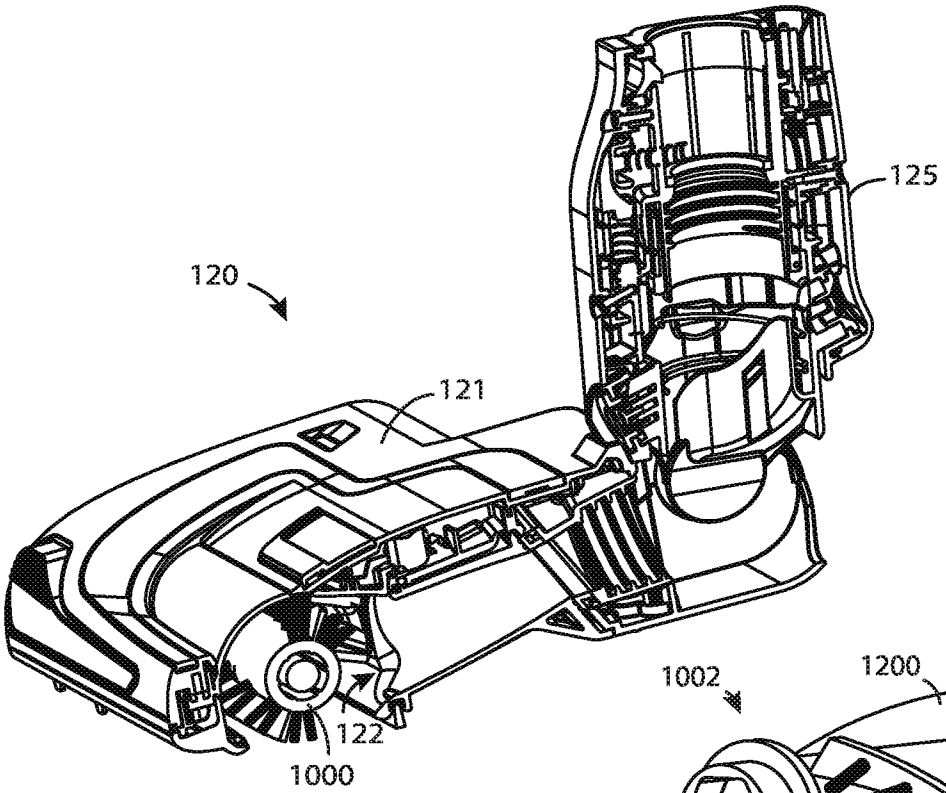
FIG. 2 is a perspective sectional view of a cleaning head of the surface cleaning apparatus of FIG. 1.

Referring to FIGS. 1 and 2, an exemplary embodiment of a surface cleaning apparatus is shown generally as 100. The following is a general discussion of this embodiment which provides a basis for understanding several of the features which are discussed herein. As discussed subsequently, each of the features may be used individually or in any particular combination or sub-combination in this or in other embodiments disclosed herein.

In the embodiment illustrated in FIG. 1, the surface cleaning apparatus 100 includes a hand-held vacuum cleaner 110, which is commonly referred to as a "hand vacuum cleaner" or a "handvac", a surface cleaning head 120, and an elongate wand 130. In this configuration, the surface cleaning apparatus may be characterized as a stickvac cleaning apparatus (e.g. a stickvac), and may be used to clean a floor or other surface in a manner analogous to a conventional upright-style vacuum cleaner. Optionally, surface cleaning apparatus 100 could be any other surface cleaning apparatus such as an upright vacuum cleaner, a canister vacuum cleaner, a wet-dry vacuum cleaner, an extractor and the like. The surface cleaning apparatus may be of any configuration and may use any air treatment or filtration member or members.

As exemplified in FIG. 1, the surface cleaning apparatus 100 may comprise a main body 140 having housing 142 and a handle 144, at least one air treatment member 150, a dirty air inlet 152, a clean air outlet 154, and an air flow path extending between the inlet 152 and outlet 154. A suction motor (not shown) is provided to generate vacuum suction through the air flow path. The suction motor may be upstream or downstream from the air treatment member.

Power can be supplied to the surface cleaning apparatus 100 by an optional electrical cord 190 that can be connected to a standard wall electrical outlet. Alternatively, or additionally, the power source for the surface cleaning apparatus can be one or more onboard energy storage members, including, for example, one or more batteries.

The at least one at least one air treatment member 150 is configured to treat the air in a desired manner, including, for example, removing dirt particles and other debris from the air flow, and may be any suitable member that can treat the air. Optionally, the air treatment member 150 may include at least one cyclonic cleaning stage, and may in some instances include two or more cyclonic cleaning stages arranged in series with each other. Alternatively, the air treatment member need not include a cyclonic cleaning stage, and can incorporate a bag, a porous physical filter media (such as foam or felt) or other air treating means.

The surface cleaning head 120 may be of any suitable design, and may include a variety of features, such as height adjustment mechanisms, lights, wheels, glides and the like. In the illustrated example, the surface cleaning head includes a body 121, a pair of rear wheels 123 connected to the body to rollingly support the surface cleaning head 120 above a surface to be cleaned, and a cleaning head dirty air inlet 122 in the downward facing lower body surface. The surface cleaning head 120 also includes a support member 125 that is pivotally connected to the body 121. The lower end 132 of the wand 130 can be connected to the support member 125, whereby the wand is movable relative to the surface cleaning head. In the illustrated example, the support member 125 is provided in the form of an upflow duct that is in fluid communication with the cleaning head dirty air inlet 122. The lower end 132 of the wand 130 is configured to receive the upflow duct 125 (or optionally vice versa) and to fluidly connect the surface cleaning head 120 to the hand vacuum 110.

Surface cleaning head 120 also includes a rotatably mounted brush 1000, which may alternatively referred to as a brush 1000 or as a brush roll 1000. Brush 1000 may be rotated using a powered brush motor (not shown) provided in the cleaning head, an air driven turbine (e.g. a turbo brush), or any other suitable means. When brush 1000 is rotating it may help mechanically dislodge dirt, hair, and other debris from a surface being cleaned (e.g. a floor surface). When the dirt, hair, and debris have been mechanically loosened in this manner, they may be sucked up into the dirty air inlet of the surface cleaning head using relatively less suction power than would be required in the absence of the mechanical agitation.

The flowing description of different features of a rotatably mounted brush 1000 which may be associated with the dirty air inlet of any surface cleaning apparatus. These features may be used by themselves in any rotatably mounted brush 1000, or in any combination or sub-combination with any other feature or features described herein.

Brush Roll with Bristles and Leading and Trailing Blocking Members

The flowing is a description of different features of a rotatable brush roll that has bristles with leading and trailing blocking members. These features may be used by themselves in any brush roll or in any combination or sub-combination with any other feature or features described herein. For example, any of the features of the bristles with leading and trailing blocking members described herein may be used with any one or more of the sheath-encased bristles, brush roll heating element, bristles with internal blocking members, hard floor cleaning pads, flexible columns, and other features described herein.

Referring to FIGS. 3 to 10, there is illustrated a rotatable brush roll 1000 for mechanically agitating a surface being cleaned. Brush roll 1000 may be associated with (e.g. positioned proximate) the cleaning head dirty air inlet 122 of surface cleaning apparatus 100 or with a dirty air inlet of any other surface cleaning apparatus as is known in the art. It will be appreciated that the brush roll may be of any construction and shape known in the surface cleaning arts, and may be mounted using any bearing or mounting means known in the surface cleaning arts.

Figure 3:
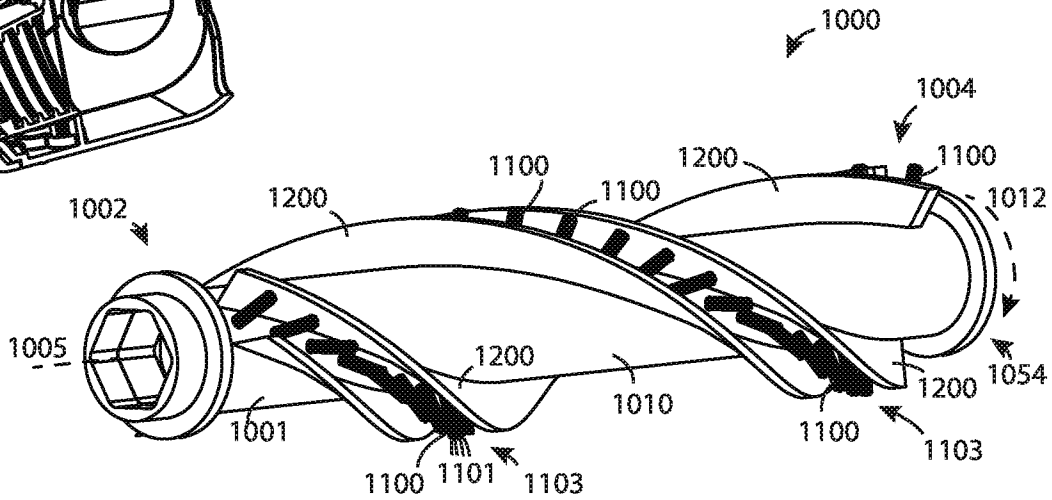
FIG. 3 is a perspective view of a brush roll in accordance with one embodiment.

As exemplified in FIG. 3, brush roll 1000 includes a generally cylindrical main body 1001 having a central longitudinal axis of rotation 1005, a first end or side 1002, a second end or side 1004, and a radial outer surface 1010. Brush roll 1000 may be configured to be normally rotated in a first rotational direction 1012 during use (i.e. during a surface cleaning operation).

Also illustrated are two exemplary optional coupling members 1052 and 1054 provided at the first end 1002 and the second end 1004, respectively. Coupling members 1052, 1054 may be used to rotatably mount or secure brush roll 1000 within a surface cleaning head, e.g. surface cleaning head 120, such that it can be selectively rotated about its axis of rotation 1005. It will be appreciated that coupling members 1052, 1054 may have any suitable arrangement and/or configuration. For example, while coupling members 1052, 1054 are shown as having the same configuration as each other, this may not me the case in alternative embodiments. For example, coupling member 1052 may have gearing or may be otherwise configured to receive rotational power from a brush roll motor or other drive mechanism, while coupling member 1054 may be configured to provide a passive rotational coupling between brush roll 1000 and surface cleaning head 120.

In the example illustrated in FIG. 3, a plurality of bristles 1101 extend generally radially outwardly from the outer surface 1010 of brush roll 1000. As exemplified, bristles 1101 may be arranged in groups or 'tufts' of bristles 1100. In alternative embodiments, bristles 1101 may be provided in a substantially continuous row extending from the first end 1002 to the second end 1004 of the brush roll. Bristles 1101 in a substantially continuous row or in a tuft that would contact a floor surface ahead of other bristles 1101 in that same row or tuft when the brush roll 1000 is rotated in the first rotational direction 1012 may be characterized as a forward rotational side 1112 of the bristles in that bristle row/tuft 1100, and bristles on the opposite side with respect to the direction of rotation of that row/tuft may be characterized as a rearward rotational side 1114 of the bristles in that bristle row/tuft 1100 (as shown in e.g. FIG. 4).

Bristles 1101 may be formed from any suitable material known in the art, such as nylon, propylene and the like.

The bristle tufts 1100 in the illustrated example are themselves arranged in two bristle rows 1103, with each bristle row 1103 extending in a generally helical formation from the first end 1002 to the second end 1004 of the brush roll 1000. It will be appreciated that in alternative embodiments a single row, or three or more rows, of bristles may be provided. It will also be appreciated that bristle rows 1103 may be arranged in a formation other than a helical pattern, such as a straight row extending linearly from the first end 1002 to the second end 1004, a double helical pattern (e.g. 'wrapping' around the circumference of the brush roll two or more times between the first end 1002 and the second end 1004), a chevron or V-shaped pattern, or in any other suitable formation.

Also shown in the example illustrated in FIG. 3 are a number of hair blocking members 1200 that extend generally radially outwardly from the outer surface 1010 of brush roll 1000. In the illustrated example, a leading hair blocking member 1200*a* is provided adjacent a forward rotational side of each bristle row 1103, and a trailing hair blocking member 1200*b* is provided adjacent a rearward rotational side of each bristle row 1103. It will be appreciated that hair blocking members 1200*a*, 1200*b* need not extend exactly radially outwardly but may extend at an angle to the radial direction (e.g., 5, 10, 15, or 20 degrees from the radial direction) and may be referred to as extending radially.

Hair blocking members 1200 are preferably formed from a resiliently flexible material, such as an elastomeric material such as natural or synthetic rubber, silicon, and the like or it may be made from a non-resilient material (e.g., nylon) which is sufficiently thin to bend or is constructed so as to enable the member to bend.

In the example illustrated in FIG. 3, each hair blocking member 1200 extends continuously from the first end 1002 to the second end 1004 of the brush roll 1000. Alternatively, each hair blocking member 1200 may consist of a plurality of segments, with each segment spanning a portion of the distance from the first end 1002 to the second end 1004. In some embodiments, the ends of adjacent segments may abut each other, such that the segments form a substantially continuous hair blocking member 1200. Alternatively, the ends of adjacent segments may be spaced from each other, providing an axial gap between adjacent segments.

Figure 4:
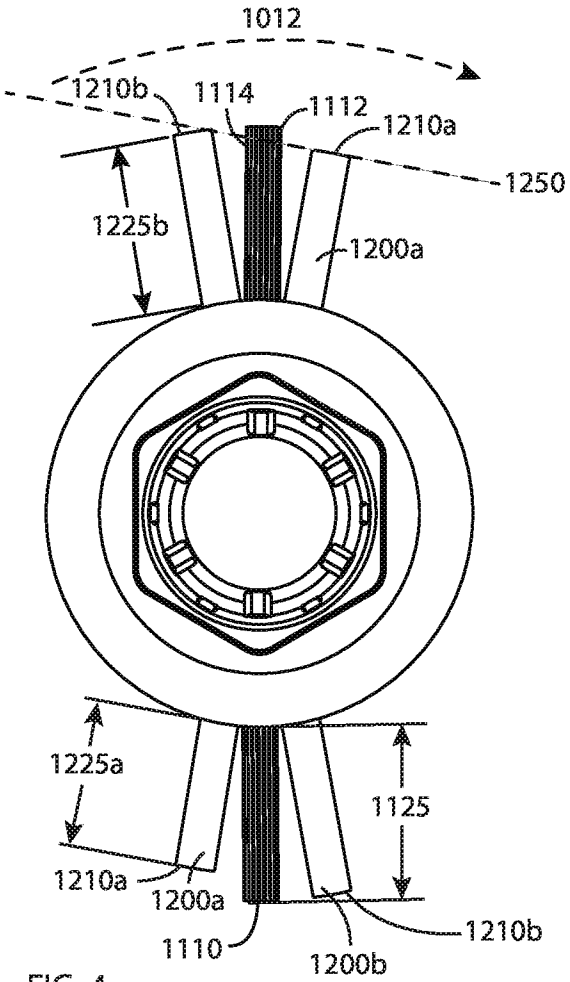
FIG. 4 is an end view of a brush roll in accordance with another embodiment.

Turning to FIG. 4, bristles 1100 have a height or length, which may be referred to as a radial height 1125 from the outer surface 1010 of brush roll 1000 to the radial outer ends 1110 of the bristles. Also, each hair blocking member 1200 has a height or length, which may be referred to as a radial height 1225, from the outer surface 1010 of brush roll 1000 to the radial outer end 1210 of the blocking member. In the example illustrated in FIG. 4, each leading hair blocking member 1200*a* has a length 1225*a*, and each trailing hair blocking member 1200*b* has a length 1225*b*.

An advantage of providing leading and trailing hair blocking members 1200*a*, 1200*b* ahead of and behind bristles 1100 is that the blocking members may inhibit or prevent hair, string, or other strand-like material from becoming embedded in the bristles 1100. For example, the outer ends 1210 of the hair blocking members 1200 may define a plane 1250 that extends adjacent to or through the outer ends of the bristles 1100. In this way, if a hair or other piece of strand-like debris contacts the ends 1210*a*, 1210*b* of both the leading and trailing hair blocking members, the hair may extend and remain taut between the hair blocking members, and thereby be inhibited or prevented from becoming embedded in a bristle tuft and/or bristle row, and/or from migrating between the bristles 1101 radially inwardly towards the outer surface 1010 of the brush roll 1000.

Figure 5:
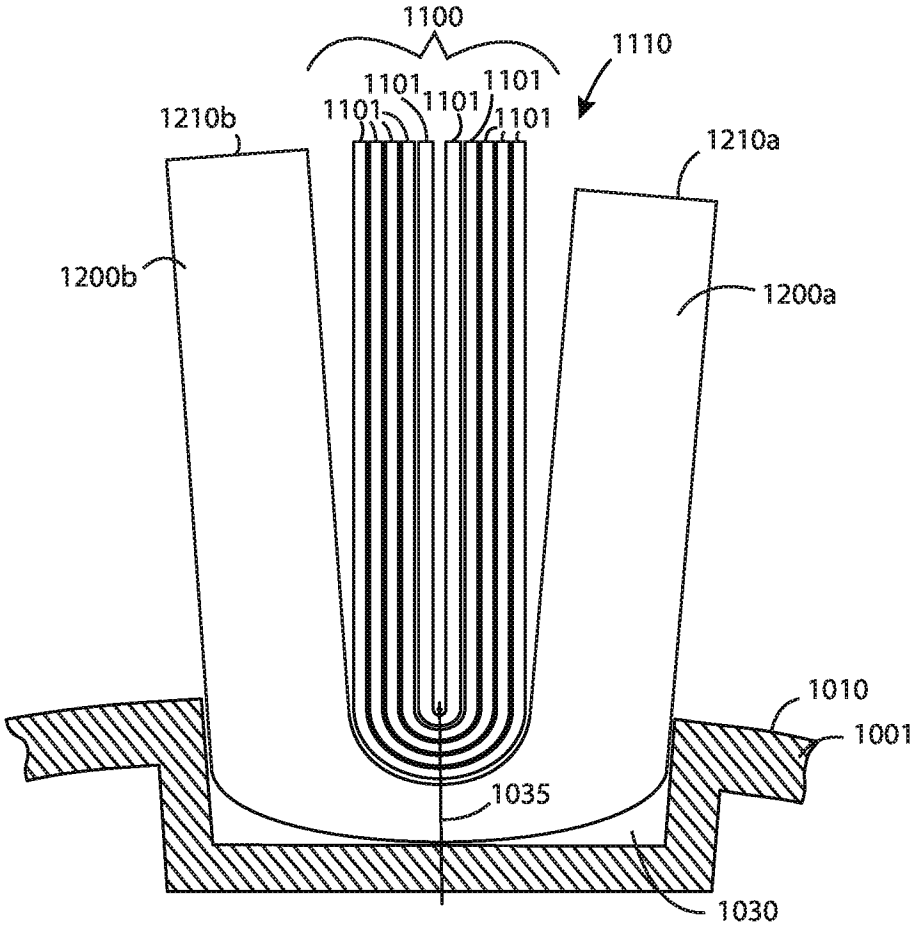
FIG. 5 is a schematic cross-section view of bristles and leading and trailing hair blocking members secured to a brush roll.

FIG. 5 illustrates a schematic example of how a plurality of bristles 1101 and hair blocking members 1200*a*, 1200*b* may be secured to a brush roll 1000. In the illustrated example, a channel or seat 1030 is provided in the main body 1001 of the brush roll 1000. A strip or segment of material positioned in the seat 1030 forms the hair blocking members 1200*a*, 1200*b*, a plurality of bristle segments positioned between the hair blocking members 1200*a*, 1200*b* form the bristles 1101, and a wire 1035 is used to secure the bristles 1101 and the hair blocking members 1200*a*, 1200*b* to the seat 1030. It will be appreciated that any other suitable means of securement may be used, such as adhesives and/or other mechanical securement means.

Notably, in the example illustrated in FIG. 5, the leading hair blocking member 1200*a* is in contact with the forward rotational side 1112 of bristles 1100, and the trailing hair blocking member 1200*b* is in contact with the rearward rotational side 1114 of bristles 1100. Alternatively, the bristles 1100 may be secured to the brush roll 1000 in a position spaced from—i.e. not in contact with—leading hair blocking member 1200*a* and/or trailing hair blocking member 1200*b*.

FIGS. 6-10 illustrate an example of how the leading hair blocking member 1200*a* and/or trailing hair blocking member 1200*b* may not only inhibit or prevent hair, string, or other strand-like material from becoming embedded in the bristles 1100, but may also assist in urging hair, string, or other strand-like material embedded in bristles 1100 to migrate outwardly towards the ends 1110 of the bristles, and/or to assist in partially or completely dislodging hair or other strand-like material from the bristles.

Figure 6:
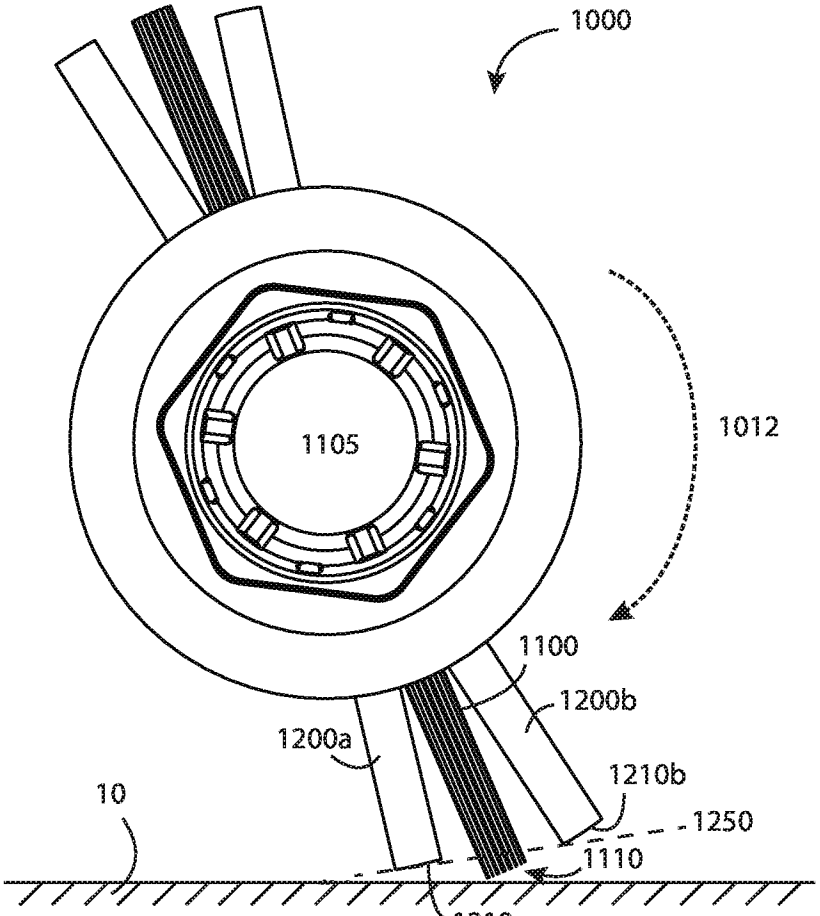
FIG. 6 is an end view of the brush roll of FIG. 4 positioned above a floor surface.

In FIG. 6, brush roll 1000 is at a position where the bristles 1100 and the leading and trailing hair blocking members 1200*a*, 1200*b* are approaching a floor surface 10 being cleaned.

Figure 7:
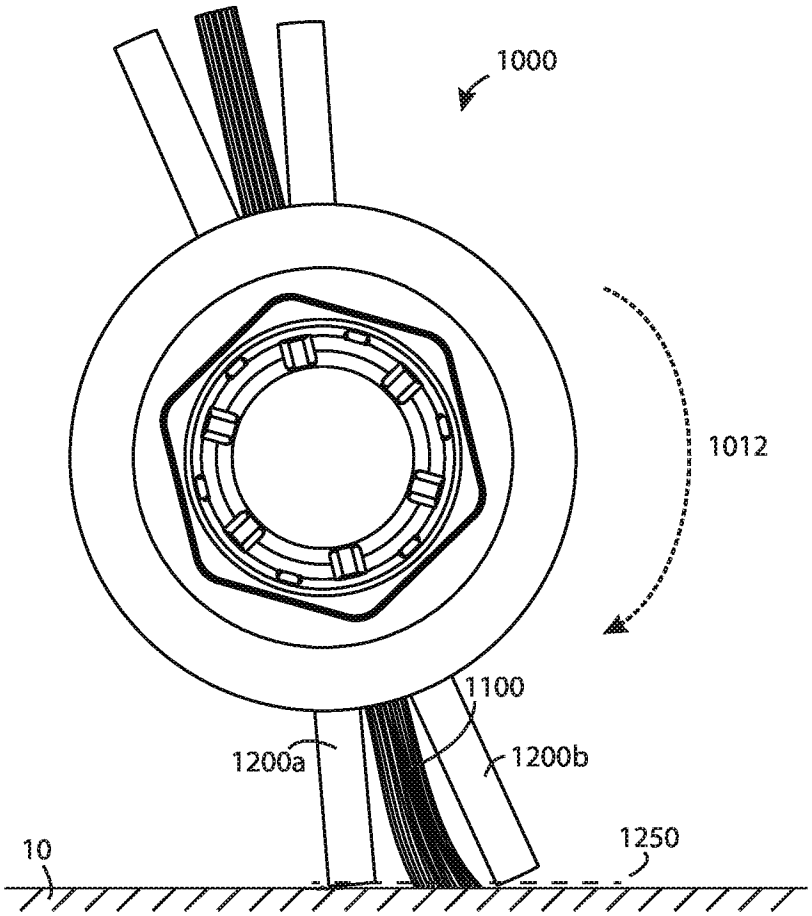
FIG. 7 is an end view of the brush roll and floor surface of FIG. 6, with the brush roll rotated to bring the bristles into contact with the floor surface.

In FIG. 7, the brush roll 1000 has been rotated so that the bristles 1100 are in contact with the floor surface 10. In the exemplified embodiment, the leading hair blocking member has a radial length such that it does not contact the floor. It will be appreciated that the leading hair blocking member may have a radial length such that it contacts the floor. In such a case, the leading hair blocking member may be positioned sufficiently forward of the bristles such that the bristles may flex when the bristles contact the floor being cleaned without the leading hair blocking member blocking the bristles from contacting the floor or further compressing the bristles when they contact the floor.

Figure 8:
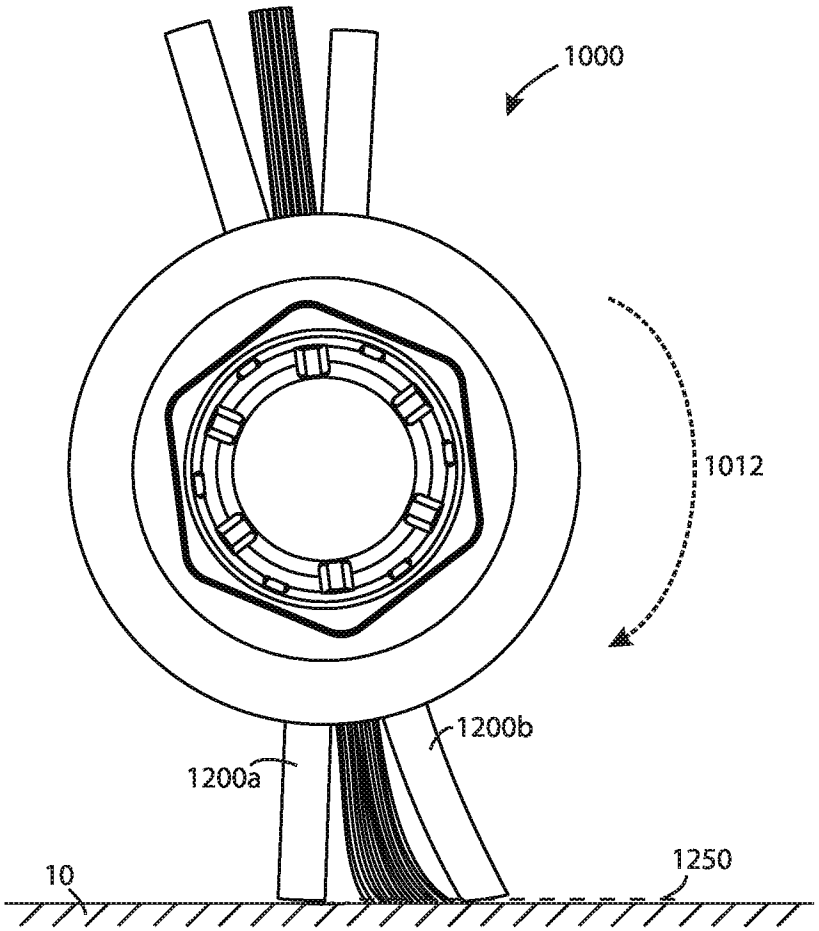
FIG. 8 is an end view of the brush roll and floor surface of FIG. 6, with the brush roll rotated to bring a trailing hair blocking member into contact with the floor surface while the bristles remain in contact with the floor surface.

In FIG. 8, the brush roll 1000 has been further rotated so that the bristles 1100 have flexed rearwardly and are sweeping over the floor surface 10, and the trailing hair blocking member 1200*b* is just in contact with the floor surface 10.

Figure 9:
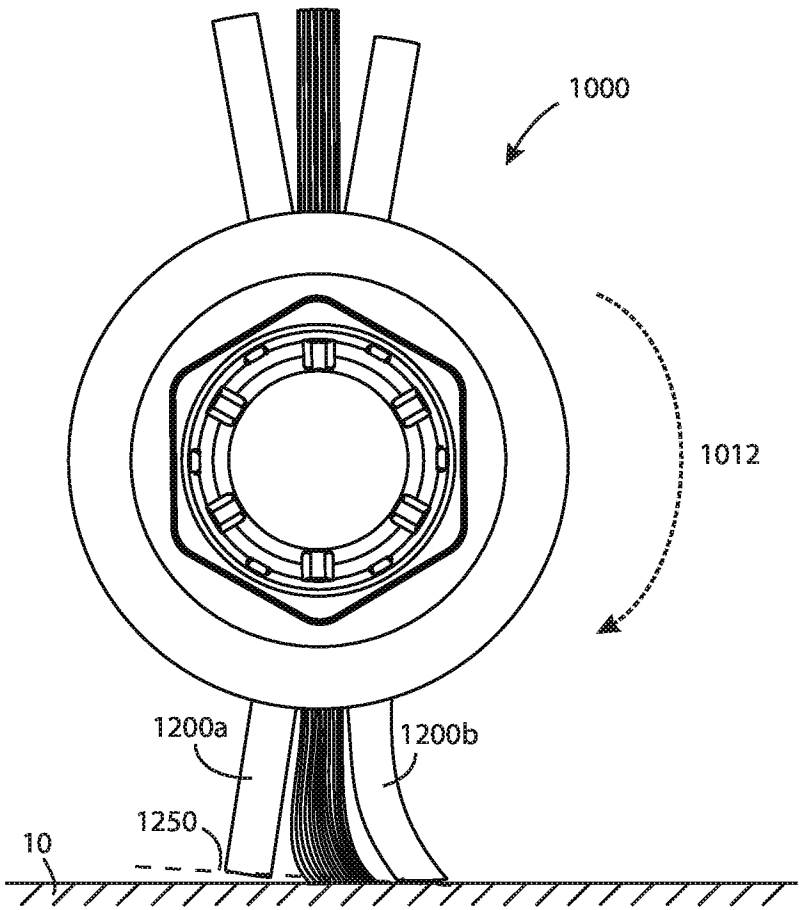
FIG. 9 is an end view of the brush roll and floor surface of FIG. 6, with the brush roll further rotated with the trailing hair blocking member and bristles remaining in contact with the floor surface.

In FIG. 9, the brush roll 1000 has been further rotated so that the bristles 1100 continue to sweep over the floor surface 10. The trailing hair blocking member 1200*b* is fully in contact with the floor surface 10, and has flexibly deformed rearwardly such that its outer surface 1210*b* is radially closer to the axis 1005 of brush roll 1000. In this position, the plane 1250 defined by the outer ends 1210*a*, 1210*b* of the hair blocking members 1200*a*, 1200*b* is approximately co-incident with the floor surface 10. Also, in this position the ends 1110 of the bristles 1100 are also approximately co-incident with the floor surface 10.

In this way, a hair or other piece of strand-like debris that was embedded in the bristles 1100 prior to the bristles coming into contact with the floor surface 10 (e.g. in the position shown in FIG. 6) and was also in contact with the ends 1210*a*, 1210*b* of both the leading and trailing hair blocking members may be pulled taut between the ends 1210*a*, 1210*b* of the hair blocking members—i.e. towards the plane 1250. Since the ends 1110 of the bristles 1100 are also located approximately at the plane 1250, the hair or other piece of strand-like debris may be drawn outwardly towards the ends 1110 of the bristles 1100.

Additionally, or alternatively, when plane 1250 is approximately co-incident with the floor surface 10 (e.g. as shown in FIG. 9), the outer ends 1210*a*, 1210*b* of one and/or both of the hair blocking members 1200*a*, 1200*b* may inhibit or prevent hair or other strand-like debris present on the floor surface 10 from becoming ensnared or otherwise embedded in bristles 1100.

Figure 10:
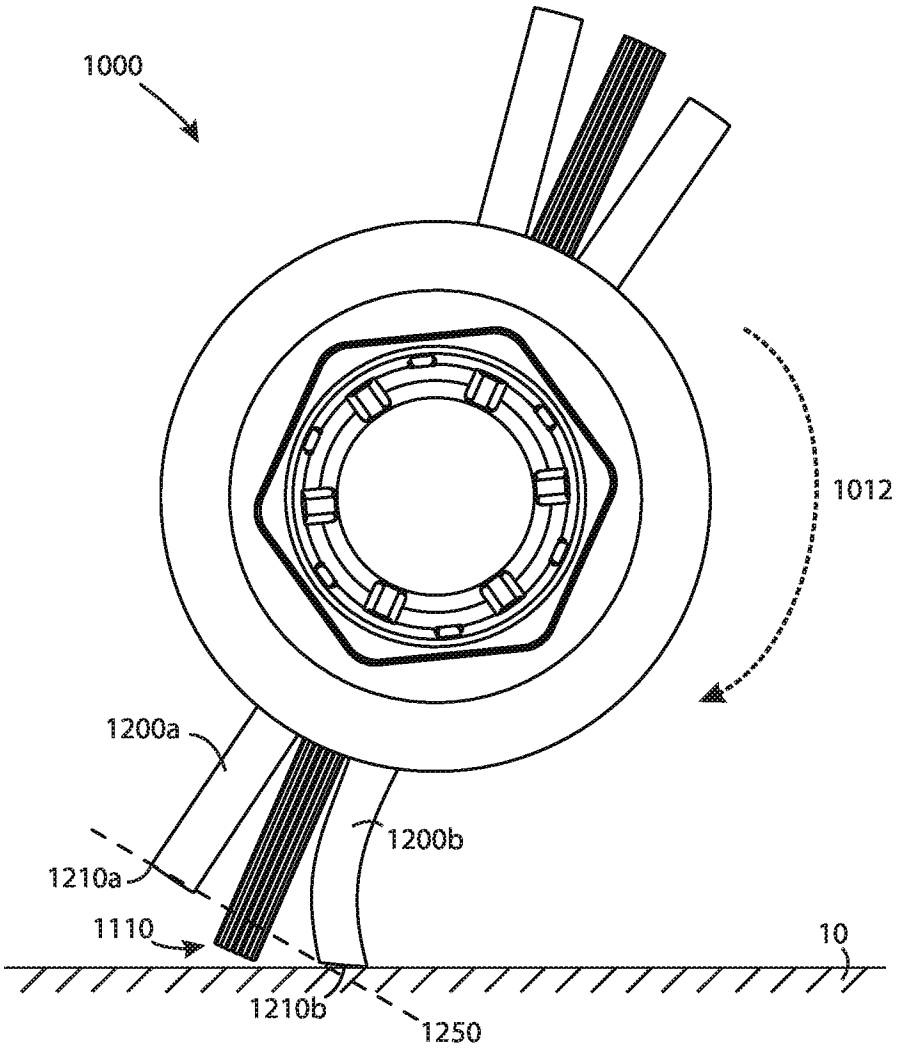
FIG. 10 is an end view of the brush roll and floor surface of FIG. 6, with the brush roll further rotated with the bristles out of contact with the floor surface and with the trailing hair blocking member remaining in contact with the floor surface.

In FIG. 10, the brush roll 1000 has been further rotated so that the bristles 1100 come out of contact with the floor surface 10. The trailing hair blocking member 1200*b* remains in contact with the floor surface 10, and remains flexibly deformed. In this position, if a hair or other piece of strand-like debris that is embedded in the bristles 1100 is also in contact with the end 1210*b* of the trailing hair blocking member 1200*b*, the hair may be at least temporarily 'pinched' or held between the floor surface 10 and the end 1210*b*. In this position, as the bristles 1100 straighten once they are no longer in contact with the floor surface 10 (e.g. between the position shown in FIG. 9 and the opposition shown in FIG. 10), hair or other piece of strand-like debris held or 'pinched' by the trailing hair blocking member 1200*b* may be partially or completely dislodged from the bristles 1100.

It will be appreciated that if an elongate member such as hair has been wrapped around the brush roll, then when the leading or trailing hair blocking members deform as they contact the floor, the distance between the radial outer ends of the leading and trailing hair blocking members may be increased and this may result in the force applied to the hair exceeding the tensile strength of the hair and the hair breaking.

The hair blocking member is preferably spaced forwardly or rearwardly (in the direction of rotation of the brush roll) from the bristles 1100, so that the hair blocking member can flex without being limited by engagement with the bristles 1100. For example, a hair blocking member may be positioned spaced 1-12, 1-8, 1-4 or 1-2 mm forward from the forward rotational side of bristles 1100 and a second hair blocking member may be positioned spaced 1-12, 1-8, 1-4 or 1-2 mm rearward from the rearward rotational side of the bristles 1100. Alternately, only one of a forward and rearwardly positioned hair blocking member may be provided.

A hair blocking member may be shorter or longer than the height of bristles 1100. For example, the outer end of a forward and/or rearwardly positioned hair blocking member may be positioned spaced ±1, 2, 3 mm radially inwardly or radially outwardly of the radial outer end of the bristles 1100 pad. Optionally, a front or forwardly positioned hair blocking member may be shorter than the rear or rearwardly positioned hair blocking member.

Preferably, as in the example illustrated in FIGS. 6-10, the length 1225*a* of the leading hair blocking member 1200*a* is less than the length 1125 of the bristles 1100. An advantage of providing a shorter leading hair blocking member 1200*a* is that this blocking member may not come into contact with a floor surface 10, and may therefore not be bent back towards the bristles 1100, which may maintain plane 1250 in a position where it extends through the ends 1110 of the bristles. In alternative embodiments, the length 1225*a* of the leading hair blocking member 1200*a* may be approximately equal to the length 1125 of the bristles 1100.

Preferably, the leading and trailing hair blocking members 1200*a*, 1200*b* are less flexible than the bristles 1101. An advantage of providing less-flexible hair blocking members is that the outer ends 1210*a*, 1210*b* may be less easily deformed towards the outer surface 1010 of brush roll 1000, thereby making it easier for the ends 1110 of the bristles 1100 to be flexed or deformed towards or preferably radially inwardly of the plane 1250.

Optionally, the trailing hair blocking member 1200*b* may be less flexible than the leading hair blocking member 1200*a*. An advantage of this design is that a 'pinching' effect between the outer end 1210*b* and the floor surface 10 may be stronger, which may improve the ability of the trailing hair blocking member 1200*b* to partially or completely dislodged hair or other strand-like debris from the bristles 1100 (e.g. as discussed above with reference to FIG. 10).

Sheath-Encased Bristles

The flowing is a description of different features of bristles partially encased in a sheath or sleeve that may be provided on a rotatably mounted brush 1000. These features may be used by themselves in any brush roll or in any combination or sub-combination with any other feature or features described herein. For example, any of the features of the sheath-encased bristles described herein may be used with any one or more of the bristles with leading and trailing blocking members, brush roll heating element, bristles with internal blocking members, hard floor cleaning pads, flexible columns, and other features described herein.

Referring to FIGS. 11 to 16, a rotatable brush roll is provided with a plurality of groups or 'tufts' of bristles. Each bristle tuft may be encased in a sheath. The sheaths may inhibit or prevent hair or other strand-like material from migrating radially inwardly between sheathed bristles towards the outer surface of the brush roll.

Figure 11:
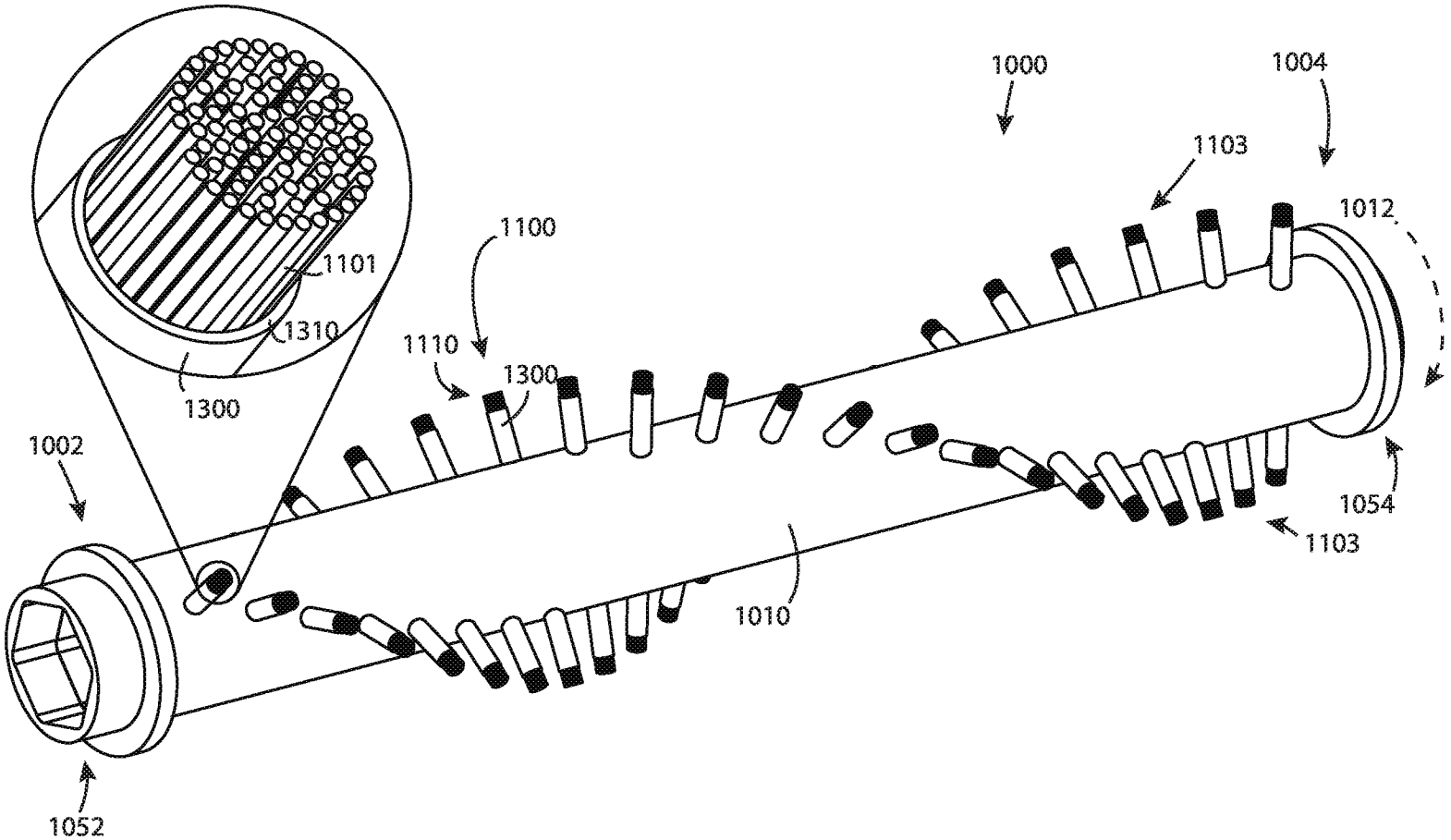
FIG. 11 is a perspective view of a brush roll in accordance with another embodiment, with an enlarged view of an end of a sheathed bristle tuft.

In the example illustrated in FIG. 11, a plurality of bristles 1101 arranged in groups or 'tufts' of bristles 1100 extend generally radially outwardly from the outer surface 1010 of brush roll 1000. Each bristle tuft 1100 is encased in a sheath 1300. Each sheath 1300 has a height or length 1325 from the outer surface 1010 of brush roll 1000 to a radial outer end 1310 of the sheath.

An advantage of providing some or all of the bristle tufts 1100 with sheaths 1300 is that a piece of hair, string, or other strand-like material that has become ensnared between individual bristles 1101 in the bristle tuft 1100 may be inhibited or prevented by the radial outer end 1310 of the bristle sheath 1300 from migrating inwardly between the bristles 1101 and towards the outer surface 1010 of the brush roll 1000, and may thereby be prevented from becoming deeply embedded between the bristles 1101.

Figure 12:
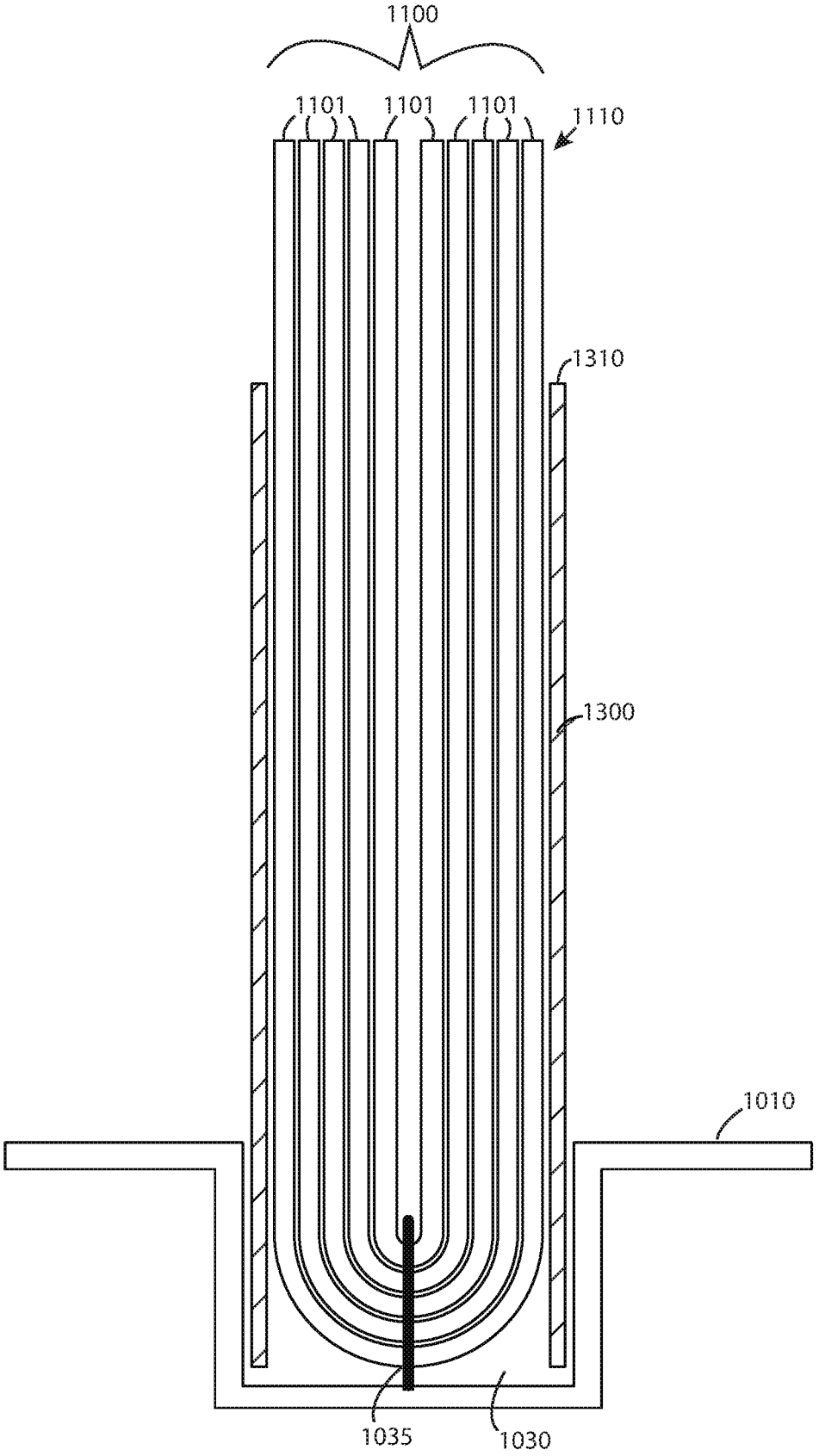
FIG. 12 is a schematic cross-section view of a sheathed bristle tuft.

FIG. 12 illustrates a schematic example of how a plurality of bristles 1101 and a sheath 1300 may be secured to a brush roll 1000. In the illustrated example, a channel or seat 1030 is provided in the main body 1001 of the brush roll 1000. A plurality of bristle segments are positioned in the seat to form the bristle tuft 1100, and a wire 1035 is used to secure the bristles 1101 and to the seat 1030. The sheath 1300 is positioned around the bristles 1101, and is secured to the seat 1030 and/or to a lower portion (i.e. radially inward with respect to brush roll 1000) of the bristle tuft 1100, e.g. using an adhesive. It will be appreciated that any other suitable means of securement may be used, such as adhesives and/or other mechanical securement means.

Figure 13:
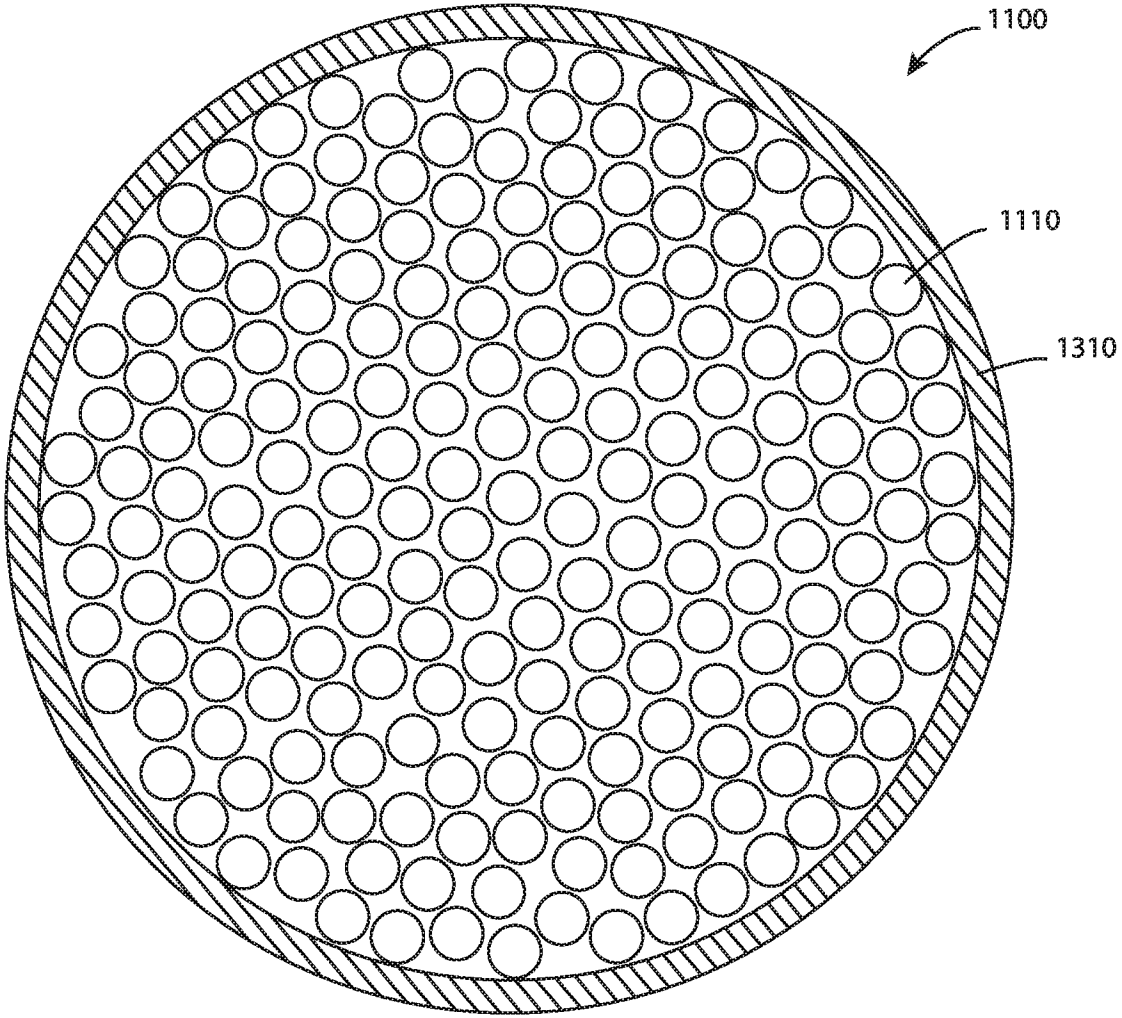
FIG. 13 is a top axial view of a sheathed bristle tuft in accordance with an embodiment.
Figure 15:
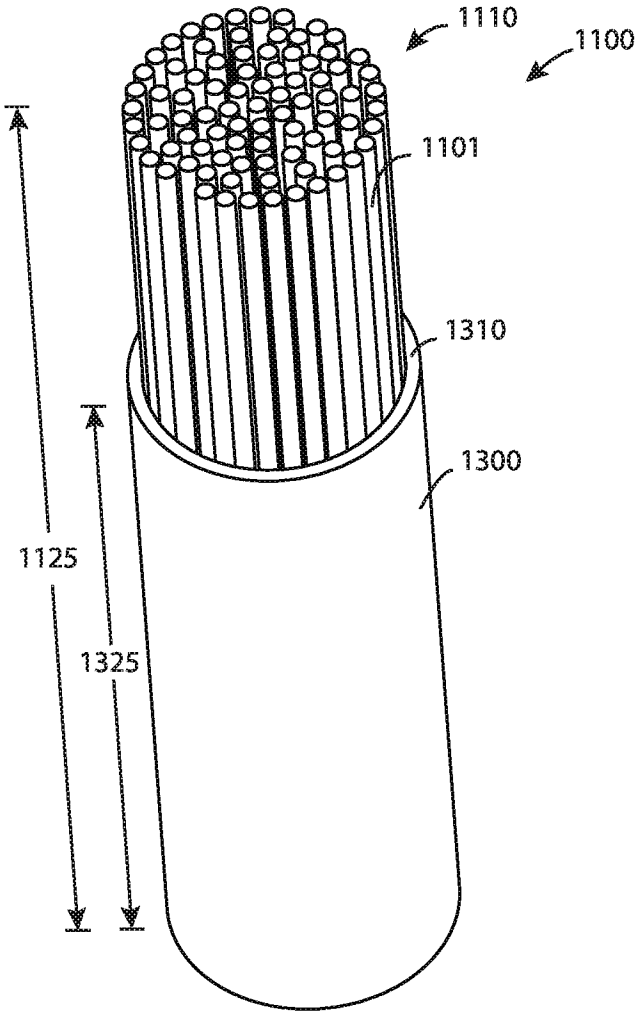
FIG. 15 is a perspective view of a sheathed bristle tuft in accordance with another embodiment.
Figure 14:
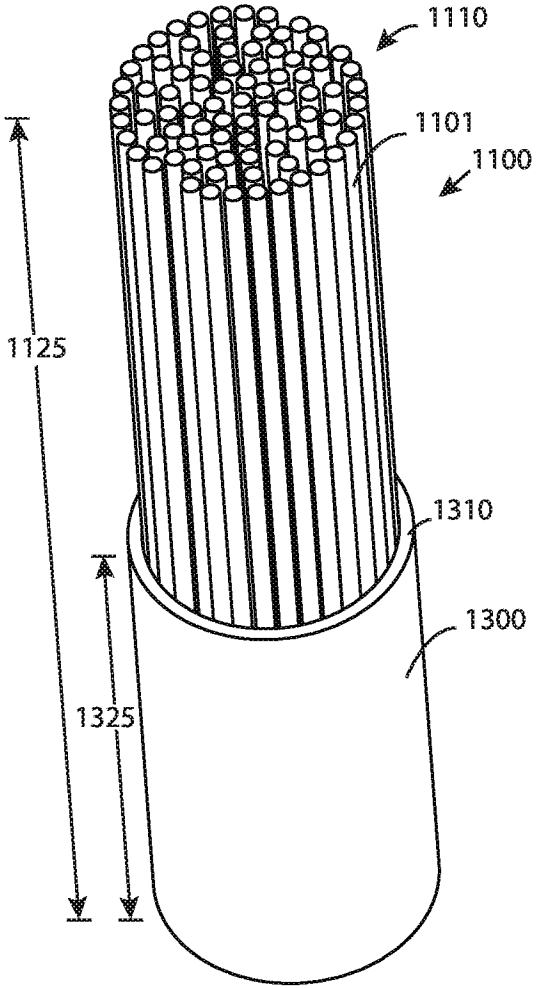
FIG. 14 is a perspective view of a sheathed bristle tuft in accordance with an embodiment.

Preferably, the sheath may have a cross-sectional shape that conforms generally to an outer perimeter of the bristle tuft 1100 that the sheath encases. For example, as illustrated in FIG. 13, the sheath may be generally circular in cross-section, when viewed in a direction transverse to a radial length of a circular tuft of encased bristles 1101.

The length 1325 of sheath 1300 relative to the length 1125 of the bristle tuft that the sheath encases may be varied, e.g. to provide a desired flexibility of the sheathed tuft, and/or to provide a desired restriction on the depth of inward migration of hair or other strand-like material before contacting the sheath. For example, in the example illustrated in FIG. 14, the length 1325 of the sheath 1300 is about 50% of the length 1125 of the bristle tuft 1100. In the example illustrated in FIG. 15, the length 1325 of the sheath 1300 is about 75% of the length 1125 of the bristle tuft 1100. In the example illustrated in FIG. 16, the length 1325 of the sheath 1300 is about 90% of the length 1125 of the bristle tuft 1100.

Preferably, the sheaths 1300 are made from a flexible material, such as an elastomeric material. For example, sheaths 1300 may be formed from a resiliently flexible material, such as an elastomeric material such as natural or synthetic rubber, silicon, and the like or it may be made from a non-resilient material (e.g., nylon) which is sufficiently thin to bend or is constructed so as to enable the member to bend.

An advantage of providing flexible sheaths 1300 is that the sheath may have a limited or negligible impact on the ability of the sheathed bristles 1100 to bend or flex, e.g. when they contact a floor surface, as compared with unsheathed bristles. By providing a flexible sheath 1300, the entire length 1125 of the bristles 1100 may be able to flex, even though only about 50%, 25%, or about 10% of the length of the bristles 1110 may protrude radially outwardly from the outer end 1310 of the sheath 1300.

Bristles with Internal Hair Blocking Member

The flowing is a description of different features of bristles with internal hair blocking members that may be provided on a rotatably mounted brush 1000. These features may be used by themselves in any brush roll or in any combination or sub-combination with any other feature or features described herein. For example, any of the features of the internal hair blocking members described herein may be used with any one or more of the bristles with leading and trailing blocking members, sheath-encased bristles, heating element, hard floor cleaning pads, flexible columns, and other features described herein.

Referring to FIGS. 17 to 51, a rotatable brush roll is provided with a plurality of groups or 'tufts' of bristles. Each bristle tuft may be provided with an internal blocking member within or adjacent to that tuft. The internal blocking member may inhibit or prevent hair or other strand-like material from migrating radially inwardly between the bristles of an adjacent tuft towards the outer surface of the brush roll. It will be appreciated that an internal hair blocking member may be used if the bristles are not provided in tufts, e.g. if they are arranged as individual bristles in a row along the length of a brush roll.

Bristle Tufts with Embedded Internal Hair Blocking Members

In the examples illustrated in FIGS. 17 to 39, an internal blocking member is provided within a bristle tuft, so that when the brush roll is rotated, a portion of the bristles in the tuft precede the hair blocking member, and a portion of the bristles in the tuft follow the hair blocking member. The internal blocking member may inhibit or prevent hair or other strand-like material from migrating radially inwardly between the bristles of that tuft towards the outer surface of the brush roll.

An advantage of providing some or all of the bristle tufts 1100 with internal blocking members 1500 is that pieces of hair, string, or other strand-like material may be inhibited or prevented from becoming ensnared between individual bristles 1101 in the bristle tuft 1100 by the radial outer end 1510 of the internal blocking member 1500. Additionally, or alternatively, a piece of hair, string, or other strand-like material that has become ensnared between individual bristles 1101 in the bristle tuft 1100 may be inhibited or prevented by the radial outer end 1510 of the internal hair blocking member 1500 from migrating inwardly between the bristles 1101 towards the outer surface 1010 of the brush roll 1000.

Each internal blocking member 1500 has a height or length 1525 from the outer surface 1010 of brush roll 1000 to the radial outer end 1510 of the blocking member. The length 1525 may be approximately equal to the length 1125 of the bristle tuft 1100 in which the blocking member is embedded. Optionally, the length 1525 may be less than the length 1125, e.g. to inhibit or prevent the end 1510 of the hair blocking member 1500 from contacting a floor surface 10 during use. For example, the length 1525 the hair blocking member 1500 may be between 80% and 95% of the length 1125 of the bristle tuft 1100.

The hair blocking members are preferable oriented such that the longer length of the radial outer end 1510 is oriented generally transverse to the direction of travel of the floor cleaning head (e.g., the longer length may define a leading edge of the hair blocking member). Accordingly, the hair blocking member may be oriented to extend generally axially (i.e., in the same general direction as the brush axis).

The radial outer end 1510 of the internal blocking member 1500 preferably has a width 1560 (which may extend in the axial direction or in the direction of the row of bristles) that may be at least the same as, and optionally greater than, a width 1160 of the bristle tuft 1100.

Figure 17:
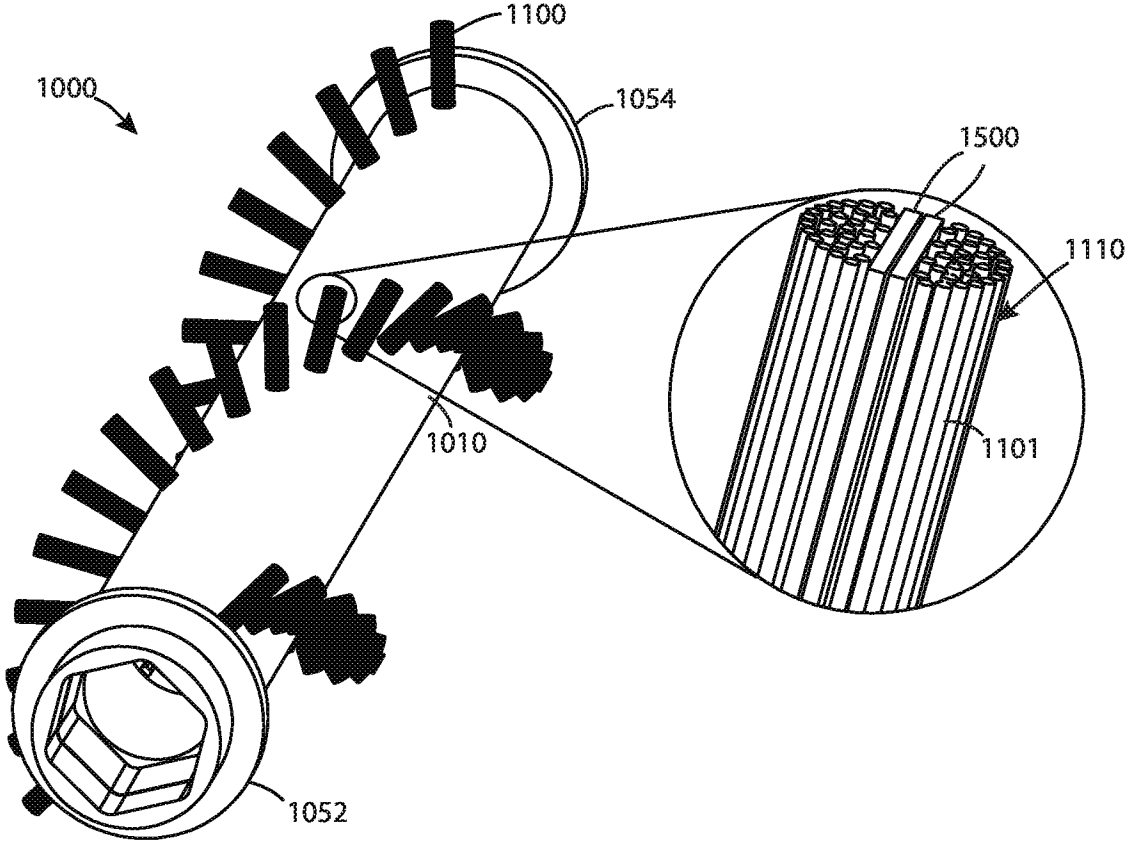
FIG. 17 is a perspective view of a brush roll in accordance with another embodiment, with an enlarged view of an end of a bristle tuft with an internal hair blocking member.
Figure 16:
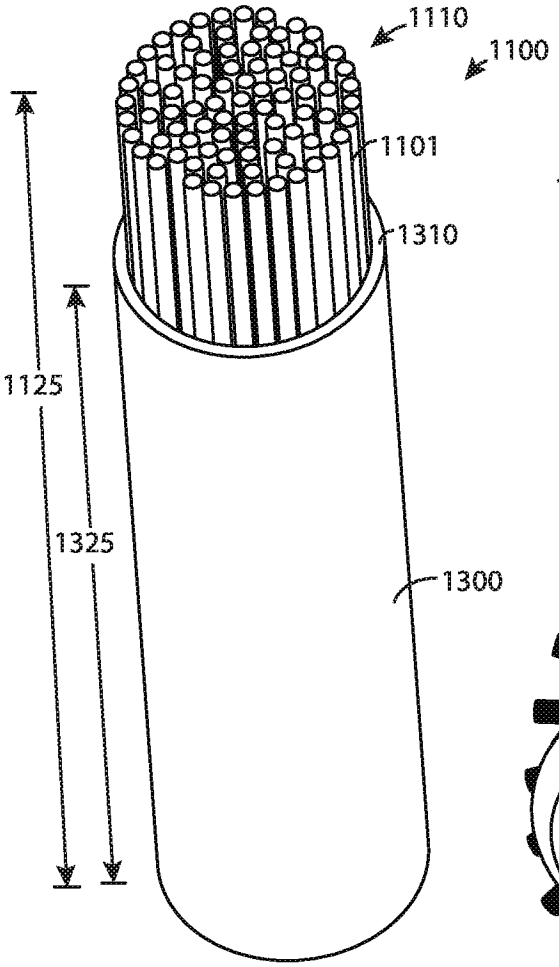
FIG. 16 is a perspective view of a sheathed bristle tuft in accordance with another embodiment.
Figure 18:
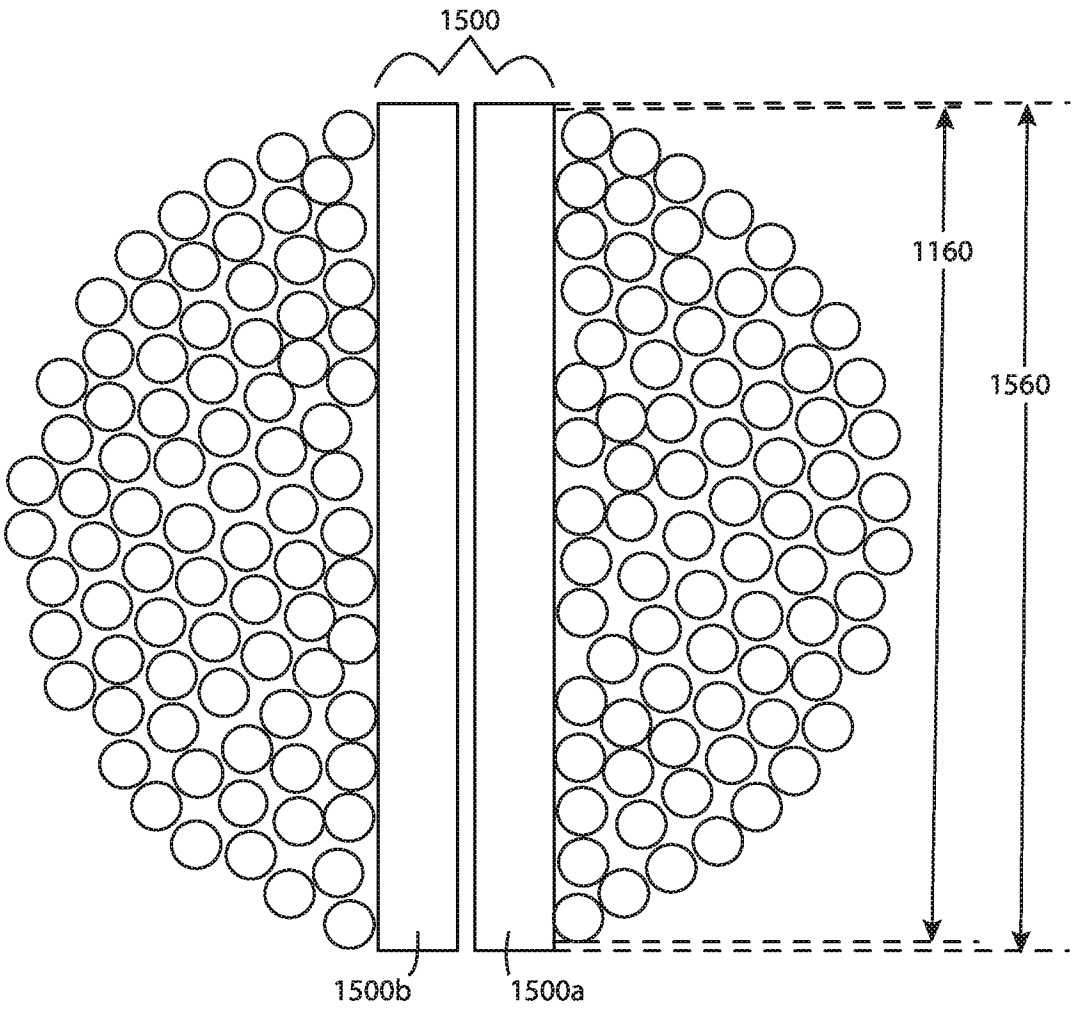
FIG. 18 is a top axial view of the bristle tuft of FIG. 17.

As exemplified in FIGS. 17 and 18, an internal blocking member 1500 may comprise a pair of blocking members 1500*a*, 1500*b*, which may abut along their longer faces. Alternatively, one internal blocking member 1500 or three or more internal blocking members may be provided.

Internal hair blocking members 1500 are preferably formed from a resiliently flexible material, such as an elastomeric material such as natural or synthetic rubber, silicon, and the like or it may be made from a non-resilient material (e.g., nylon) which is sufficiently thin to bend or is constructed so as to enable the member to bend.

Internal hair blocking members 1500 may be shorter or longer than the height of bristles 1100. For example, the outer end of an internal hair blocking members 1500 may be positioned spaced ±1, 2, 3 mm radially inwardly or radially outwardly of the radial outer end of the bristles 1100 pad.

Preferably, the internal hair blocking members 1500 are less flexible than the bristles 1101. This is particularly preferred if the internal hair blocking member is radially shorter than the bristles. An advantage of providing less-flexible hair blocking members is that the outer end 1510 may be less easily deformed towards the outer surface 1010 of brush roll 1000. In this arrangement, the ends 1110 of the bristles 1100 may be flexed or deformed towards or preferably radially inwardly of the outer end 1510 of the blocking member. In this way, when the bristles and the blocking member are flexed, the outer end 1510 of a more-rigid blocking member, by deforming less, may effectively 'push' hair or other strand-like material that has become ensnared between individual bristles 1101 in the bristle tuft 1100 outwardly towards the ends 1110 of the bristles 1100.

Figure 19:
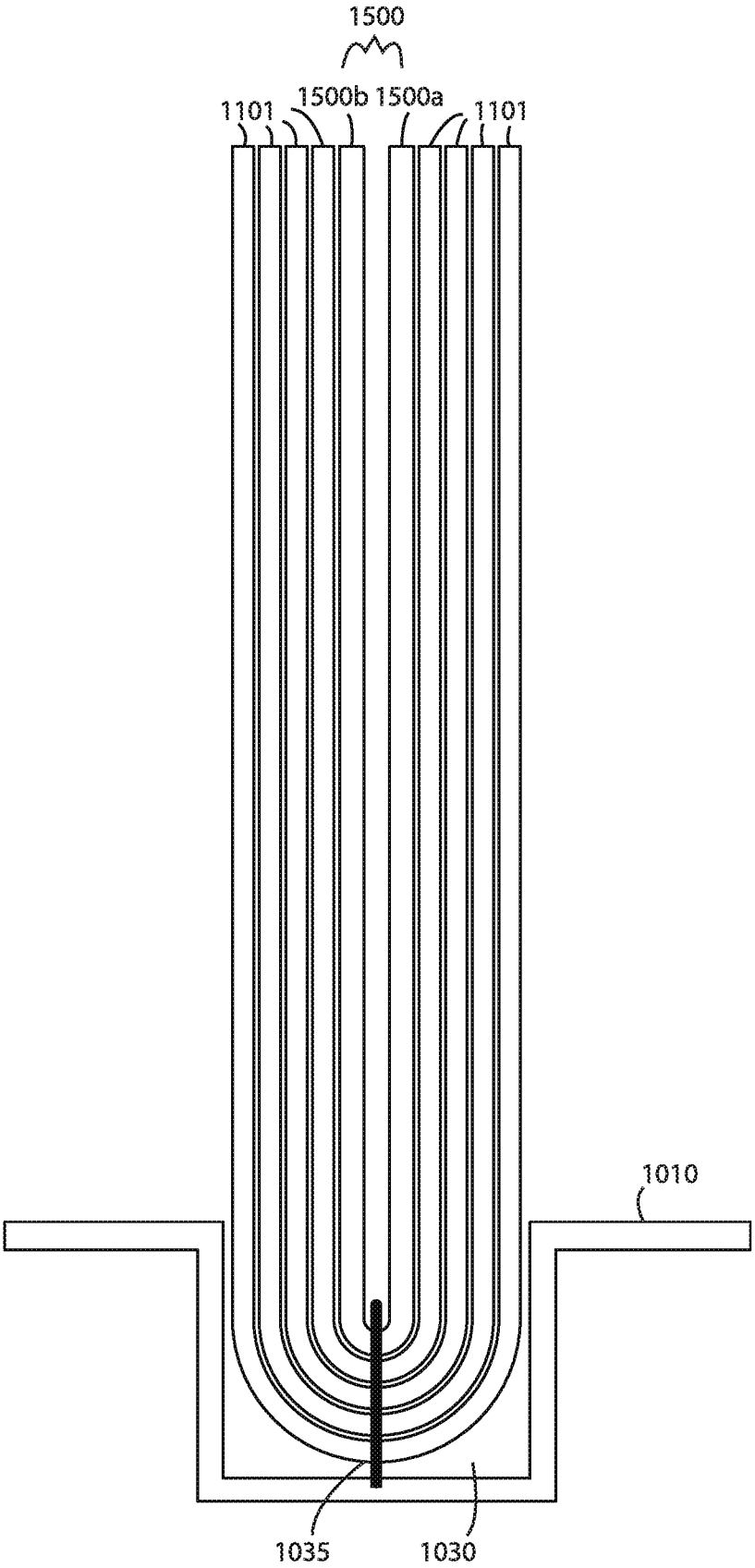
FIG. 19 is a schematic cross-section view of bristles and an internal hair blocking member secured to a brush roll.

FIG. 19 illustrates a schematic example of how a plurality of bristles 1101 and an internal blocking member 1500 may be secured to a brush roll 1000. In the illustrated example, a channel or seat 1030 is provided in the main body 1001 of the brush roll 1000. A plurality of bristle segments are positioned in the seat to form the bristle tuft 1100, and a wire 1035 is used to secure the bristles 1101 and to the seat 1030. The internal blocking member 1500 is positioned within the bristles 1101, and is also secured to the seat 1030 by the wire 1035. It will be appreciated that any other suitable means of securement may be used, such as adhesives and/or other mechanical securement means.

In the example illustrated in FIGS. 17 and 18, the internal blocking member 1500 has a width 1560 that is approximately constant along the entire length 1525 of the blocking member. Alternatively, an internal blocking member 1500 may have a support column 1501 extending away from the radial outer surface 1010 of the brush roll 1000 towards the outer end 1510 of the clocking member, and the outer end 1510 may be wider than the support column, i.e. as wide as, and optionally wider than a width of the bristle tuft in which the support column is embedded.

Figure 20:
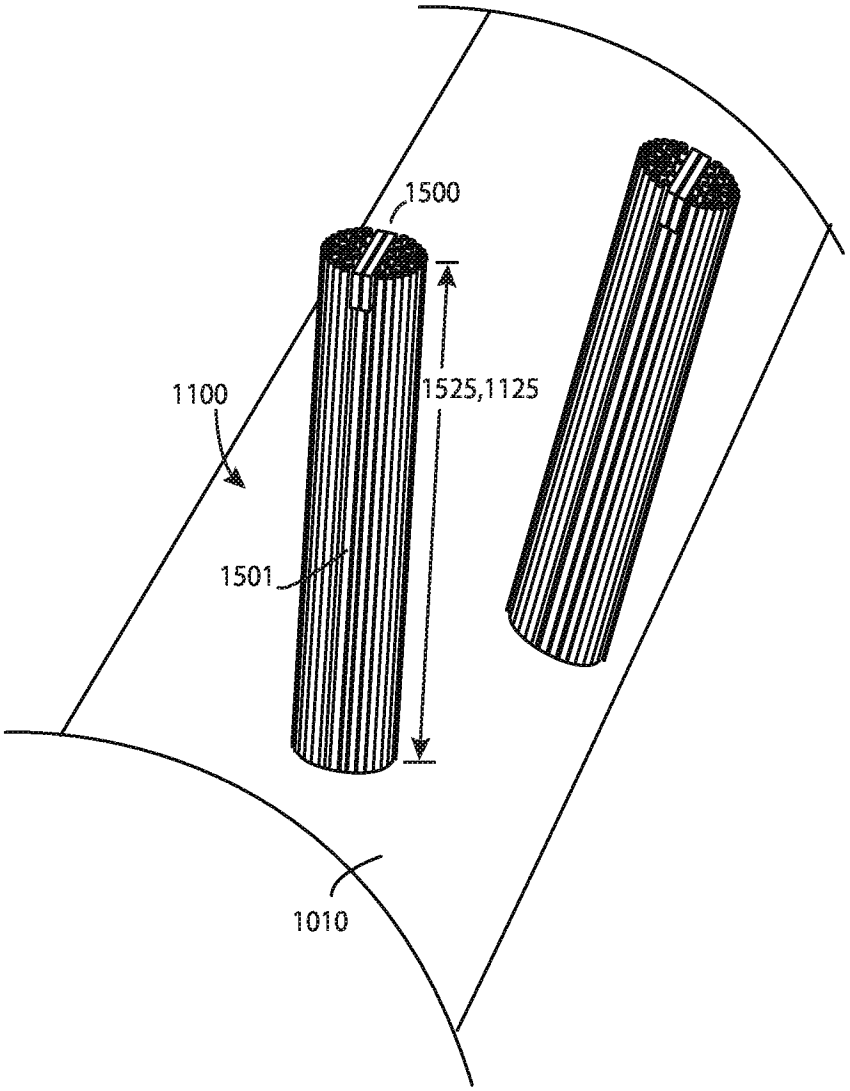
FIG. 20 is a perspective view of bristle tufts with internal hair blocking members in accordance with another embodiment.

For example, as illustrated in FIG. 20, an internal blocking member 1500 may have a generally T-shaped profile, in a front elevational view, with a relatively narrow support column 1501, and a cross member 1503 that has a width 1560 that is about the same as a width 1160 of the bristle tuft 1100. It will be appreciated that the cross member may have a width that is wider than the column but not as wide as, about as wide as, or wider than the bristle tuft, so as to have a generally T-shaped profile.

In the examples illustrated in FIGS. 17, 18, and 20, the bristle tufts 1100 are each generally circular in cross-section, when viewed in a direction transverse to a radial length of a the bristles 1101 of that tuft 1100. Alternatively, bristle tufts 1100 may have a rectangular or square cross-sectional shape or other shape.

Figure 21:
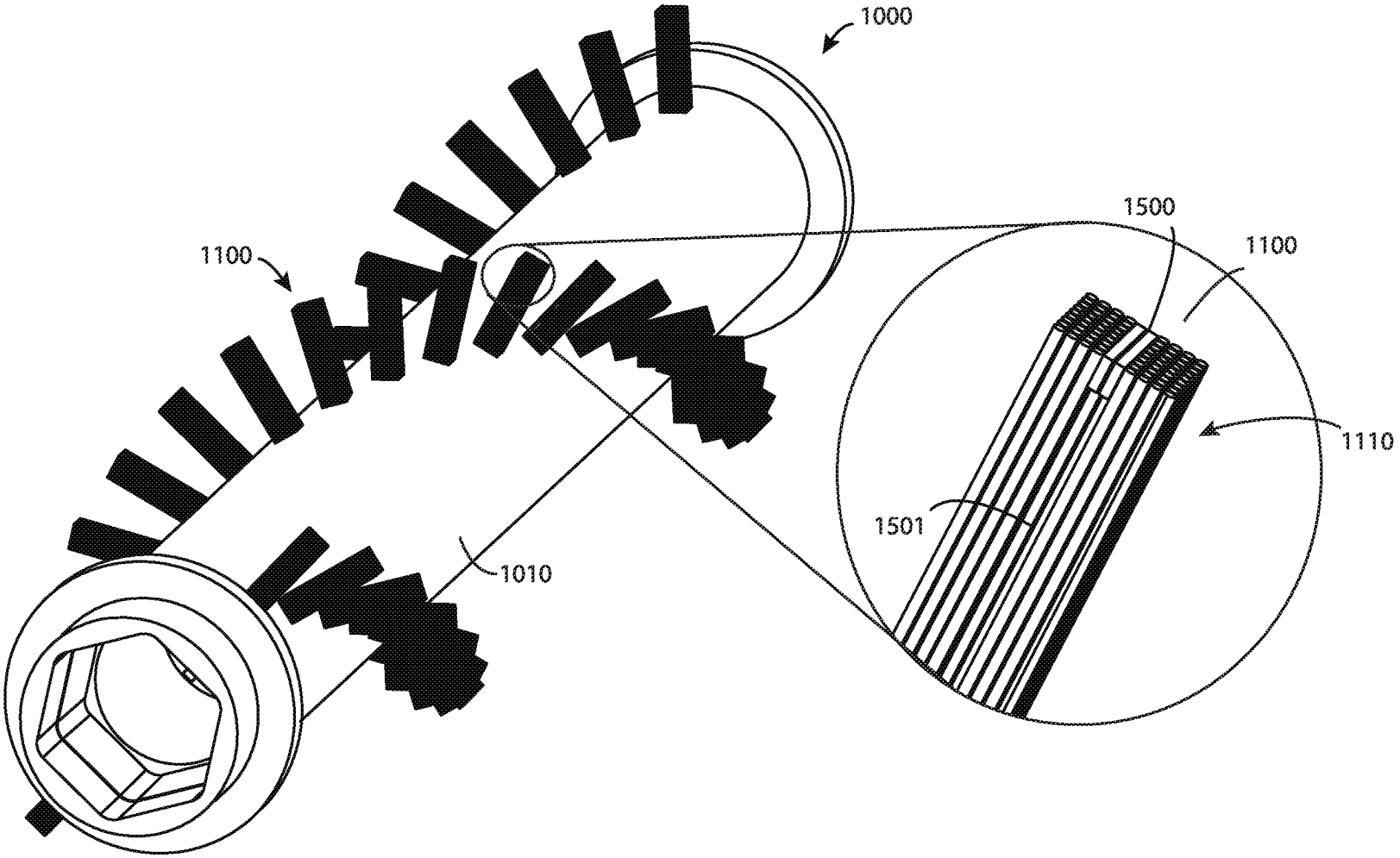
FIG. 21 is a perspective view of a brush roll in accordance with another embodiment, with an enlarged view of an end of a rectangular bristle tuft with an internal hair blocking member.
Figure 22:
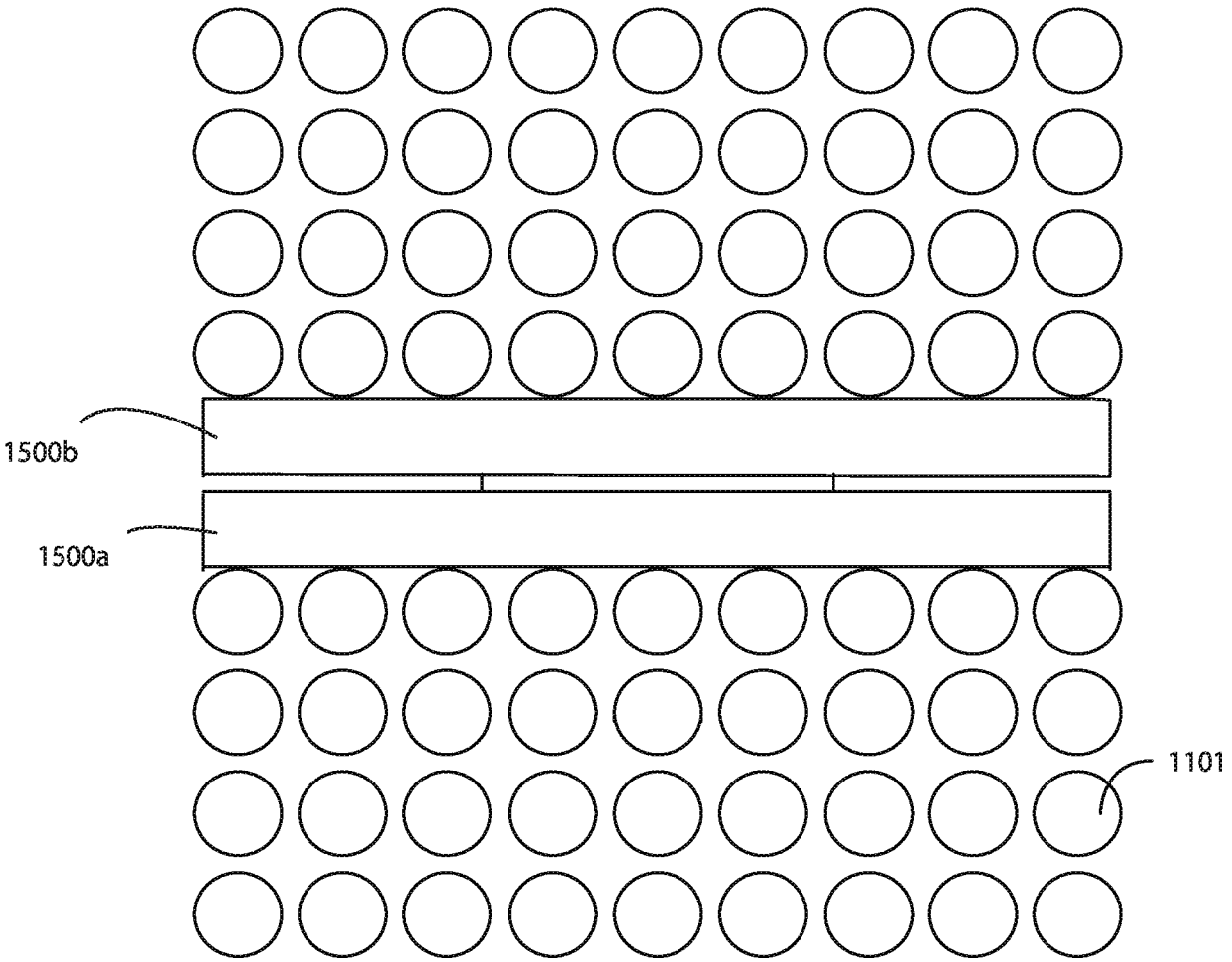
FIG. 22 is a top axial view of the bristle tuft of FIG. 21.

For example, in the example illustrated in FIGS. 21 and 22, an internal blocking member 1500 having a generally T-shaped profile is embedded within a rectangular bristle tuft 1100. It will be appreciated that the internal blocking member may have any other shape disclosed herein.

Figure 23:
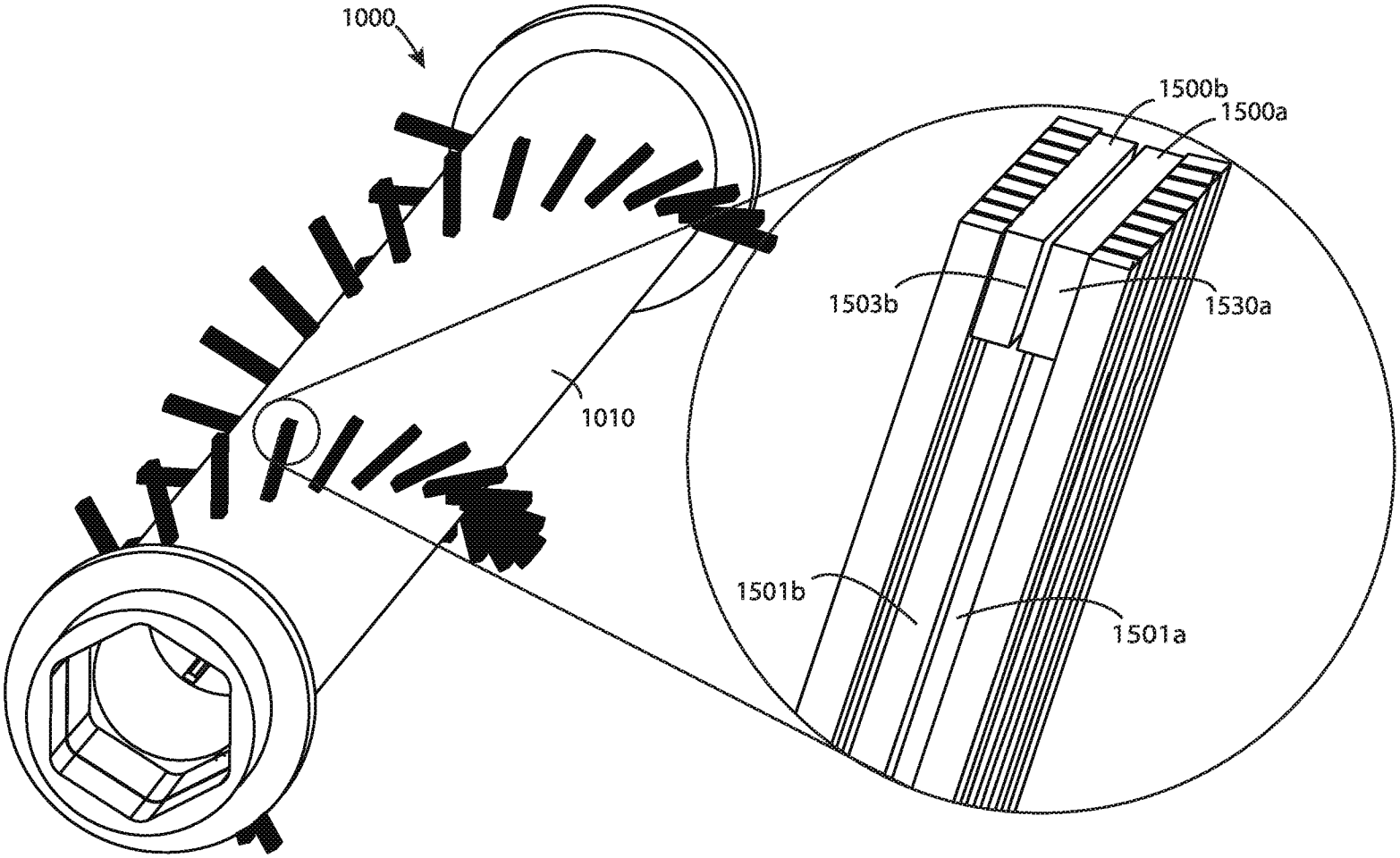
FIG. 23 is a perspective view of a brush roll in accordance with another embodiment, with an enlarged view of an end of a rectangular bristle tuft with an internal hair blocking member.
Figure 24:
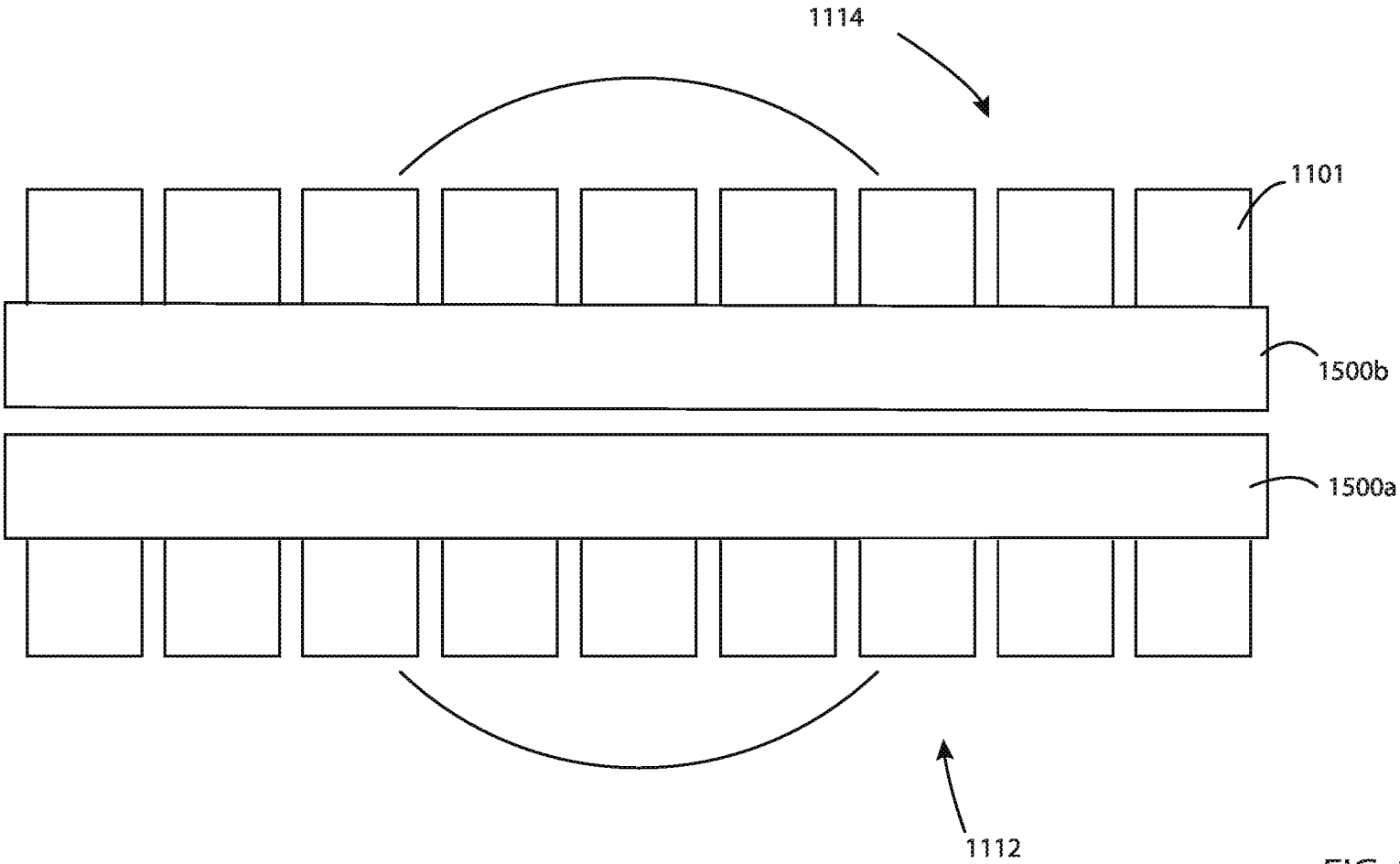
FIG. 24 is a top axial view of the bristle tuft of FIG. 23.

In the example illustrated in FIGS. 23 and 24, an internal blocking member 1500 having a generally T-shaped profile is embedded within a rectangular bristle tuft 1100 in which a single row of bristles 1101 is provided on the forward rotational side 1112 of the tuft, and a single row of bristles is provided on the rearward rotational side 1114 of the tuft.

As previously discussed, the radial outer end 1510 of an internal blocking member 1500 preferably has a width that is at least the same as, and optionally greater than, a width of the bristle tuft in which it is positioned. Optionally, the radial outer end 1510 may also have a portion that extends from the forward rotational side 1112 of the bristles in a bristle row/tuft 1100 to the rearward rotational side 1114 of the bristles in that bristle row/tuft 1100 (i.e., in the direction of rotation of the brush roll).

Figure 25:
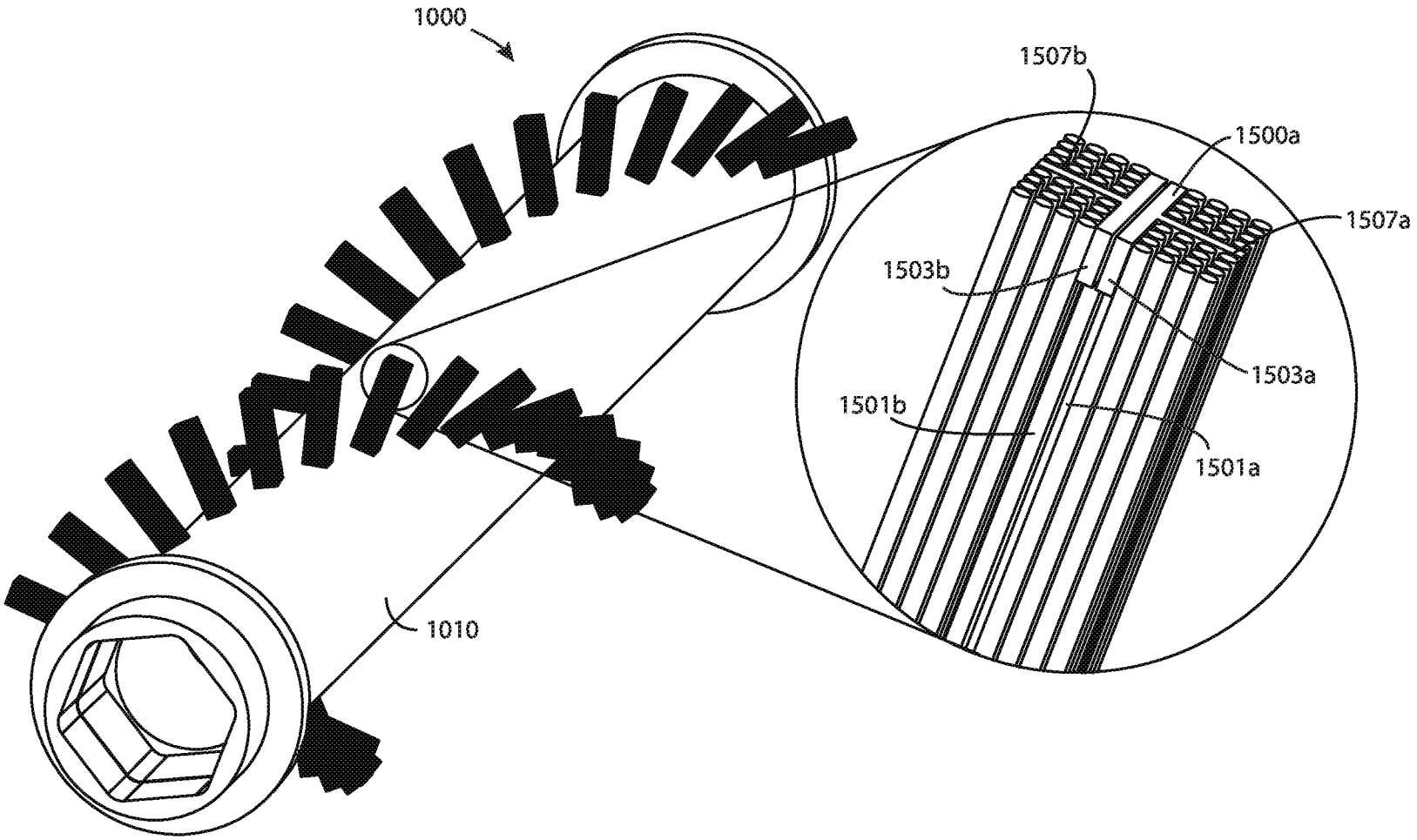
FIG. 25 is a perspective view of a brush roll in accordance with another embodiment, with an enlarged view of an end of a rectangular bristle tuft with an internal hair blocking member.
Figure 26:
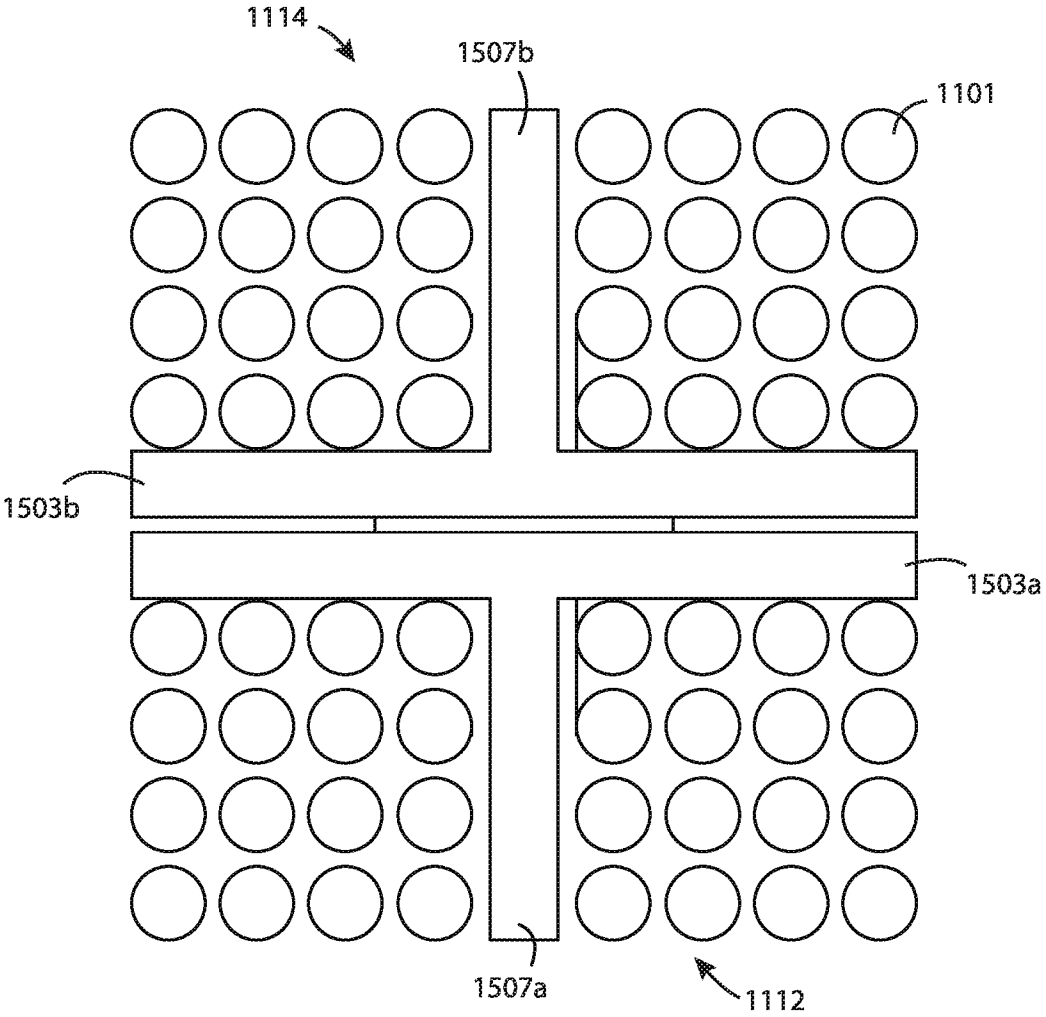
FIG. 26 is a top axial view of the bristle tuft of FIG. 25.

For example, in the example illustrated in FIGS. 25 and 26, an internal blocking member 1500 has a generally T-shaped end face when viewed in a top plan view, with a first cross member 1503 that has a width 1560 that is about the same as a width 1160 of the bristle tuft 1100, and a second cross member 1507 that has a length 1562 that may be about the same as a depth 1162 of the bristle tuft 1100.

An advantage of this design is that by having the radial outer end 1510 extend across the width and the depth of the bristle tuft 1100, the likelihood of hair or other strand-like material contacting the outer end 1510 of the internal blocking member 1500 and thereby be inhibited or prevented from migrating between the bristles 1101 may be increased.

Figure 27:
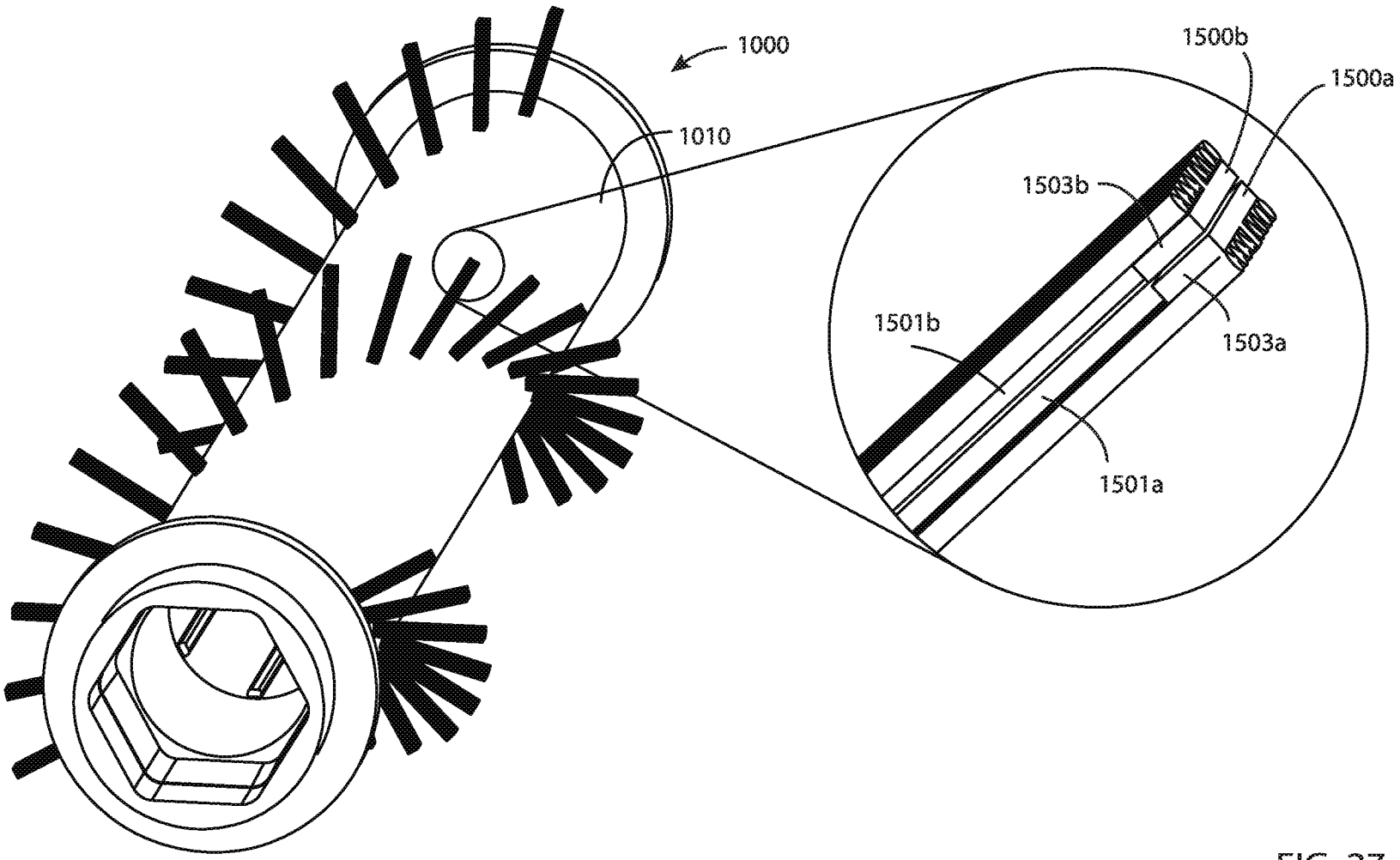
FIG. 27 is a perspective view of a brush roll in accordance with another embodiment, with an enlarged view of an end of a rectangular bristle tuft with an internal hair blocking member.
Figure 28:
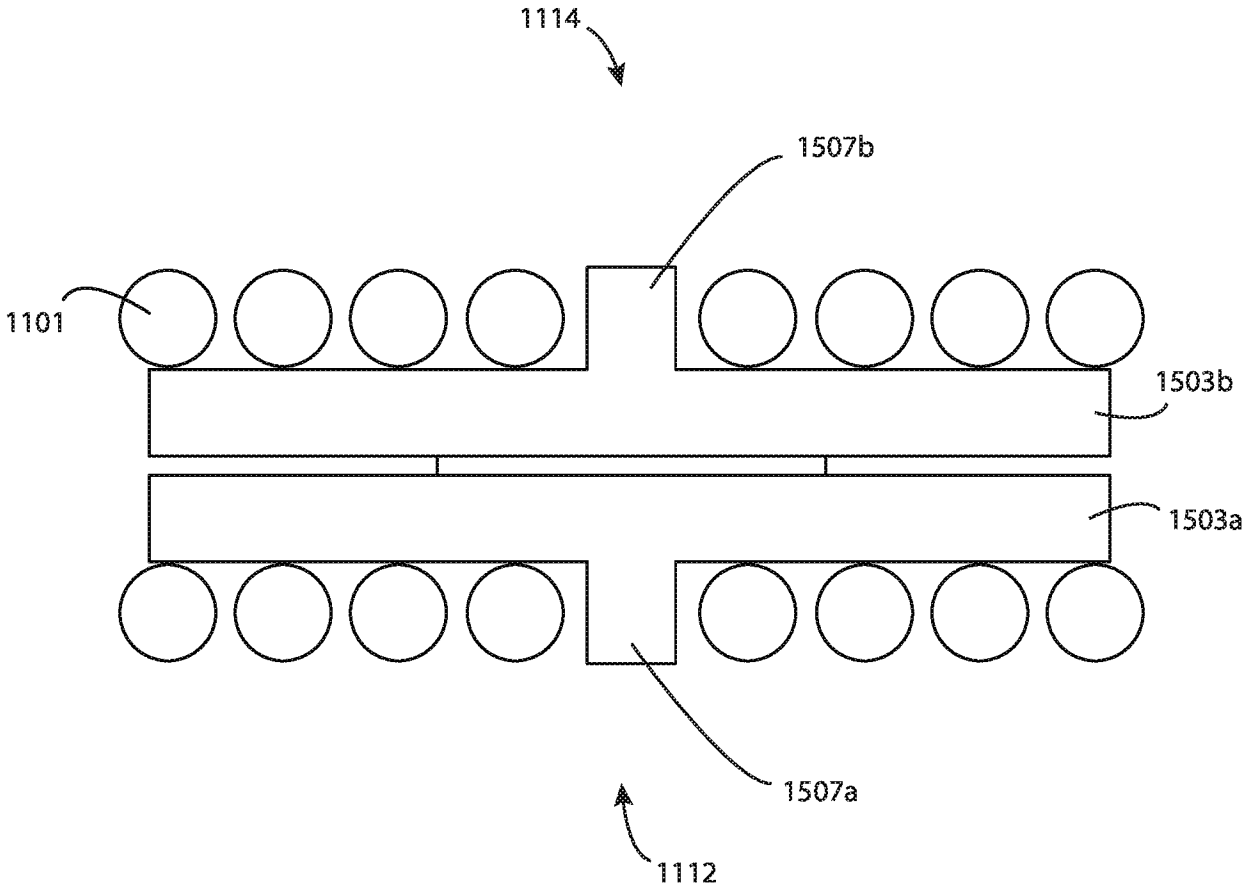
FIG. 28 is a top axial view of the bristle tuft of FIG. 27.

In the example illustrated in FIGS. 27 and 28, an internal blocking member 1500 having a generally T-shaped end face is embedded within a rectangular bristle tuft 1100. In this example, a single row of bristles 1101 is provided on the forward rotational side 1112 of the tuft, and a single row of bristles is provided on the rearward rotational side 1114 of the tuft.

As stated previously, in some embodiments, one or more bristle tufts 1100 may have both an internal blocking member 1500 and a sheath 1300. An advantage of this design is that the internal blocking member may inhibit or prevent hair or other strand-like material from becoming embedded within the bristles 1101 of the tuft 1100, while the sheath 1300 may inhibit or prevent any hair that does manage to become embedded within the bristles from migrating inwardly between the bristles 1101 and towards the outer surface 1010 of the brush roll 1000.

Figure 29:
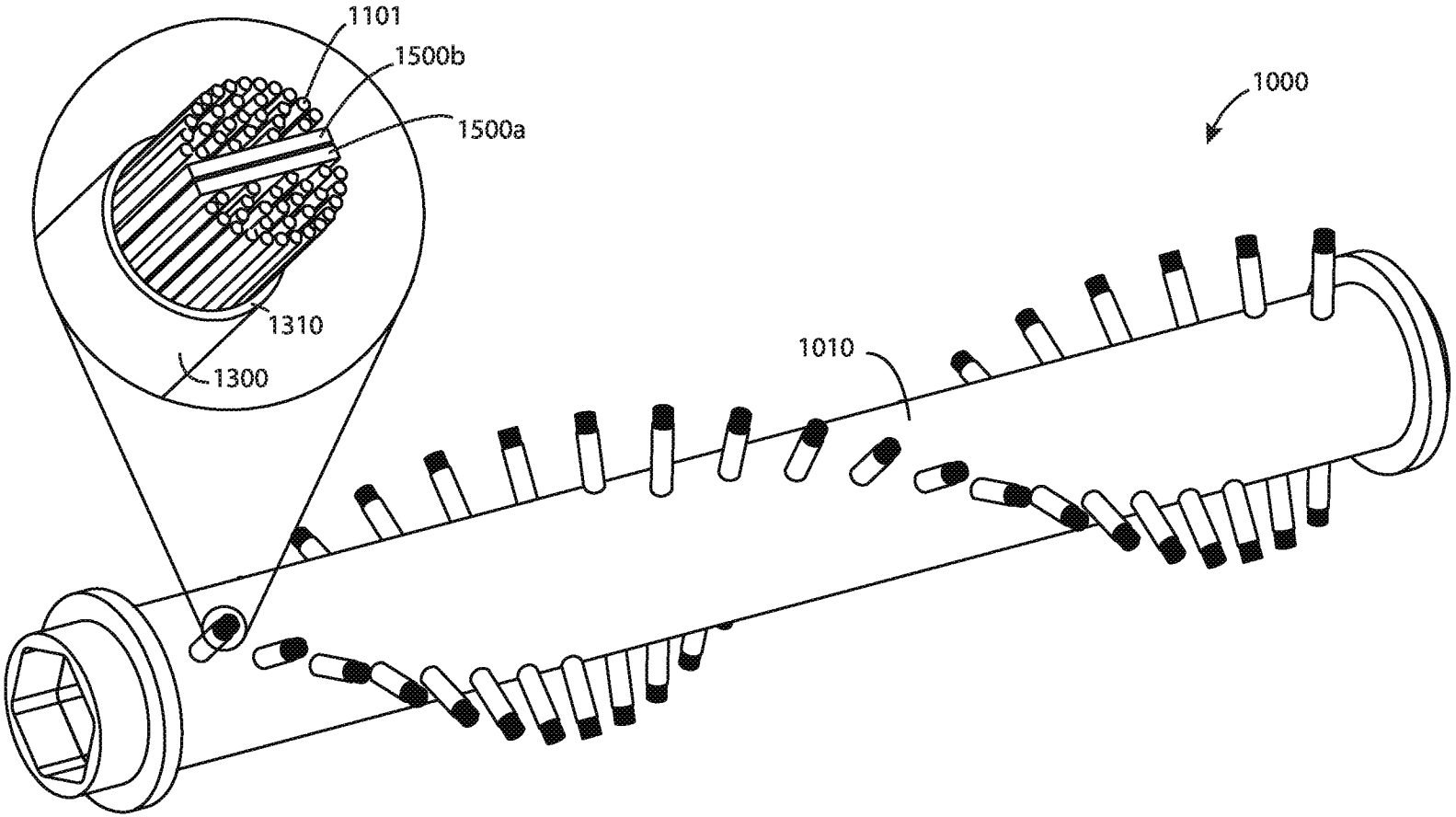
FIG. 29 is a perspective view of a brush roll in accordance with another embodiment, with an enlarged view of an end of a sheathed bristle tuft with an internal hair blocking member.

In the example illustrated in FIG. 29, bristle tufts 1100 having an embedded internal blocking member 1500 that includes a pair of blocking members 1500*a*, 1500*b*—like those illustrated in FIGS. 17 and 18—are provided with sheaths 1300.

Figure 30:
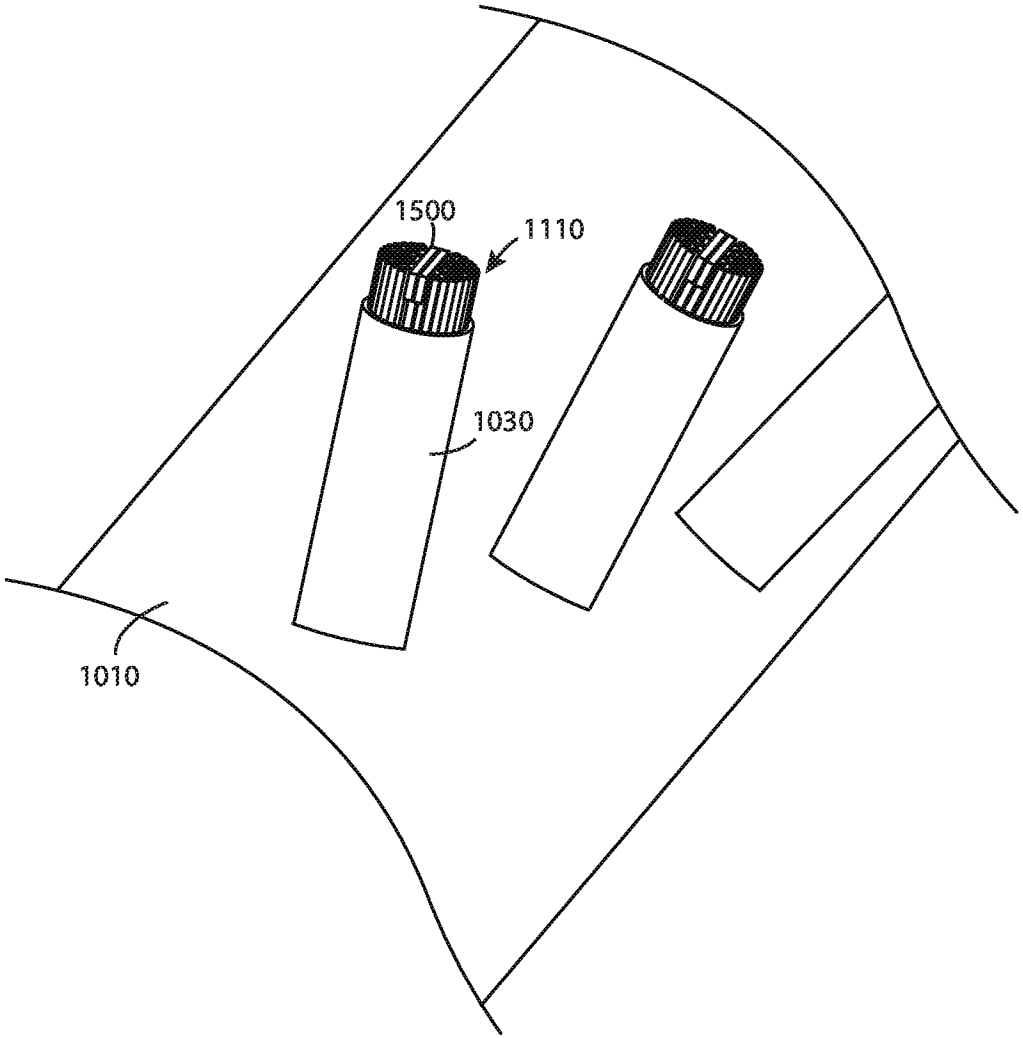
FIG. 30 is a perspective view of bristle tufts with internal hair blocking members in accordance with another embodiment.

In the example illustrated in FIG. 30, bristle tufts 1100 having an embedded internal blocking member 1500 having a generally T-shaped profile—like those illustrated in FIG. 20—are provided with sheaths 1300.

Figure 31:
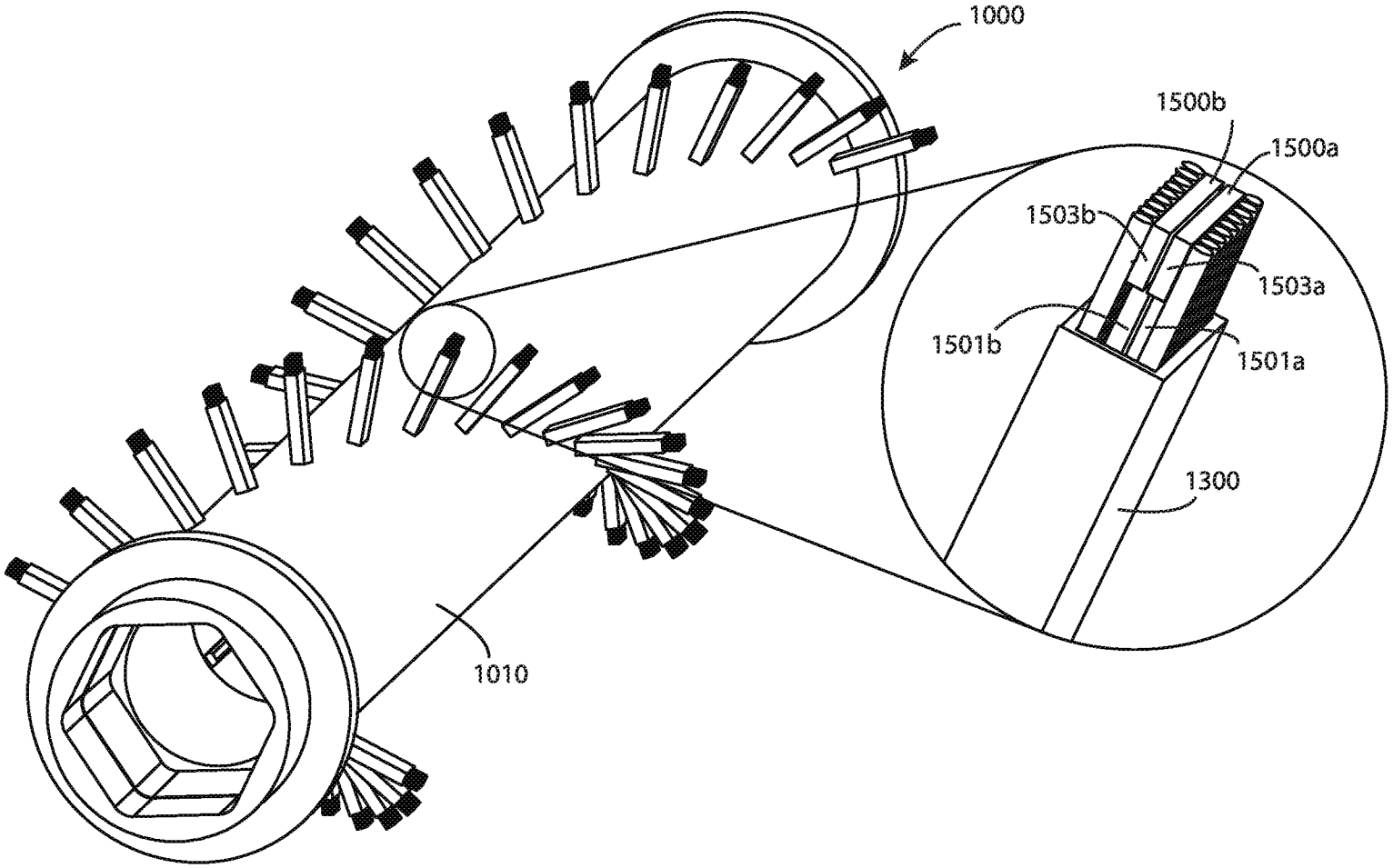
FIG. 31 is a perspective view of a brush roll in accordance with another embodiment, with an enlarged view of an end of a sheathed rectangular bristle tuft with an internal hair blocking member.
Figure 32:
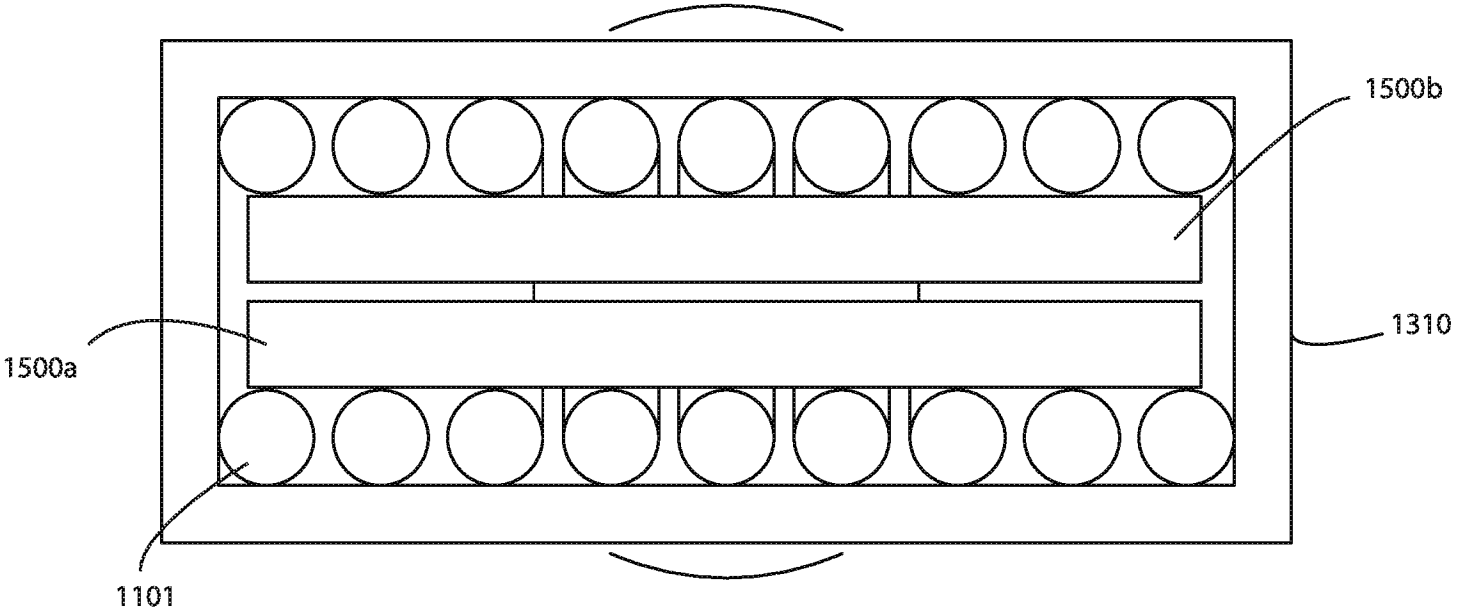
FIG. 32 is a top axial view of the sheathed bristle tuft of FIG. 31.

In the example illustrated in FIGS. 31 and 32, rectangular bristle tufts 1100 having an embedded internal blocking member 1500 that includes a pair of T-shaped blocking members 1500*a*, 1500*b*—like those illustrated in FIGS. 23 and 24—are provided with sheaths 1300.

Figure 33:
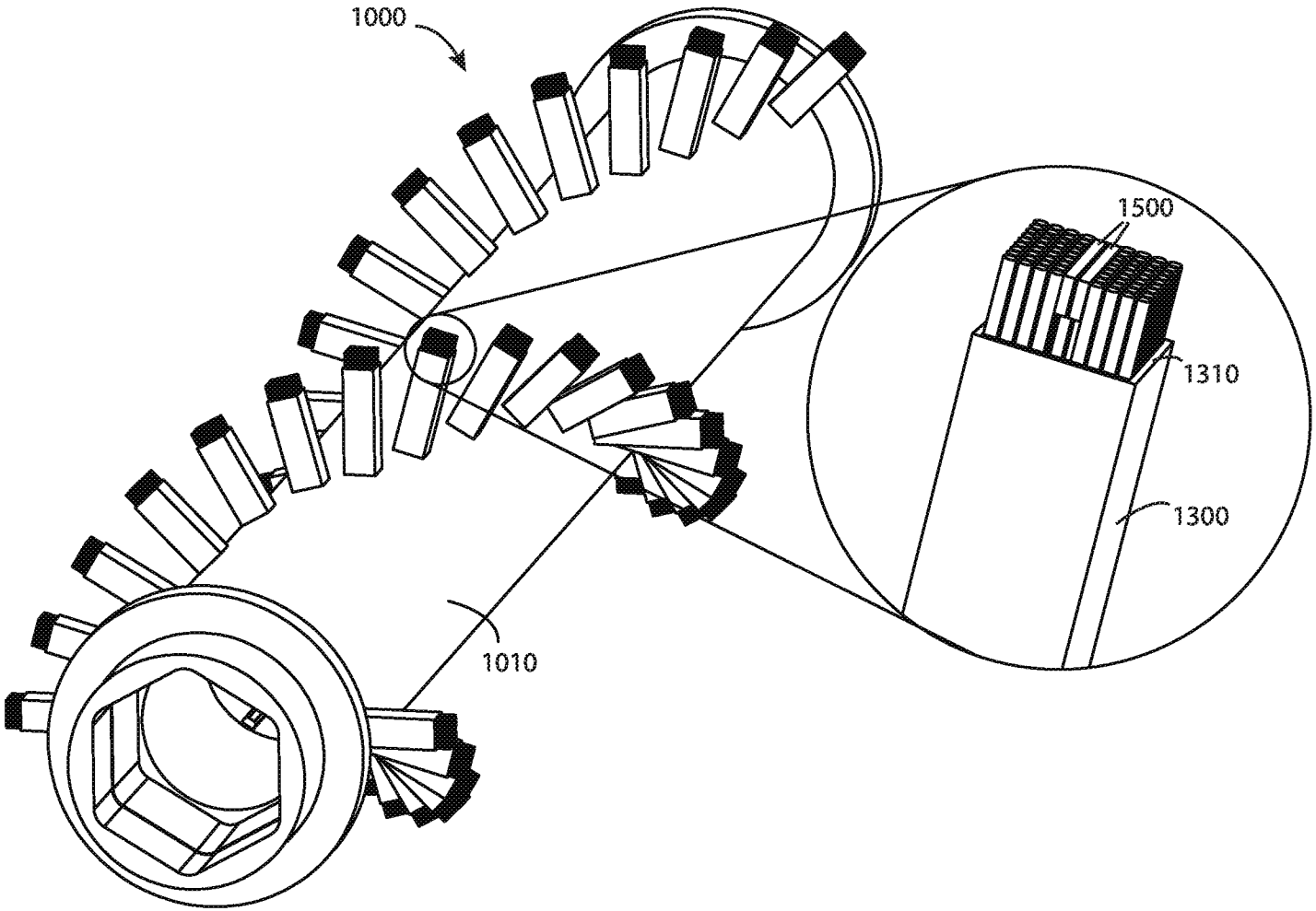
FIG. 33 is a perspective view of a brush roll in accordance with another embodiment, with an enlarged view of an end of a sheathed rectangular bristle tuft with an internal hair blocking member.
Figure 34:
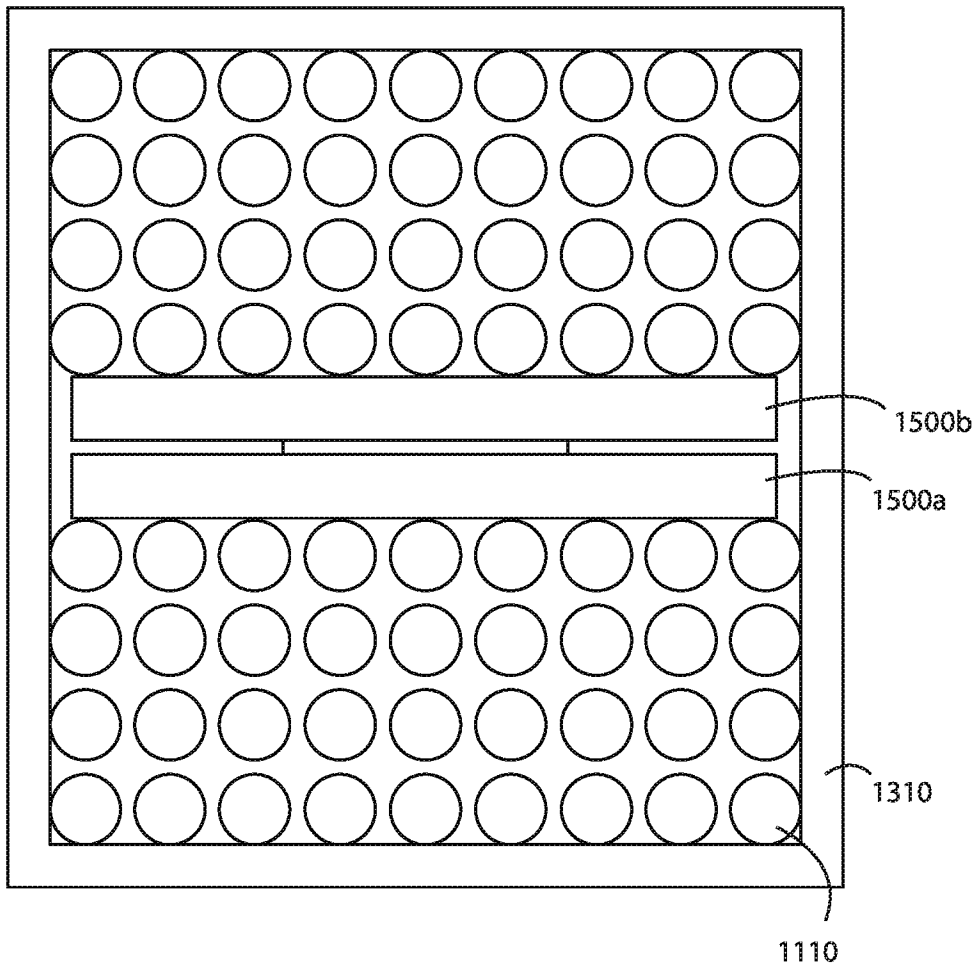
FIG. 34 is a top axial view of the sheathed bristle tuft of FIG. 33.

In the example illustrated in FIGS. 33 and 34, rectangular bristle tufts 1100 having an embedded internal blocking member 1500 that includes a pair of T-shaped blocking members 1500*a*, 1500*b*—like those illustrated in FIGS. 21 and 22—are provided with sheaths 1300.

Figure 35:
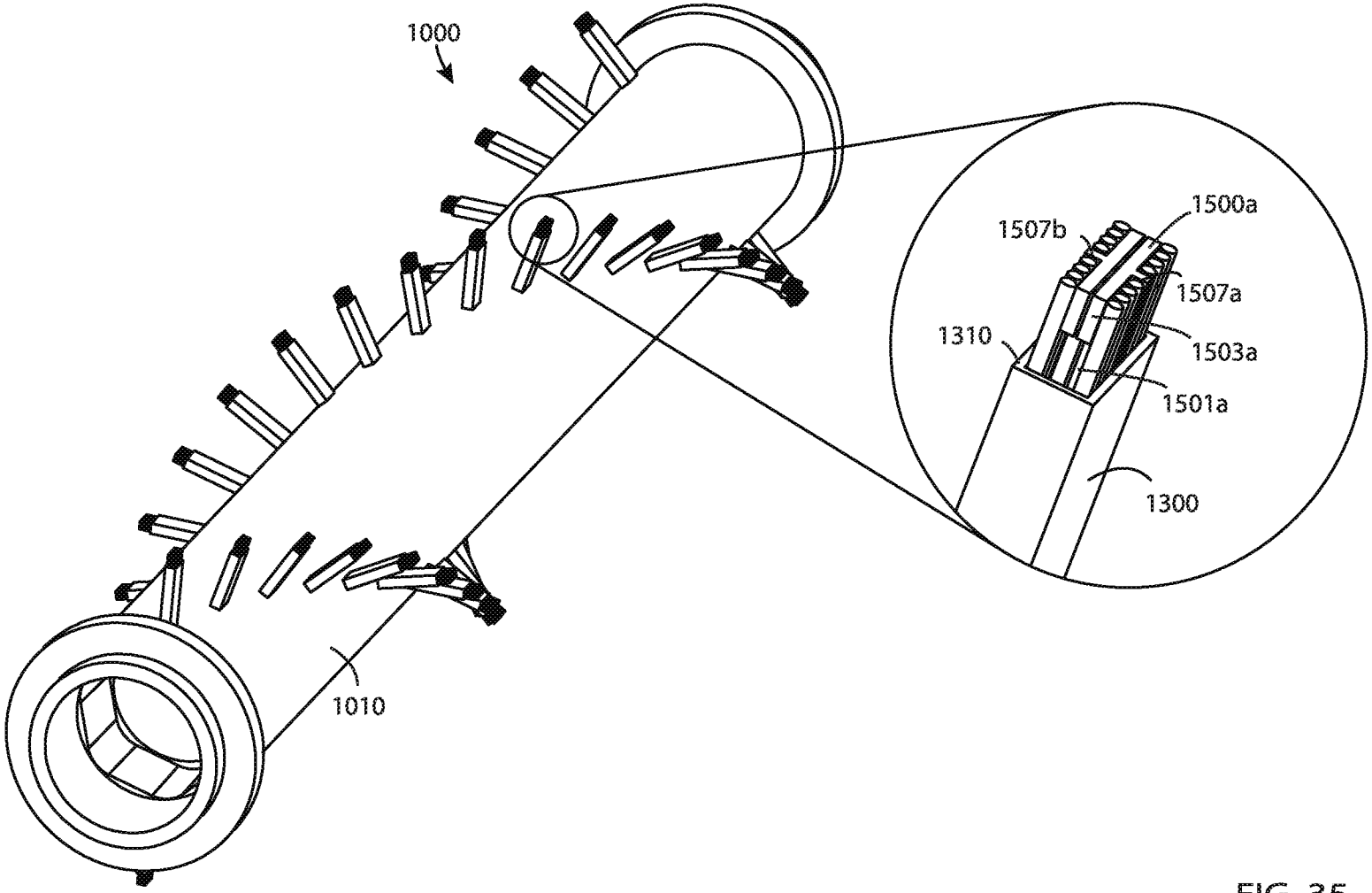
FIG. 35 is a perspective view of a brush roll in accordance with another embodiment, with an enlarged view of an end of a sheathed rectangular bristle tuft with an internal hair blocking member.
Figure 36:
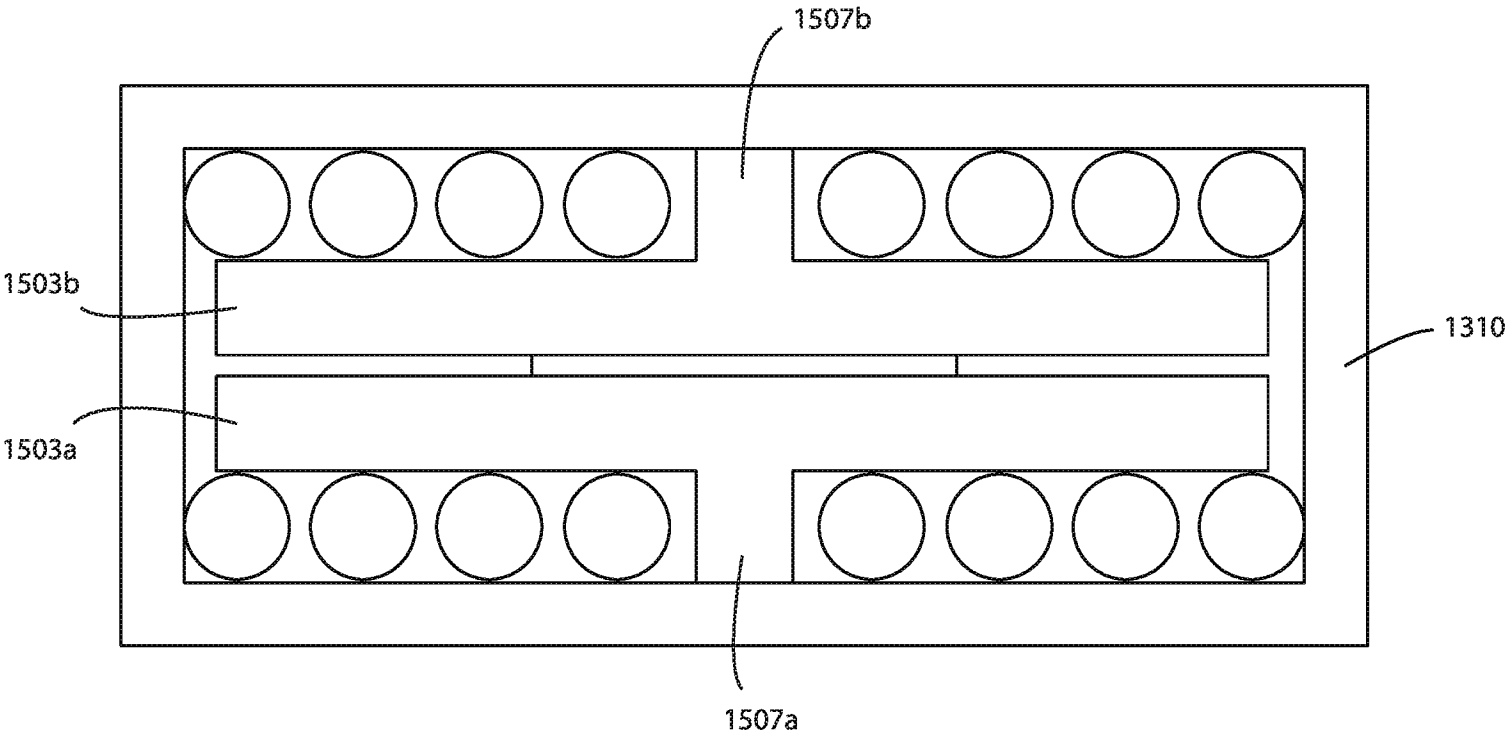
FIG. 36 is a top axial view of the sheathed bristle tuft of FIG. 35.

In the example illustrated in FIGS. 35 and 36, rectangular bristle tufts 1100 having an embedded internal blocking member 1500 that includes a pair of T-shaped end face blocking members 1500*a*, 1500*b*—like those illustrated in FIGS. 27 and 28—are provided with sheaths 1300.

Figure 38:
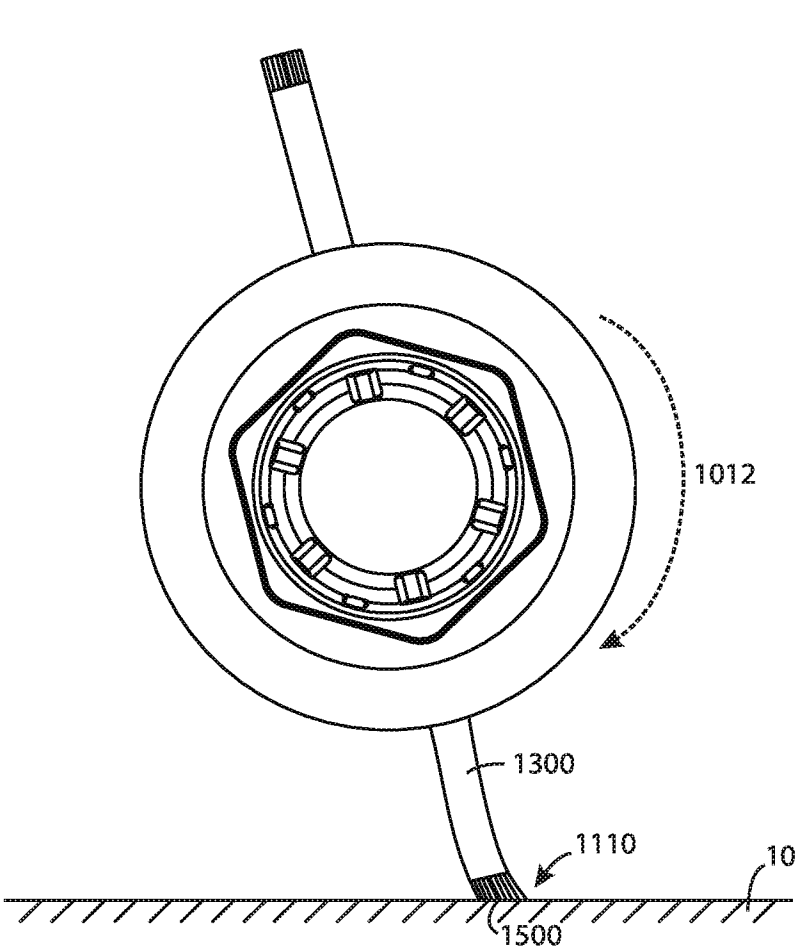
FIGS. 37 to 39 are a series of schematic end views showing a brush roll in accordance with another embodiment being rotated along a floor surface.
Figure 37:
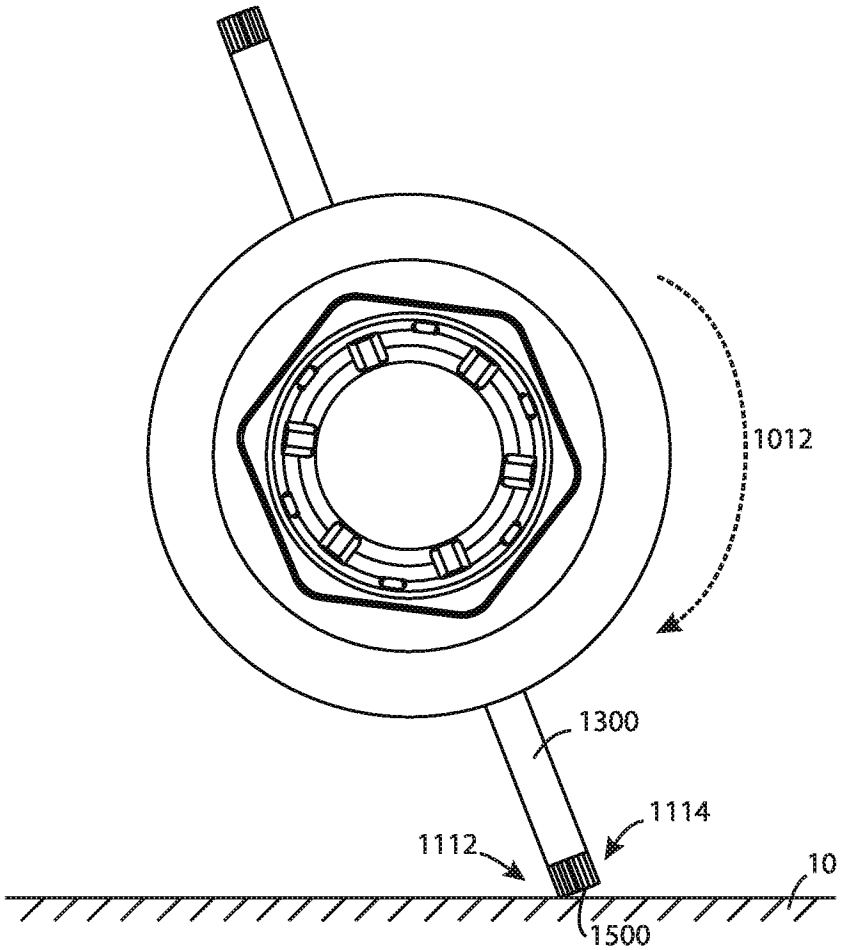
Figure 39:
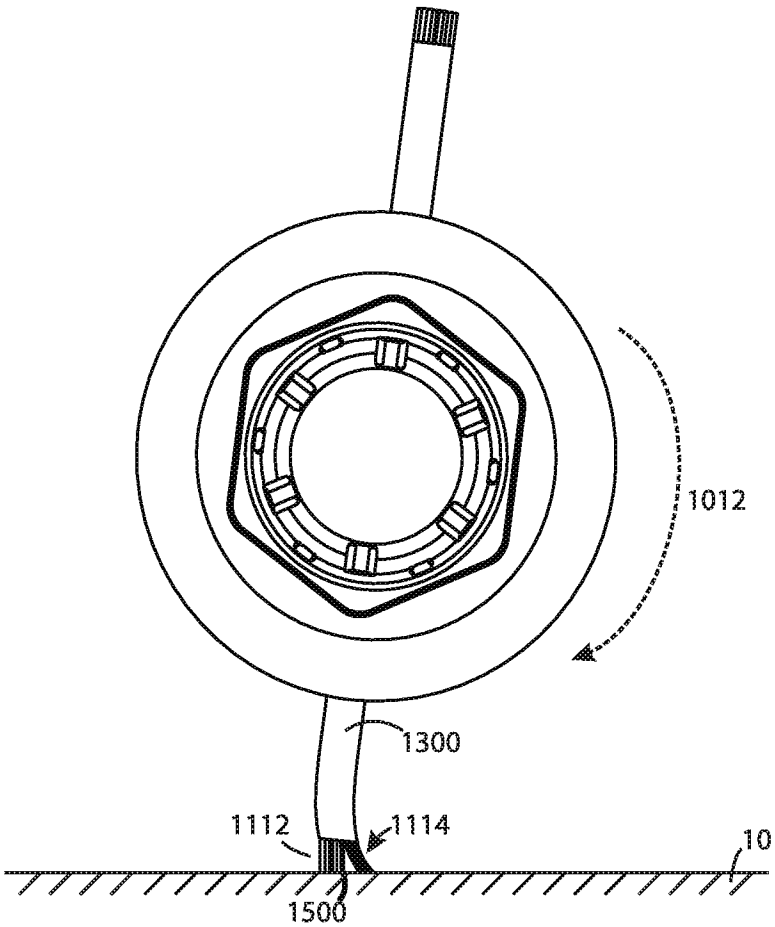

FIGS. 37-39 illustrate an example of how a bristle tuft 1100 with an internal hair blocking member 1500 and a sheath 1300 may not only inhibit or prevent hair, string, or other strand-like material from becoming embedded in the bristles 1100, but may also assist in urging hair, string, or other strand-like material embedded in bristles 1100 to migrate outwardly towards the ends 1110 of the bristles, and/or to assist in partially or completely dislodging hair or other strand-like material from the bristles.

In FIG. 37, brush roll 1000 is at a position where the forward rotational side 1112 of bristles 1100 is in contact with the floor surface 10. In FIG. 38, the brush roll 1000 has been rotated so that the bristles 1100 are sweeping over the floor surface 10, and the internal hair blocking member 1500 is in contact with the floor surface 10.

In FIG. 39, the brush roll 1000 has been further rotated so that the bristles 1100 and the internal hair blocking member

1500 continue to sweep over the floor surface 10. The internal hair blocking member 1500 remains in contact with the floor surface 10. In this position, if a hair or other piece of strand-like debris that is embedded in the bristles 1100 is also in contact with the end 1510 of the internal hair blocking member 1500, the hair may be at least temporarily 'pinched' or held between the floor surface 10 and the end 1510. In this position, as the rearward rotational side 1114 of bristles 1100 are deflected by the floor surface 10, a hair or other piece of strand-like debris held or 'pinched' by the internal hair blocking member 1500 may be partially or completely dislodged from the rearward rotational side 1114 of the bristles 1100.

Optionally, the internal hair blocking member 1500 is less flexible than the bristles 1101. This is preferred if the internal hair blocking member 1500 is radially shorter than the bristles 1101. An advantage of providing a less-flexible hair blocking member is that the outer end 1510 may be less easily deformed towards the outer surface 1010 of brush roll 1000, thereby making it easier for the ends 1110 of the bristles 1100 to be flexed or deformed towards or preferably radially inwardly of the outer end 1510.

Hair Blocking Member Positioned Between Bristle Tufts

In the examples illustrated in FIGS. 40 to 51, a hair blocking member is provided proximate a plurality of bristle tufts, with some of the plurality of tufts positioned forward of the blocking member, some of the plurality of tufts positioned rearward of the blocking member. In this arrangement, when the brush roll is rotated, some of the tufts precede the hair blocking member, and some of the tufts follow the hair blocking member. The internal blocking member may inhibit or prevent hair or other strand-like material from migrating radially inwardly between the bristles of tufts proximate the blocking member towards the outer surface of the brush roll.

Figure 40:
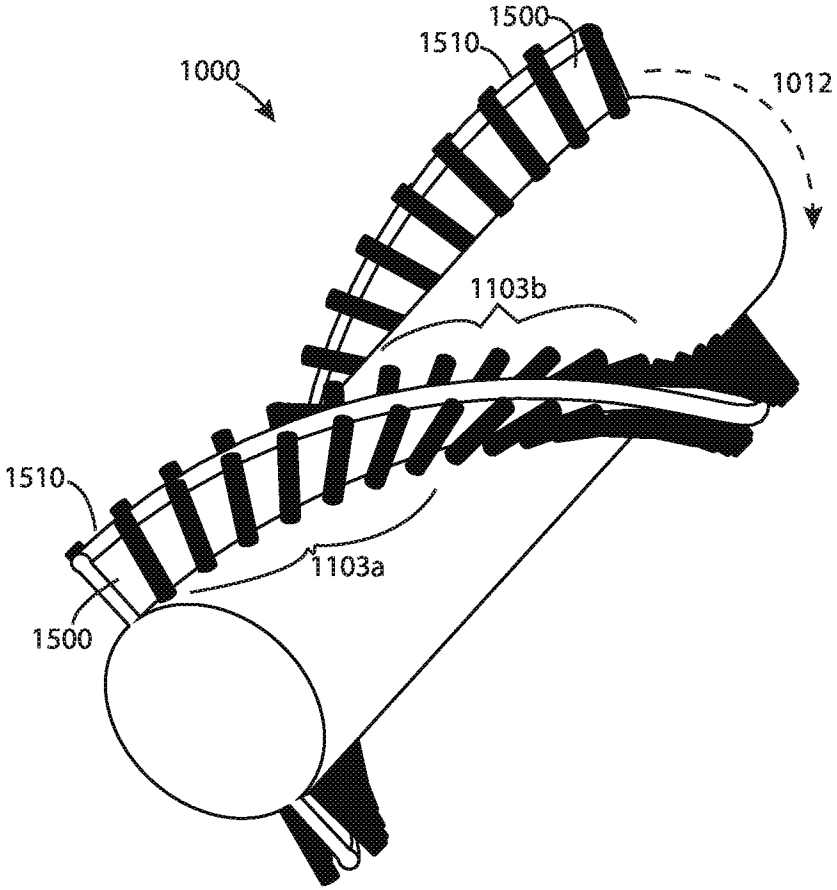
FIG. 40 is a perspective view of a brush roll in accordance with another embodiment, wherein a continuous strip comprises a plurality of internal hair blocking members that are positioned between rows of bristle tufts.
Figure 41:
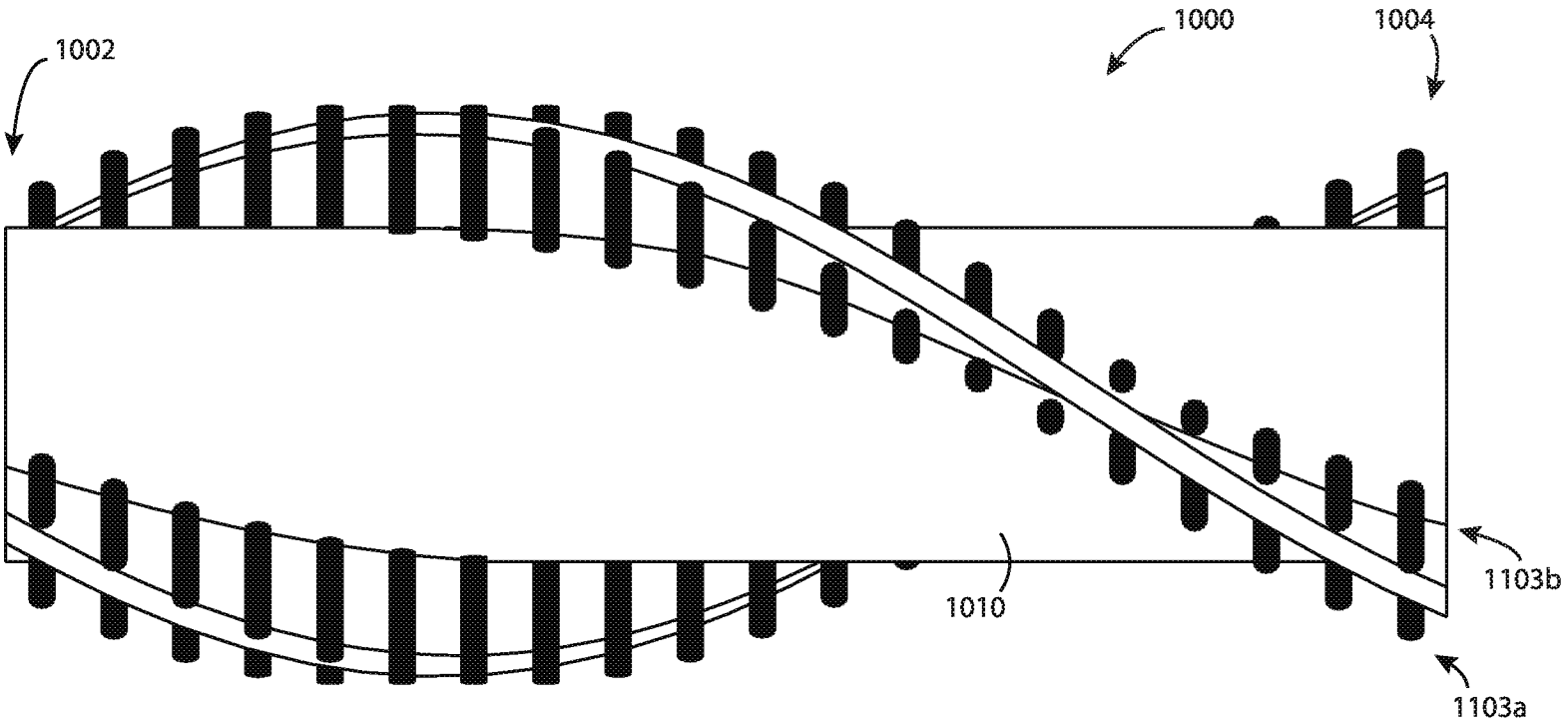
FIG. 41 is a top view of the brush roll of FIG. 40.

In the example illustrated in FIGS. 40 and 41, a first or leading row 1103*a* of bristle tufts 1100 and a second or trailing row 1103*b* of bristle tufts 1100 each extend axially along the brush roll in a generally helical formation from the first end 1002 to the second end 1004 of the brush roll 1000.

In the illustrated example, an internal hair blocking member 1500 is provided between the bristle rows 1103*a*, 1103*b*. In this arrangement, the hair blocking member 1500 is adjacent a rearward rotational side 1114 of the bristles 1100 in leading bristle row 1103*a*, and adjacent a forward rotational side 1112 of the bristles 1110 in trailing bristle row 1103*b*. The hair blocking member 1500 may abut the rearward rotational side 1114 of the bristles 1100 in leading bristle row 1103*a*, and/or may abut the forward rotational side 1112 of the bristles 1110 in trailing bristle row 1103*b*. The hair blocking member may be spaced from the rearward rotational side 1114 of the bristles 1100 in leading bristle row 1103*a*, and/or may be spaced from the forward rotational side 1112 of the bristles 1110 in trailing bristle row 1103*b* by, e.g., in the direction of rotation of the brush roll, 1, 2, 3, or 4 times the width of a tuft of bristles.

The internal blocking member 1500 may have the same radial length as the blocking member exemplified in FIGS. 17-39. Optionally, the internal blocking member may be shorter than the bristles.

The hair blocking member is preferably spaced forwardly or rearwardly (in the direction of rotation of the brush roll) from the bristles 1100, so that the hair blocking member can flex without being limited by engagement with the bristles 1100. For example, a hair blocking member may be positioned spaced 1-12, 1-8, 1-4 or 1-2 mm forward from the forward rotational side of bristles 1100 and a second hair blocking member may be positioned spaced 1-12, 1-8, 1-4 or 1-2 mm rearward from the rearward rotational side of the bristles 1100. Alternately, only one of a forward and rearwardly positioned hair blocking member may be provided.

In the example illustrated in FIGS. 40 and 41, the internal blocking member 1500 extends continuously from the first end 1002 to the second end 1004 of the brush roll 1000. Thus, the width 1560 of the radial outer end 1510 of the blocking member 1500 is substantially the same as the axial length of the brush roll 1000. Alternatively, the hair blocking member 1500 may consist of a plurality of segments, with each segment spanning a portion of the distance from the first end 1002 to the second end 1004 of the brush roll 1000. In some embodiments, the ends of adjacent segments may abut each other, such that the segments form a substantially continuous hair blocking member 1500. Alternatively, the ends of adjacent segments may be spaced from each other.

Figure 42:
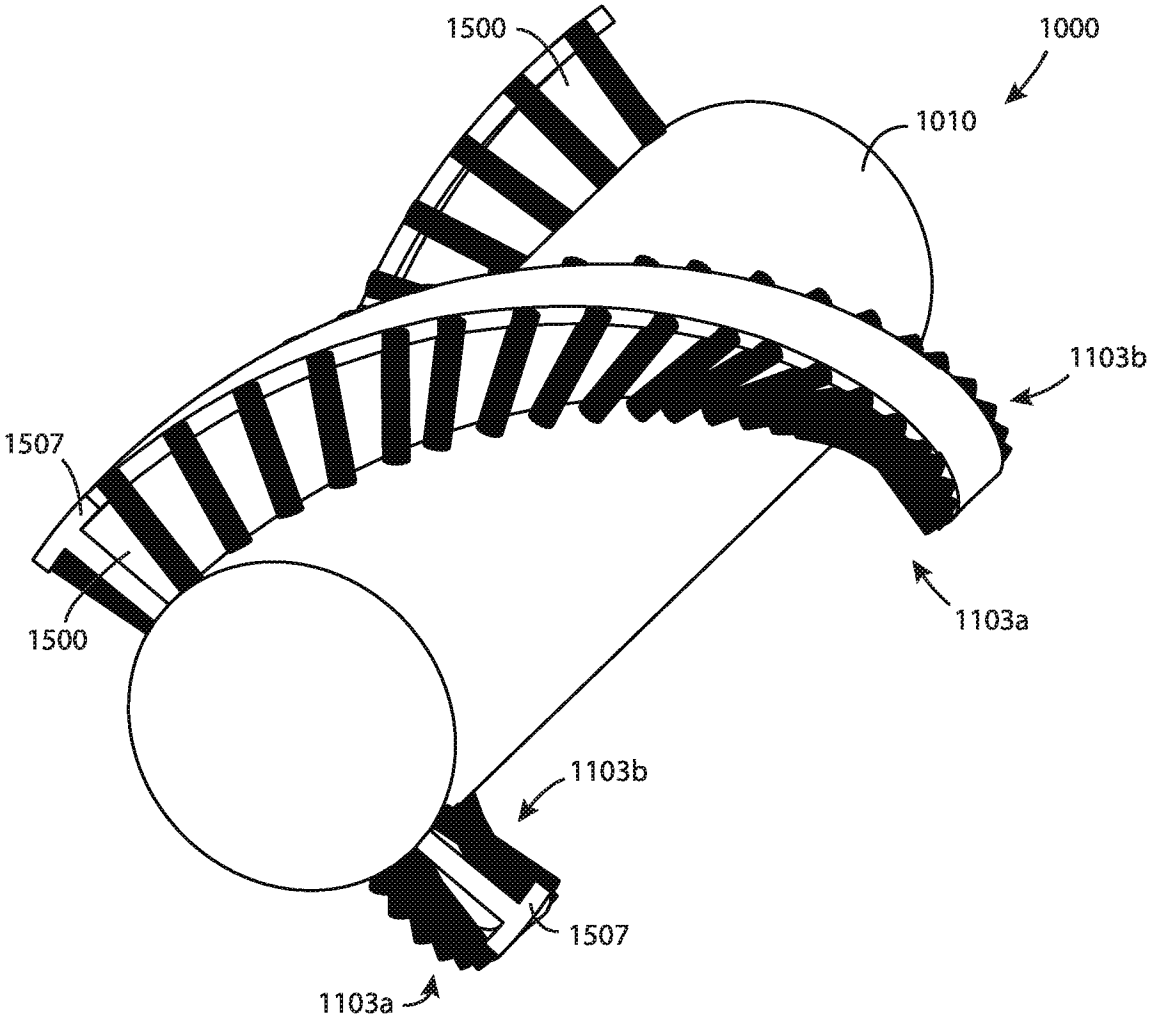
FIG. 42 is a perspective view of a brush roll in accordance with another embodiment, wherein a continuous T-shaped strip extends along a row of bristles and defines internal hair blocking members that are positioned between rows of bristle tufts.
Figure 43:
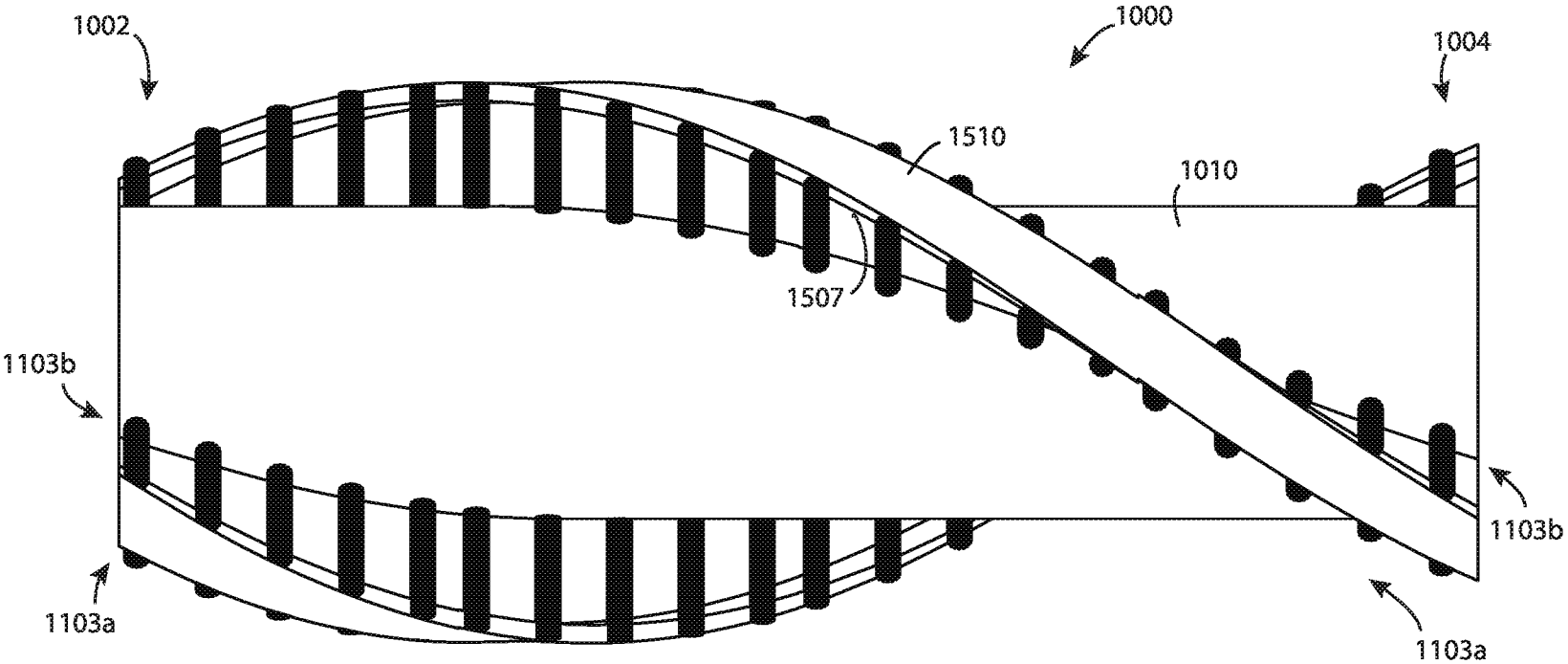
FIG. 43 is a top view of the brush roll of FIG. 42.

In the example illustrated in FIGS. 42 and 43, the radial outer end 1510 of the blocking member 1500 has a cross member 1507 that extends between, and optionally abuts, the forward rotational side 1112 of the bristles 1100 in bristle row 1103*a*, and the rearward rotational side 1114 of the bristles 1110 in bristle row 1103*b* (e.g., the blocking member 1500 may have a T-shaped profile in side view when viewed from an end of the brush roll). An advantage of this design is that hair or other strand-like material may be inhibited or prevented from accumulating between the bristle rows 1103*a*, 1103*b*. The radial outer extend of cross member 1507 may be recessed radially inwardly from the radially outer end of the bristles.

Figure 44:
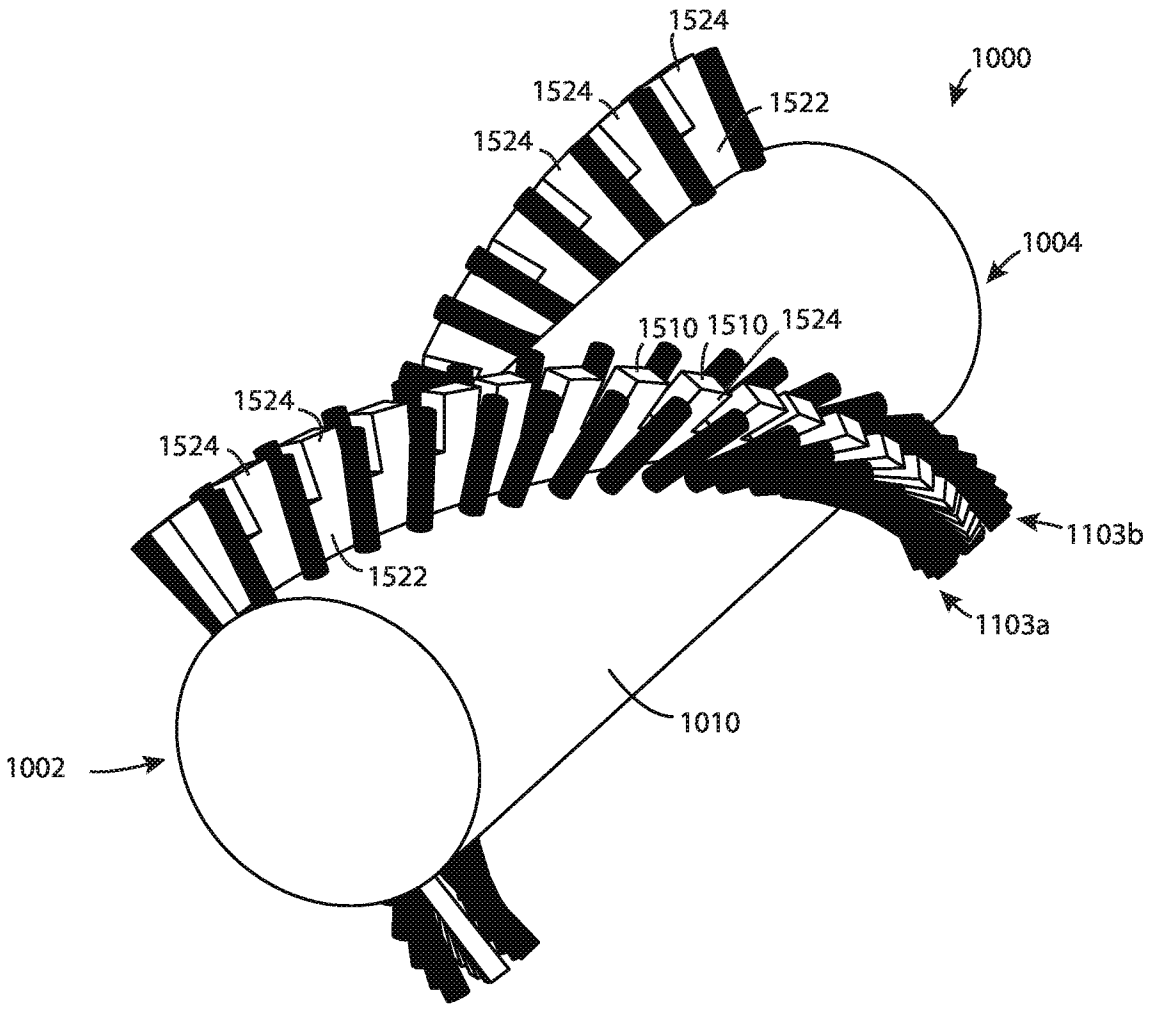
FIG. 44 is a perspective view of a brush roll in accordance with another embodiment, wherein a continuous strip comprises a plurality of individual internal hair blocking members that are positioned between rows of bristle tufts.
Figure 45:
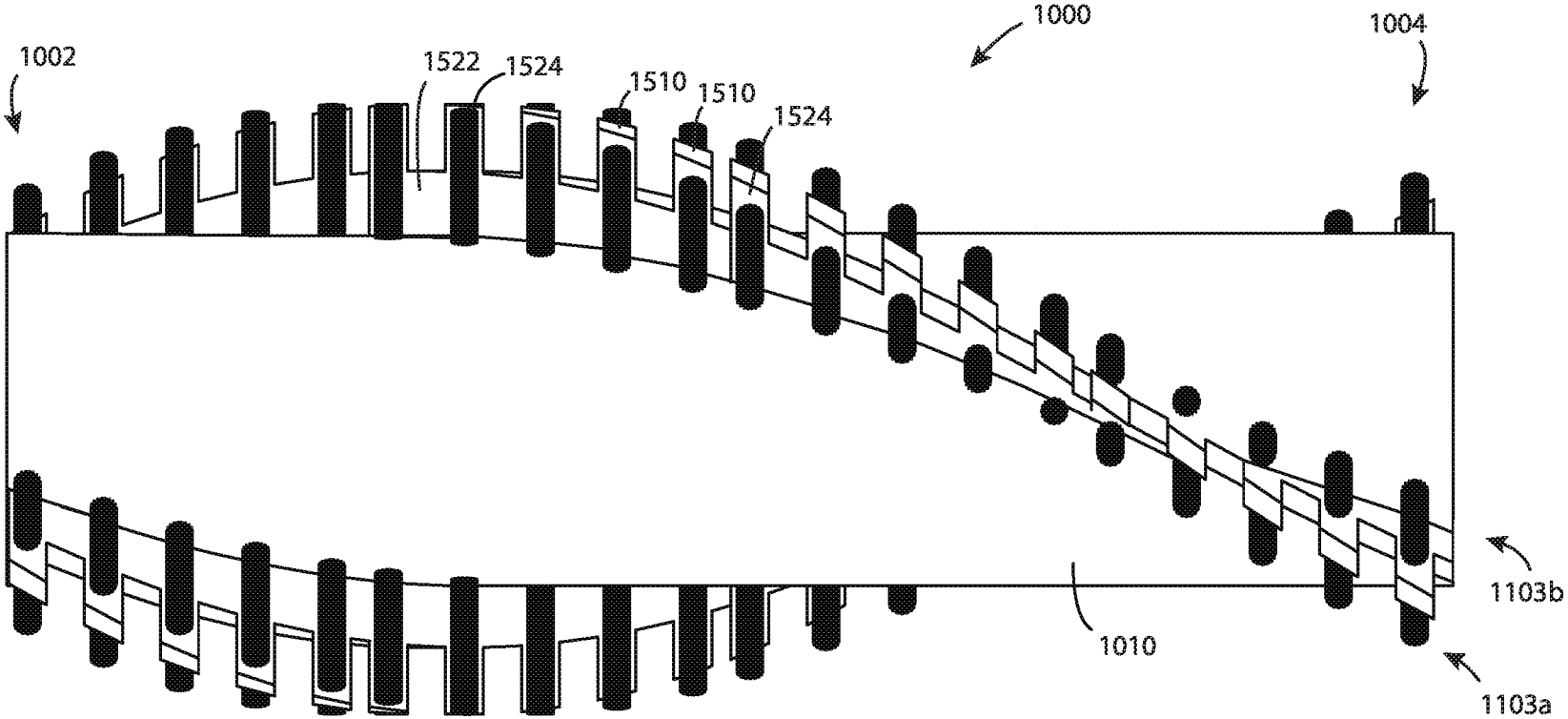
FIG. 45 is a top view of the brush roll of FIG. 44.

In the example illustrated in FIGS. 44 and 45, the blocking member 1500 has a proximate portion 1522 (proximate the brush roll core) that extends continuously from the first end 1002 to the second end 1004 of the brush roll 1000, and a plurality of distal segments 1524 (distal to the brush roll core) that extend radially outwardly from the proximate portion 1522. The radial outer ends 1510 of the distal segments 1524 may be longitudinally aligned with the bristle tufts 1100, as perhaps best seen in FIG. 45, so as to be positioned so as to extend through part or all of a tuft of bristles. It will be appreciated that the width of each distal segment 1524 may be the same as the width of an internal blocking member discussed with respect to FIGS. 17-39.

Figure 46:
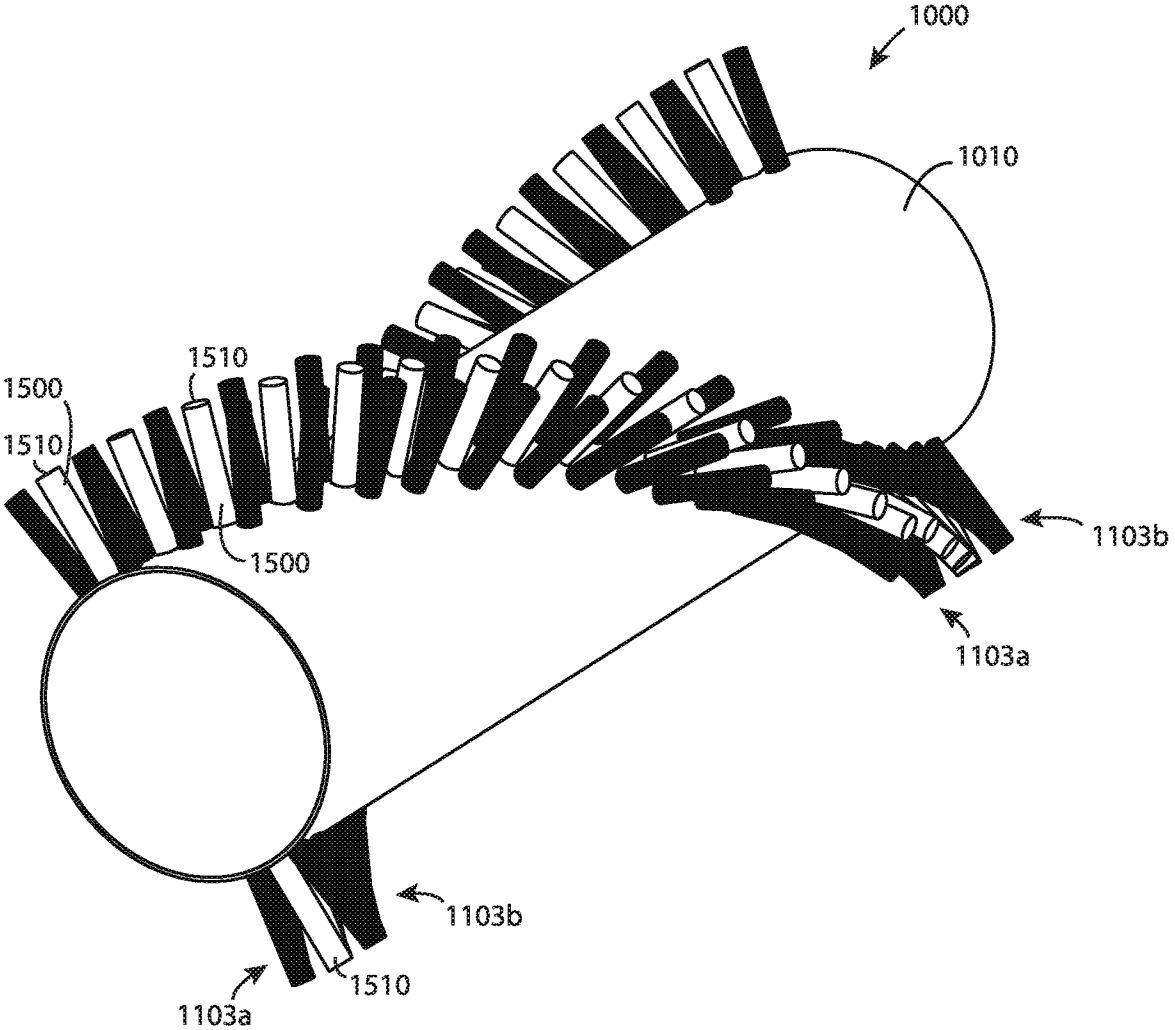
FIG. 46 is a perspective view of a brush roll in accordance with another embodiment, with a plurality of individual internal hair blocking members positioned between rows of bristle tufts.
Figure 47:
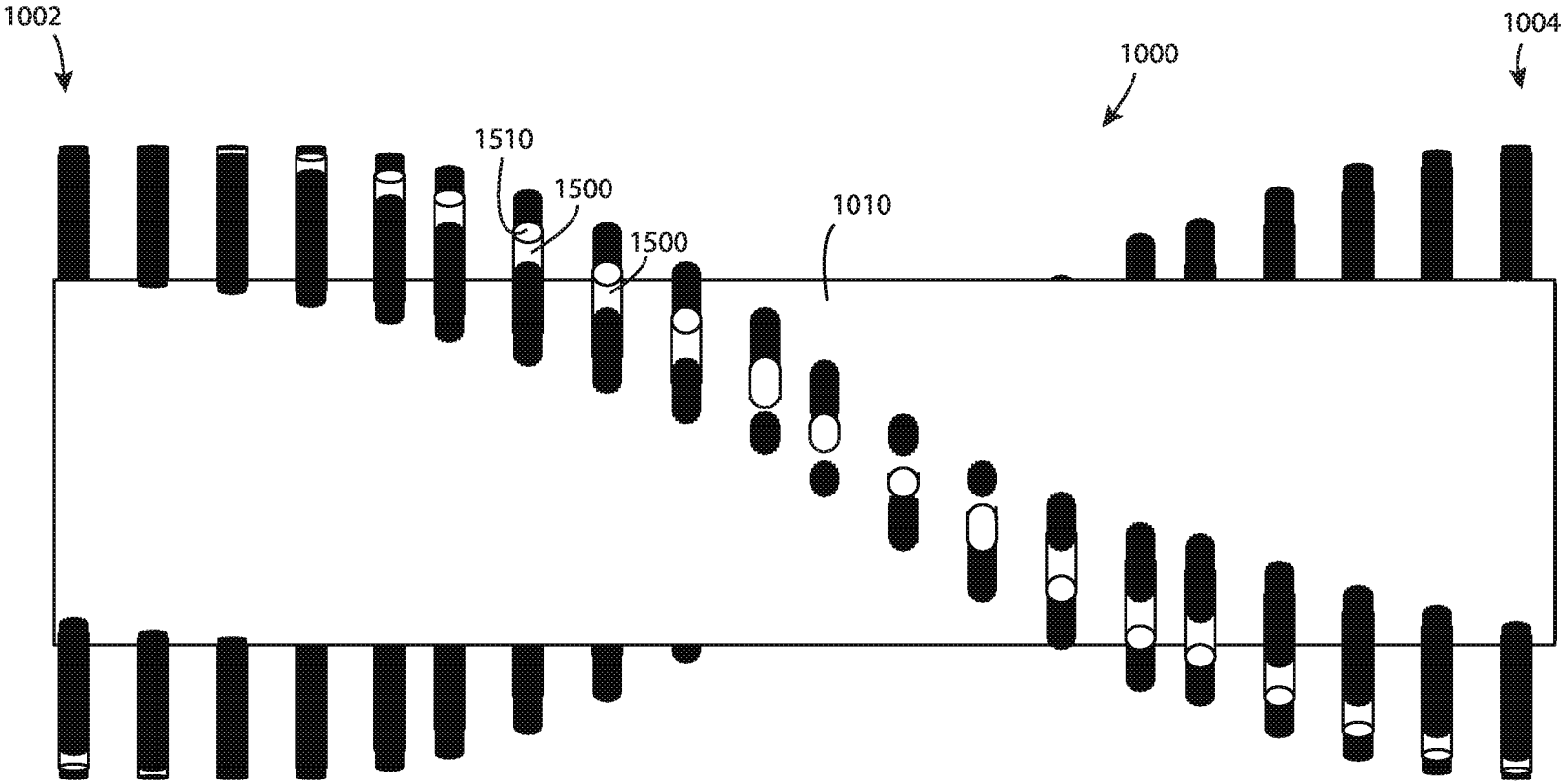
FIG. 47 is a top view of the brush roll of FIG. 46.

In the example illustrated in FIGS. 46 and 47, a plurality of blocking members 1500 in the form of flexible columns or posts are provided between bristle tufts 1100 in bristle rows 1103*a*, 1103*b*. It will be appreciated that the longitudinal positioning and the radial length of posts may be the same as discussed with respect to the distal segments 1524.

Figure 48:
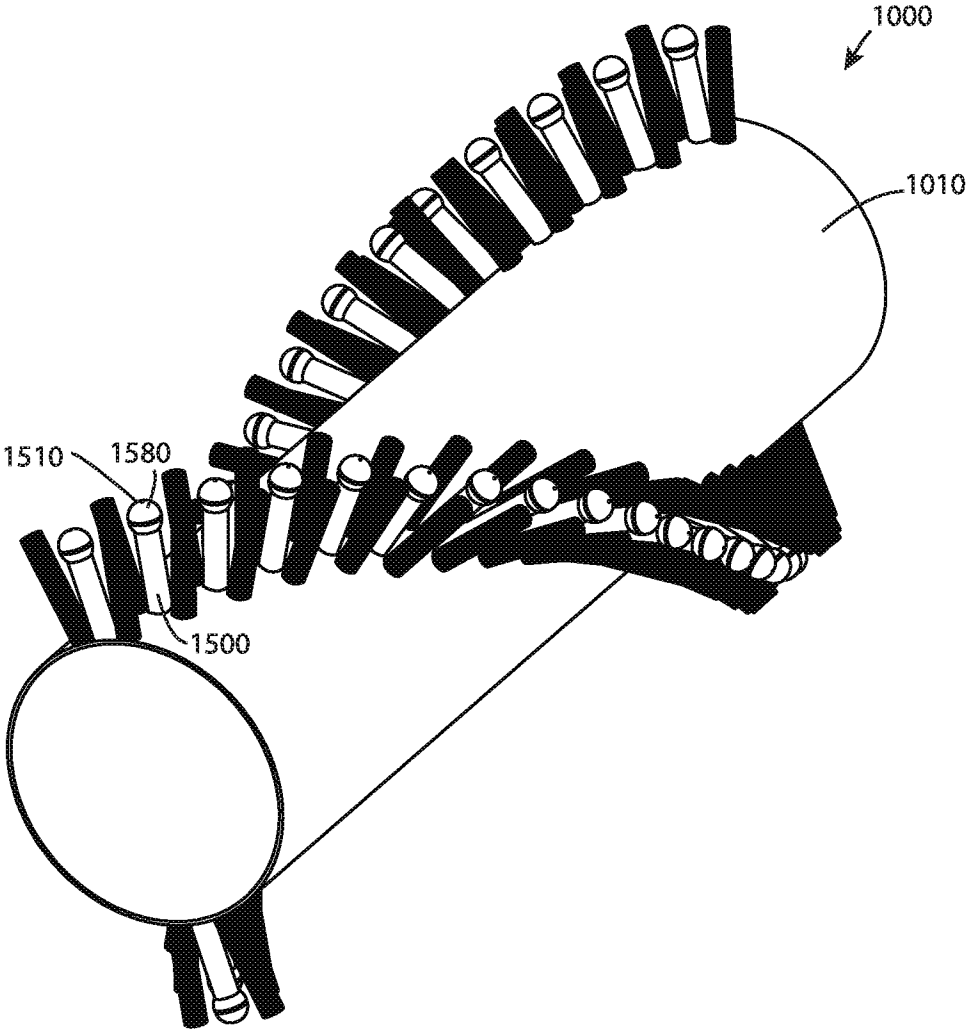
FIG. 48 is a perspective view of a brush roll in accordance with another embodiment, with a plurality of individual internal hair blocking members having rounded outer ends positioned between rows of bristle tufts.
Figure 49:
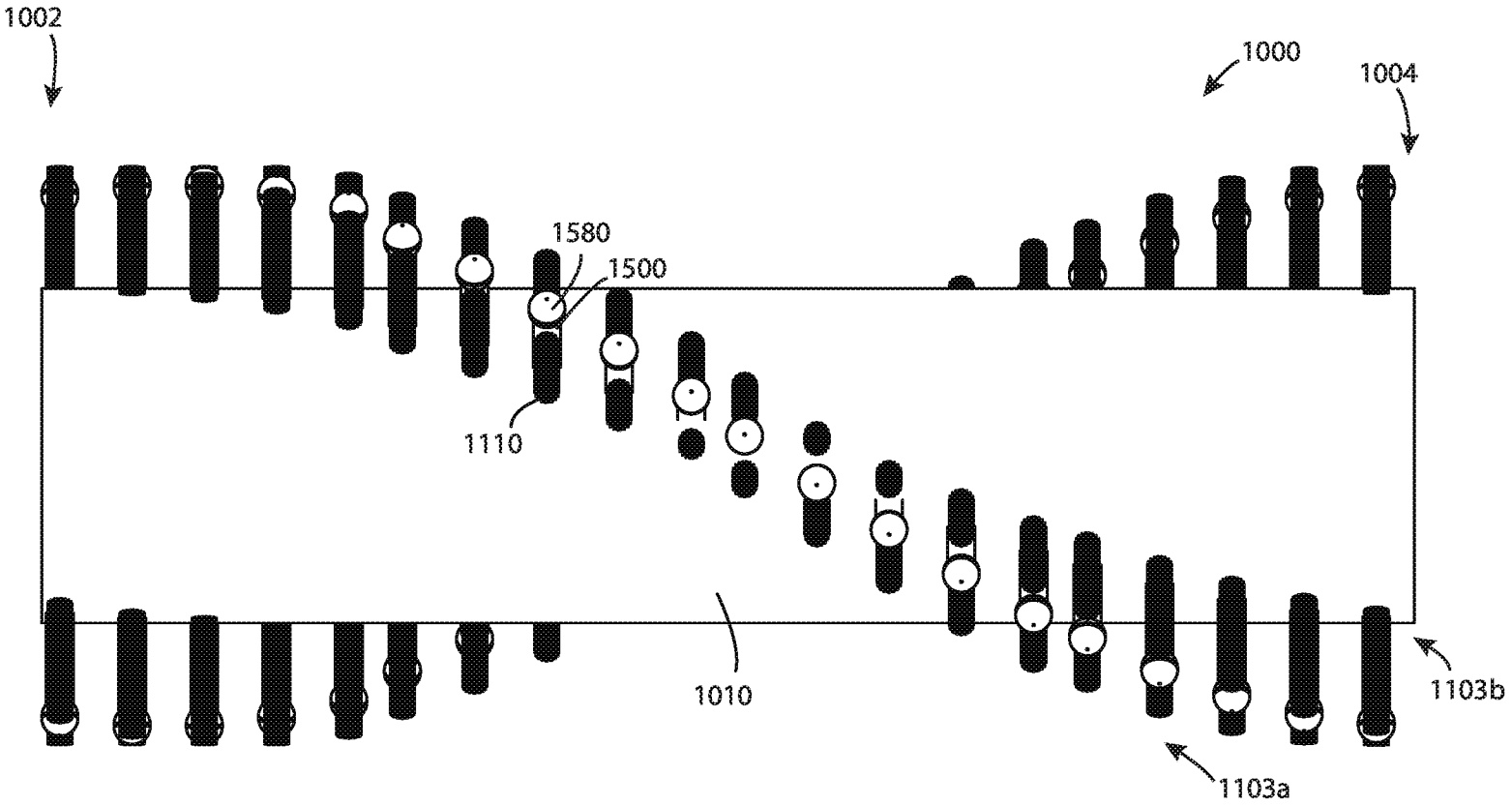
FIG. 49 is a top view of the brush roll of FIG. 48.

In the example illustrated in FIGS. 48 and 49, blocking members 1500 in the form of columns or posts are provided with rounded 'caps' or domes 1580 at their radial outer ends 1510. An advantage of this design is that the spherical shape of the domes 1580 may reduce the contact area between the outer ends 1510 of the blocking members 1500 and a floor surface being cleaned.

Figure 50:
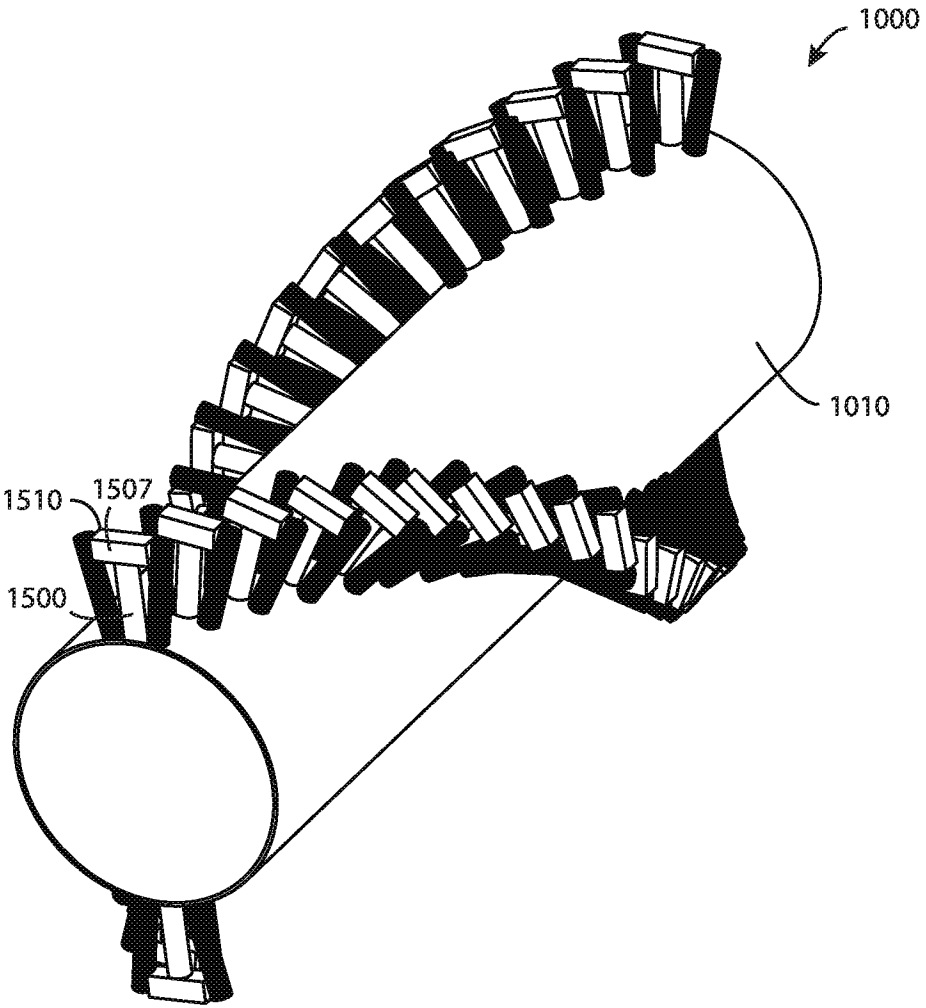
FIG. 50 is a perspective view of a brush roll in accordance with another embodiment, with a plurality of individual internal hair blocking members having T-shaped outer ends positioned between rows of bristle tufts.
Figure 51:
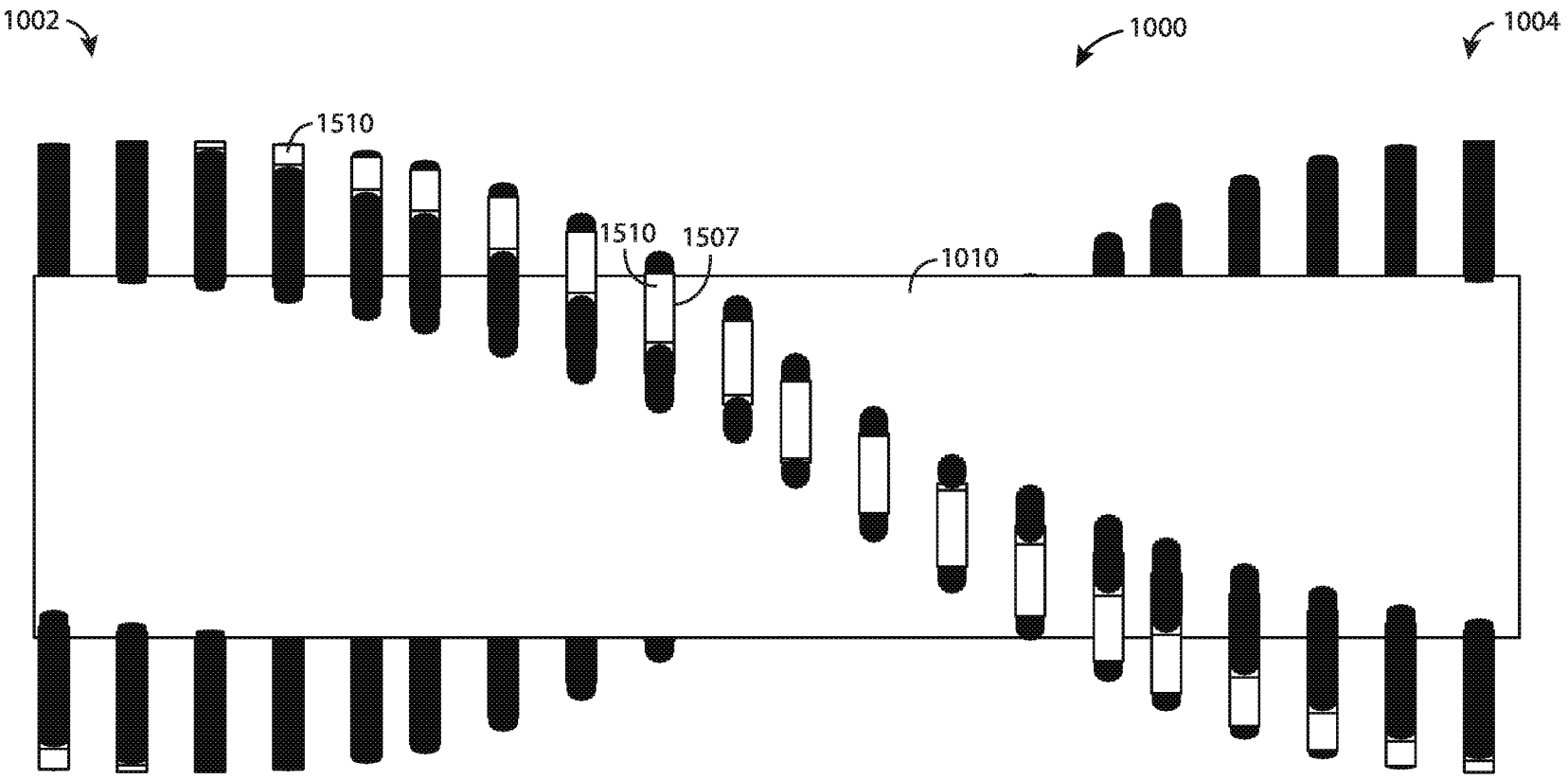
FIG. 51 is a top view of the brush roll of FIG. 50.

In the example illustrated in FIGS. 50 and 51, blocking members 1500 in the form of columns or posts are provided with rectangular cross members 1507 at their radial outer ends 1510. Each cross member 1507 extends between, and optionally abuts, the forward rotational side 1112 of the bristles 1100 in bristle row 1103*a*, and the rearward rotational side 1114 of the bristles 1110 in bristle row 1103*b*. An advantage of this design is that hair or other strand-like material may be inhibited or prevented from accumulating between the bristle tufts between which a blocking member 1500 is positioned.

Brush Roll with Heating Element

The flowing is a description of different features of a heating element that may be provided on a rotatably mounted brush 1000. These features may be used by themselves in any brush roll or in any combination or subcombination with any other feature or features described herein. For example, any of the features of the heating element described herein may be used with any one or more of the bristles with leading and trailing blocking members, sheath-encased bristles, bristles with internal blocking members, hard floor cleaning pads, flexible columns, and other features described herein.

Referring to FIGS. 52 to 63, a rotatable brush roll is provided with at least one heating element, such as a resistive heating element, exterior to the brush core. The heating element may be activated (i.e. heated) to thermally degrade or break hair, string, or other strand-like material that has become wound about the brush roll.

An advantage of this design is that hair or other strand-like debris may be broken into smaller pieces without requiring the use of e.g. a knife, scissors, or other mechanical means. For example, instead of requiring a user to remove or otherwise access the brush roll and manually cut and/or dislodge the wound debris, a user may simply activate the resistive heating element. This may be considered more convenient and/or less laborious by a user.

Figure 52:
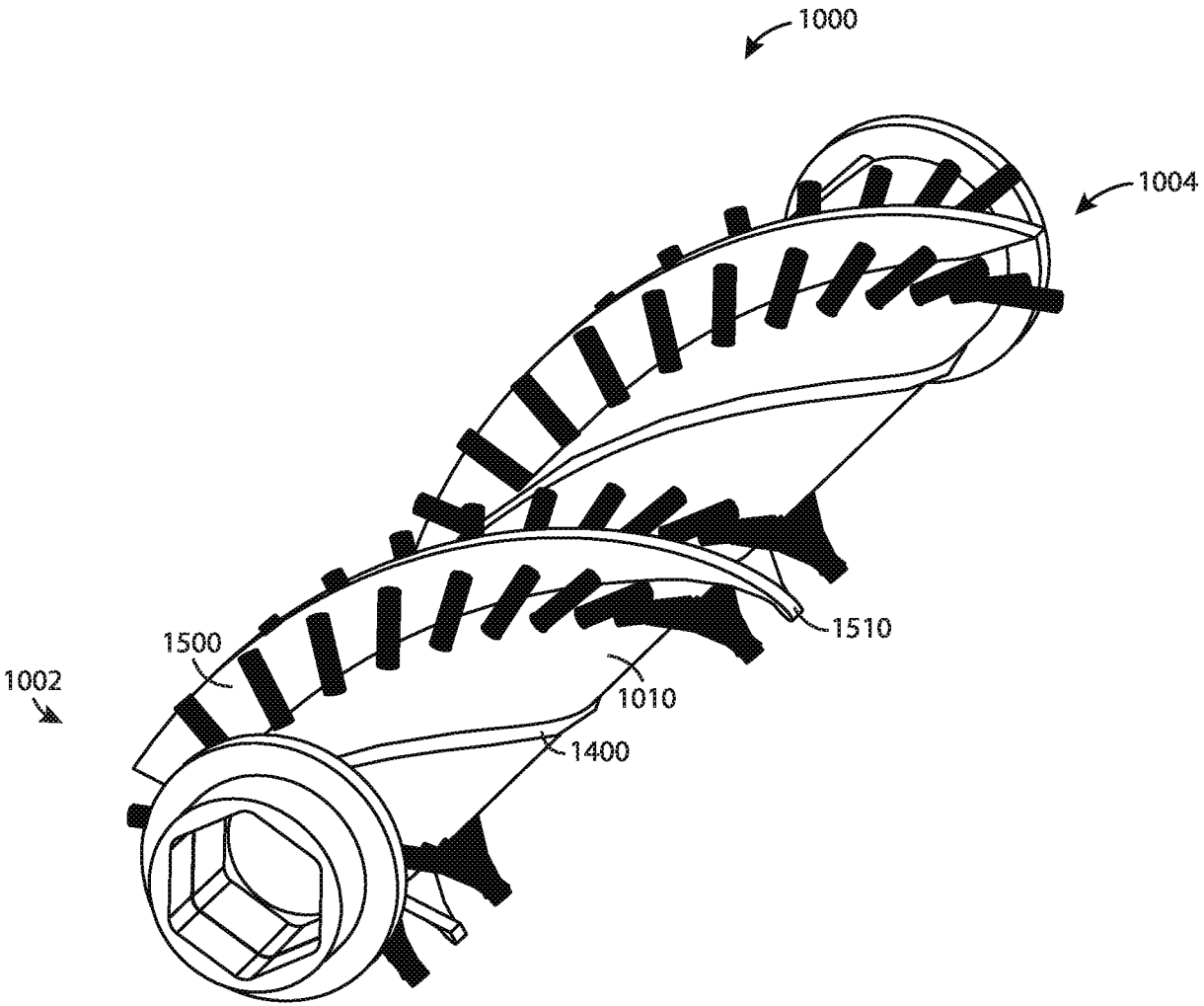
FIG. 52 is a perspective view of a brush roll in accordance with another embodiment, with a continuous strip defining internal hair blocking members positioned between rows of bristle tufts, and a heating element positioned on an outer surface of the brush core.
Figure 53:
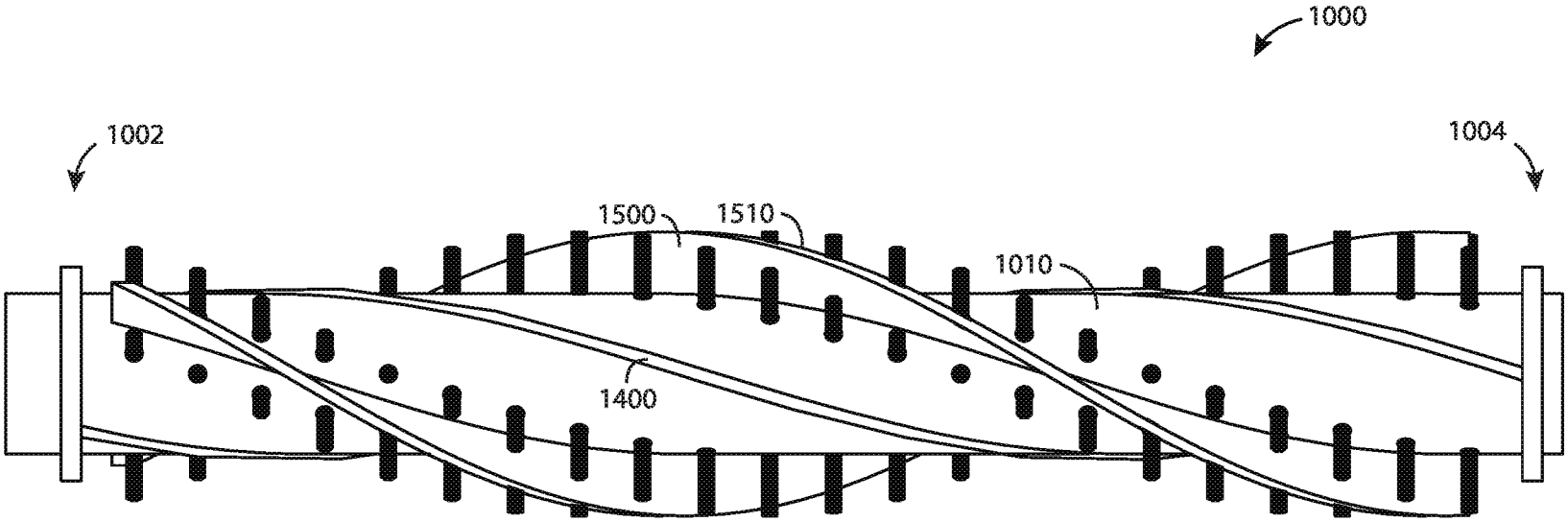
FIG. 53 is a top view of the brush roll of FIG. 52.
Figure 54:
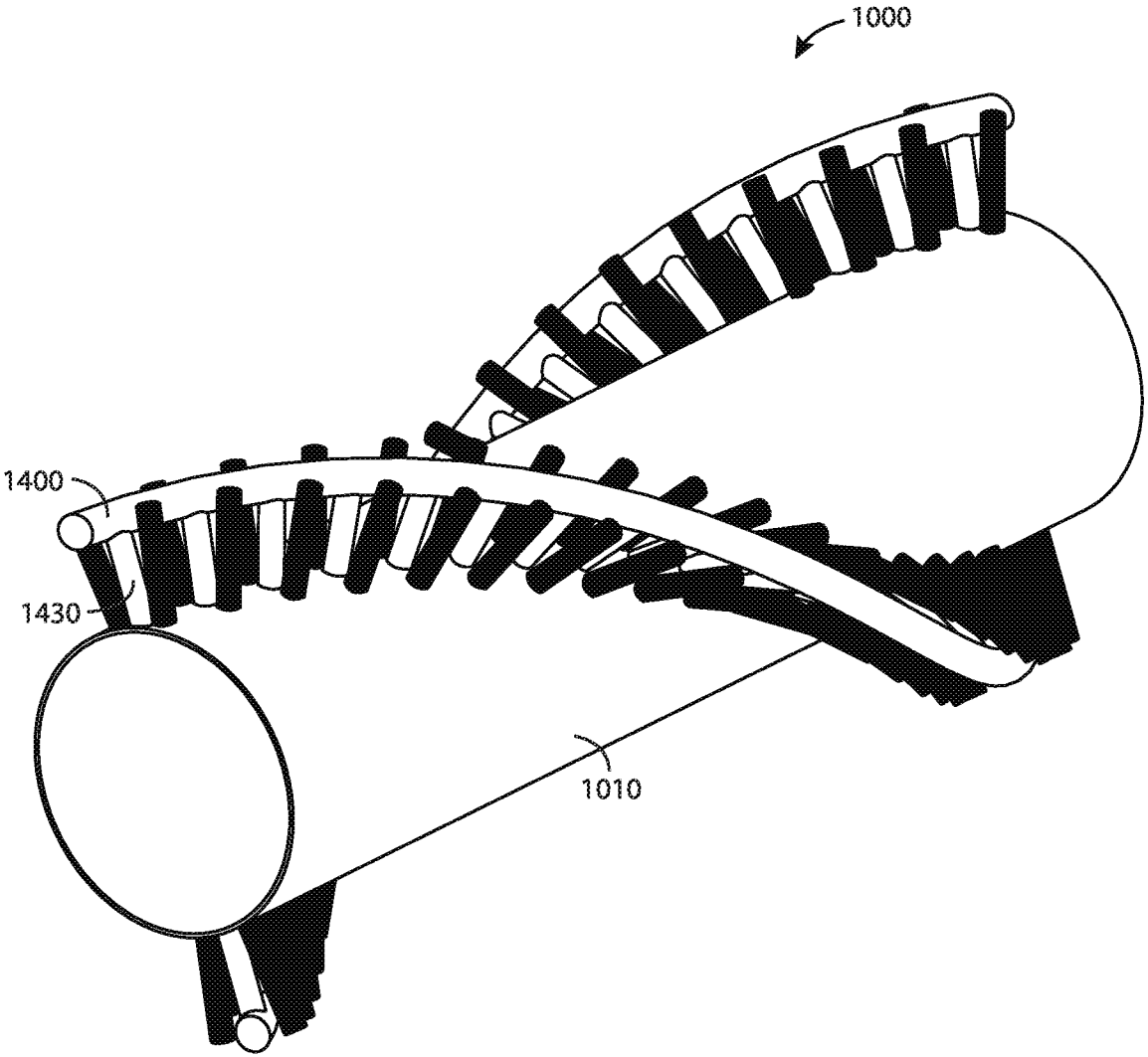
FIG. 54 is a perspective view of a brush roll in accordance with another embodiment, with a heating element spaced from an outer surface of the brush core.
Figure 55:
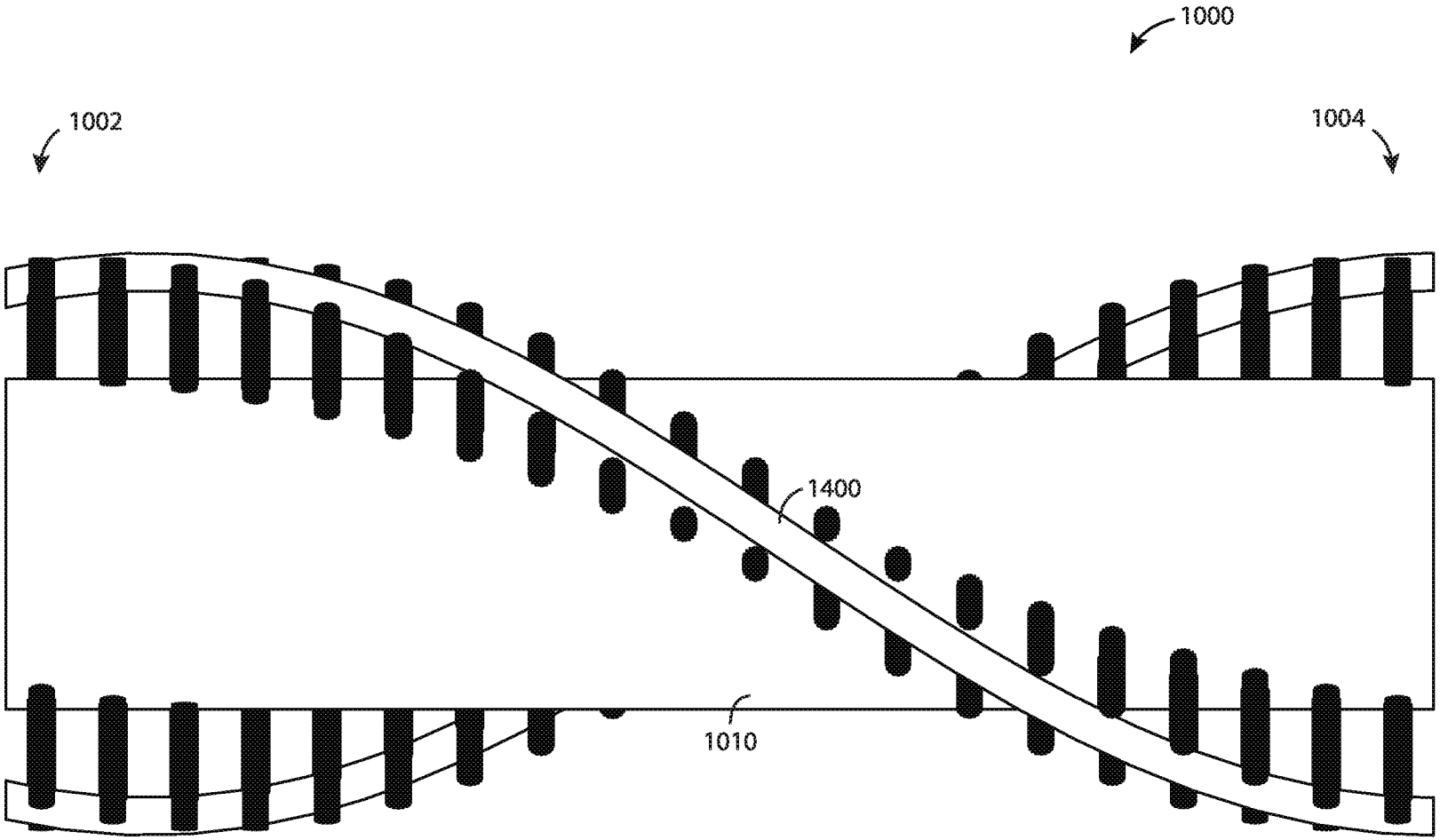
FIG. 55 is a top view of the brush roll of FIG. 54.
Figure 56:
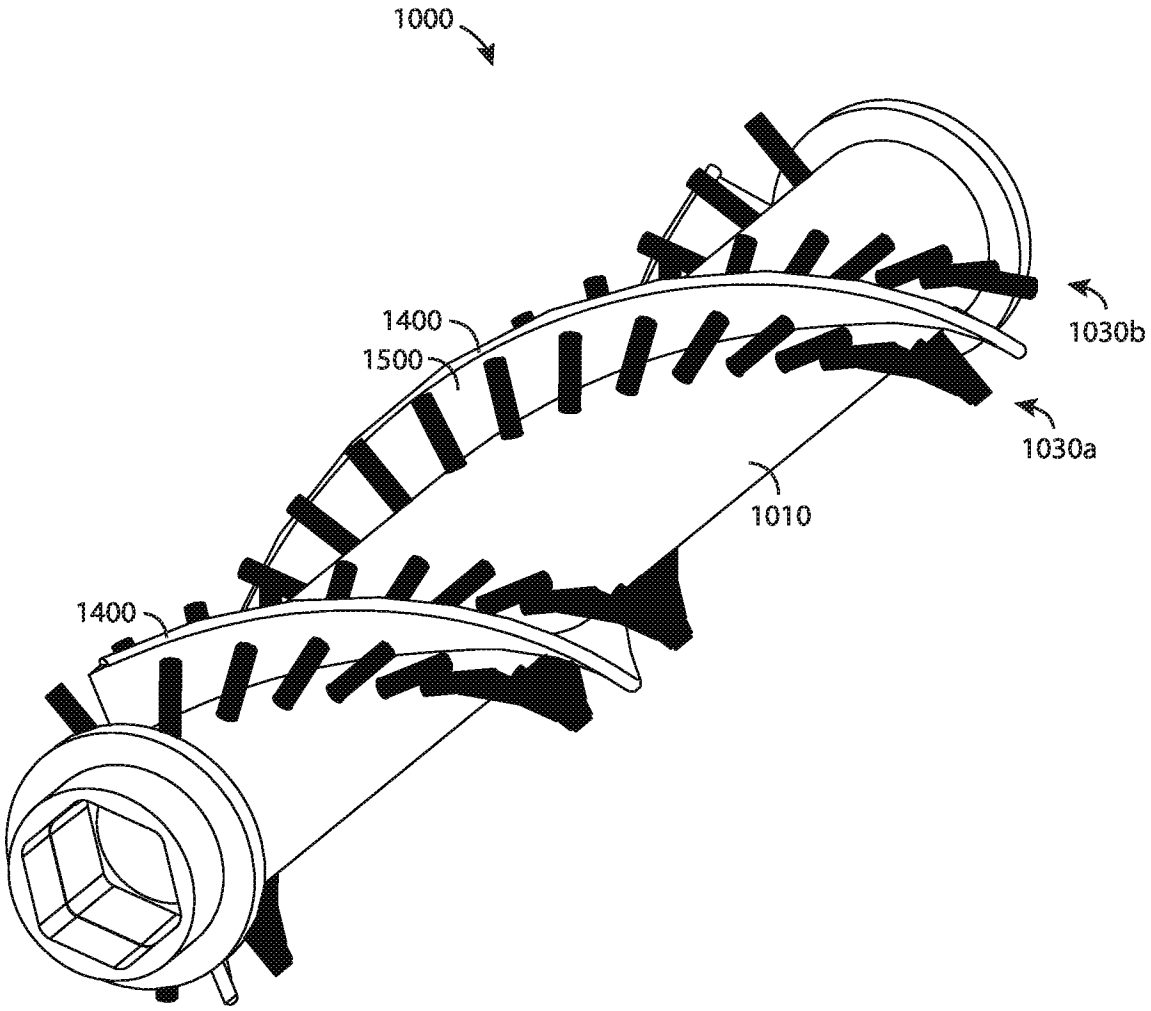
FIG. 56 is a perspective view of a brush roll in accordance with another embodiment, with a heating element spaced from an outer surface of the brush core.
Figure 57:
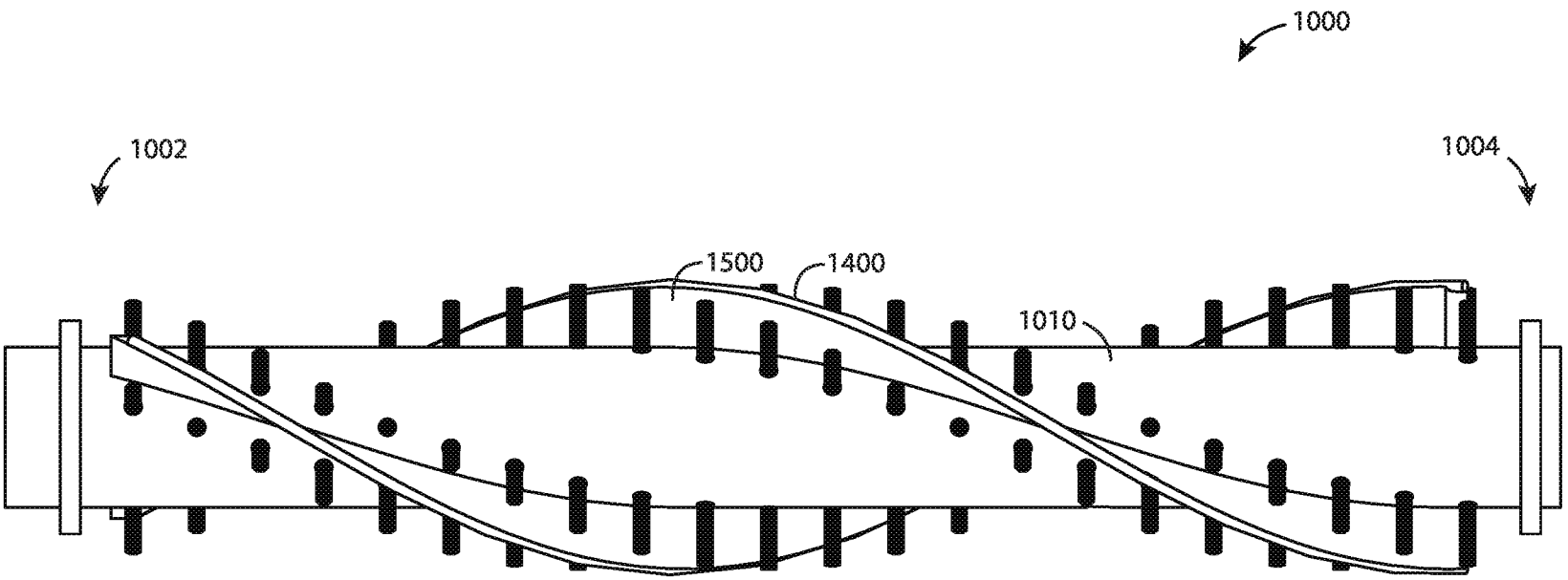
FIG. 57 is a top view of the brush roll of FIG. 56.

In the example illustrated in FIGS. 52 and 53, two heating elements 1400 are provided on the radial outer surface 1010 of brush roll 1000. Each heating element 1400 extends in a generally helical formation from the first end 1002 to the second end 1004 of the brush roll 1000. It will be appreciated that in alternative embodiments a single heating element, or three or more heating elements, may be provided. It will also be appreciated that heating elements 1400 may be arranged in a formation other than a helical pattern, such as a straight row extending linearly from the first end 1002 to the second end 1004, a double helical pattern (e.g. 'wrapping' around the circumference of the brush roll two or more times between the first end 1002 and the second end 1004), a chevron or V-shaped pattern, or in any other suitable formation. Optionally, the heating element may be positioned between two rows of bristles and may be arranged in the same pattern as the rows of bristles.

Heating elements 1400 may be resistive heating elements, and may be formed from any suitable resistive heating material known in the art.

In the example illustrated in FIGS. 52 and 53, each heating element 1400 extends continuously from the first end 1002 to the second end 1004 of the brush roll 1000. Alternatively, each heating element 1400 may consist of a plurality of segments, with each segment spanning a portion of the distance from the first end 1002 to the second end 1004. In some embodiments, the ends of adjacent segments may abut each other, such that the segments form a substantially continuous heating element 1400. Alternatively, the ends of adjacent segments may be spaced from each other, providing an axial gap between adjacent segments.

In the example illustrated in FIGS. 52 and 53, the heating elements 1400 are provided on the radial outer surface 1010 of brush roll 1000. Alternatively, one or more heating elements may be spaced radially outwardly from the outer surface 1010. An advantage of such an arrangement is that the heating element may be positioned closed to the radial outer ends of any bristles and/or any hair blocking members also provided on the brush roll.

The heating elements may be recessed inwardly from the radial outer ends of the bristles so as not to contact the floor when the brush is in use. Alternatively, one or more heating elements may be provided at the radial outer end of the bristles. As exemplified in FIGS. 54 and 55, heating elements 1400 may be supported on a plurality of columns or posts 1430. Supports 1430 may be flexible or rigid, and provide spacing between the outer surface 1010 of brush roll 1000 and the heating elements 1400. Alternatively, as exemplified in FIGS. 56 and 57, heating elements 1400 may be supported on a support member 1430, which may be a blocking member 1500, that extends from the first end 1002 to the second end 1004 of the brush roll 1000.

Preferably, the heating element is operable at a temperature above a temperature at which hair burns and below a degradation temperature of the bristles 1101, sheathes 1300 and/or any hair blocking members, such as members 1200 or 1500 that may be provided on a brush roll 1000. That is, the bristles, sheathes, and/or blocking members may be unaffected (or at least only negligibly affected) by heat emitted by the heating element. An advantage of this design is that the heating element may be operated for longer periods of time without risk of damaging the bristles, which may lead to greater degradation of wound hair, string, or other strand-like material.

Optionally, in order to prevent floor surfaces from thermal damage, a surface cleaning apparatus may include a 'lift off' mechanism operable to move a cleaning head (e.g. a cleaning head 120) and/or a rotatably mounted brush roll 1000 between a floor cleaning position in which the rotatably mounted brush is positioned to clean a floor on which the surface cleaning head is positioned, and a raised position in which the rotatably mounted brush is spaced from the floor.

Where such a 'lift off' mechanism is provided, optionally the heating element may be operable only when the lift off mechanism is in the raised position. For example, the lift off mechanism may be automatically moved to the raised position when e.g. an upright section of a surface cleaning apparatus is moved into the upright storage position. In such an arrangement, the surface cleaning apparatus may have a sensor operable to determine when the upright section is in the upright storage position, and the heating element may be actuated when the sensor issues a signal indicative that the upright section is in the upright storage position. In some embodiments, the heating element may be automatically actuated when the lift off mechanism is moved to the raised position.

FIGS. 58 to 63 illustrate examples of lift-off mechanisms that may be used to move any brush roll 1000 with a heating element 1400 to a raised position in which the rotatably mounted brush is spaced from the floor. It will be appreciated that any surface cleaning head lift off mechanism or brush roll lift off mechanism may be used.

Figure 58:
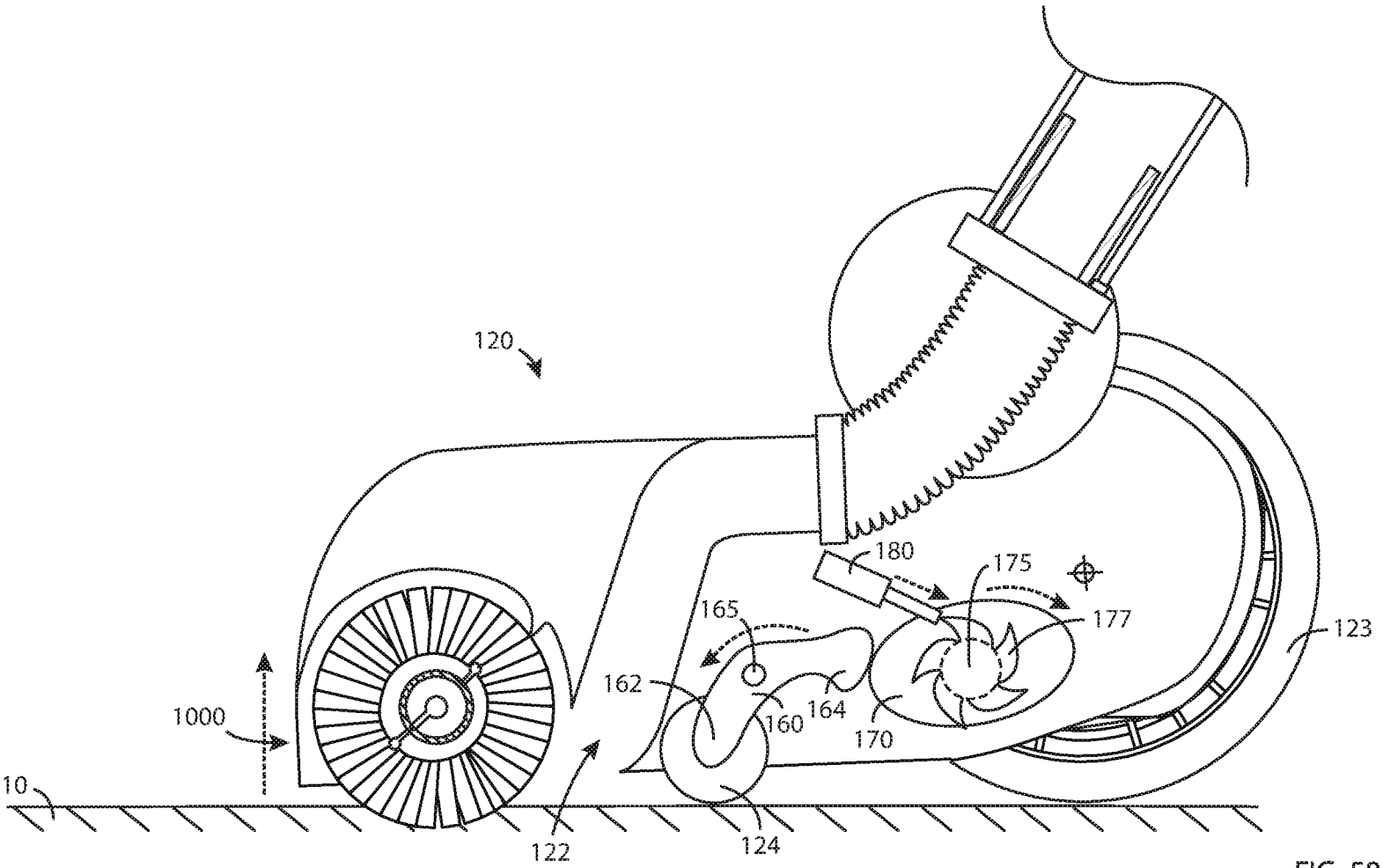
FIG. 58 is a schematic cross-section view of a cleaning head with a lift off mechanism, in a floor cleaning position.
Figure 59:
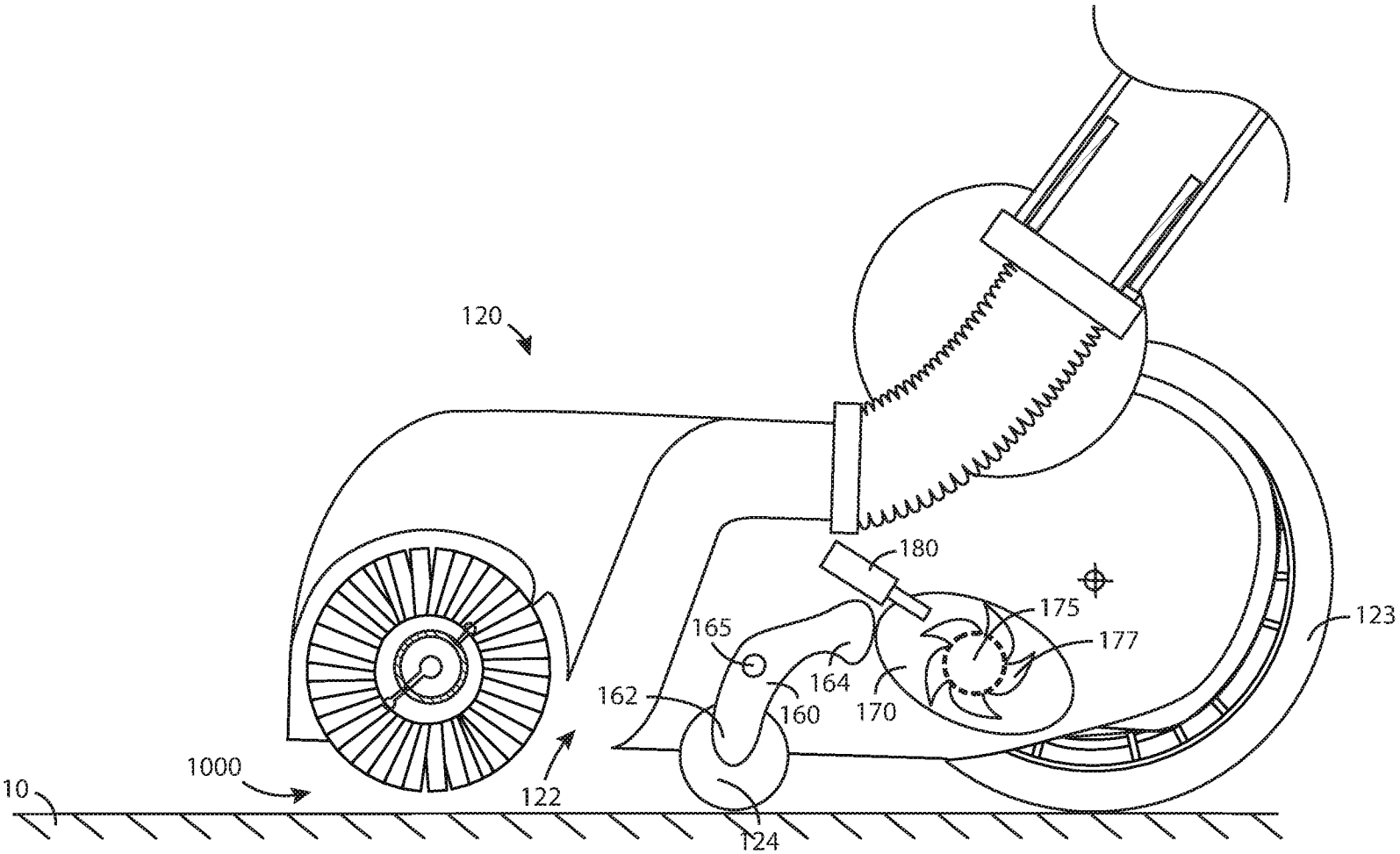
FIG. 59 is a schematic cross-section view of the cleaning head of FIG. 58, in a raised position.

In the example illustrated in FIGS. 58 and 59, a cleaning head 120 has a rotatably mounted brush roll 1000 positioned adjacent a cleaning head dirty air inlet 122. Cleaning head 120 also include rear wheels 123 and at least one brush height adjustment wheel 124 positioned forward of the rear wheels 123.

Brush height adjustment wheel 124 is secured to a first end 162 of a pivotable support arm 160. The support arm 160 is pivotable about an axis 165, located between the first end 162 and a second end 164 of the support arm 160. The second end 164 bears against an oval cam wheel 170. The oval cam wheel 170 is pivotable about an axis 175, and also includes a ratchet mechanism 177.

To adjust the vertical position of the brush height adjustment wheel 124 relative to the cleaning head 120—and thereby adjust the spacing between the axis 1005 of the brush roll 1000 relative to the floor surface 10—a ratchet actuator 180, such as a solenoid, may be pulsed or otherwise actuated to advance the ratchet mechanism, thereby rotating the oval cam wheel 170. As the oval cam wheel 170 is rotated, the location of the point of contact between the second end 164 of the support arm 160 and the oval cam wheel 170 is varied, thereby varying the vertical height of brush height adjustment wheel 124. Continuing to advance the ratchet mechanism 177 will alternately raise and lower the brush height adjustment wheel 124.

In the position illustrated in FIG. 58, the ratchet mechanism 177 has been advanced, and the brush height adjustment wheel 124 is raised relative to the cleaning head 120, resulting in bristles of the brush roll 1000 being in contact with the floor surface 10. This may be characterized as a floor cleaning position. In the position illustrated in FIG. 59, the brush height adjustment wheel 124 is lowered relative to the cleaning head 120, resulting in bristles of the brush roll 1000 being lifted clear of contact with the floor surface 10. This may be characterized as a raised position.

Figure 60:
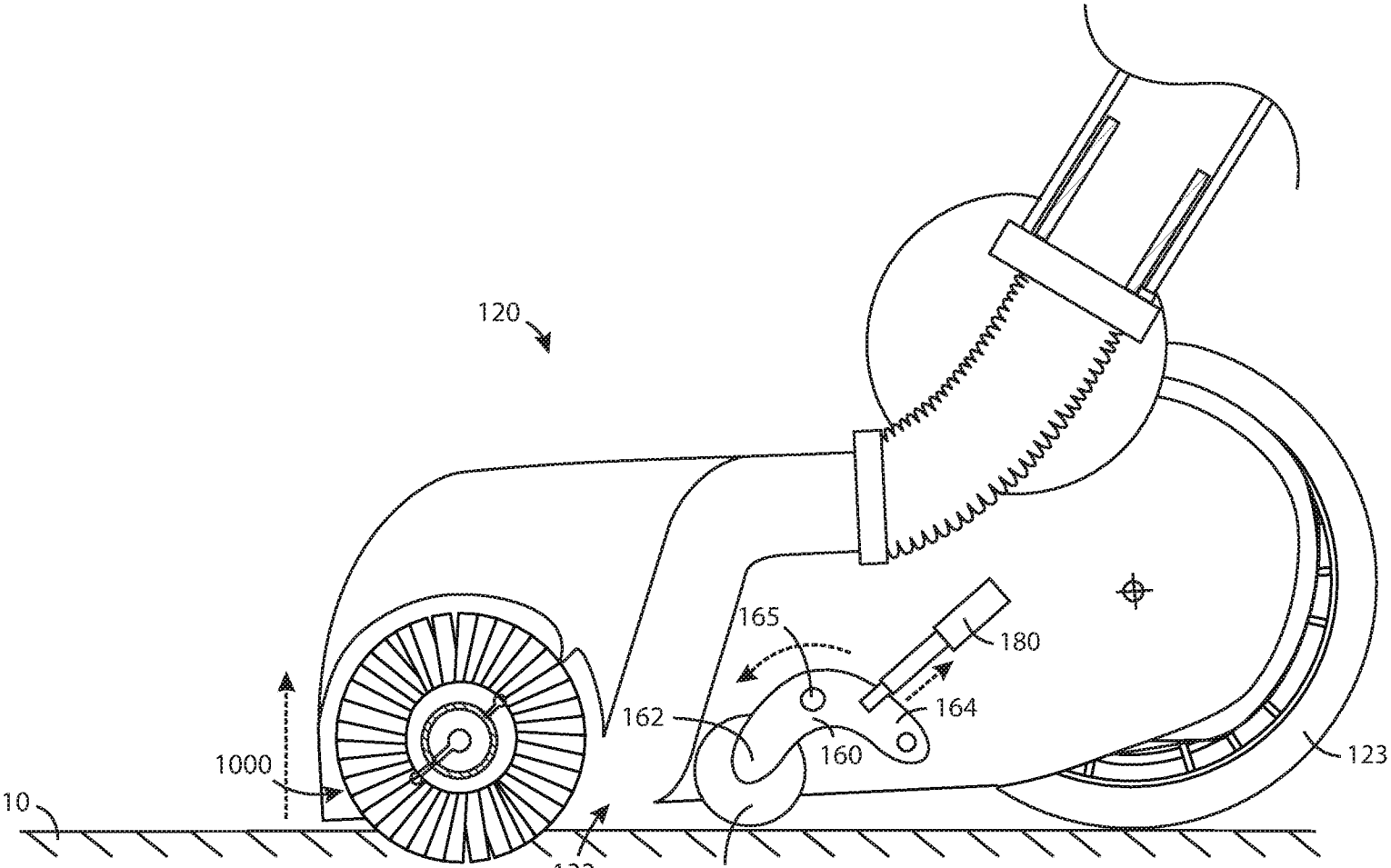
FIG. 60 is a schematic cross-section view of a cleaning head with a lift off mechanism in accordance with another embodiment, in a floor cleaning position.
Figure 61:
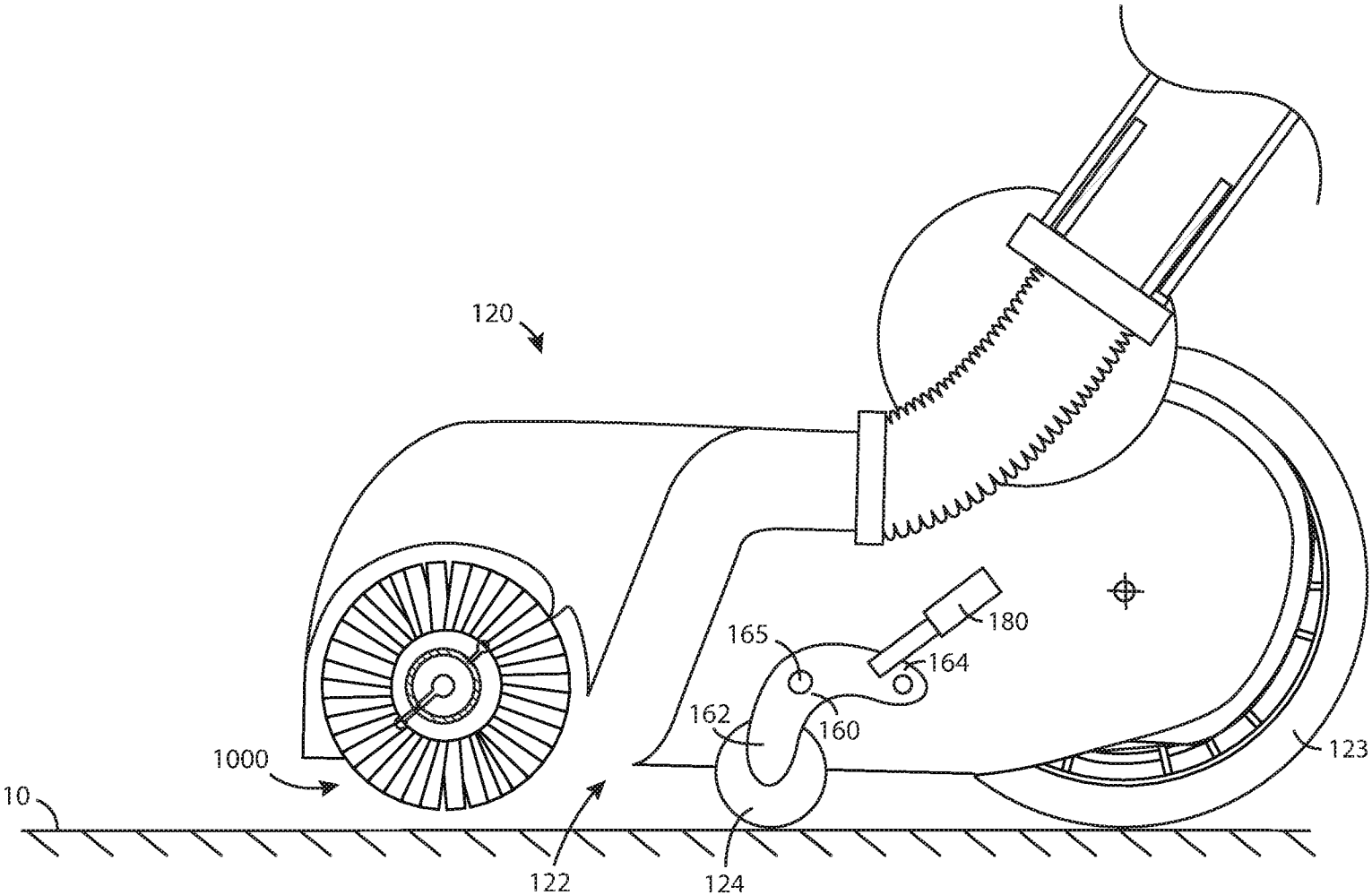
FIG. 61 is a schematic cross-section view of the cleaning head of FIG. 60, in a raised position.

In the example illustrated in FIGS. 60 and 61, the second end 164 of the support arm 160 is directly coupled to an actuator 180, such as a solenoid, which may be extended to raise the brush height adjustment wheel 124 relative to the cleaning head 120, resulting in a floor cleaning position as illustrated in FIG. 60, or retracted to lower the brush height adjustment wheel 124 relative to the cleaning head 120, resulting in a raised position as illustrated in FIG. 61.

Figure 62:
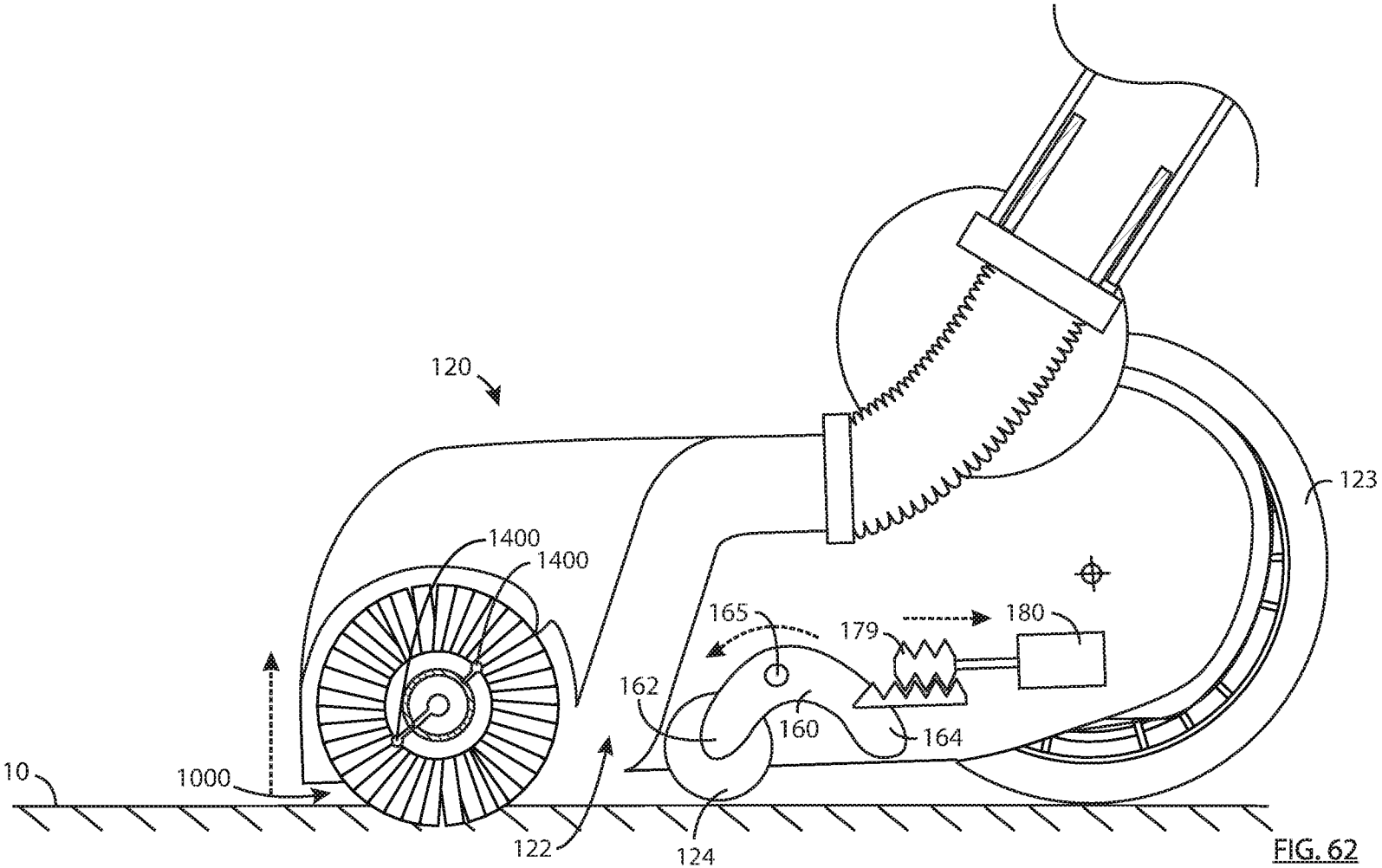
FIG. 62 is a schematic cross-section view of a cleaning head with a lift off mechanism in accordance with another embodiment, in a floor cleaning position.
Figure 63:
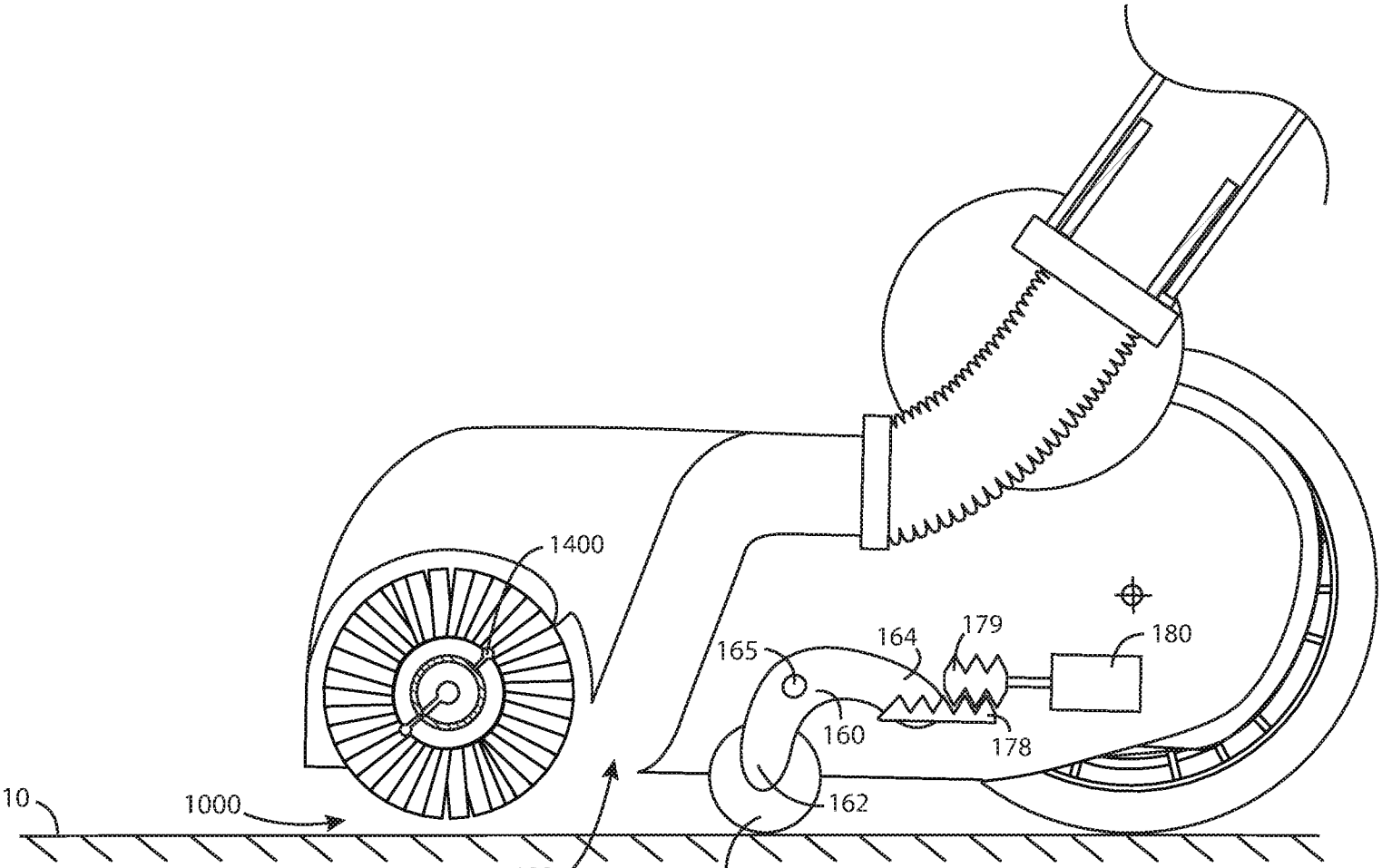
FIG. 63 is a schematic cross-section view of the cleaning head of FIG. 62, in a raised position.

In the example illustrated in FIGS. 62 and 63, the second end 164 of the support arm 160 is coupled to a rack 178, and a pinion 179 driven by an actuator, such as a solenoid, may be rotated in a first direction to advance the rack 178 towards the second end 164, thereby raising the brush height adjustment wheel 124 relative to the cleaning head 120, resulting in a floor cleaning position as illustrated in FIG. 62, or rotated in a second, opposite direction to retract the rack towards the actuator, thereby lowering the brush height adjustment wheel 124 relative to the cleaning head 120, resulting in a raised position as illustrated in FIG. 63.

It will be appreciated that thermally degrading or burning hair may result in the emission of undesirable odors. Optionally, the suction motor of the surface cleaning apparatus may be operated when the heating element is actuated. Thus, some or all of the odorous particles released during the thermal degradation of the hair may be drawn into air treatment member of the surface cleaning apparatus, which may reduce or otherwise mitigate odors resulting from the thermal degradation.

Accordingly, the suction motor may be automatically actuated when the heating member is actuated. Alternatively, or in addition, the suction motor may be operable at a lower air flow rate then when the surface cleaning apparatus is used to clean a surface.

Brush Roll with Hard Floor Cleaning Pad and Flexible Protective Pad Member

The flowing is a description of different features of a rotatable brush roll that has at least one hard floor cleaning pad and at least one flexible protective pad member. These features may be used by themselves in any brush roll or in any combination or sub-combination with any other feature or features described herein. For example, any of the features of the hard floor cleaning pad and flexible protective pad member described herein may be used with any one or more of the bristles with leading and trailing blocking members, sheath-encased bristles, heating element, internal hair blocking members, flexible columns, and other features described herein.

In any embodiment disclosed herein, a rotatable brush roll 1000 may be provided with at least one hard floor cleaning pad and a flexible protective pad member (e.g. bristles and/or bristle tufts). The protective pad member is preferably spaced forwardly or rearwardly (in the direction of rotation of the brush roll) from the hard floor cleaning pad, so that the protective pad member can flex without being limited by engagement with the hard floor cleaning pad. For example, a protective pad member may be positioned spaced 1-12, 1-8, 1-4 or 1-2 mm forward from the forward rotational side of the hard floor cleaning pad and a second protective pad member may be positioned spaced 1-12, 1-8, 1-4 or 1-2 mm rearward from the rearward rotational side of the hard floor cleaning pad. Alternately, only one of a forward and rearwardly positioned protective pad member may be provided.

A protective pad member may be shorter or longer than the height of a hard floor cleaning pad (if the pad is mounted to a brush core) or, if the hard floor cleaning pad is mounted to a base or cushion, which base or cushion is mounted to a brush core, the height of a hard floor cleaning pad and the base or cushion. For example, the outer end of the forward and/or rearwardly positioned protective pad member may be positioned spaced ±1, 2, 3 mm radially inwardly or radially outwardly of the radial outer end of the floor cleaning pad. Optionally, a front or forwardly positioned protective pad member may be shorter than the rear or rearwardly positioned protective pad member.

An advantage of this design is that, even though the hard floor cleaning pad may be recessed radially from the outer end of the flexible protective pad member, when the end of the protective pad member has flexed due to contact with a surface being cleaned, the outer surface of the hard floor cleaning pad may also contact the floor surface. When the hard floor cleaning pad and the flexible protective pad member are both in contact with the floor surface, hair or other strand-like debris that has migrated or otherwise become embedded in or trapped on the flexible protective pad member may be partially or completely dislodged from the protective pad member.

Optionally, a first protective pad member may be positioned forwardly (in the direction of rotation of the brush roll) from the hard floor cleaning pad and a second protective pad member may be positioned rearwardly (in the direction of rotation of the brush roll) from the hard floor cleaning pad.

The protective pad member may comprise bristles, which may include one or more of an internal hair blocking member, a leading hair blocking member and a trailing hair blocking member. Alternatively, or in addition, the bristles may be encased in a sheath. Alternatively, or in addition, a hair blocking member may be used in the absence of any bristles. The hair blocking member or members may be any of those discussed herein.

Figure 64:
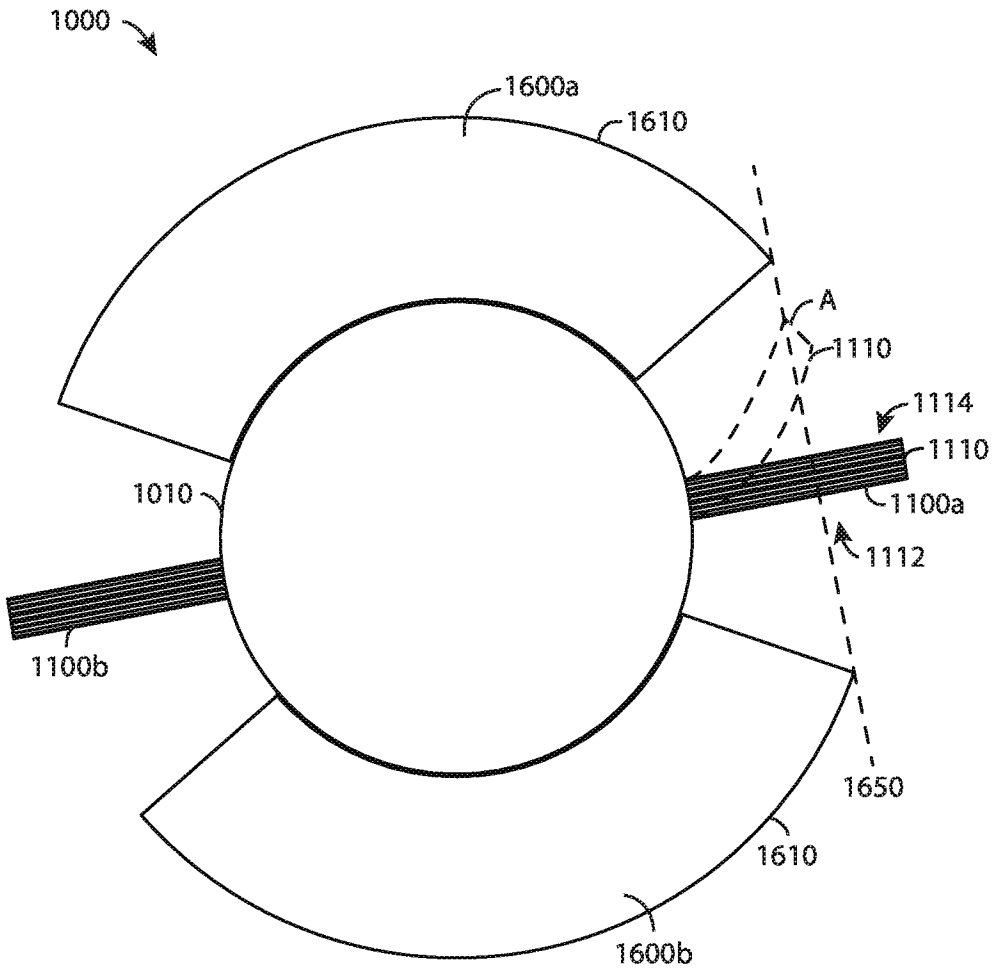
FIG. 64 is a schematic end section view of a brush roll in accordance with another embodiment, with bristles and hard floor cleaning pads.

A schematic example is illustrated in FIG. 64. In this example, two flexible protective pad members in the form of bristles 1100*a*, 1100*b* are each positioned between one of two hard floor cleaning pads 1600*a*, 1600*b*. Each hard floor cleaning pad 1600 has a height or length 1625 from the outer surface 1010 of brush roll 1000 to the radial outer surface 1610 of the pads.

The radial outer surfaces 1610 of the hard floor cleaning pads 1600*a*, 1600*b* may define a plane 1650 that extends between the cleaning pads. Preferably, the cleaning pads are less flexible and/or less compressible than the bristles 1100, such that when the bristles 1100 are flexed (e.g. due to engagement with a floor surface 10) the bristle ends 1110 may be approximately co-incident or recessed radially inwardly from the plane 1650, e.g. when in a position shown by dashed lines A.

The radial outer surface 1610 of hard floor cleaning pad 1600 may comprise any material suitable for cleaning a non-carpeted surface, such as tile, hardwood, and the like. For example, a microfiber material 1620 may be provided on a support 1630, which may include a flexible or compressible support member such as an open cell or closed cell foam support structure. For example, a flexible support member 1630 may be deflected or otherwise resiliently deformed such that the outer surface 1610 may be moved radially inwardly when urged towards brush roll axis 1105, e.g. as a result of roll 1000 being compressed against a floor surface 10.

Alternatively, a microfiber material 1620 may be provided on a non-compressible support 1630.

FIGS. 65-78 illustrate various examples of brush rolls 1000 having a combination of hard floor cleaning pads and flexible protective pad members.

Figure 65:
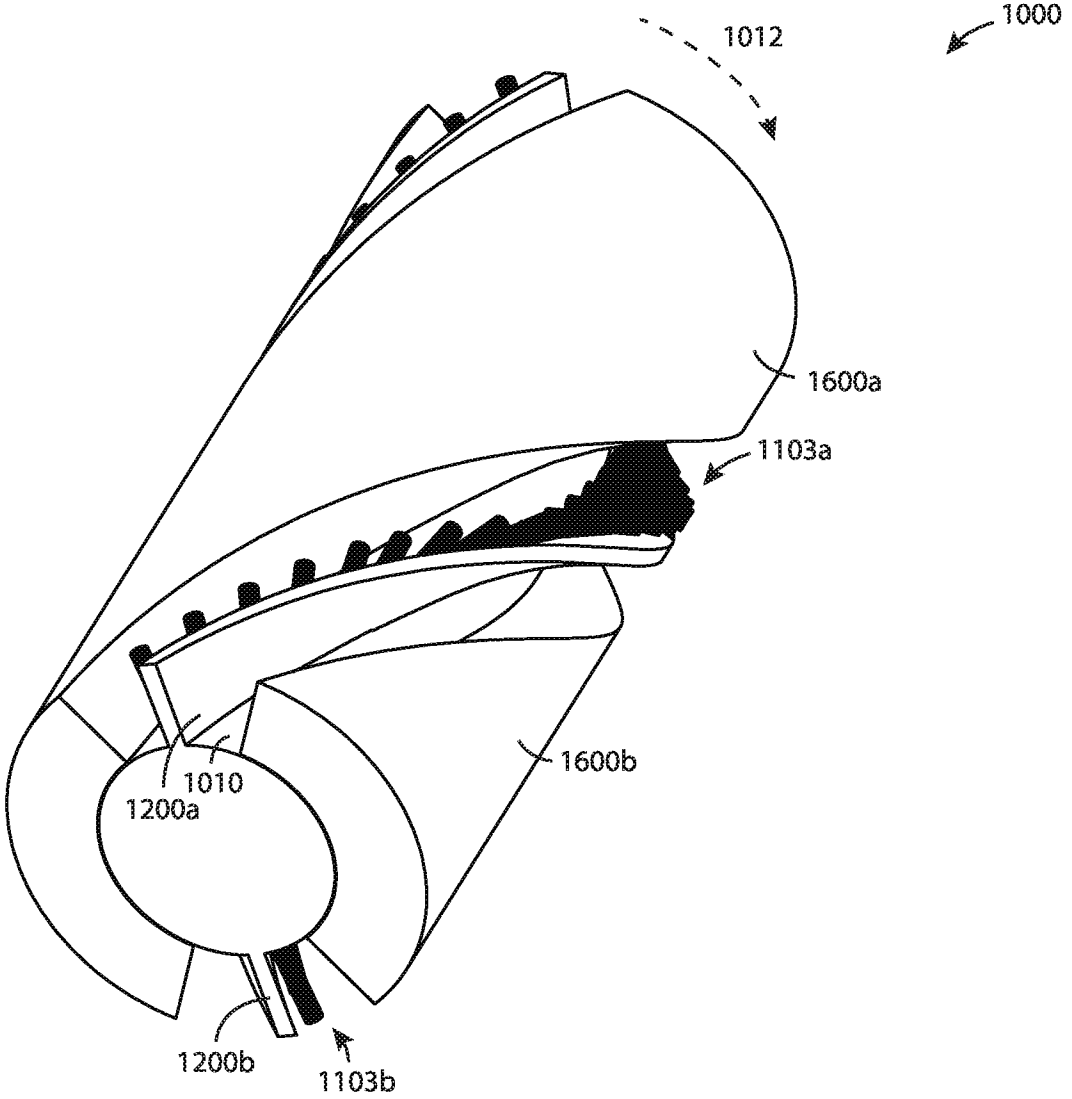
FIG. 65 is a perspective view of a brush roll in accordance with another embodiment, with hair blocking members, bristle tufts, and hard floor cleaning pads.
Figure 66:
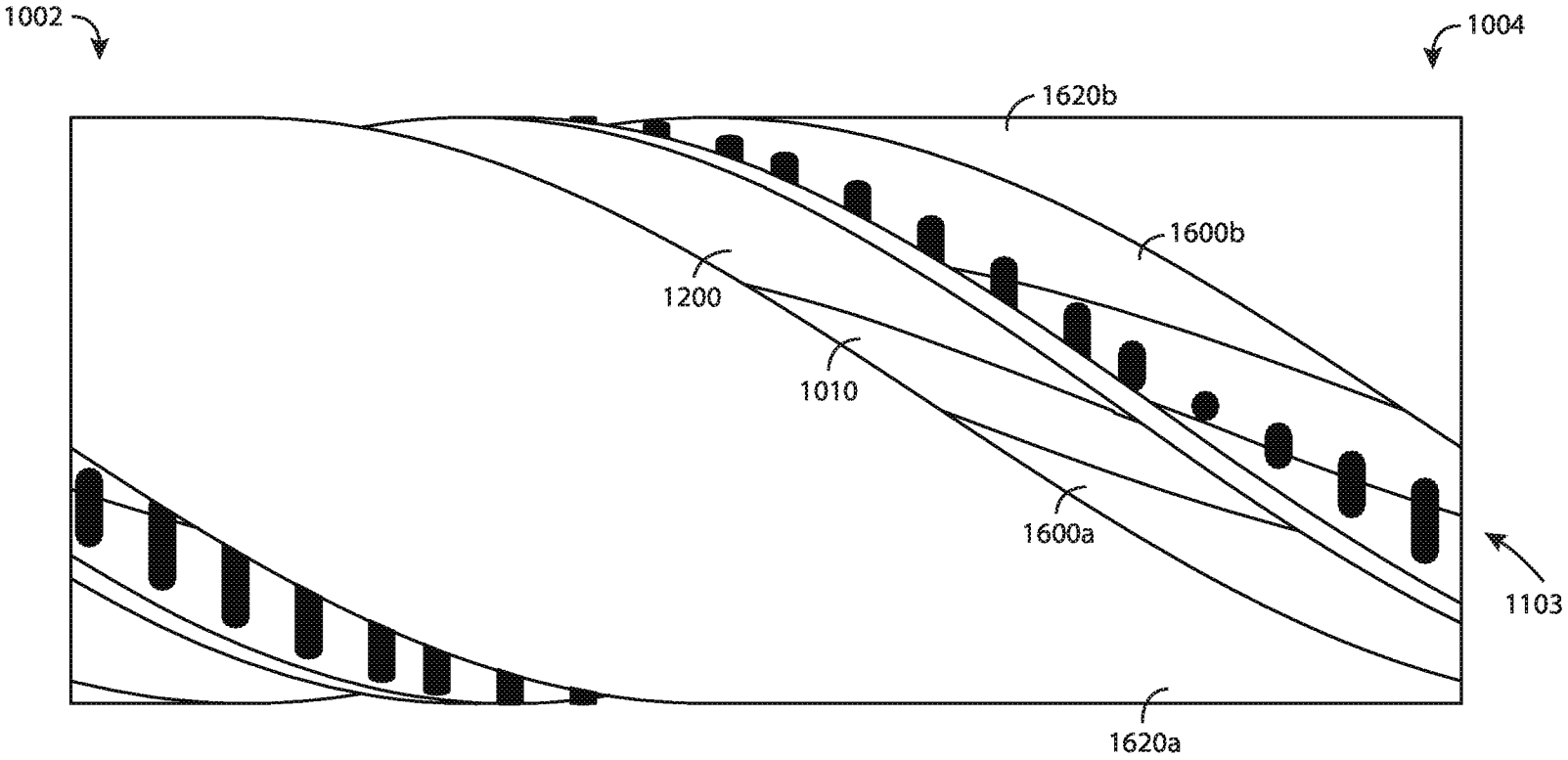
FIG. 66 is a top view of the brush roll of FIG. 65.

In the example illustrated in FIGS. 65 and 66, brush roll 1000 has two hard floor cleaning pads 1600*a*, 1600*b*, with flexible protective pad members in the form of a row 1103 of bristle tufts 1100 and a hair blocking member 1200 positioned between the leading and trailing ends of the hard floor cleaning pads. In this example, the hair blocking member 1200 precedes the bristle tufts 1100 when the brush roll is rotated in rotational direction 1012. The flexible protective pad members may be positioned midway between the hard floor cleaning pads 1600*a*, 1600*b*, closer to the leading edge of hard floor cleaning pad 1600*a*, or closer to the trailing edge of hard floor cleaning pad 1600*b*.

Figure 67:
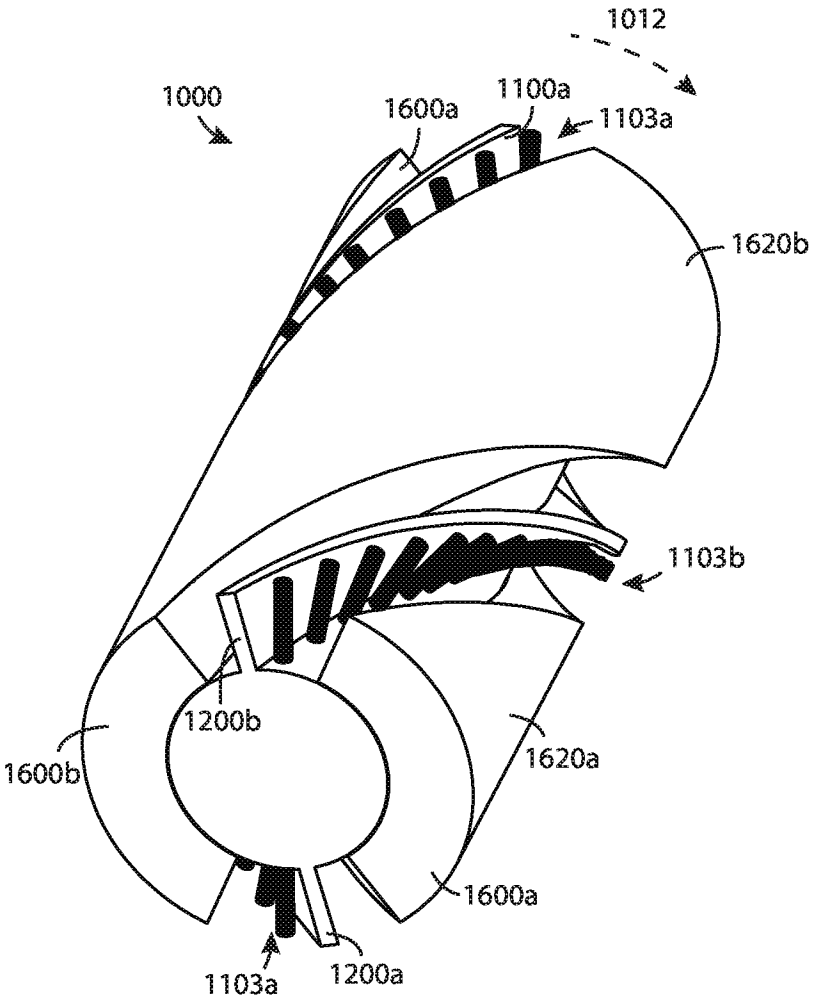
FIG. 67 is a perspective view of a brush roll in accordance with another embodiment, with hair blocking members, bristle tufts, and hard floor cleaning pads.
Figure 68:
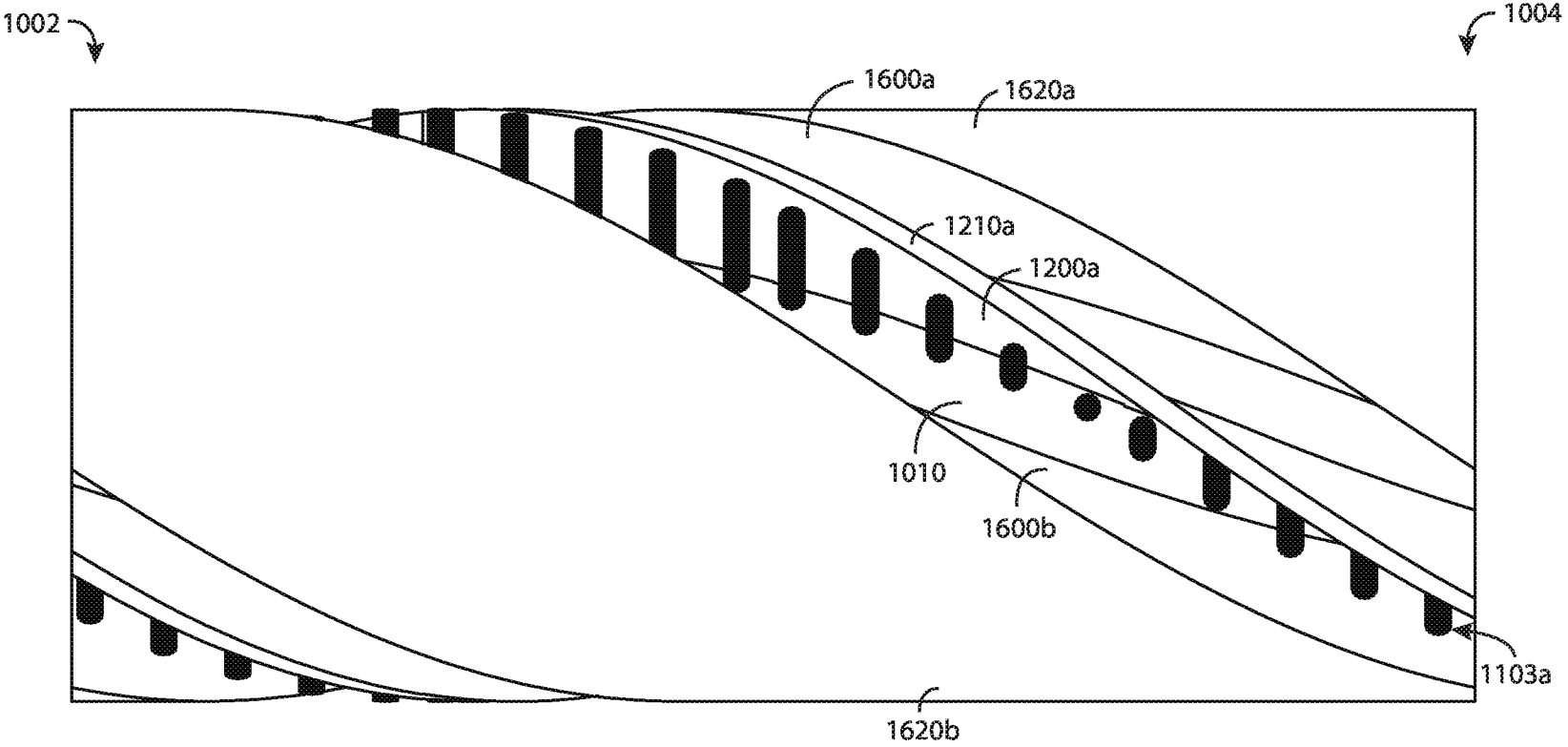
FIG. 68 is a top view of the brush roll of FIG. 67.

In the example illustrated in FIGS. 67 and 68, brush roll 1000 has two hard floor cleaning pads 1600*a*, 1600*b*, with a row 1103 of bristle tufts 1100 and a hair blocking member 1200 positioned between the leading and trailing ends of the hard floor cleaning pads—like those illustrated in FIGS. 65 and 66—but in this example, the bristle tufts 1100 precede the hair blocking member 1200 when the brush roll is rotated in rotational direction 1012. The flexible protective pad members may be positioned midway between the hard floor cleaning pads 1600*a*, 1600*b*, closer to the leading edge of hard floor cleaning pad 1600*a*, or closer to the trailing edge of hard floor cleaning pad 1600*b*.

Figure 69:
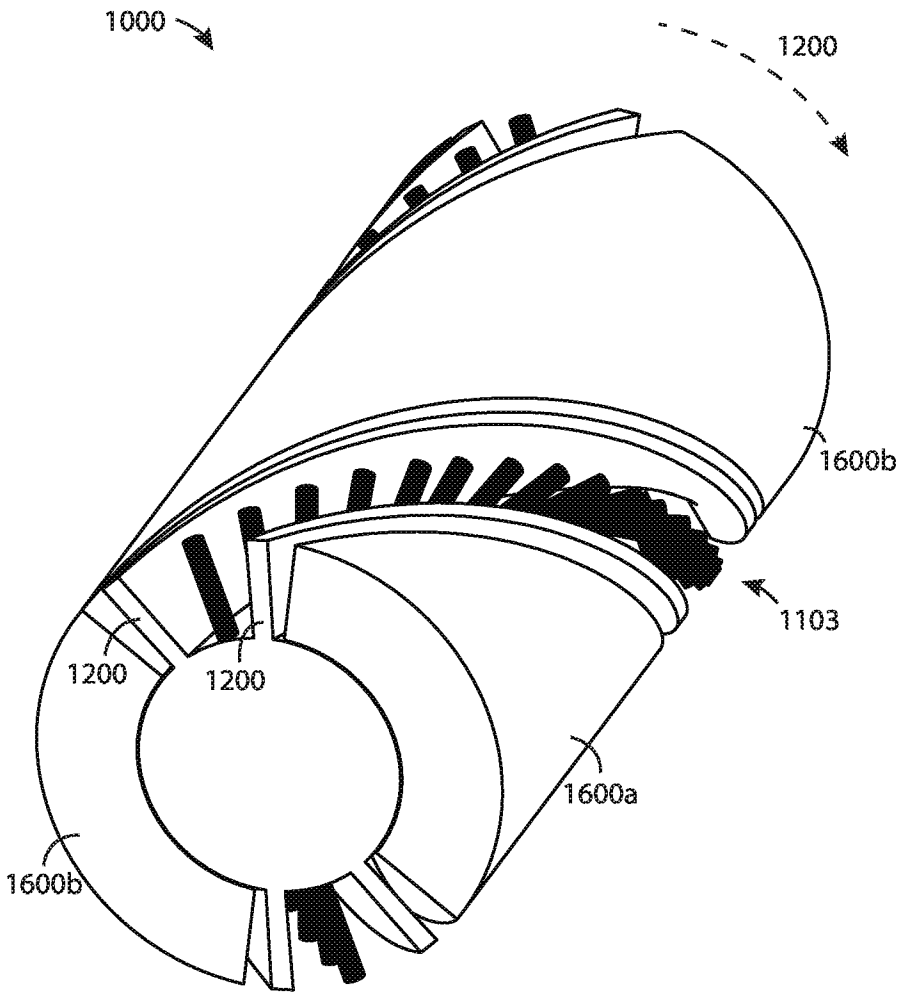
FIG. 69 is a perspective view of a brush roll in accordance with another embodiment, with hair blocking members, bristle tufts, and hard floor cleaning pads.
Figure 70:
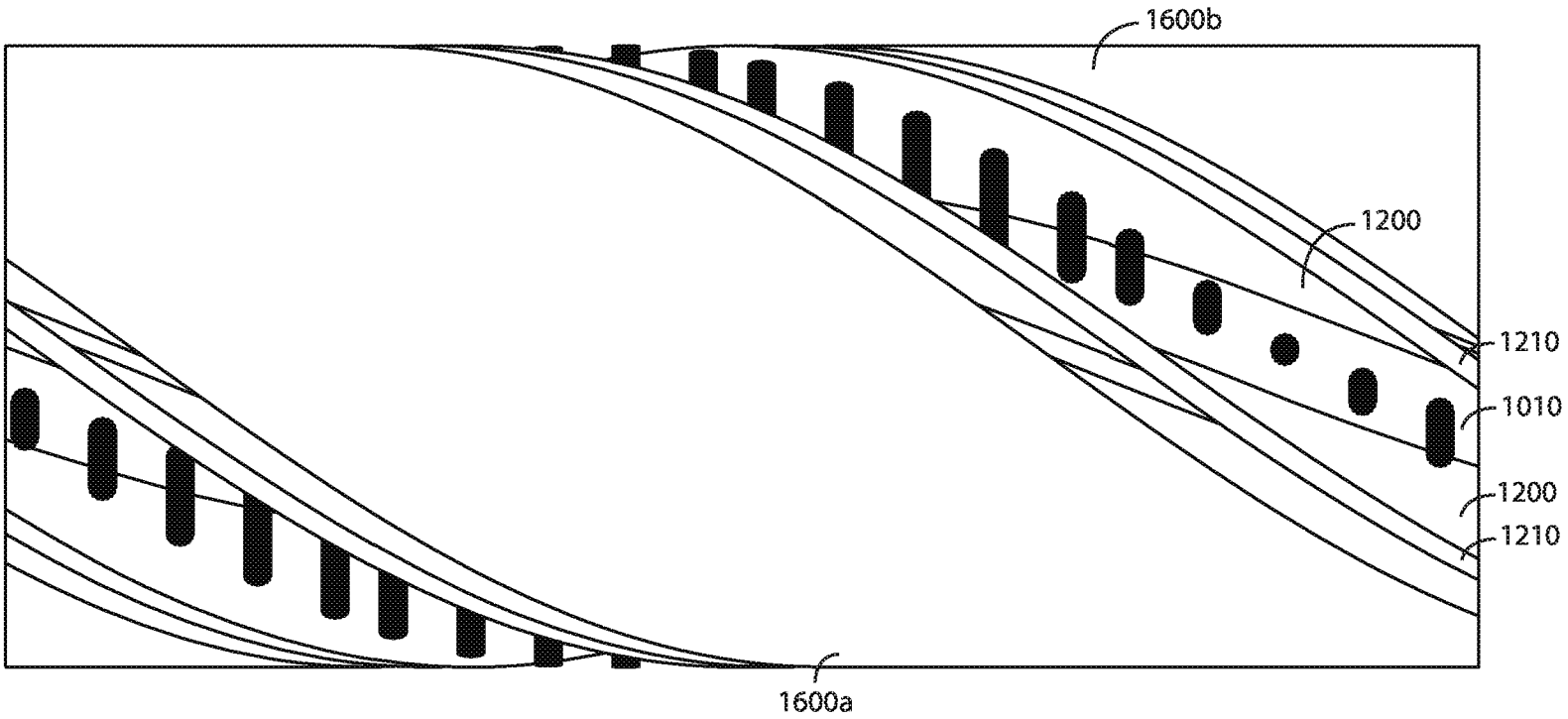
FIG. 70 is a top view of the brush roll of FIG. 69.

In the example illustrated in FIGS. 69 and 70, brush roll 1000 has two hard floor cleaning pads 1600*a*, 1600*b*, with a row 1103 of bristle tufts 1100 positioned between two hair blocking members 1200*a*, 1200*b* that are themselves positioned between the ends of the hard floor cleaning pads. In this example, one of the hair blocking members 1200*a*, 1200*b* may be positioned proximate the leading edge of a pad and the other may be positioned proximate a trailing edge of the same pad and may therefore act to inhibit hair and the like from becoming trapped on the pad.

Figure 71:
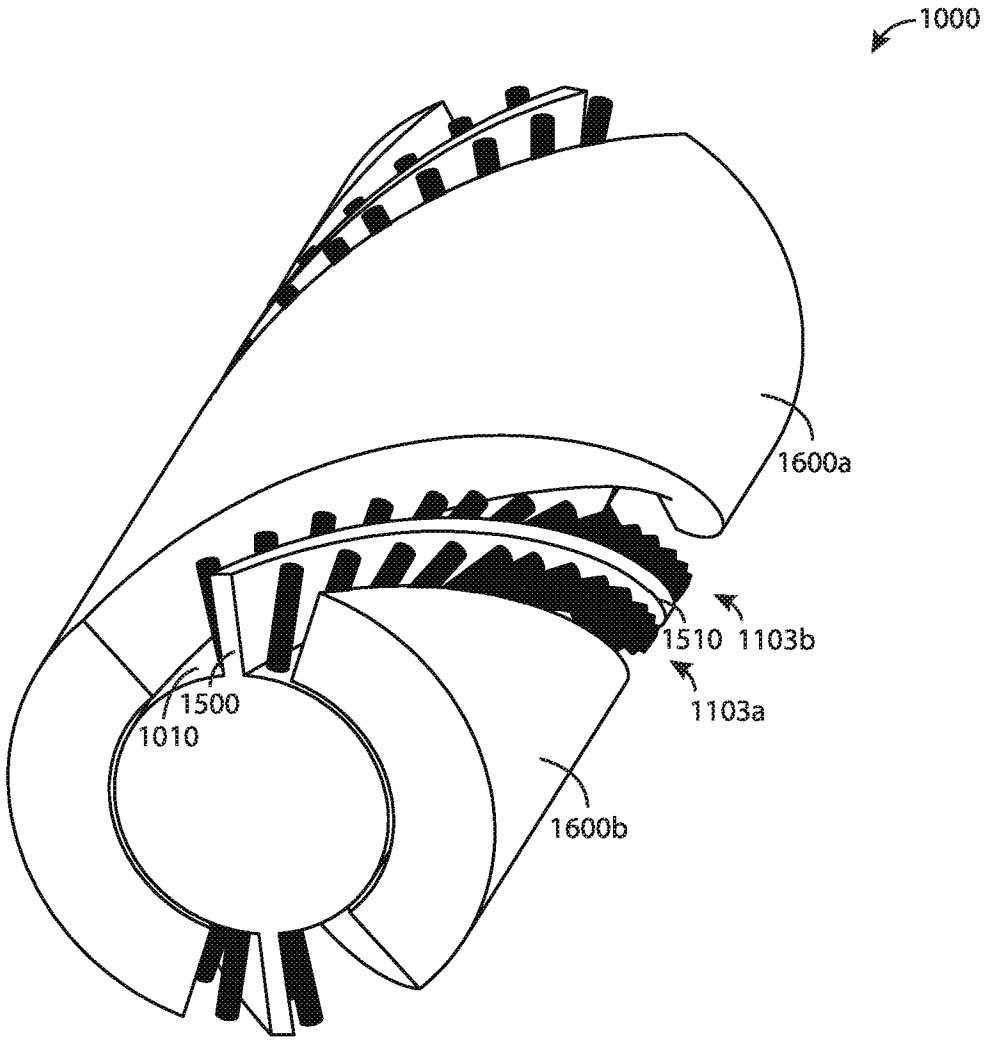
FIG. 71 is a perspective view of a brush roll in accordance with another embodiment, with hair blocking members, bristle tufts, and hard floor cleaning pads.
Figure 72:
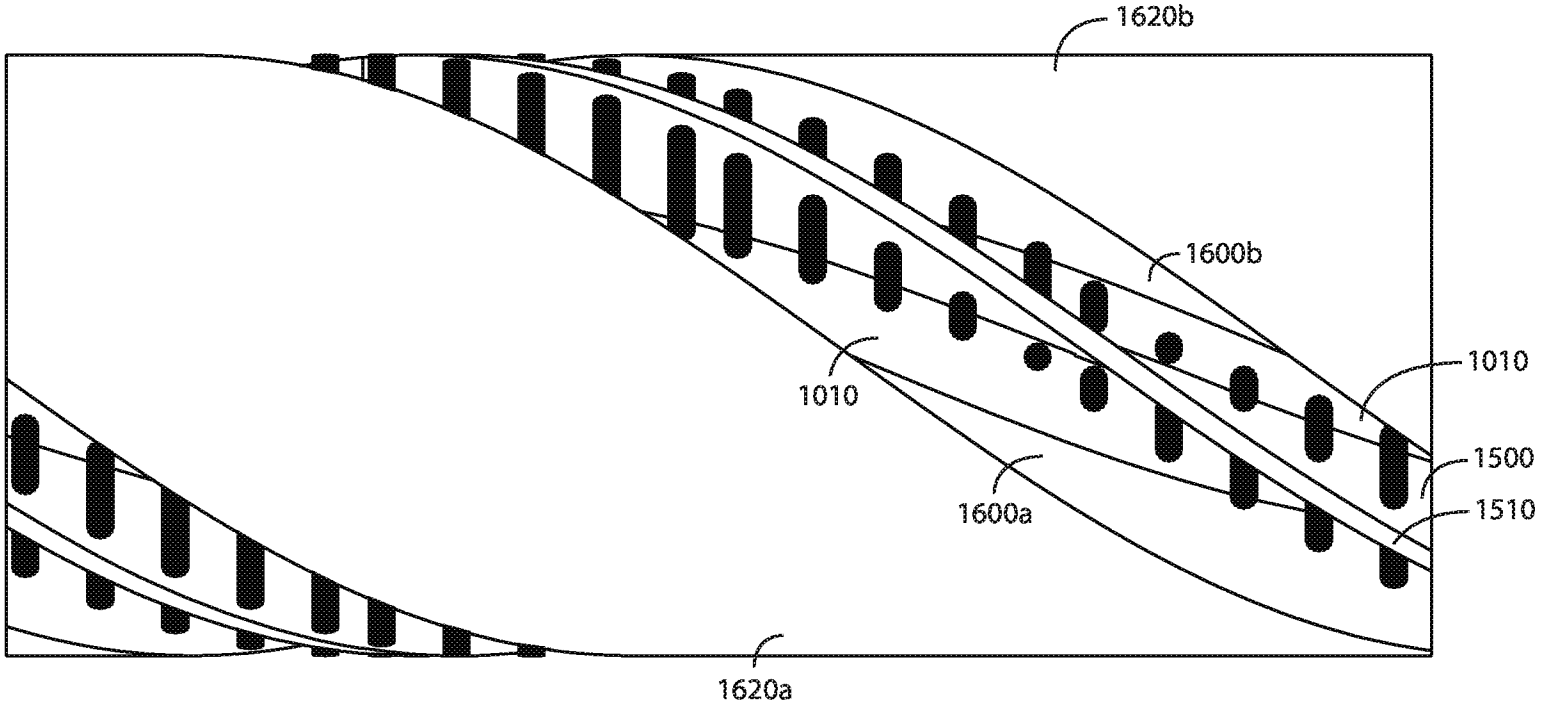
FIG. 72 is a top view of the brush roll of FIG. 71.

In the example illustrated in FIGS. 71 and 72, brush roll 1000 has two hard floor cleaning pads 1600*a*, 1600*b*, with a hair blocking member 1500 positioned between two rows 1103*a*, 1103*b* of bristle tufts 1100 that are themselves positioned between the ends of the hard floor cleaning pads.

Figure 73:
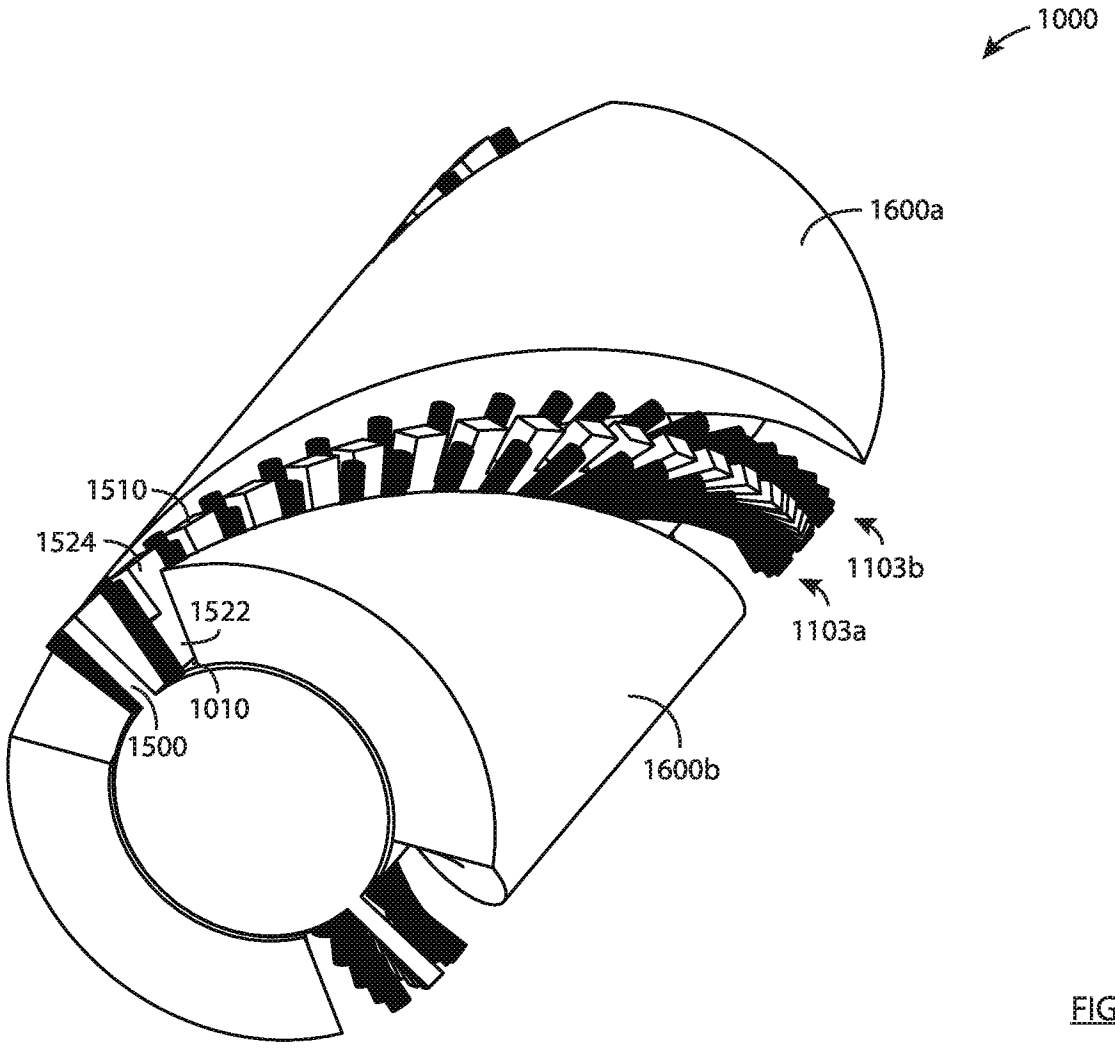
FIG. 73 is a perspective view of a brush roll in accordance with another embodiment, with hair blocking members, bristle tufts, and hard floor cleaning pads.
Figure 74:
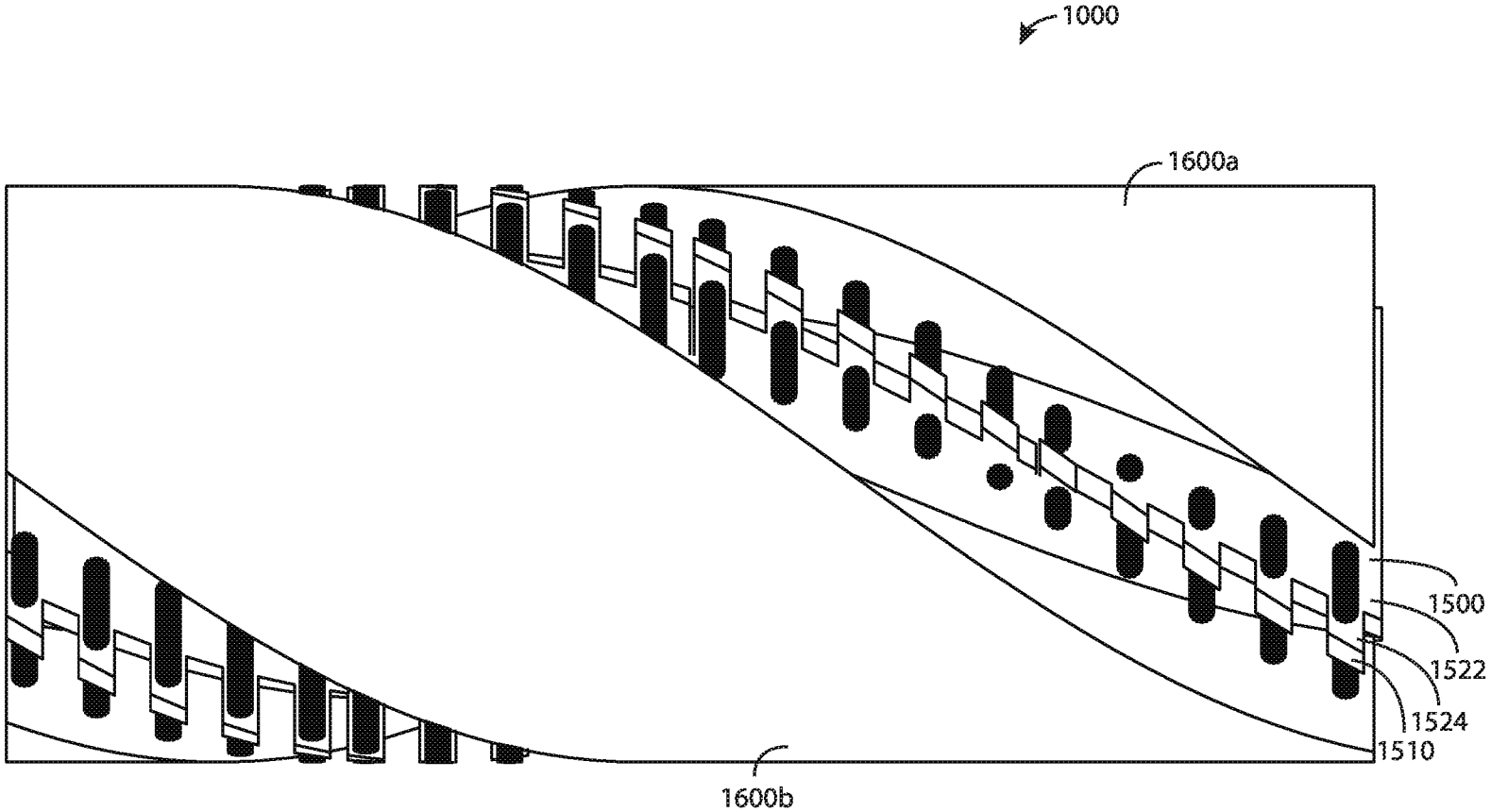
FIG. 74 is a top view of the brush roll of FIG. 73.

The example illustrated in FIGS. 73 and 74 is similar to the example illustrated in FIGS. 71 and 72, but the hair blocking member 1500 has a proximate portion 1522 that extends continuously from the first end 1002 to the second end 1004 of the brush roll 1000, and a plurality of distal segments 1524 that extend radially outwardly from the proximate portion 1522, like the hair blocking member 1500 illustrated in FIGS. 44 and 45.

Figure 75:
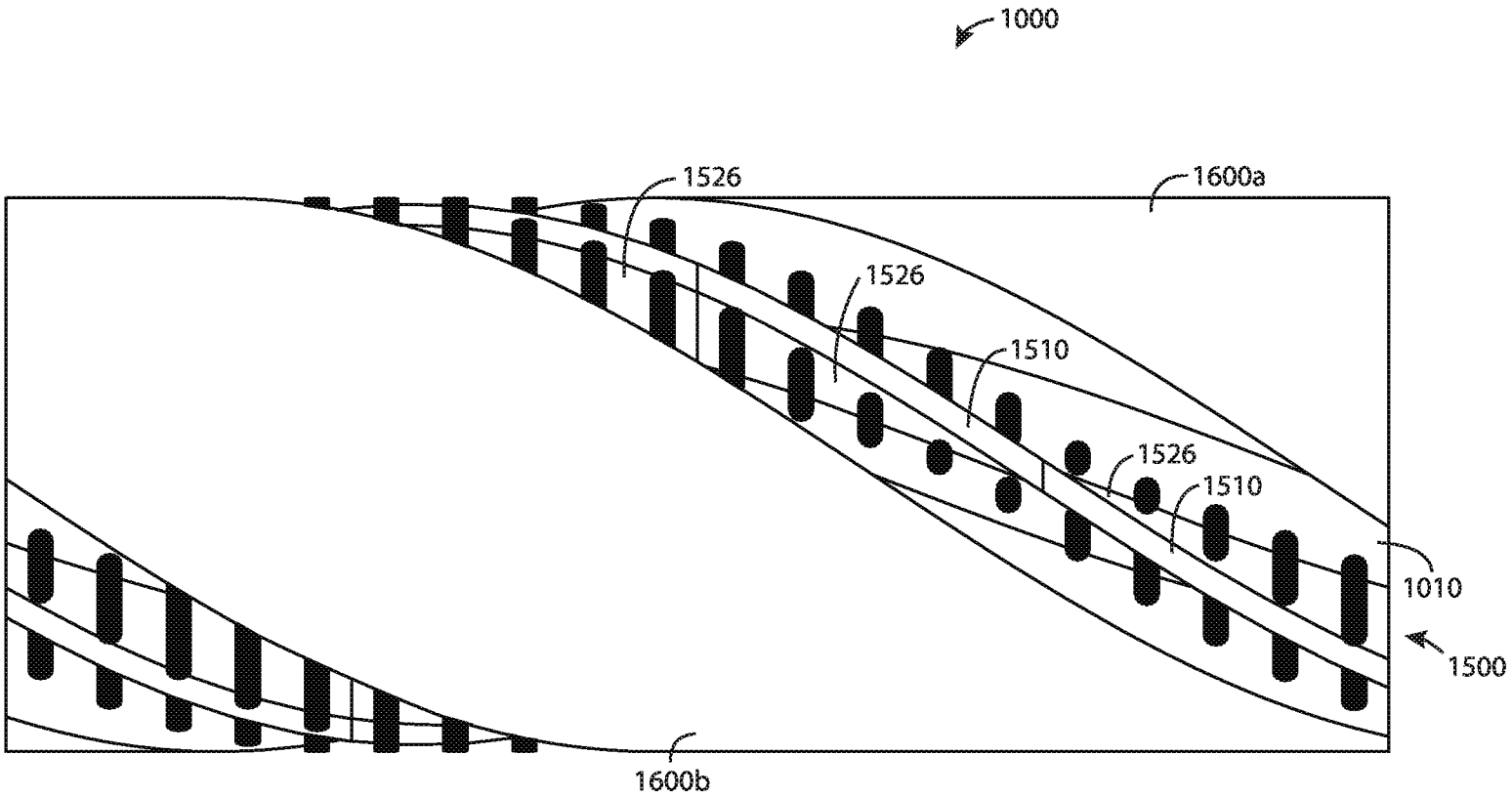
FIG. 75 is a top view of a brush roll in accordance with another embodiment, with segmented hair blocking members, bristle tufts, and hard floor cleaning pads.

In the example illustrated in FIG. 75, hair blocking member 1500 consists of a plurality of abutting segments 1526, with each segment 1526 spanning a portion of the distance from the first end 1002 to the second end 1004 of the brush roll 1000.

Figure 76:
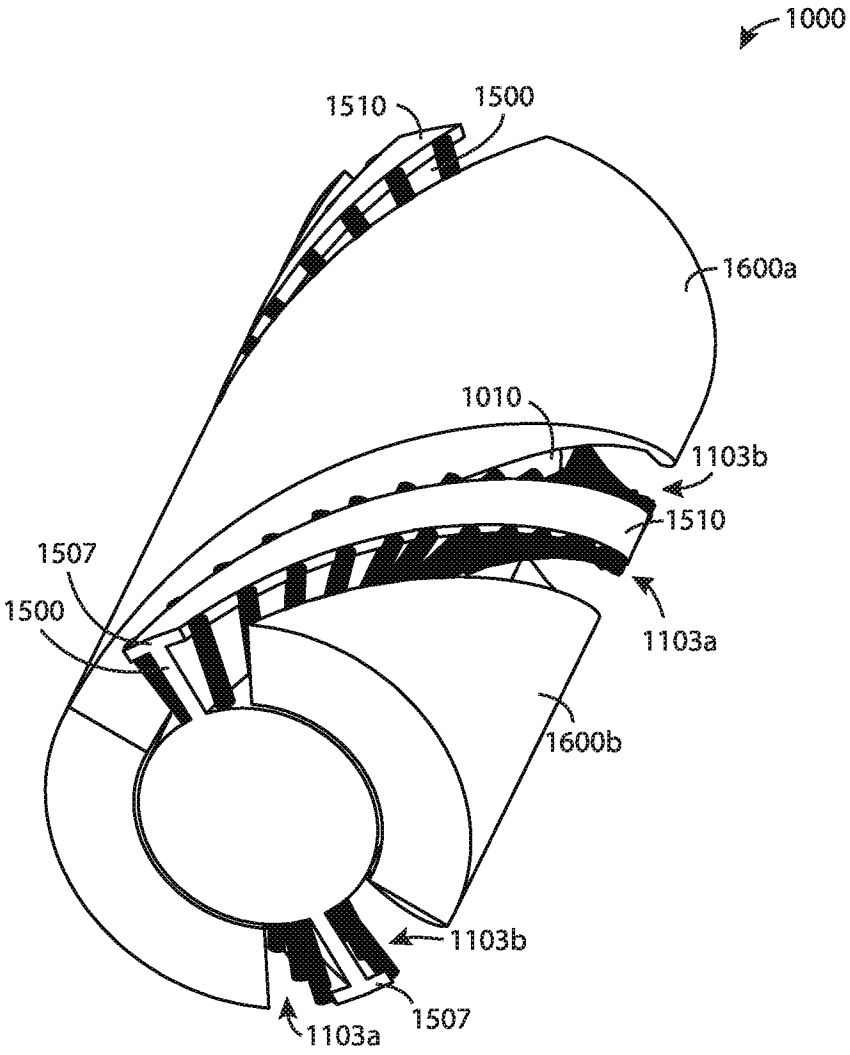
FIG. 76 is a perspective view of a brush roll in accordance with another embodiment, with hair blocking members, bristle tufts, and hard floor cleaning pads.
Figure 77:
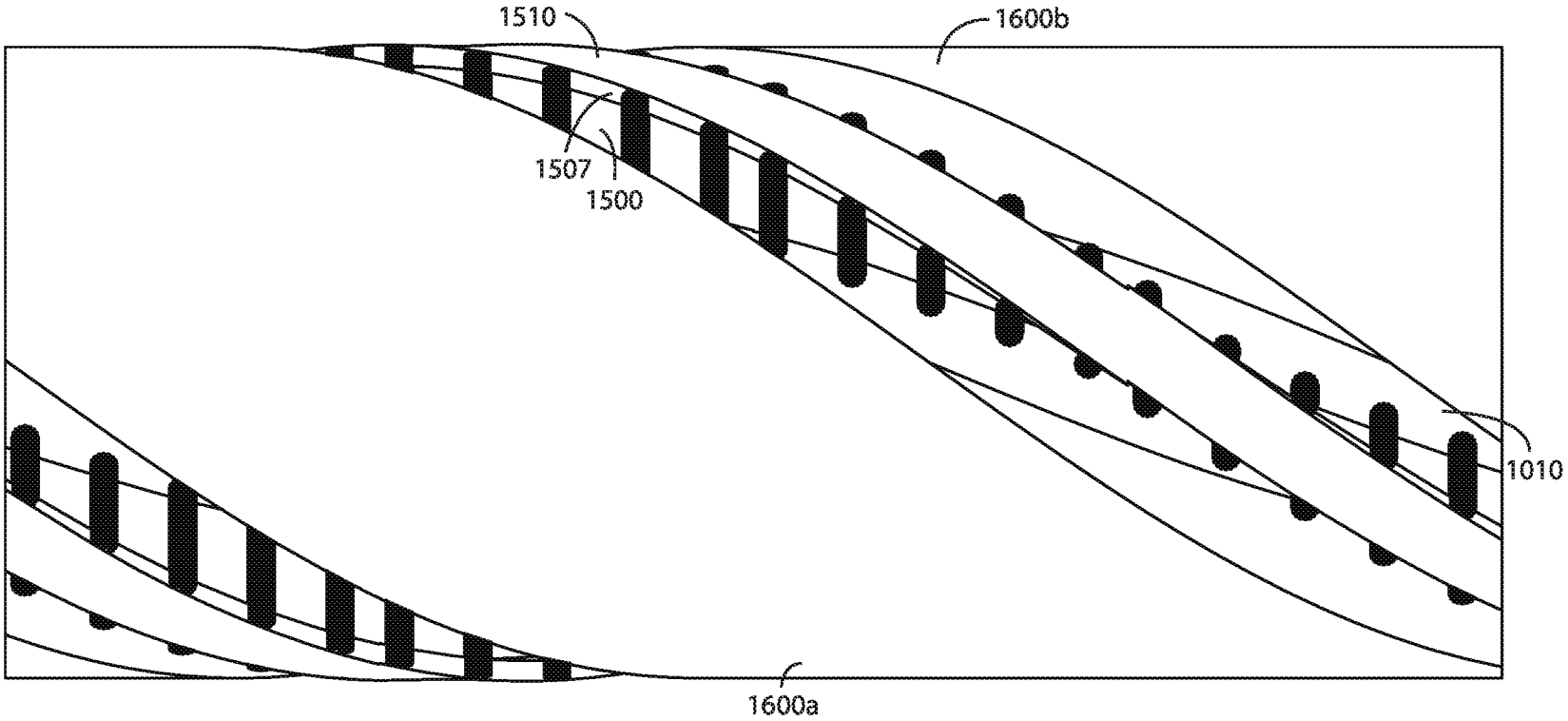
FIG. 77 is a top view of the brush roll of FIG. 76.

The example illustrated in FIGS. 76 and 77 is similar to the example illustrated in FIGS. 71 and 72, but the radial outer end 1510 of the blocking member 1500 has a cross member 1507 that extends between, and optionally abuts, the forward rotational side 1112 of the bristles 1100 in bristle row 1103*a*, and the rearward rotational side 1114 of the bristles 1110 in bristle row 1103*b*, like the hair blocking member 1500 illustrated in FIGS. 42 and 43.

Figure 78:
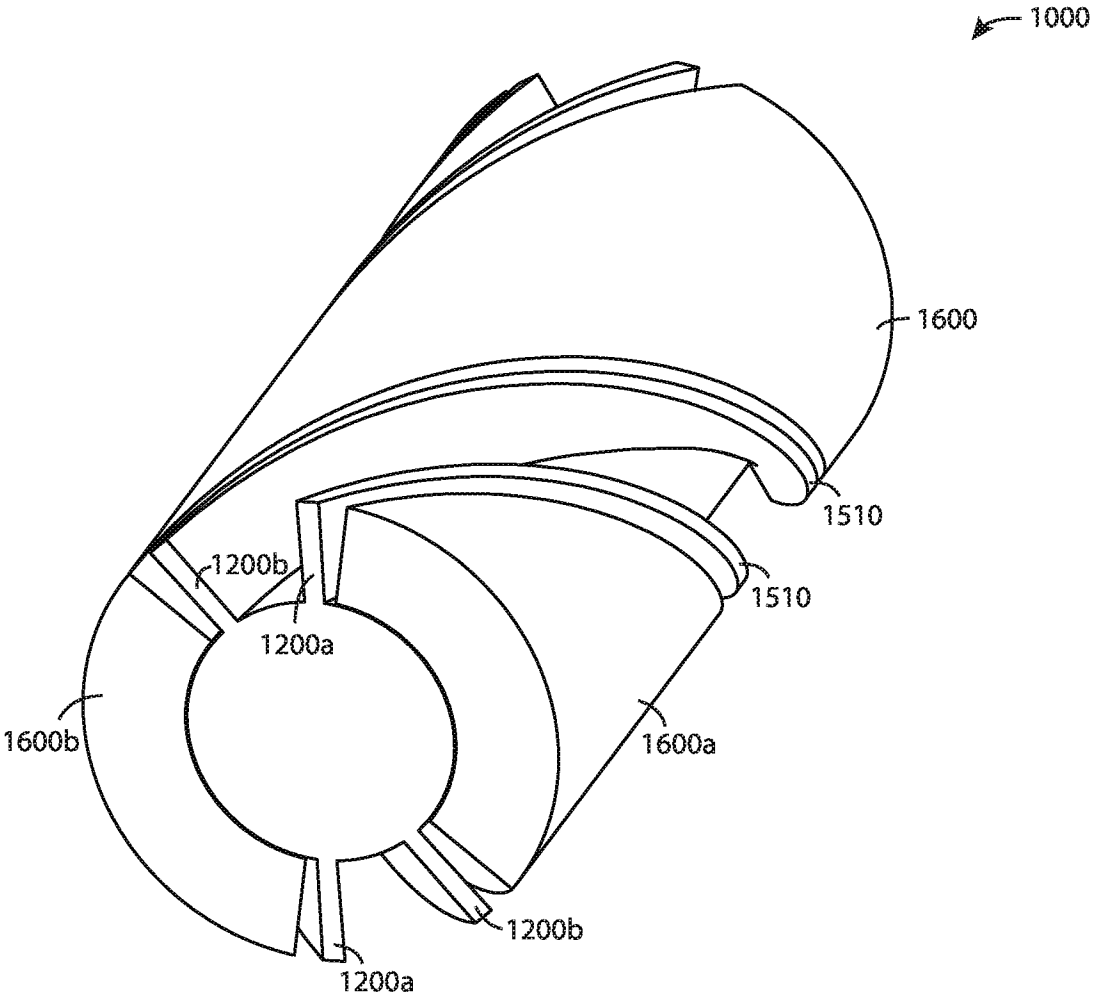
FIG. 78 is a perspective view of a brush roll in accordance with another embodiment, with hair blocking members and hard floor cleaning pads.

In the example illustrated in FIG. 78, brush roll 1000 has two hard floor cleaning pads 1600*a*, 1600*b*, with two hair blocking members 1200*a*, 1200*b* positioned between each of the ends of the hard floor cleaning pads. In this example, no bristles are provided on brush roll 1000. The hair blocking members may be any hair blocking members disclosed herein.

FIGS. 79-83 illustrate an example of a brush roll 1000 having a leading hair blocking member 1200*a*, a hard floor cleaning pad 1600, and a trailing hair blocking member 1200*b* interacting with a floor surface 10 during rotation of the brush roll 1000. Such a configuration may facilitate the partial or complete dislodgement of hair, string, or other strand-like material from the surface of the microfiber cleaning pad 1600.

Figure 80:
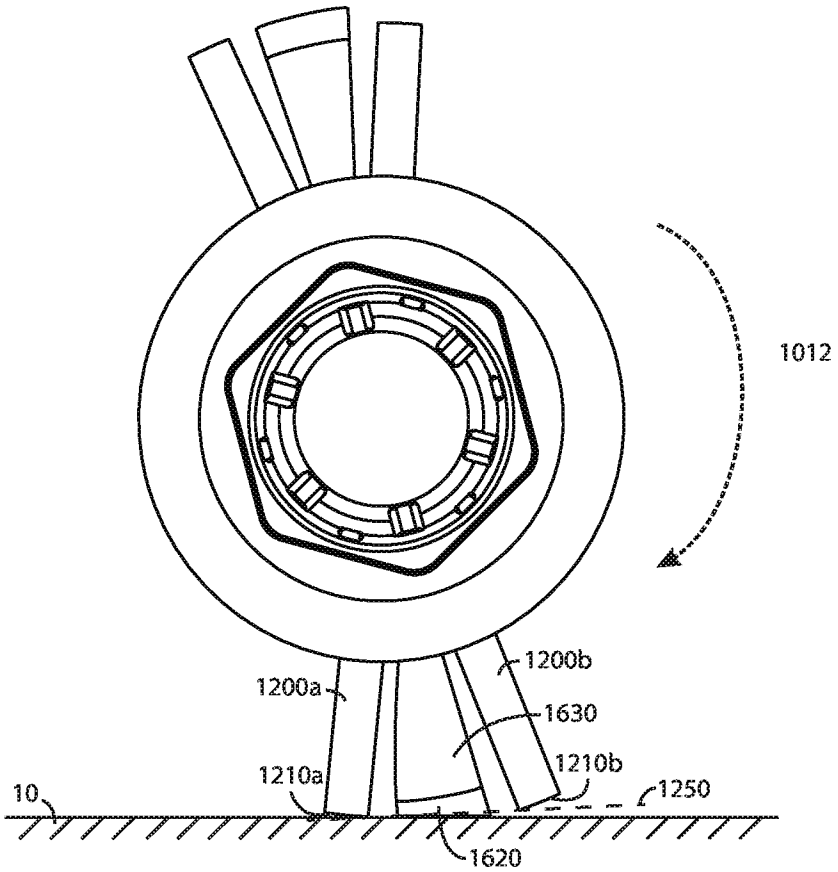
FIGS. 79 to 83 are a series of schematic end views showing a brush roll in accordance with another embodiment being rotated along a floor surface.
Figure 79:
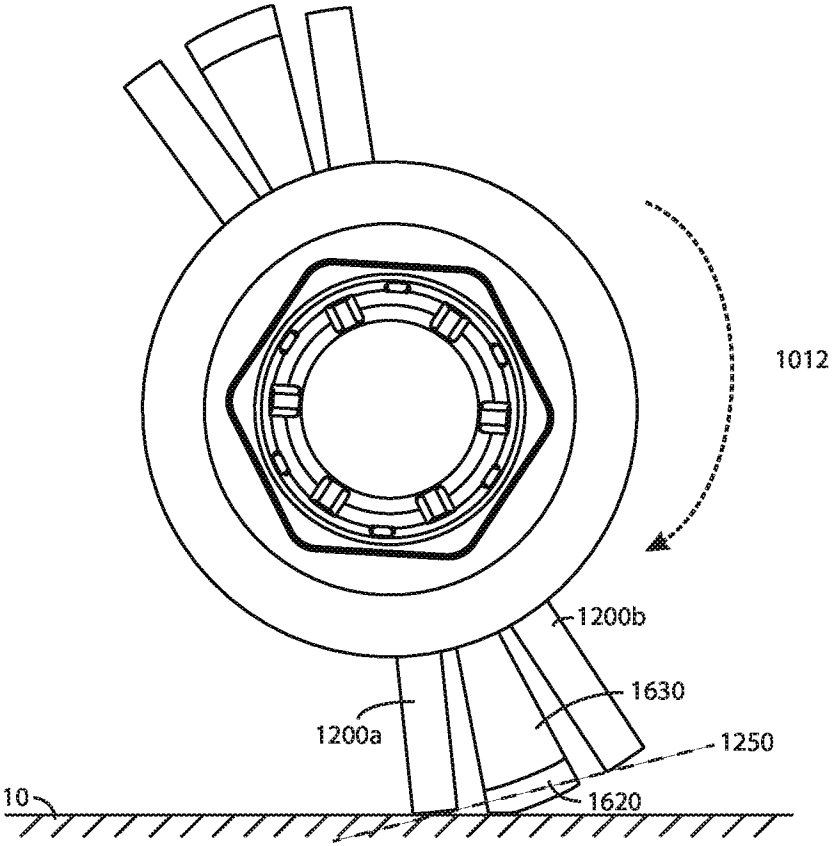

In FIG. 79, brush roll 1000 is at a position where the leading edge of the microfiber material 1620 is in contact with the floor surface 10. In FIG. 80, the brush roll 1000 has been further rotated so that the microfiber material 1620 has compressed and is sweeping over the floor surface 10, and the trailing hair blocking member 1200*b* is approaching contact with the floor surface 10.

Figure 82:
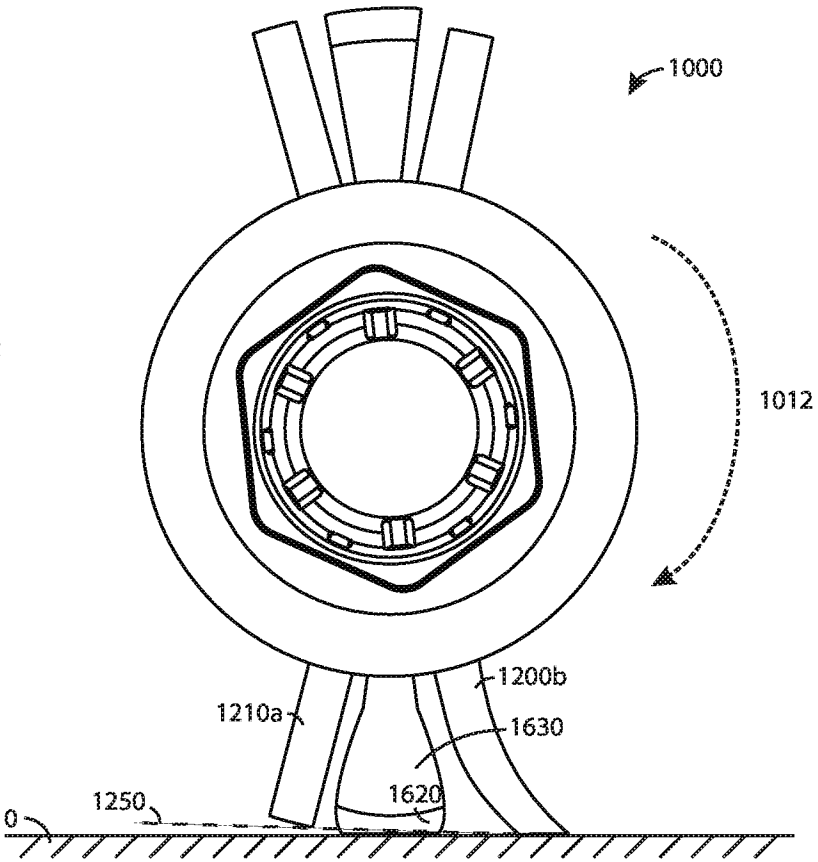
Figure 81:
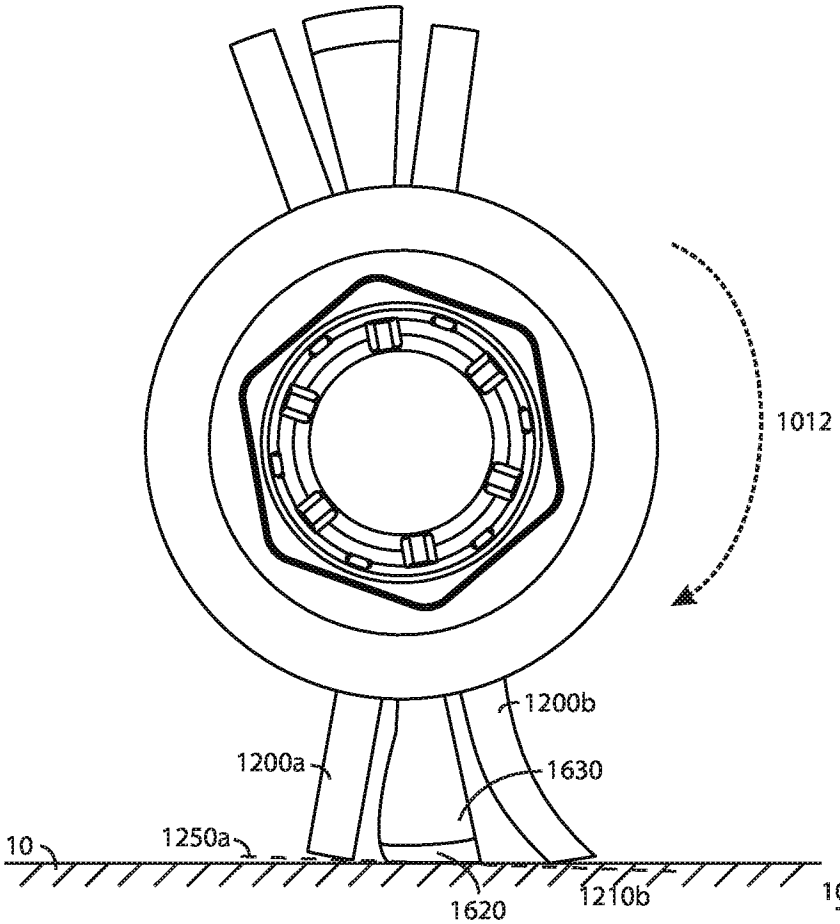
Figure 84:
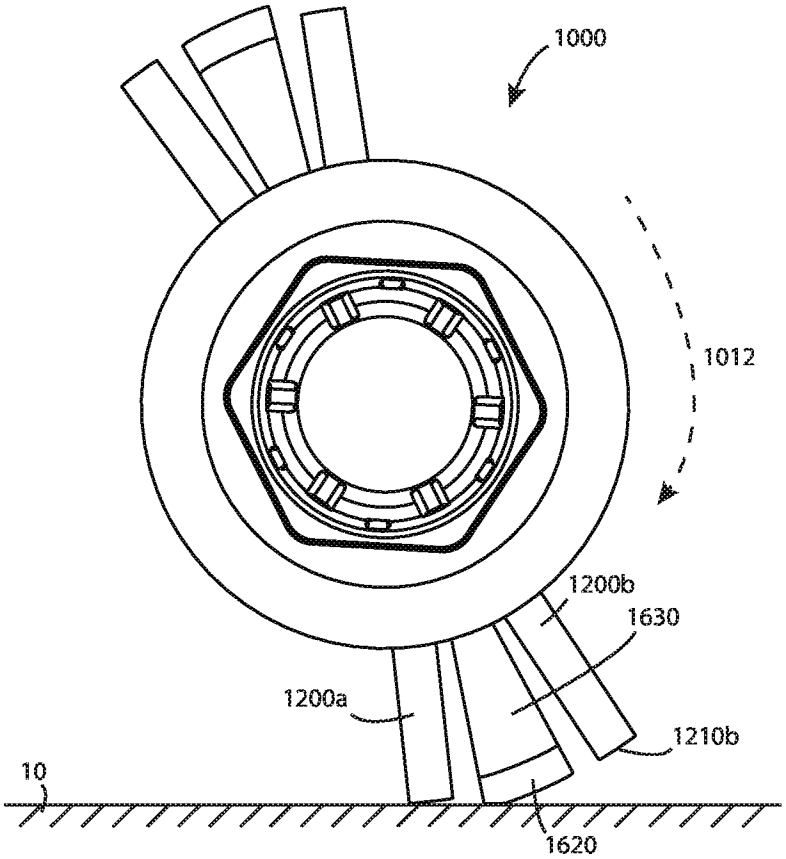
FIGS. 84 to 88 are a series of schematic end views showing a brush roll in accordance with another embodiment being rotated along a floor surface.

In FIGS. 81 and 82, the brush roll 1000 is further rotated so that the microfiber material 1620 continues to sweep over the floor surface 10. In these positions, the compressible support 1630 has been deformed in addition to the compression of the microfiber material 1620. The trailing hair blocking member 1200*b* is in contact with the floor surface 10, and has flexibly deformed such that its outer surface 1210*b* is radially closer to the axis 1005 of brush roll 1000. In these positions, the plane 1250 defined by the outer ends 1210*a*, 1210*b* of the hair blocking members 1200*a*, 1200*b* is approximately co-incident with the floor surface 10. Also, in these positions the outer surface 1610 of the hard floor cleaning pad 1600 is also approximately co-incident with the floor surface 10.

Figure 83:
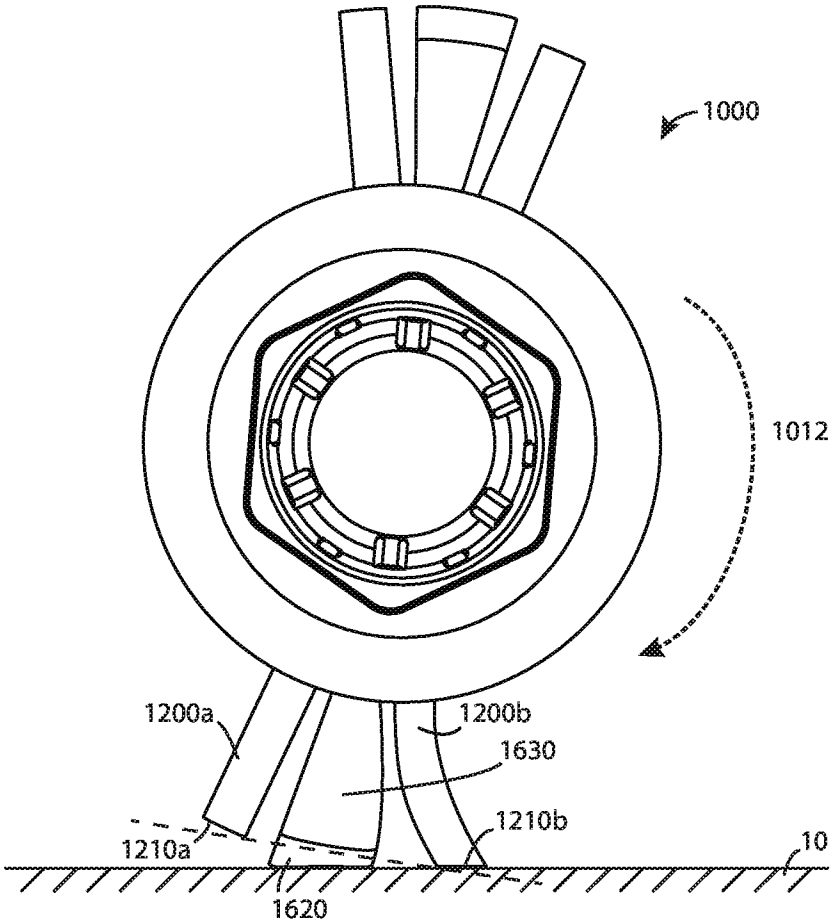
Figure 86:
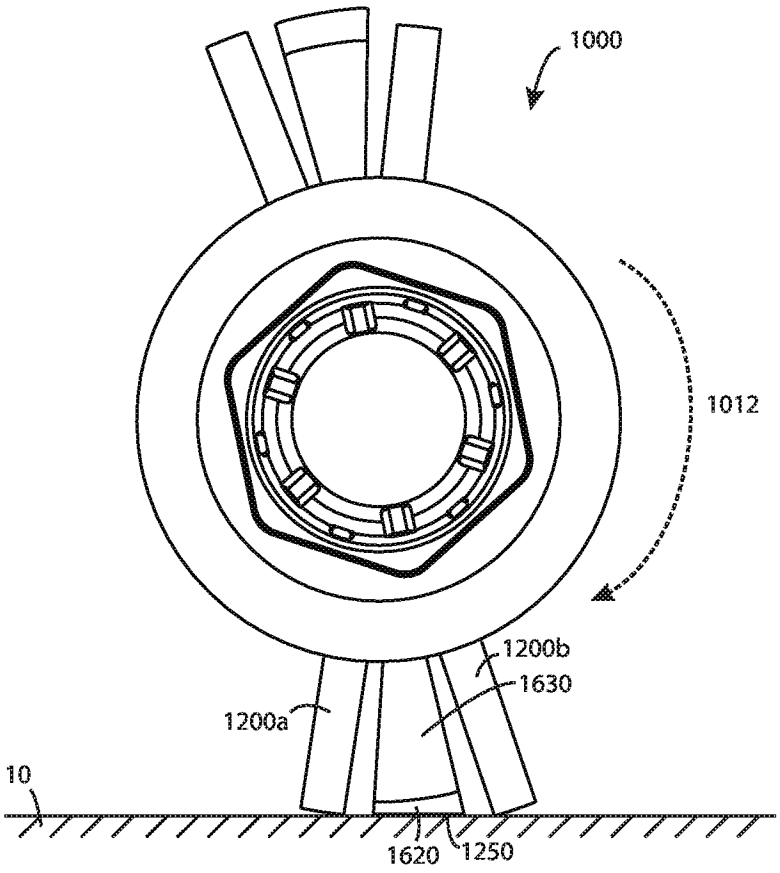
Figure 85:
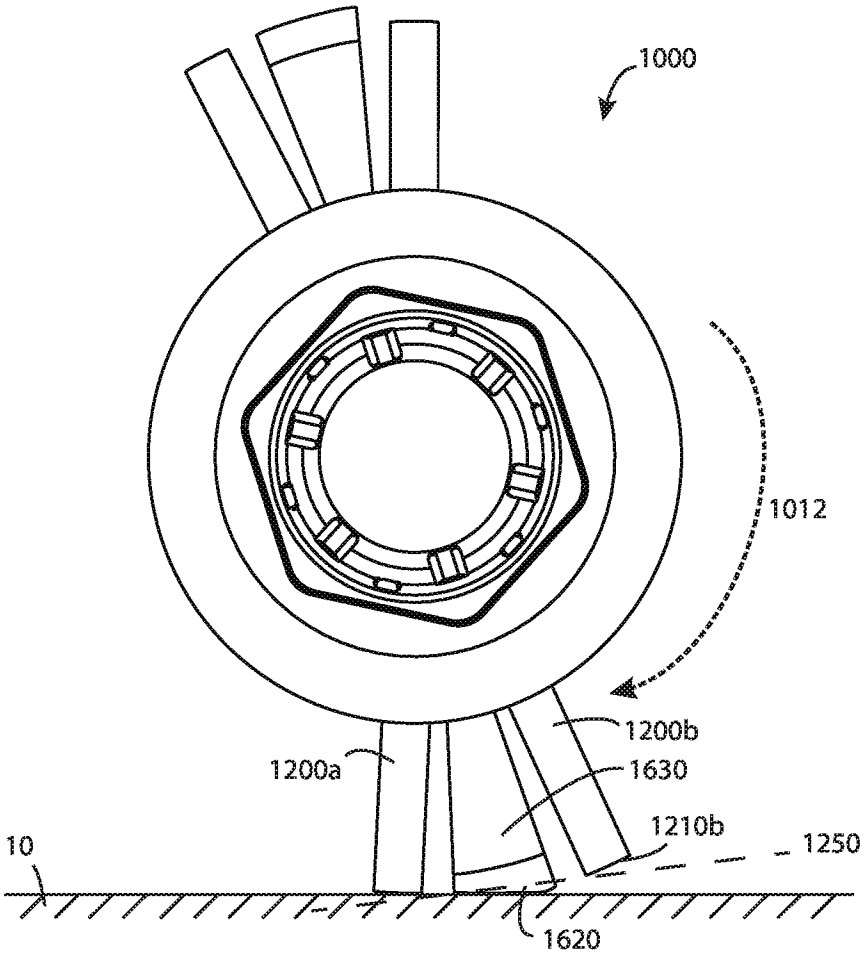
Figure 88:
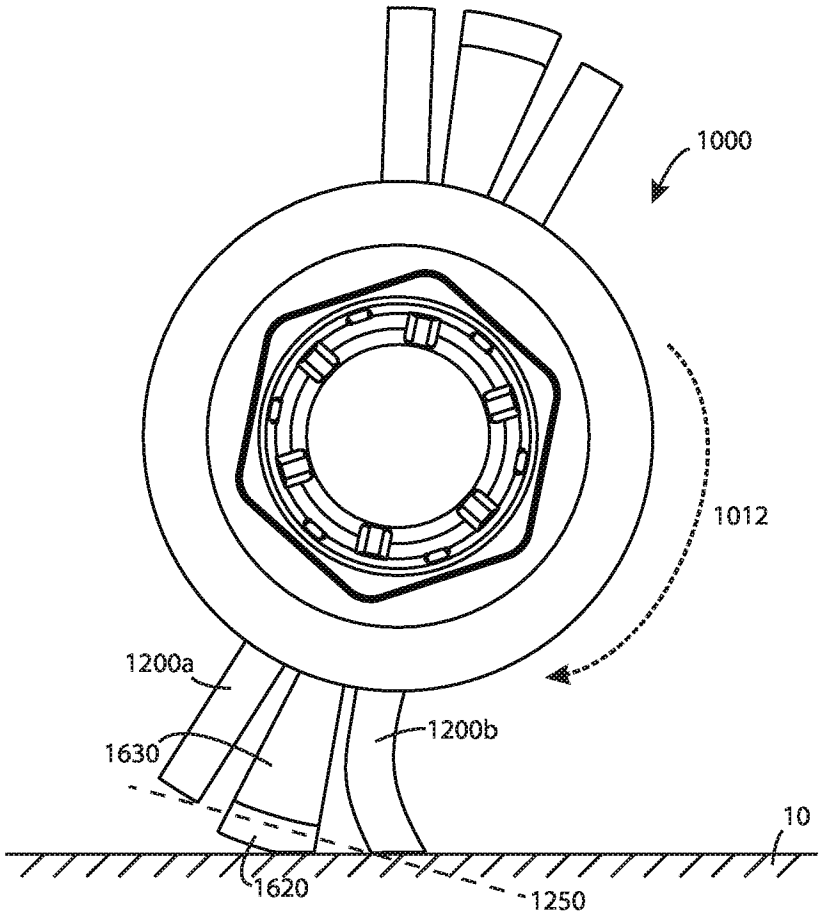
Figure 87:
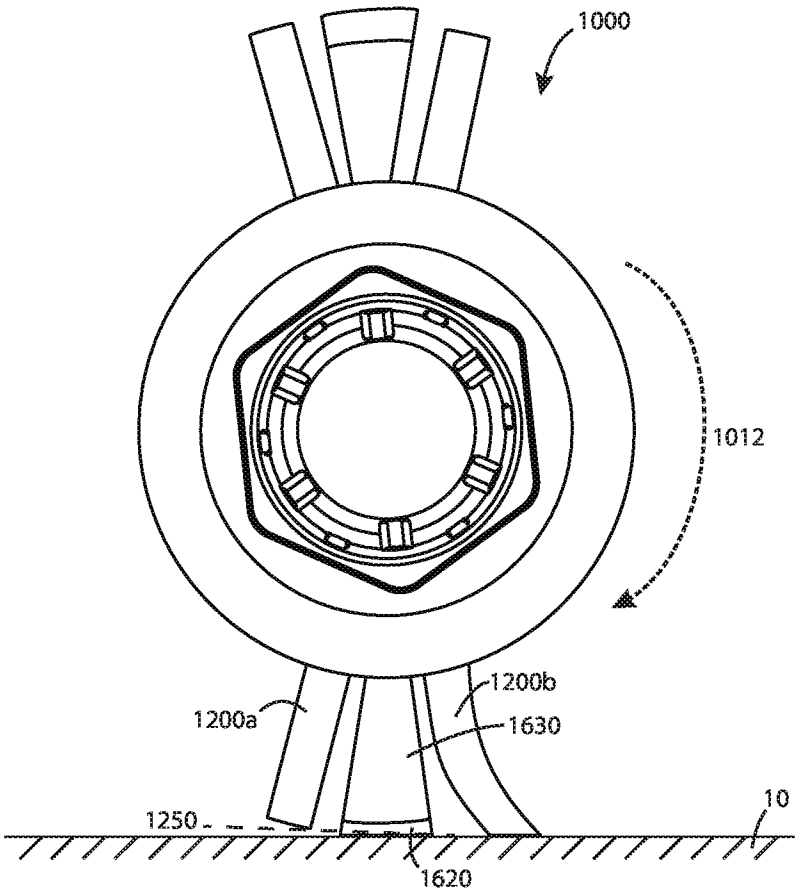
Figure 90:
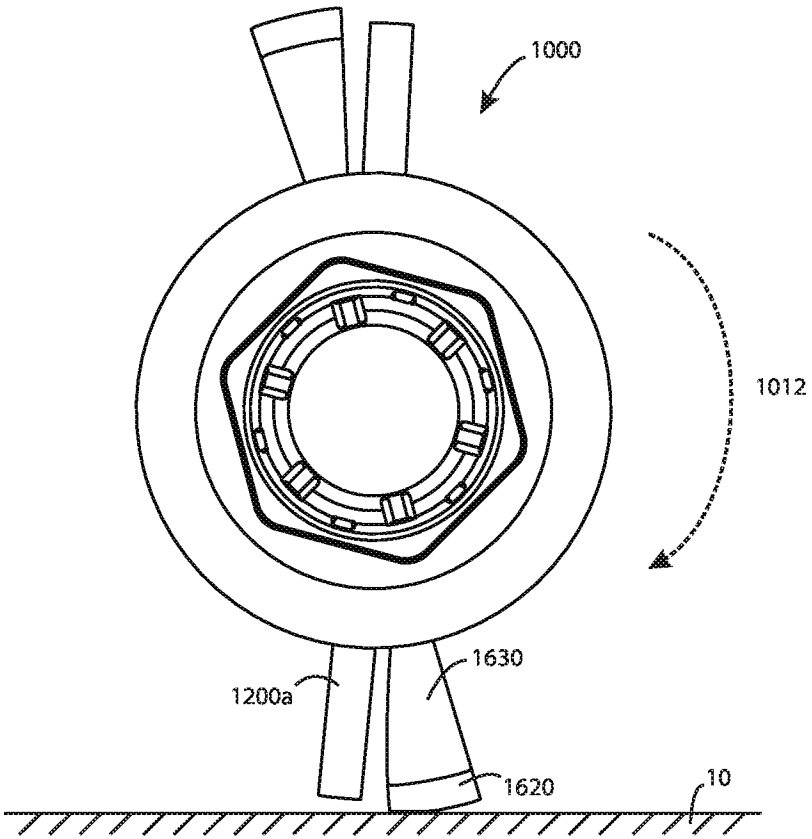
FIGS. 89 to 92 are a series of schematic end views showing a brush roll in accordance with another embodiment being rotated along a floor surface.
Figure 89:
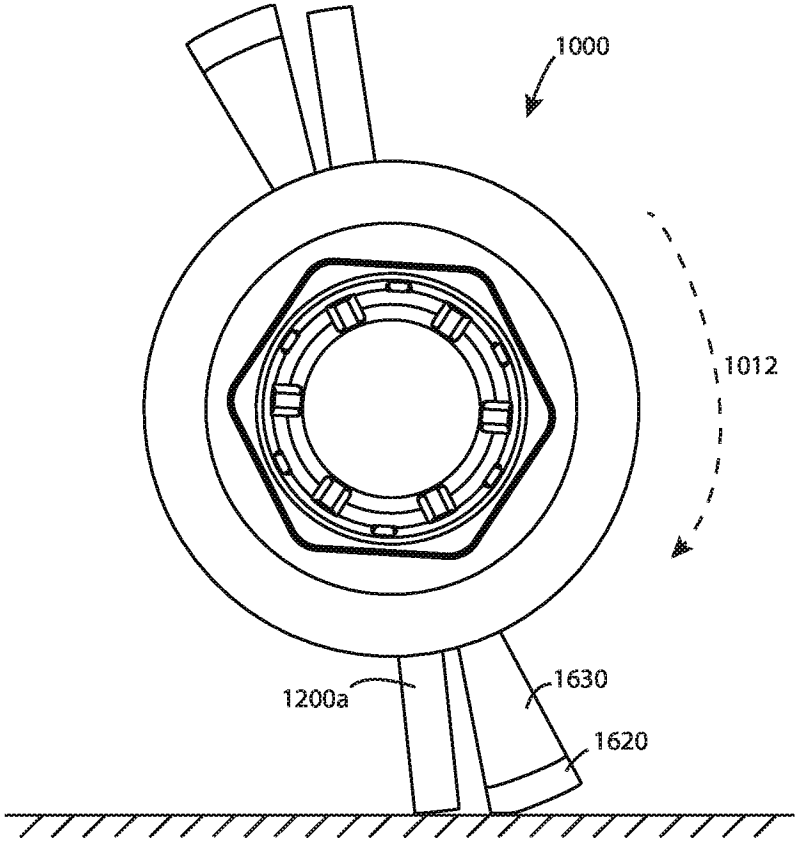
Figure 92:
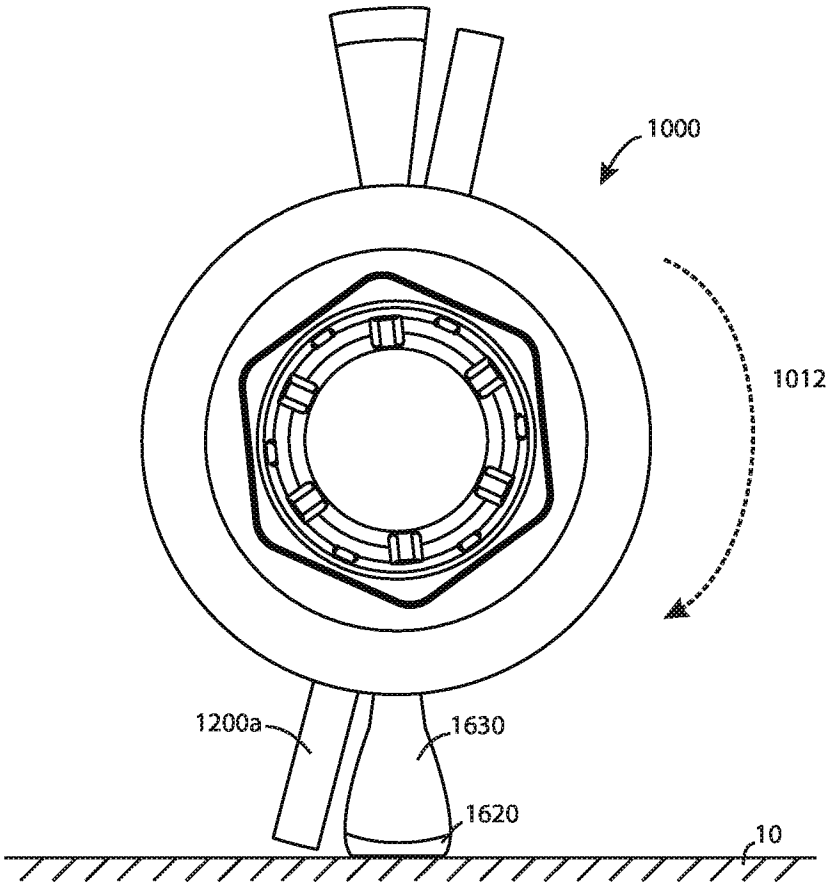
Figure 91:
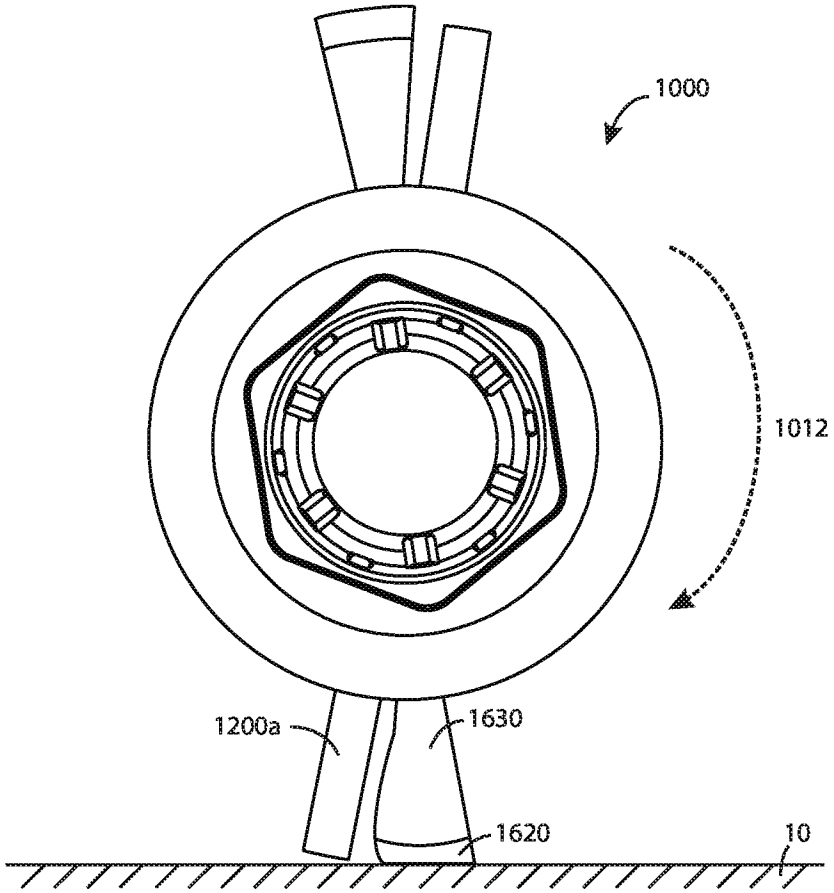
Figure 94:
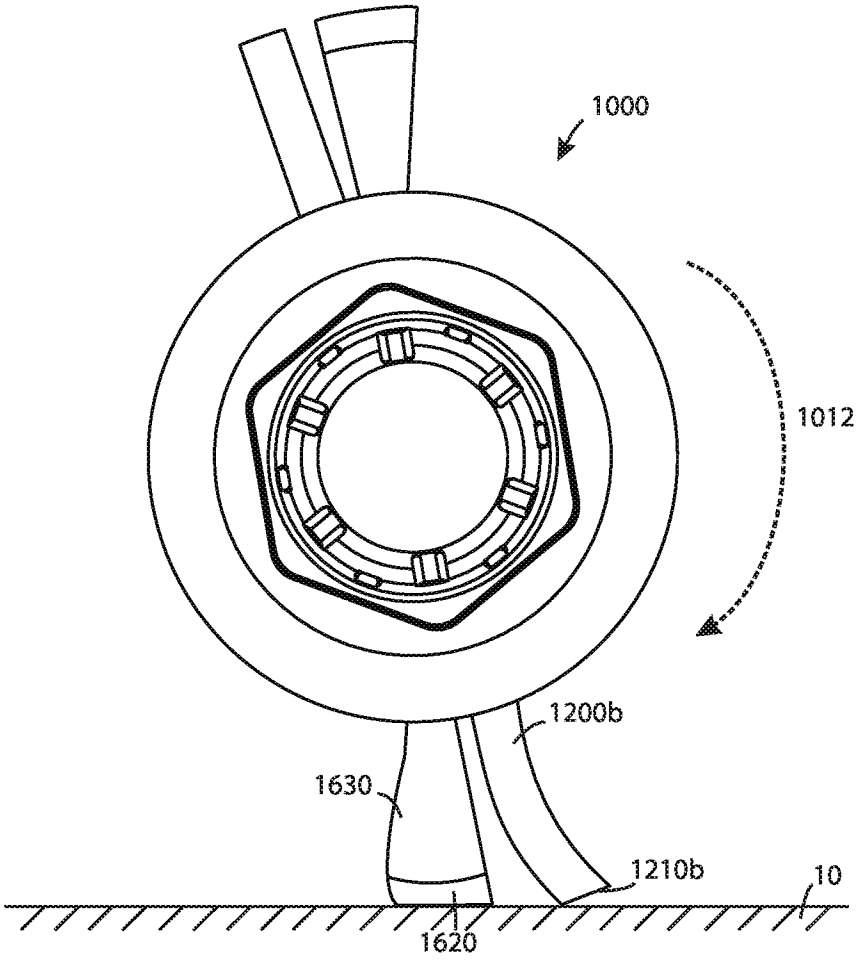
FIGS. 93 to 96 are a series of schematic end views showing a brush roll in accordance with another embodiment being rotated along a floor surface.
Figure 93:
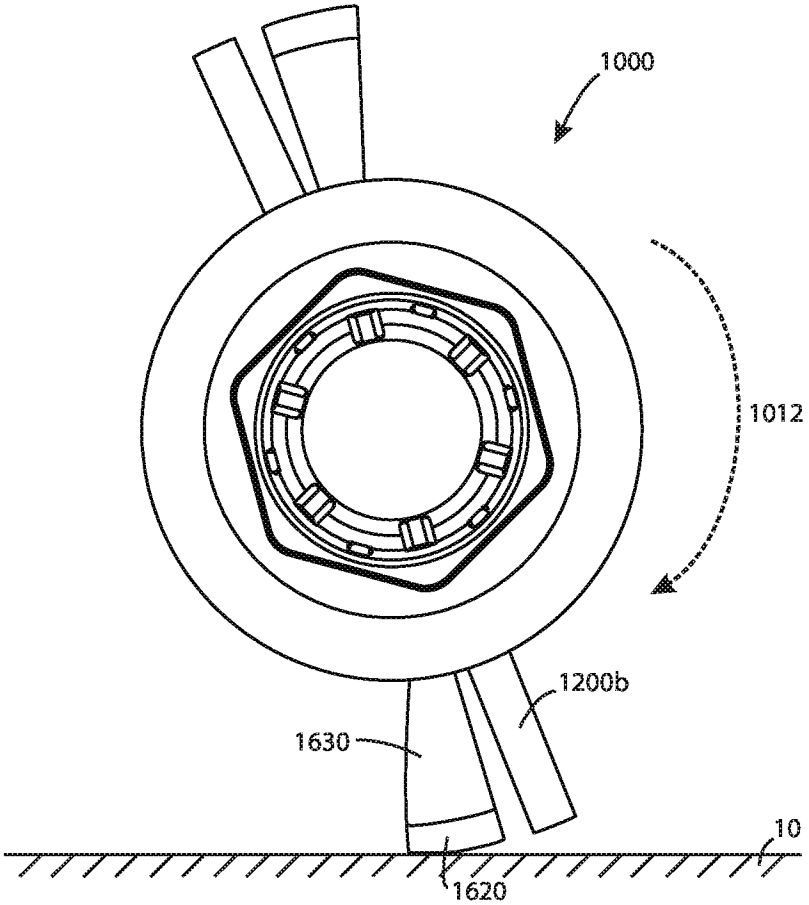
Figure 96:
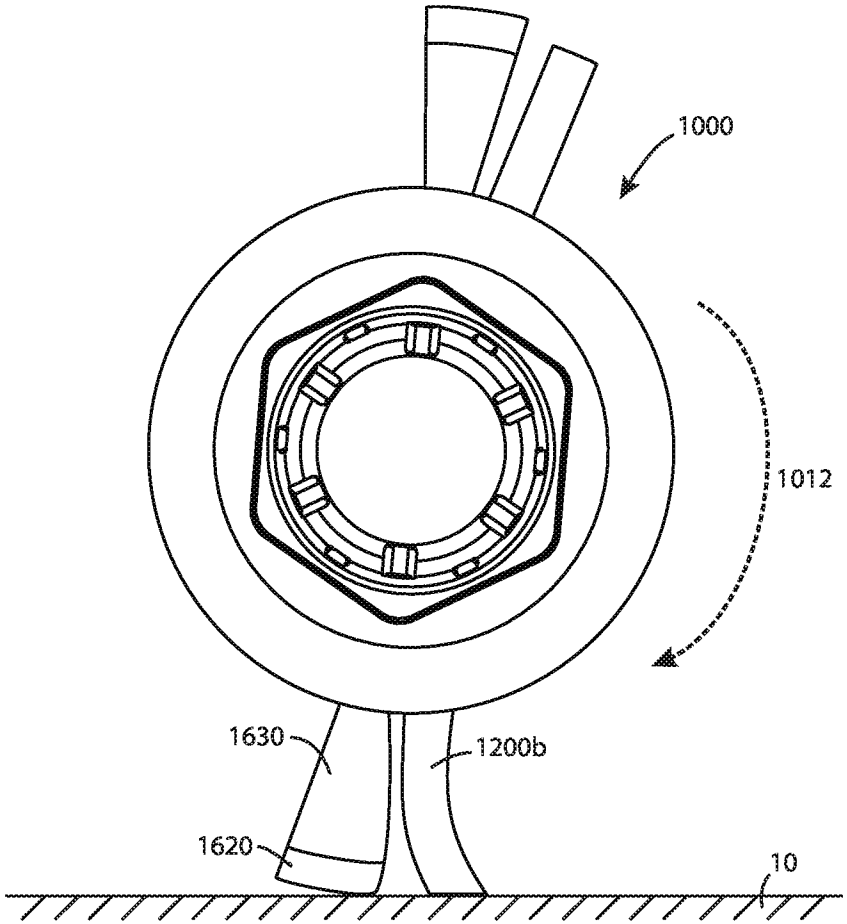

In FIG. 83, the brush roll 1000 has been further rotated so that the microfiber material 1620 is beginning to come out of contact with the floor surface 10. The trailing hair blocking member 1200*b* remains in contact with the floor surface 10, and remains flexibly deformed. In this position, if a hair or other piece of strand-like debris that is embedded in or clinging to the microfiber material 1620 is also in contact with the end 1210*b* of the trailing hair blocking member 1200*b*, the hair may be at least temporarily 'pinched' or held between the floor surface 10 and the end 1210*b*. In this position, as the compressible support 1630 decompresses once microfiber material 1620 is no longer in contact with the floor surface 10, hair or other pieces of strand-like debris held or 'pinched' by the trailing hair blocking member 1200*b* may be partially or completely debrided from the microfiber material 1620.

In this way, a hair or other piece of strand-like debris that is collected by the microfiber material 1620 from the hard floor cleaning pad coming into contact with the floor surface 10 (e.g. in the position shown in FIG. 79), and which overlaps the radial outer ends 1210*a*, 1210*b* of both the leading and trailing hair blocking members may be pulled taut between the ends 1210*a*, 1210*b* of the hair blocking members—i.e. towards the plane 1250. When the hair blocking members rebound to their starting (non-compressed) position, the hair or other piece of strand-like debris may be debrided from the microfiber material 1620.

Preferably, as in the example illustrated in FIGS. 79-83, the length 1225*a* of the leading hair blocking member 1200*a* is less than the length 1125 of the bristles 1100. An advantage of providing a shorter leading hair blocking member 1200*a* is that this blocking member may not come into contact with a floor surface 10, and may therefore not be bent back towards the bristles 1100, which may maintain plane 1250 in a position where it extends through the ends 1110 of the bristles. In alternative embodiments, the length 1225*a* of the leading hair blocking member 1200*a* may be approximately equal to the length 1125 of the bristles 1100. The leading hair blocking member may have any of the radial lengths and configurations discussed earlier with respect to other embodiments.

Preferably, the leading and trailing hair blocking members 1200*a*, 1200*b* are less flexible than the microfiber material 1620 and/or the compressible support 1630. An advantage of providing less-flexible hair blocking members is that the outer ends 1210*a*, 1210*b* may be less easily deformed towards the outer surface 1010 of brush roll 1000, thereby making it easier for the outer surface 1610 of the microfiber cleaning pad 1600 to be compressed, flexed, or otherwise deformed towards or preferably radially inwardly of the plane 1250.

FIGS. 84-88 illustrate another example of a brush roll 1000 having a leading hair blocking member 1200*a*, a hard floor cleaning pad 1600, and a trailing hair blocking member 1200*b* interacting with a floor surface 10 during rotation of the brush roll 1000. In this example, a substantially rigid support 1630 is provided for the microfiber material 1620. Accordingly, there may be relatively less, or essentially no, radially inward movement of the outer surface 1610 of the hard floor cleaning pad 1600 as it passes over the floor surface 10. This can be seen from FIGS. 85-87, in which all or substantially all of the inward deflection of the outer surface 1610 is due to compression of the microfiber material 1620.

FIGS. 89-92 illustrate an example of a brush roll 1000 having a leading hair blocking member 1200, a hard floor cleaning pad 1600 interacting with a floor surface 10 during rotation of the brush roll 1000, and no trailing hair blocking member 1200*b*. In this example, a compressible support 1630 is provided for the microfiber material 1620.

Figure 95:
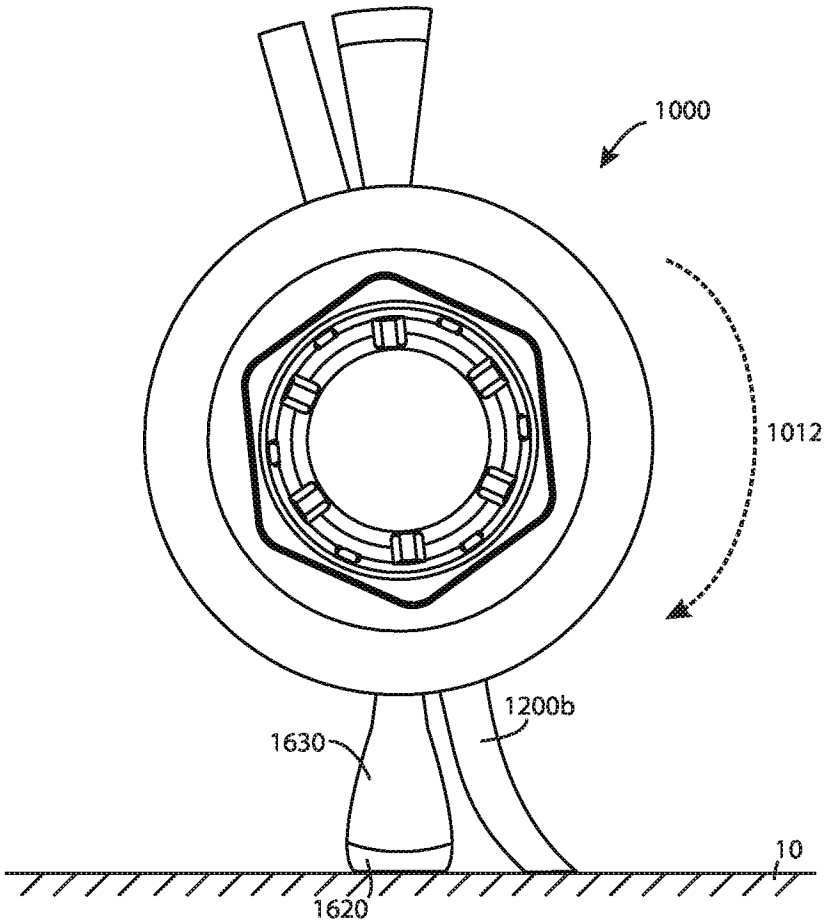

FIGS. 93-96 illustrate an example of a brush roll 1000 having a hard floor cleaning pad 1600 and a trailing hair blocking member 1200 interacting with a floor surface 10 during rotation of the brush roll 1000, and no leading hair blocking member 1200*a*. In this example, a compressible support 1630 is provided for the microfiber material 1620. As illustrated in FIGS. 95 and 95, in this example hair or other pieces of strand-like debris held or 'pinched' by the trailing hair blocking member 1200*b* may be partially or completely debrided from the microfiber material 1620, as discussed above with respect to FIG. 83.

FIGS. 97-101 illustrate an example of a brush roll 1000 having a leading hard floor cleaning pad 1600*a*, a bristle tuft 1100 provided with a sheath 1300 and with an internal blocking member 1500 embedded within the tuft, and a trailing hard floor cleaning pad 1600*b* interacting with a floor surface 10 during rotation of the brush roll 1000. In this example, rigid supports 1630 are provided for the hard floor cleaning pads. Such a configuration may facilitate the partial or complete dislodgement of hair, string, or other strand-like material from the bristles 1100 by the cleaning pads 1600*a*, 1600*b*.

Figure 97:
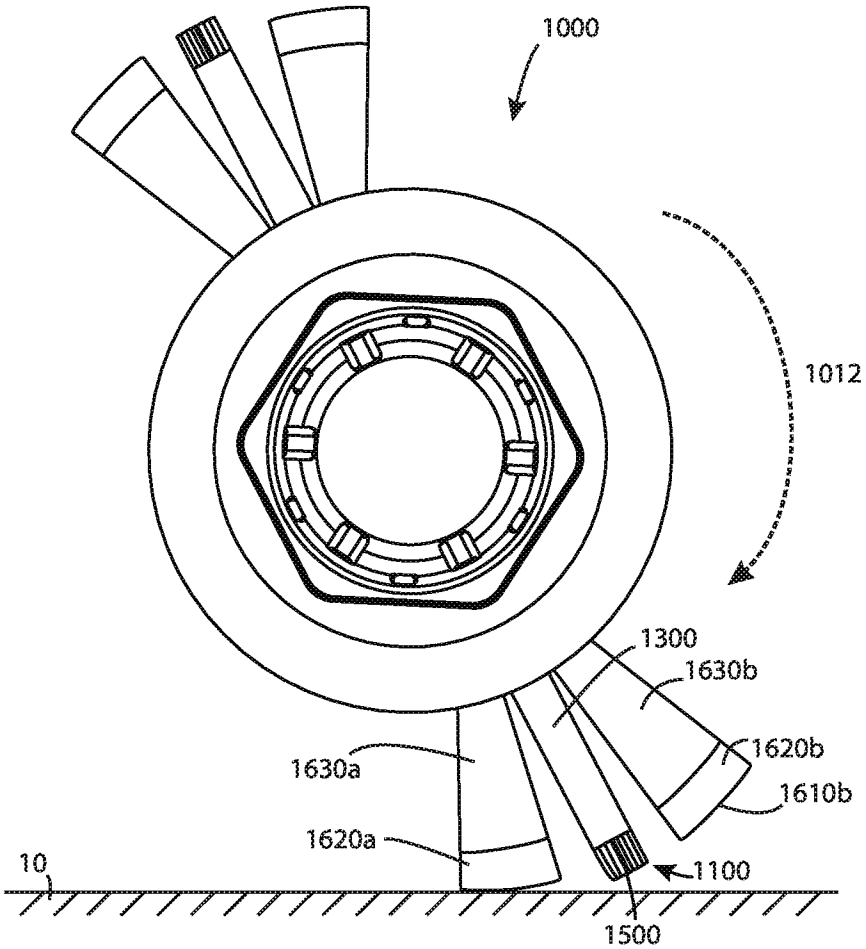
FIGS. 97 to 101 are a series of schematic end views showing a brush roll in accordance with another embodiment being rotated along a floor surface.
Figure 98:
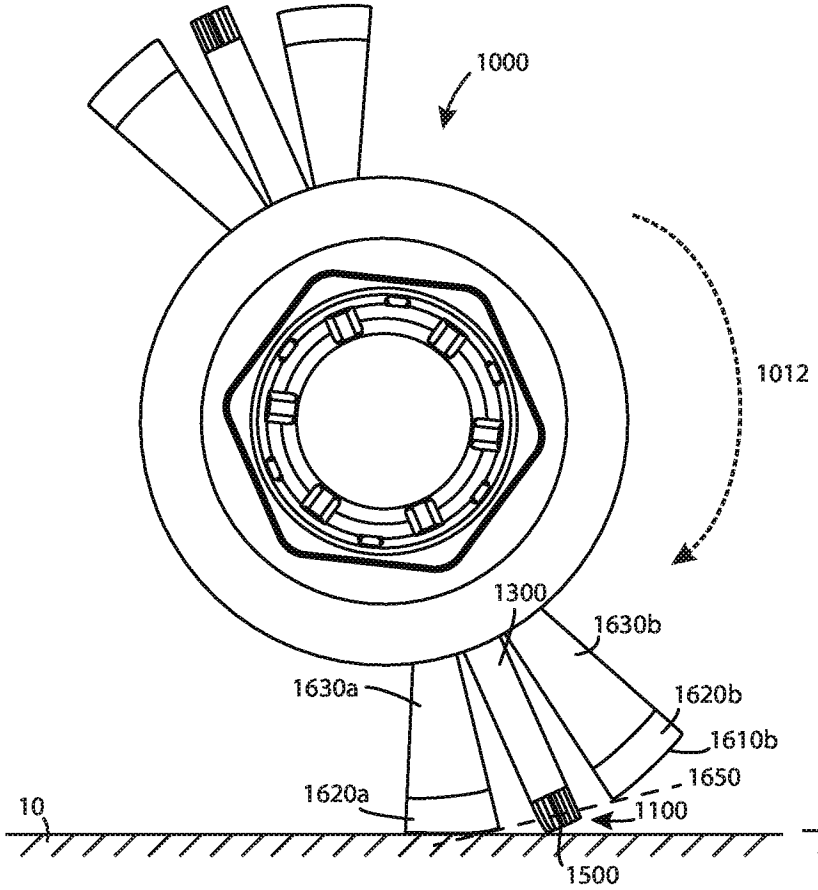

In FIG. 97, brush roll 1000 is at a position where the microfiber material 1620*a* of the leading hard floor cleaning pad 1600*a* is in contact with the floor surface 10. In FIG. 98, the brush roll 1000 has been further rotated so that the microfiber material 1620*a* has compressed and is sweeping over the floor surface 10, and the forward rotational side 1112 of the bristles 1100 has made contact with the floor surface 10.

Figure 99:
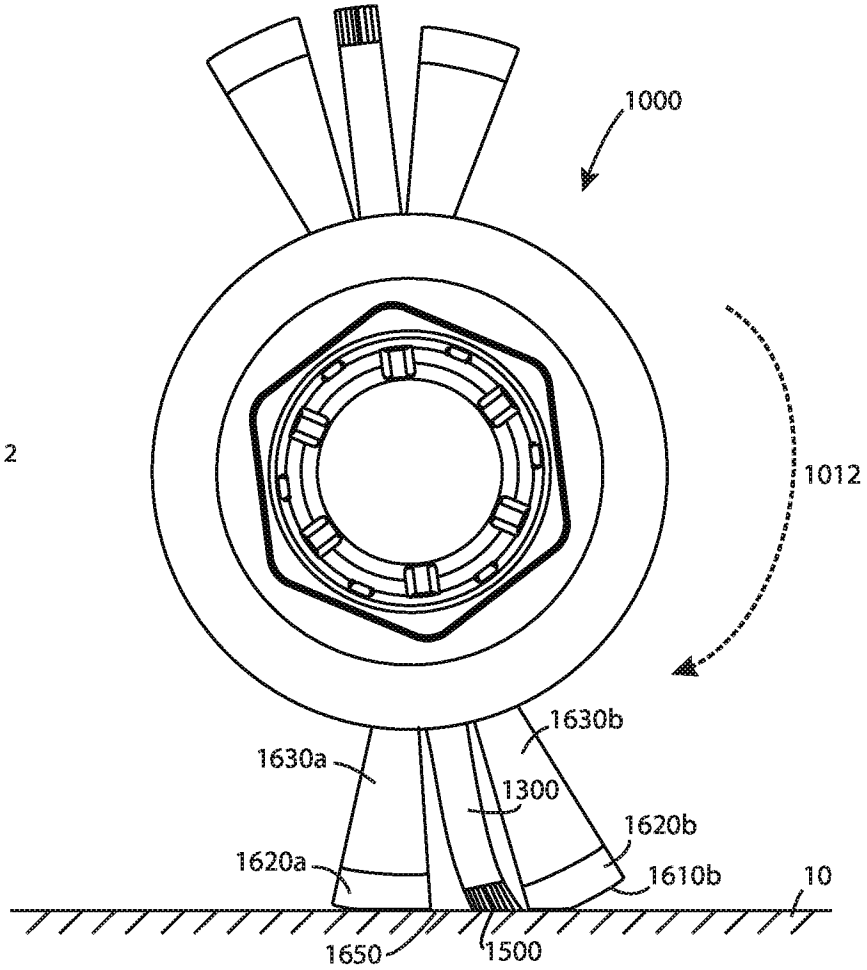

In FIG. 99, the brush roll 1000 is further rotated so that the microfiber material 1620*a* continues to sweep over the floor surface 10, and the bristles 1110 have been deflected by and are sweeping over the floor surface 10. The trailing hard floor cleaning pad 1600*b* is in contact with the floor surface 10, and microfiber material 1620*b* is being compressed such that its outer surface 1610*b* is radially closer to the axis 1005 of brush roll 1000. In this positions, the plane 1650 defined by the outer surfaces 1610*a*, 1610*b* of the hard floor cleaning pads 1600*a*, 1600*b* is approximately co-incident with the floor surface 10. Also, in this position the outer ends 1110 of the bristles 1100 are also approximately co-incident with the floor surface 10.

In this way, hair or other pieces of strand-like debris may be drawn outwardly towards the ends 1110 of the bristles 1100 by the hard floor cleaning pads 1600*a*, 1600*b*, in a manner akin to the example discussed above in FIG. 9 (with the outer surfaces 1610*a*, 1610*b* of the hard floor cleaning pads 1600*a*, 1600*b* acting in an analogous manner to the ends 1210*a*, 1210*b* of the hair blocking members 1200).

Figure 100:
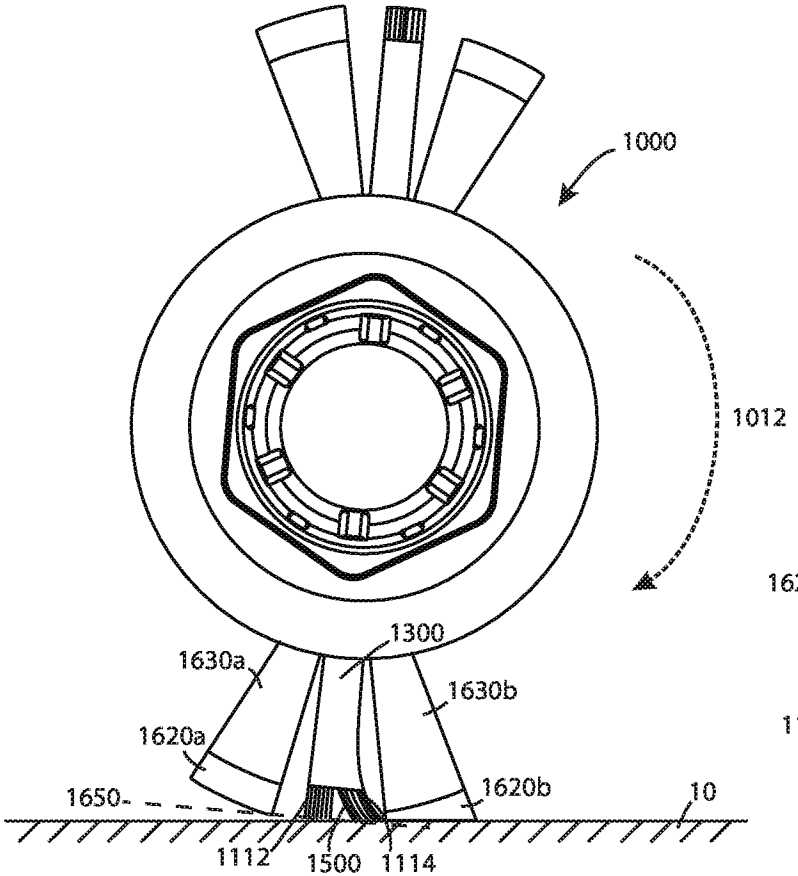

In FIG. 100, the brush roll 1000 has been further rotated so that the microfiber material 1620*a* is out of contact with the floor surface 10, and the bristles 1110 continue to sweep over the floor surface 10. The microfiber material 1620*b* of the trailing hard floor cleaning pad 1600*b* remains in contact with the floor surface 10, and remains compressed. In this position, hair or other pieces of strand-like debris held or 'pinched' by the microfiber material 1620*b* may be partially or completely debrided from the bristles 1110, in a manner akin to the example discussed above in FIG. 10 (with the outer surface 1610*b* of the hard floor cleaning pad 1600*b* acting in an analogous manner to the end 1210*b* of the hair blocking member 1200*b*).

Figure 101:
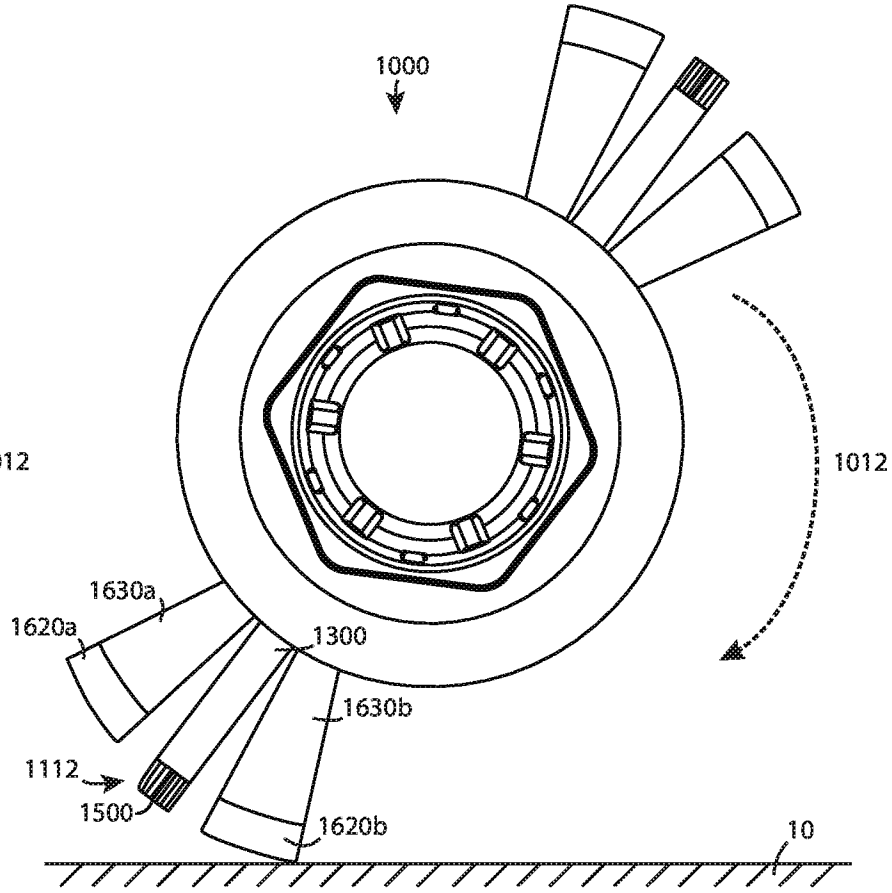

In FIG. 101, the brush roll 1000 has been further rotated so that the microfiber material 1620*b* is just out of contact with the floor surface 10.

Brush Roll with Flexible Columns

The flowing is a description of different features of a rotatable brush roll that has a plurality of flexible columns. These features may be used by themselves in any brush roll or in any combination or sub-combination with any other feature or features described herein. For example, any of the features of the flexible columns described herein may be used with any one or more of the bristles with leading and trailing blocking members, sheath-encased bristles, heating element, internal hair blocking members, hard floor cleaning pad and flexible protective pad member, and other features described herein.

Referring to FIGS. 102 to 113, a rotatable brush roll is provided with a plurality of flexible columns or posts 1500. When brush 1000 is rotated, the flexible posts 1500 may provide mechanical agitation of a surface being cleaned. The flexible posts 1500 may be provided instead of, or in addition to other agitation members, such as bristles 1100 and/or hard floor cleaning pads 1600.

The flexible posts may be located on the leading side and/or the trailing side of the bristles.

Figure 102:
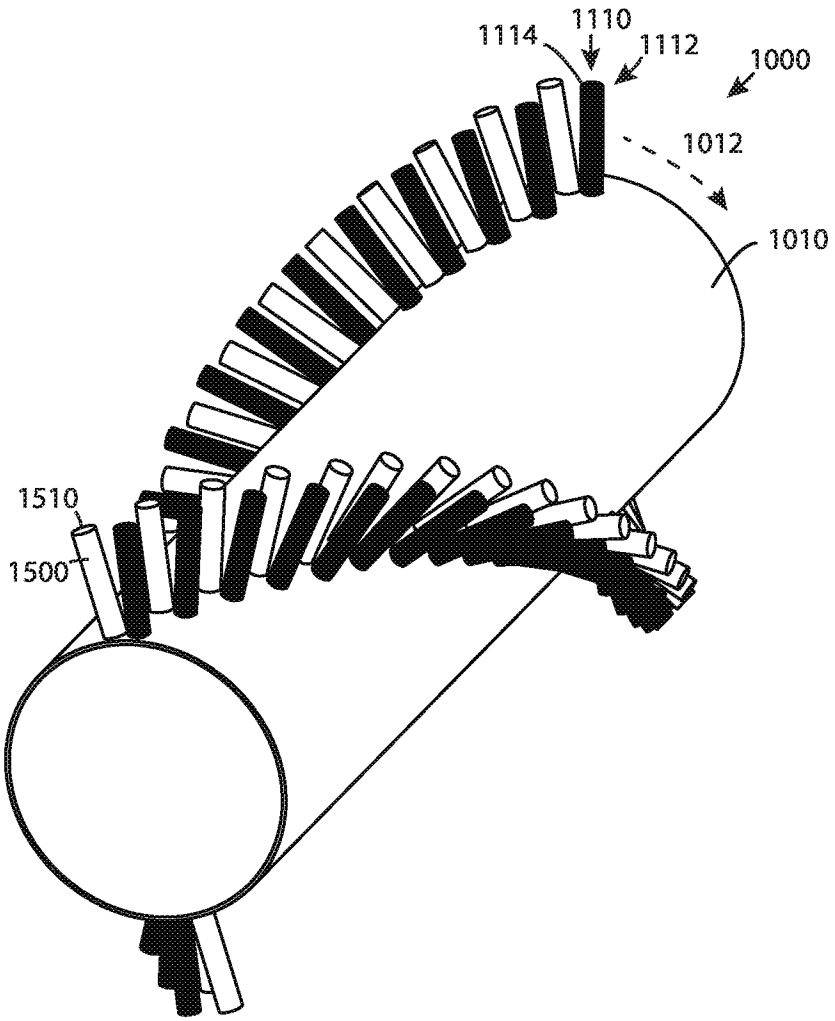
FIG. 102 is a perspective view of a brush roll in accordance with another embodiment, with agitating members and bristle tufts.
Figure 103:
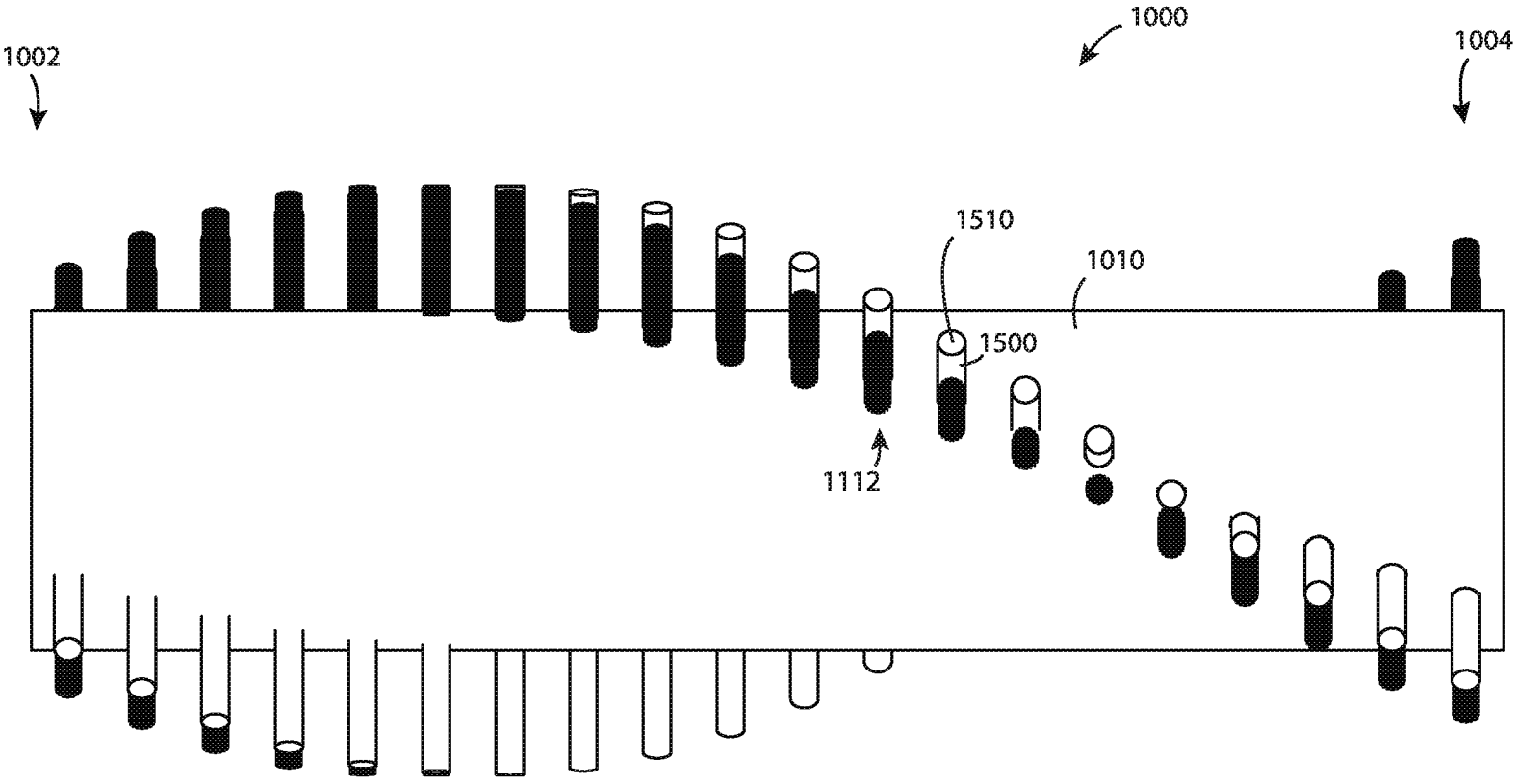
FIG. 103 is a top view of the brush roll of FIG. 102.

In the example illustrated in FIGS. 102 and 103, a plurality of flexible columns or posts 1500 are provided adjacent the rearward or trailing rotational side 1114 of bristle tufts 1100, and trail the bristle tufts 1100 as the brush roll is rotated in rotational direction 1012.

Figure 104:
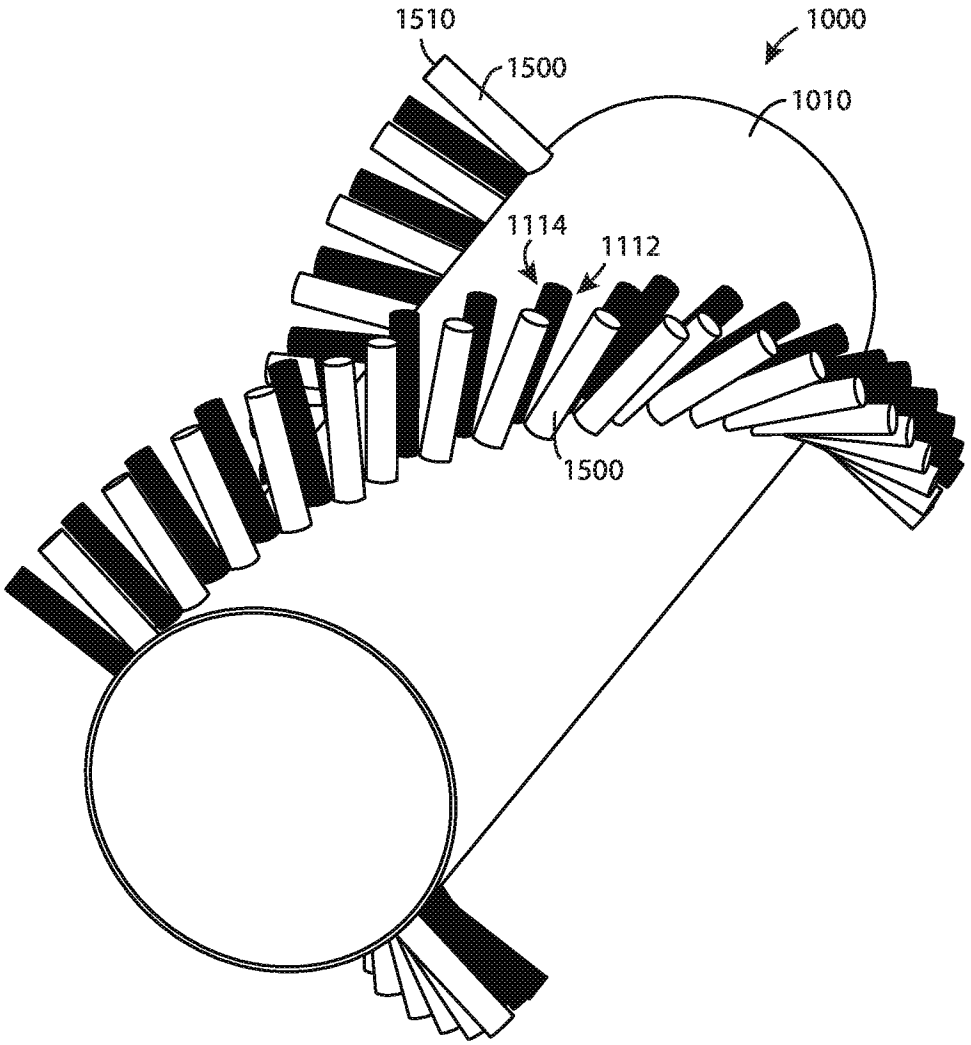
FIG. 104 is a perspective view of a brush roll in accordance with another embodiment, with agitating members and bristle tufts.
Figure 105:
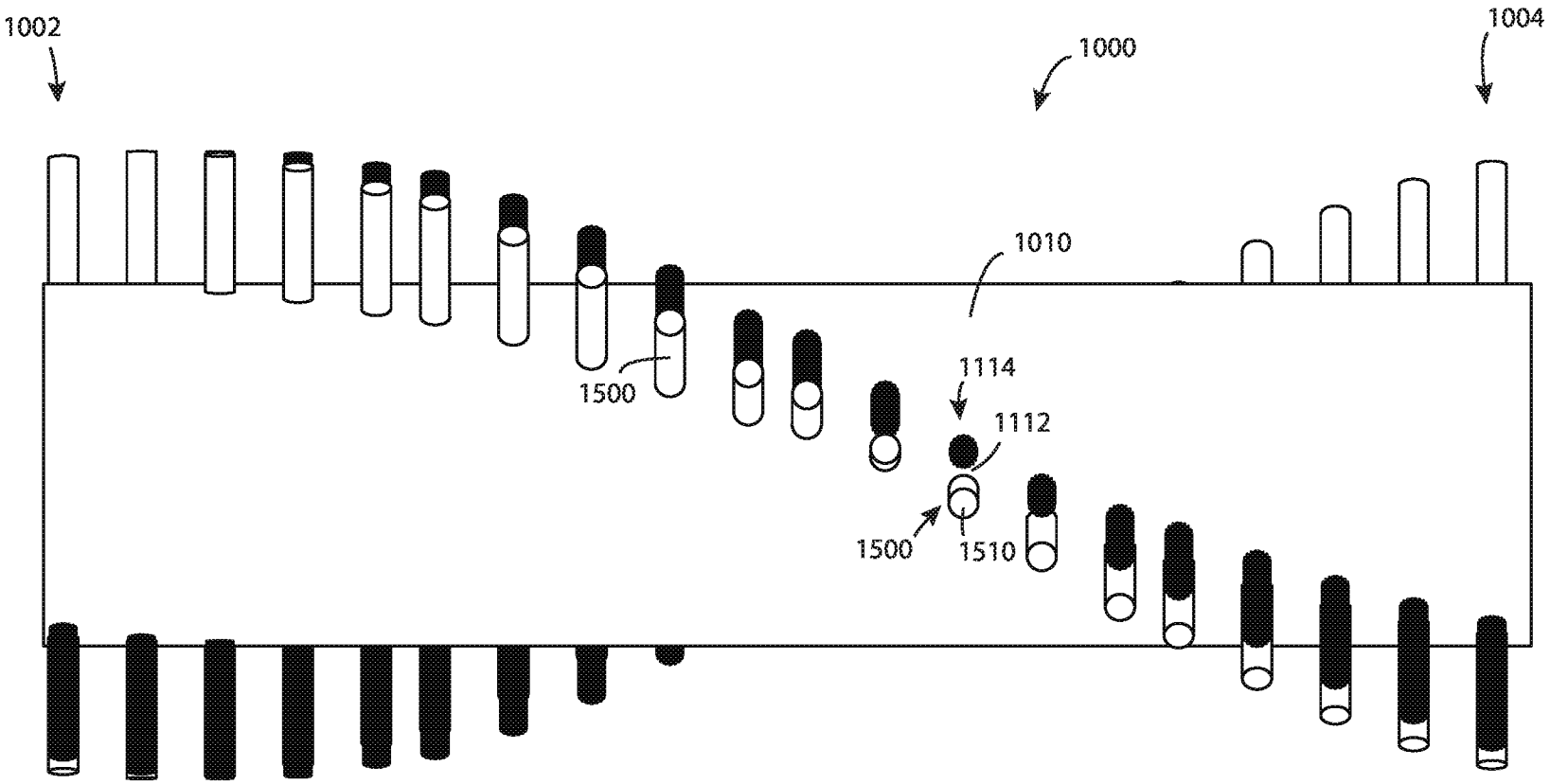
FIG. 105 is a top view of the brush roll of FIG. 104.

In the example illustrated in FIGS. 104 and 105, a plurality of flexible columns or posts 1500 are provided adjacent the forward or leading rotational side 1112 of bristle tufts 1100, and precede the bristle tufts 1100 as the brush roll is rotated in rotational direction 1012.

Figure 106:
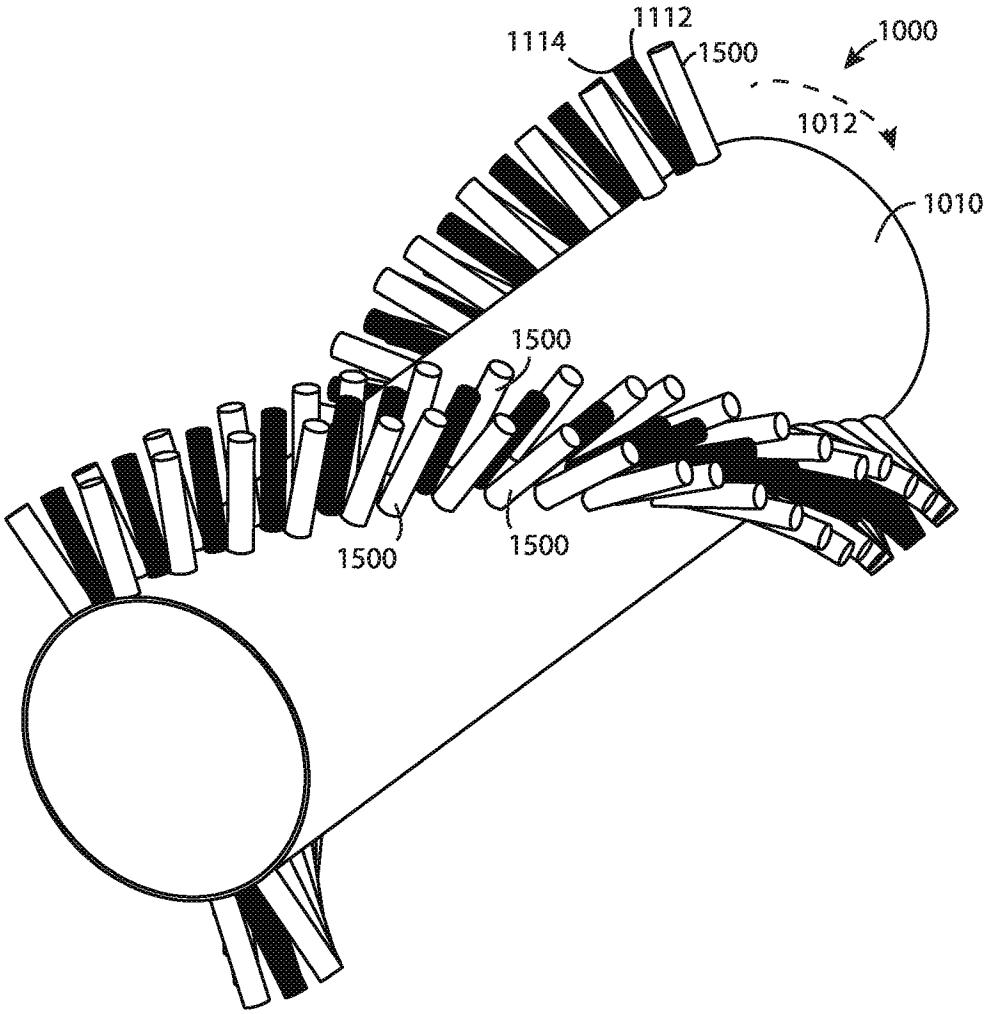
FIG. 106 is a perspective view of a brush roll in accordance with another embodiment, with agitating members and bristle tufts.
Figure 107:
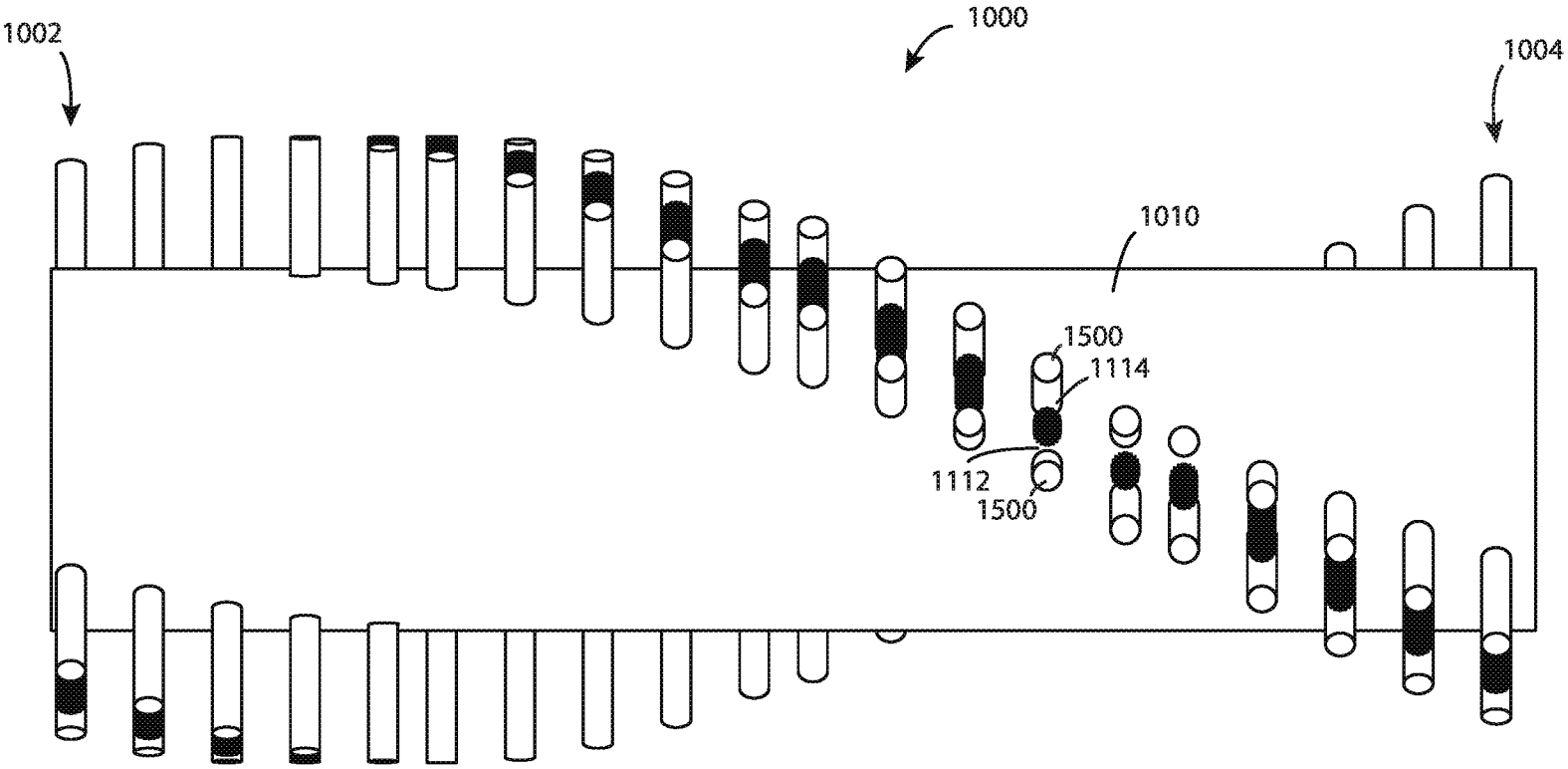
FIG. 107 is a top view of the brush roll of FIG. 106.

In the example illustrated in FIGS. 106 and 107, a plurality of flexible columns or posts 1500*a* are provided adjacent the forward rotational side 1112 of bristle tufts 1100, and a plurality of flexible columns or posts 1500*b* are provided adjacent the rearward rotational side 1114 of bristle tufts 1100.

Figure 108:
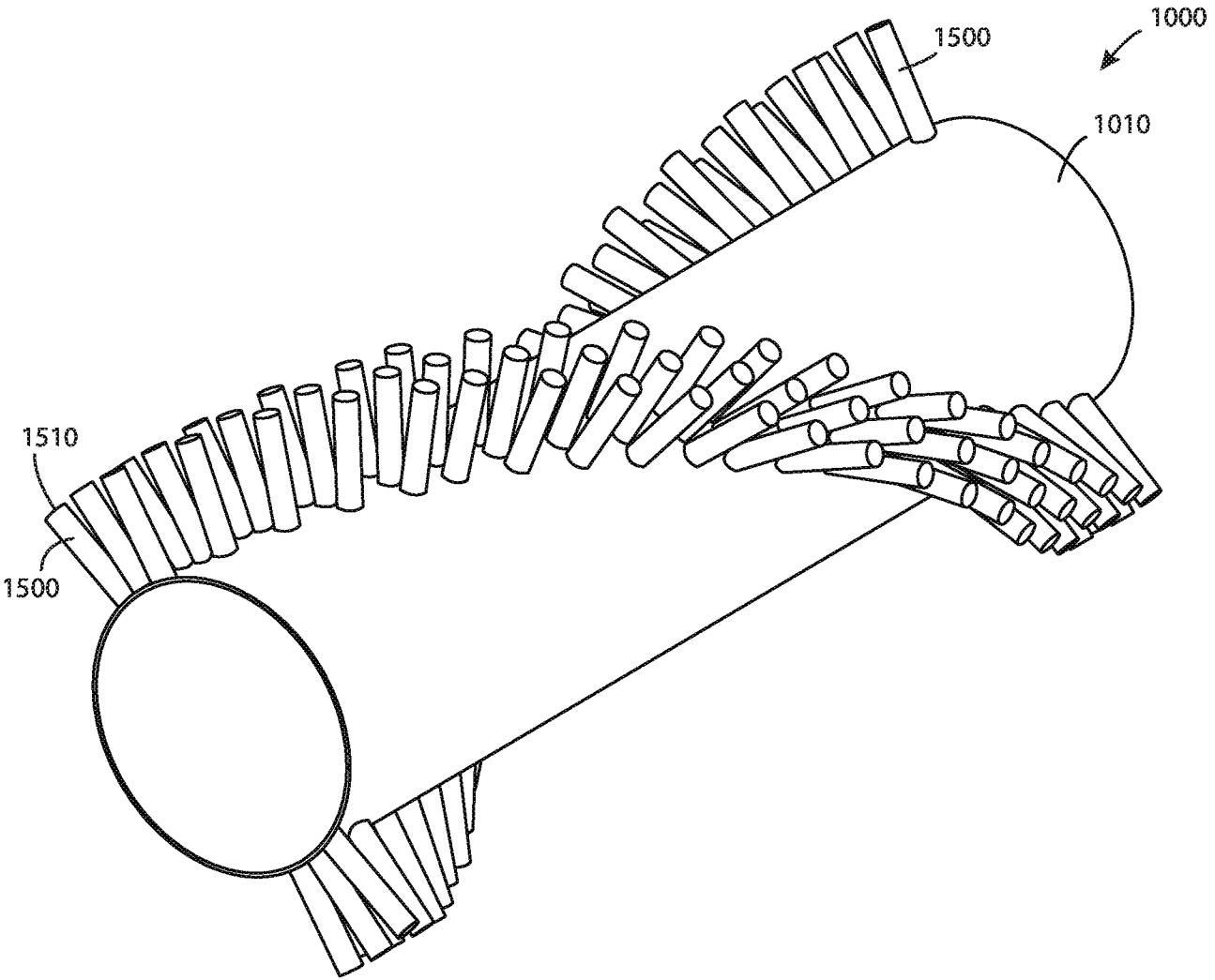
FIG. 108 is a perspective view of a brush roll in accordance with another embodiment, with agitating members.
Figure 109:
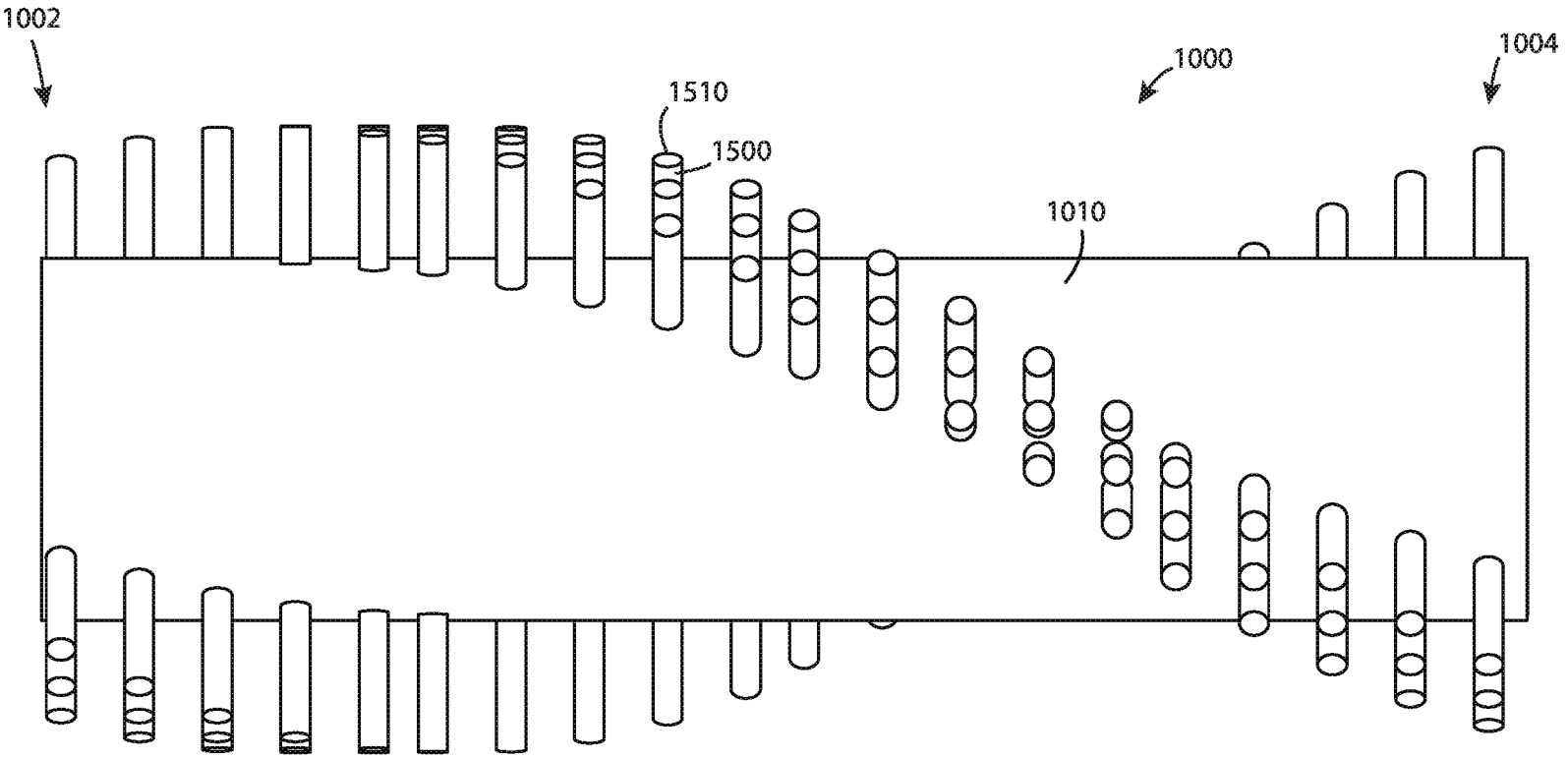
FIG. 109 is a top view of the brush roll of FIG. 108.
Figure 110:
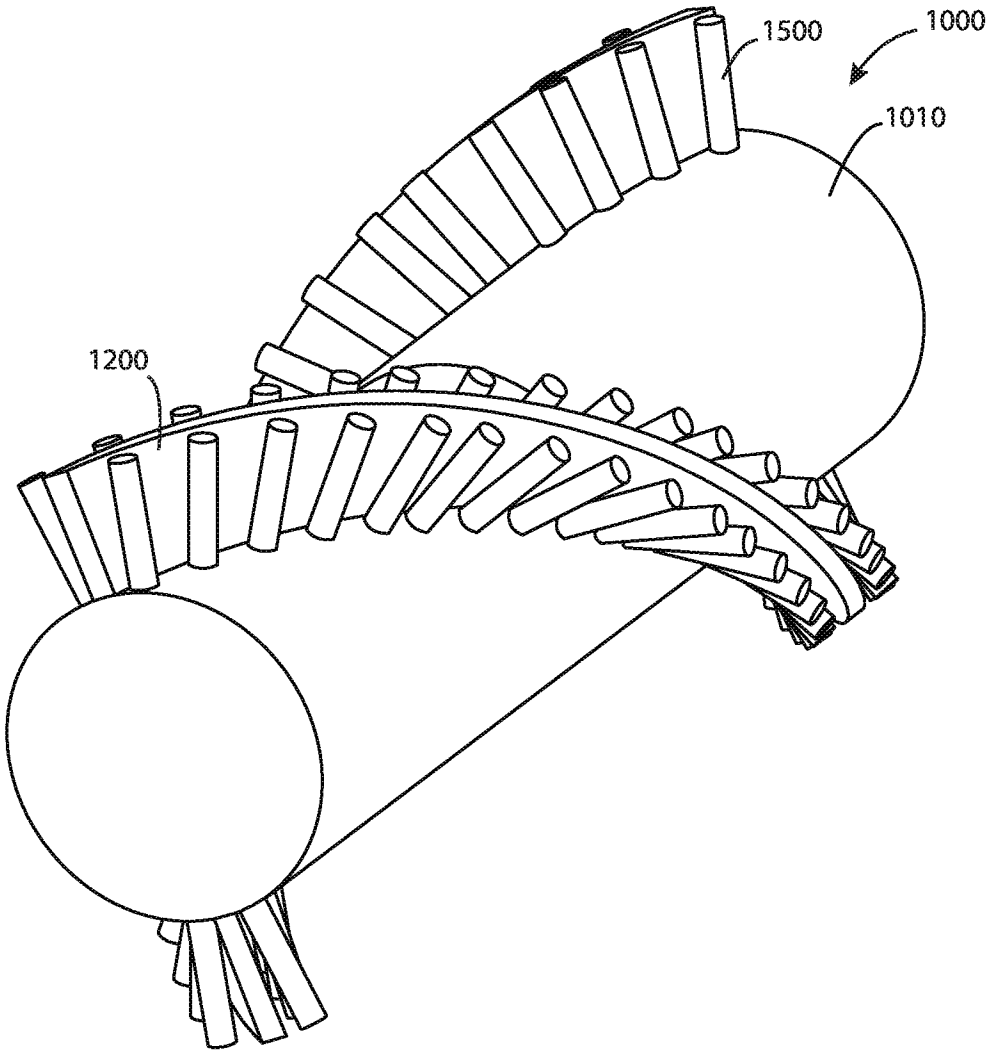
FIG. 110 is a perspective view of a brush roll in accordance with another embodiment, with agitating members and hair blocking members.
Figure 111:
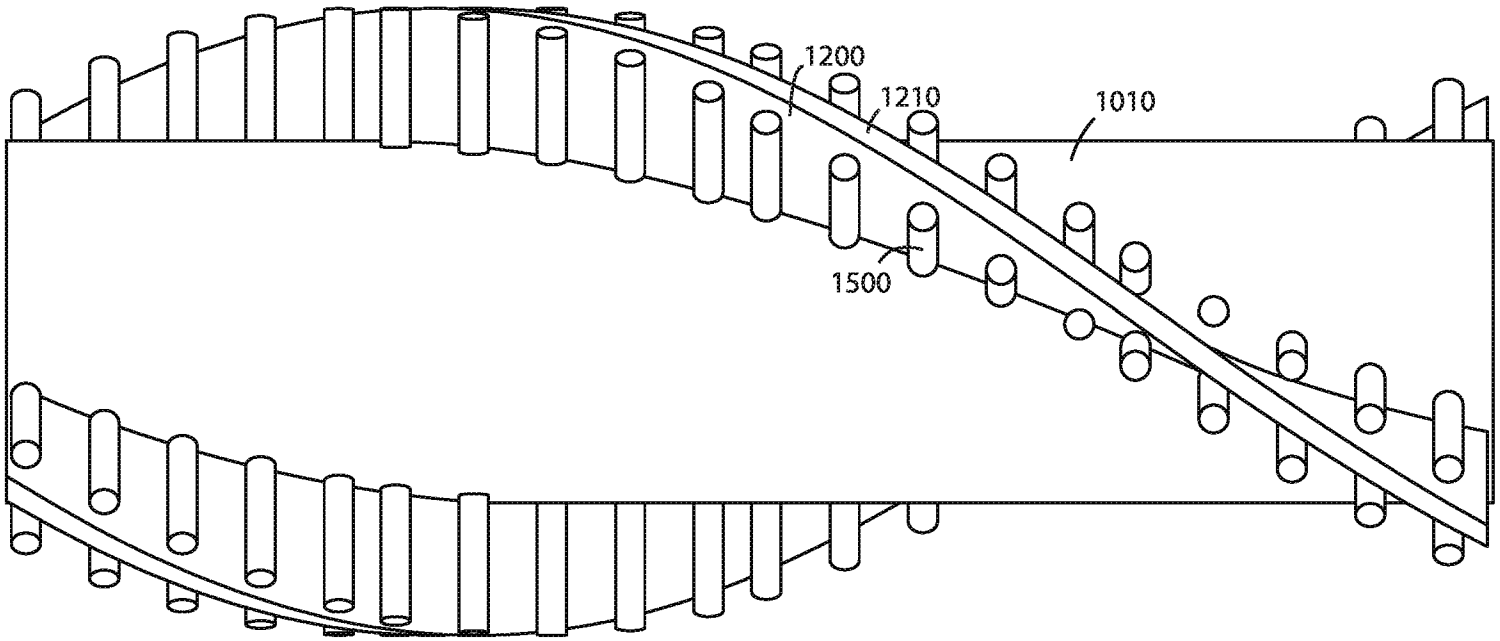
FIG. 111 is a top view of the brush roll of FIG. 110.
Figure 112:
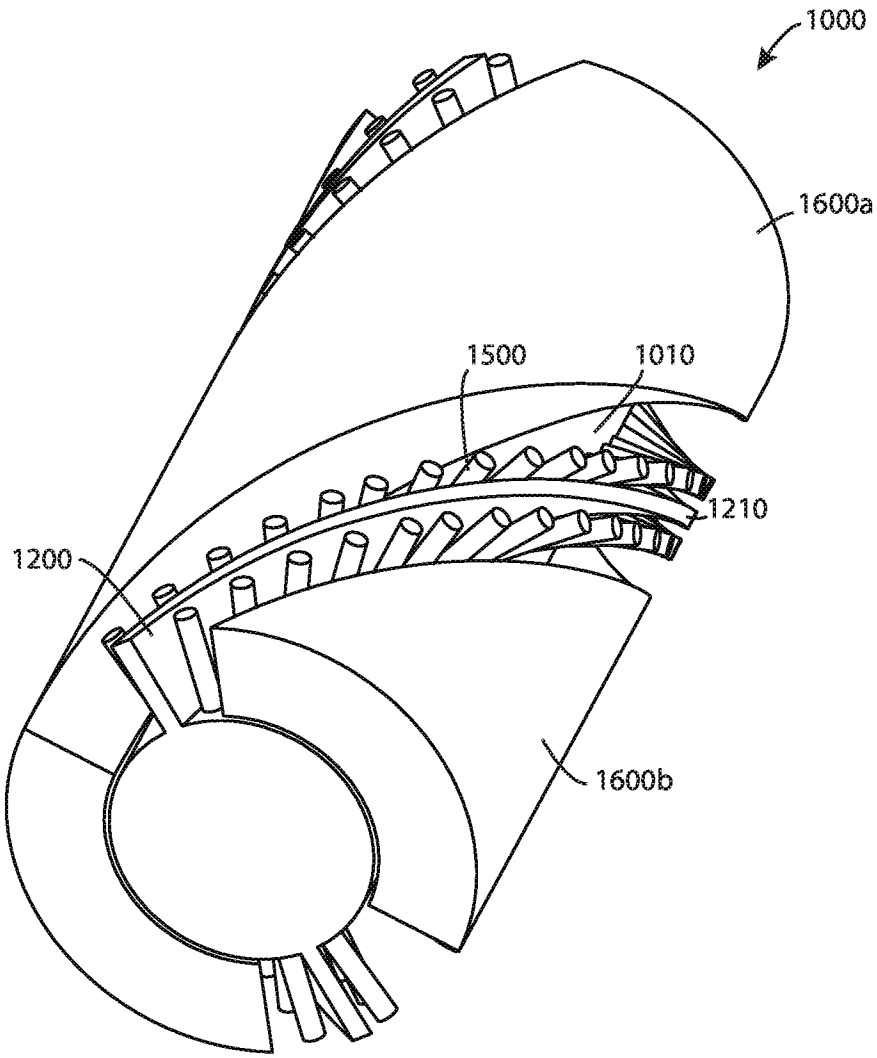
FIG. 112 is a perspective view of a brush roll in accordance with another embodiment, with agitating members, hair blocking members, and hard floor cleaning pads.
Figure 113:
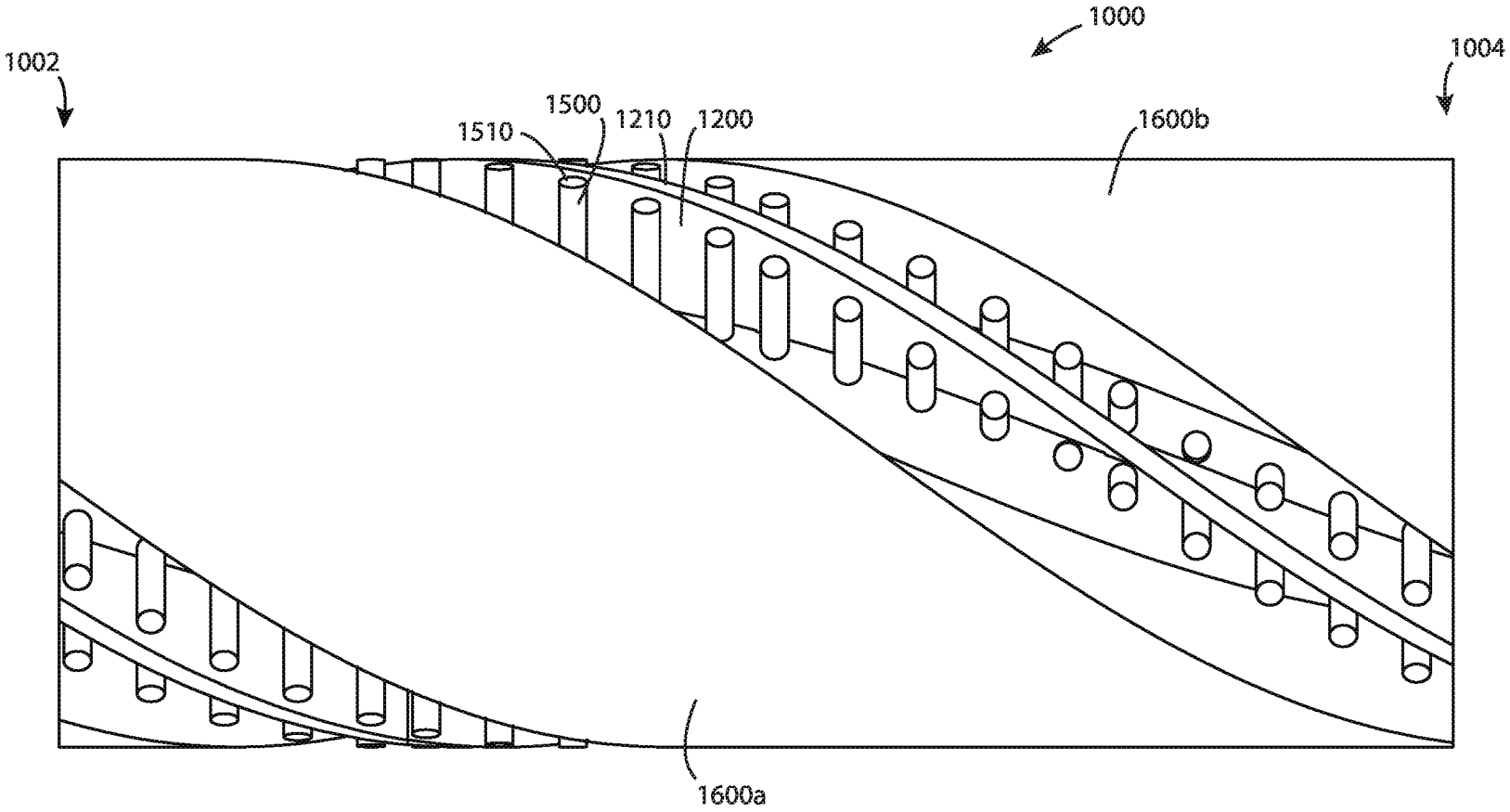
FIG. 113 is a top view of the brush roll of FIG. 110.

In the example illustrated in FIGS. 108 and 109, a plurality of flexible columns or posts 1500 are arranged in three rows that extend from the first end 1002 to the second end 1004 of the brush roll 1000. It will be appreciated that one or more rows of posts may be provided.

It will be appreciated that any hair blocking member disclosed herein may be used in combination with posts 1500, whether the posts are used in an embodiment with bristles or without bristles. In the example illustrated in FIGS. 110 and 111, a plurality of flexible columns or posts 1500 are arranged forward and rearward of a hair blocking member 1200.

It will be appreciated that posts 1500 may be used in combination with a floor cleaning pad, whether the posts are used in an embodiment with bristles or without bristles and with or without a hair blocking member. In the example illustrated in FIGS. 112 and 113, a plurality of flexible columns or posts 1500 are arranged forward and rearward of a hair blocking member 1200, and hard floor cleaning pads 1600*a*, 1600*b* are also provided.

Brush Roll with Hair Blocking Member

The flowing is a description of different features of a rotatable brush roll that has at least one hair blocking member provided adjacent a row of bristles or bristle tufts. These features may be used by themselves in any brush roll or in any combination or sub-combination with any other feature or features described herein. For example, any of the features of the hair blocking member described herein may be used with any one or more of the bristles with leading and trailing blocking members, sheath-encased bristles, heating element, internal hair blocking members, hard floor cleaning pad and flexible protective pad member, and other features described herein.

Referring to FIGS. 114 to 117, a rotatable brush roll is provided with a hair blocking member 1200 provided adjacent a row 1103 of bristles or bristle tufts 1100. The hair blocking member 1200 may inhibit or prevent hair, string, or other strand-like material from becoming wound about the outer surface 1010 of the brush roll 1000, and/or from becoming embedded in the bristles.

Figure 114:
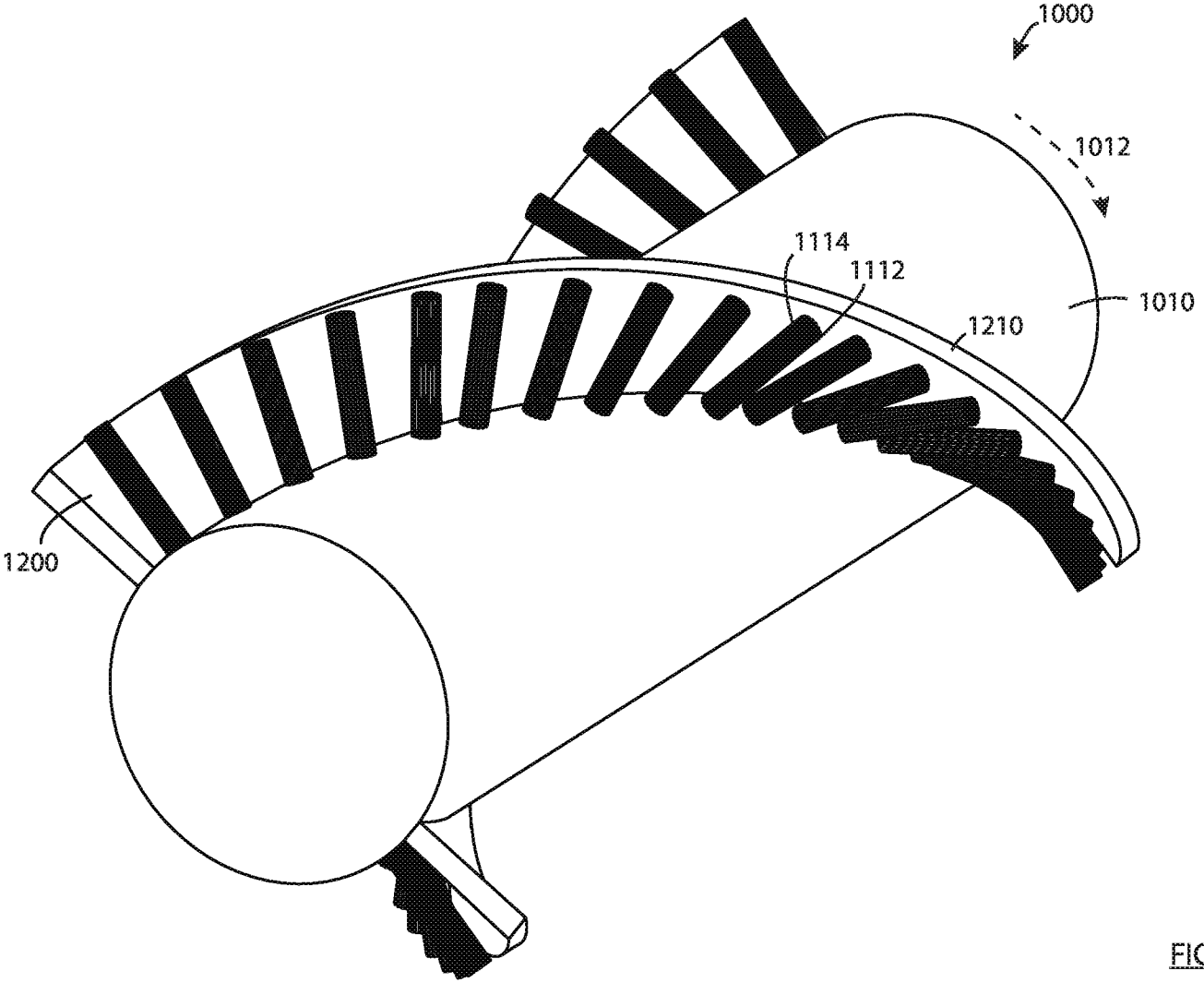
FIG. 114 is a perspective view of a brush roll in accordance with another embodiment, with hair blocking members and bristle tufts.
Figure 115:
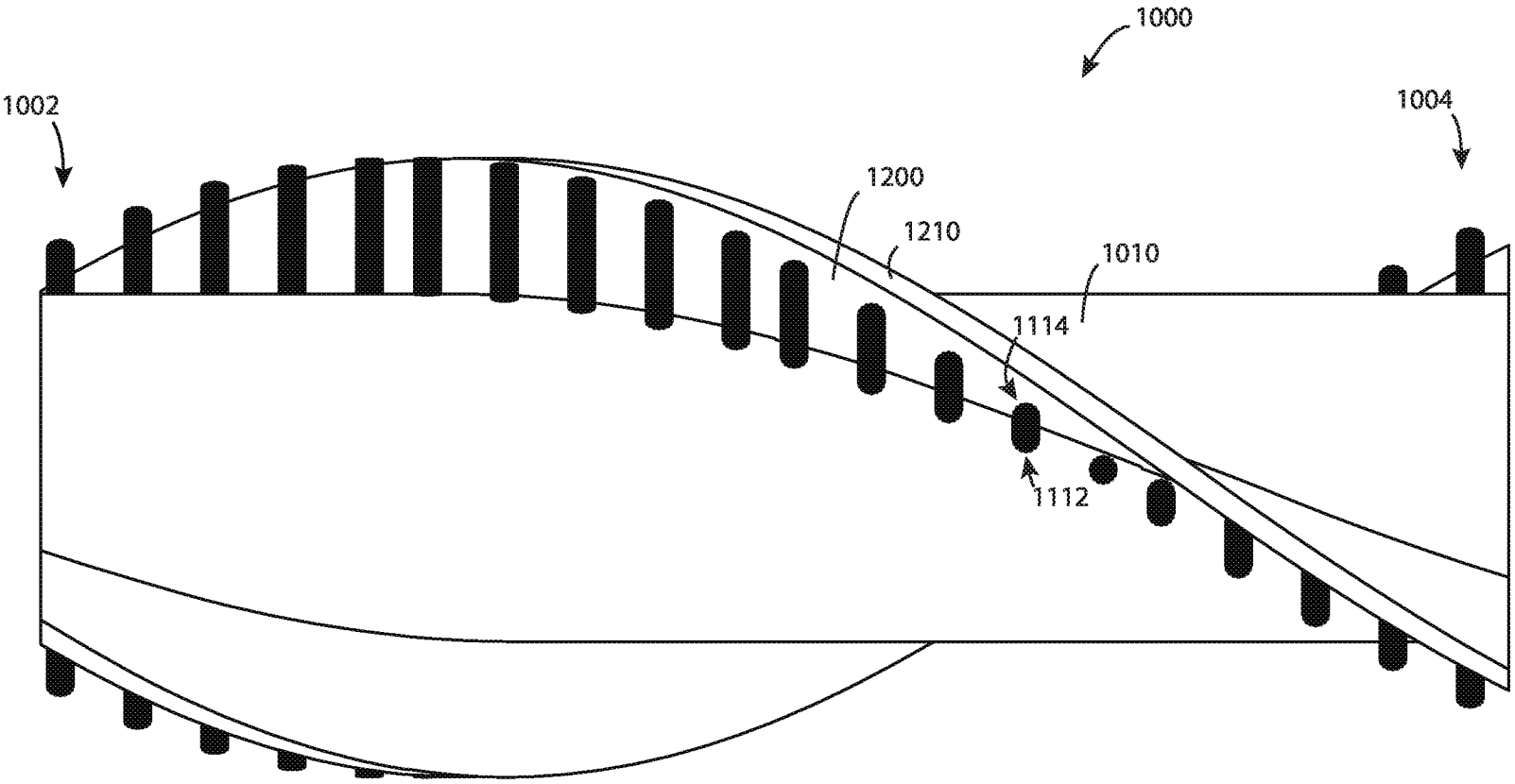
FIG. 115 is a top view of the brush roll of FIG. 114.

In the example illustrated in FIGS. 114 and 115, a hair blocking member 1200 is provided adjacent the rearward rotational side 1114 of bristle tufts 1100, and trails the bristle tufts 1100 as the brush roll is rotated in rotational direction 1012.

Figure 116:
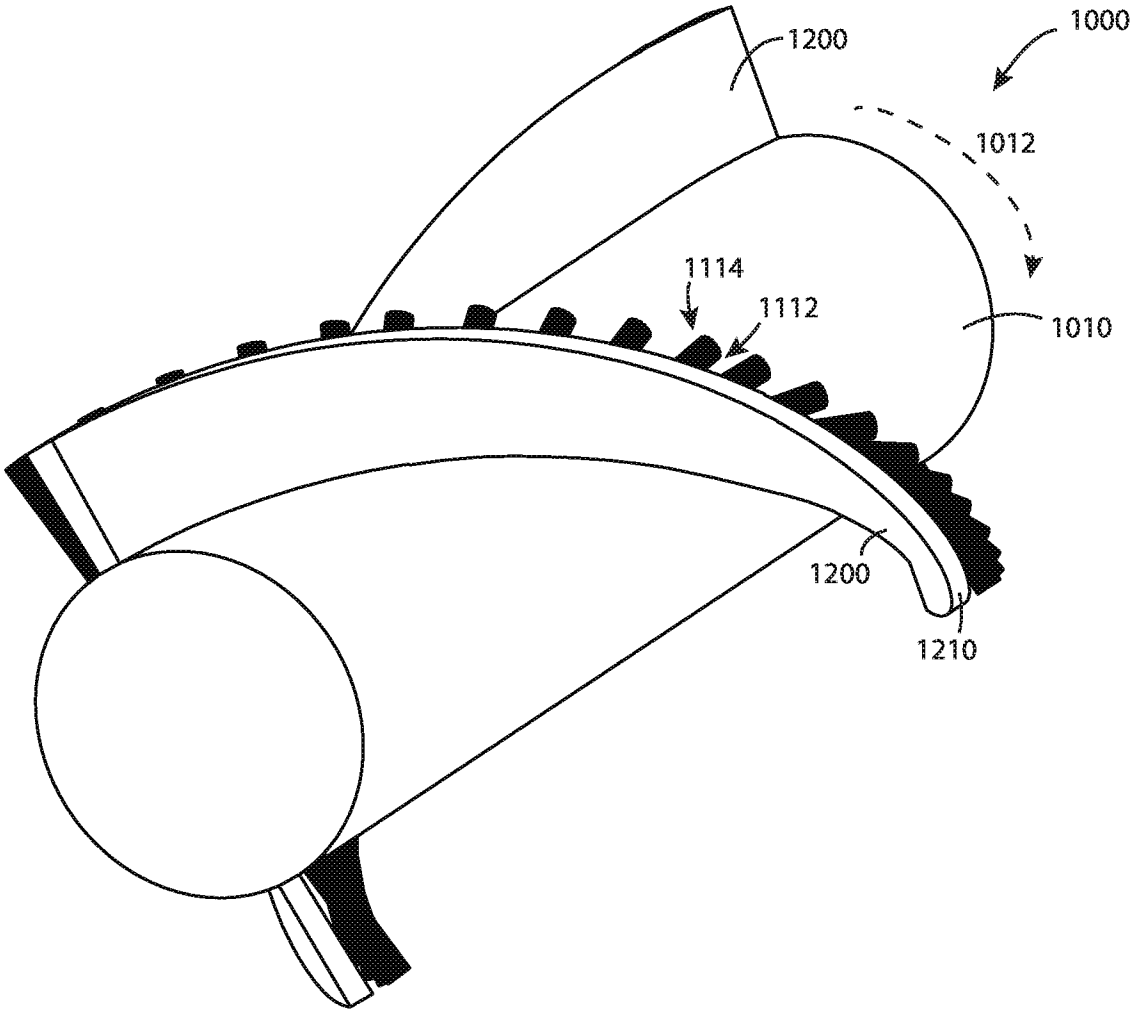
FIG. 116 is a perspective view of a brush roll in accordance with another embodiment, with hair blocking members and bristle tufts.
Figure 117:
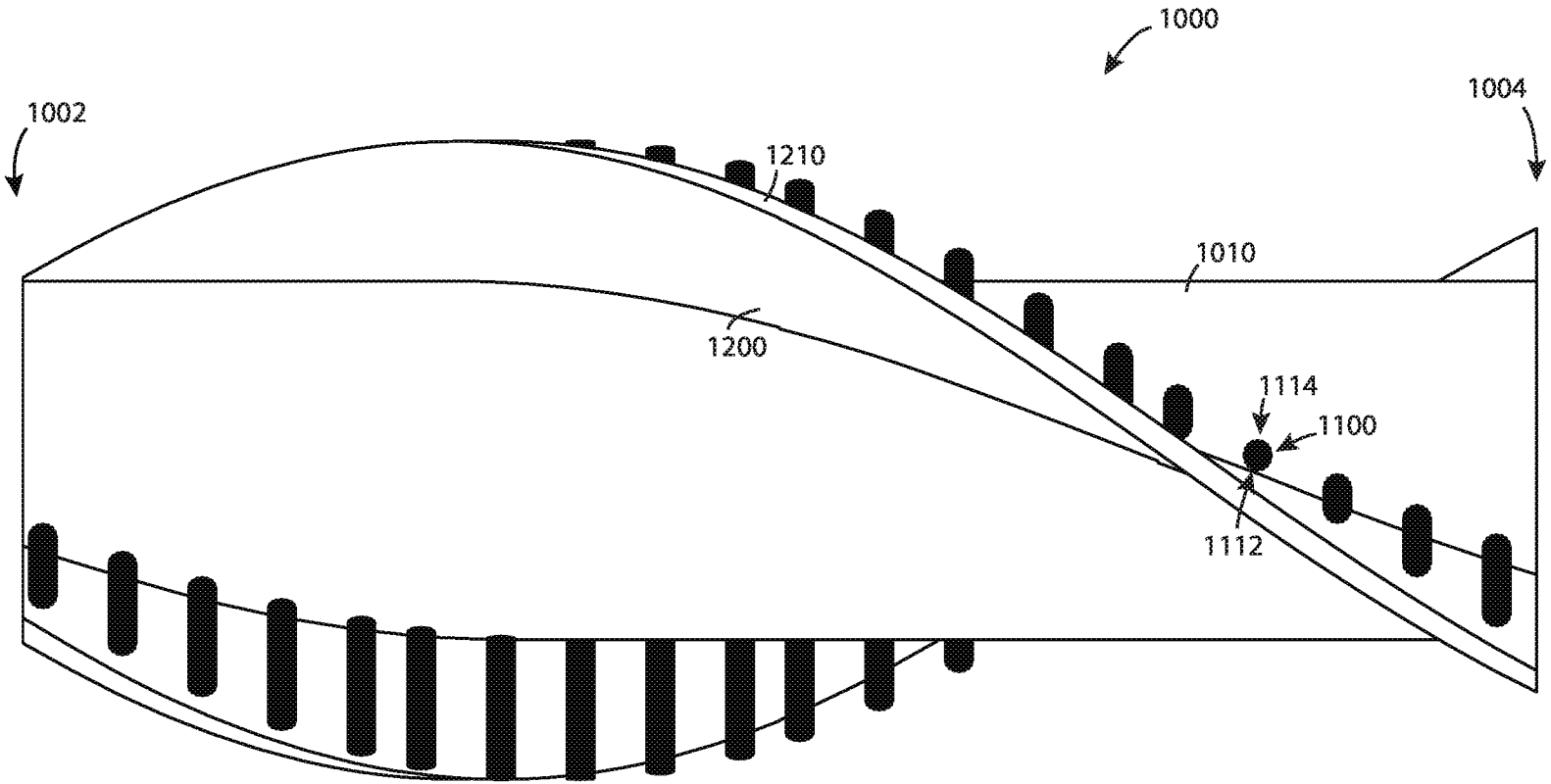
FIG. 117 is a top view of the brush roll of FIG. 116.

In the example illustrated in FIGS. 116 and 117, a hair blocking member 1200 is provided adjacent the forward rotational side 1112 of bristle tufts 1100, and precede the bristle tufts 1100 as the brush roll is rotated in rotational direction 1012.

The hair blocking member may be spaced from the bristle tufts the same amount as discussed previously respect to other hair blocking members and may have a length the same as discussed previously with respect to other hair blocking members.

As used herein, the wording "and/or" is intended to represent an inclusive-or. That is, "X and/or Y" is intended to mean X or Y or both, for example. As a further example, "X, Y, and/or Z" is intended to mean X or Y or Z or any combination thereof.

While the above description describes features of example embodiments, it will be appreciated that some features and/or functions of the described embodiments are susceptible to modification without departing from the spirit and principles of operation of the described embodiments. For example, the various characteristics which are described by means of the represented embodiments or examples may be selectively combined with each other. Accordingly, what has been described above is intended to be illustrative of the claimed concept and non-limiting. It will be understood by persons skilled in the art that other variants and modifications may be made without departing from the scope of the invention as defined in the claims appended hereto. The scope of the claims should not be limited by the preferred embodiments and examples, but should be given the broadest interpretation consistent with the description as a whole.

The invention claimed is:

1. A surface cleaning apparatus comprising:

a) an air flow path extending from a dirty air inlet to a clean air outlet with an air treatment member and a suction motor provided in the air flow path;

b) a rotatably mounted brush associated with the dirty air inlet, the rotatably mounted brush having an axis of rotation, a length in the axial direction and a radial outer surface; and, c) a plurality of bristles extending outwardly from the radial outer surface, the bristles having a bristle length from the radial outer surface to an outer end of the bristles, wherein at least some of the bristles are encased in a sheath which extends at least 50% of the length of the bristles and terminates prior to the outer end, wherein the sheath is flexible.

2. The surface cleaning apparatus of claim 1 wherein the rotatable brush comprises a plurality of tufts wherein each tuft comprises a plurality of bristles wherein at least some of the tufts are encased in a sheath.

3. The surface cleaning apparatus of claim 2 wherein the tufts are spaced apart from each other and extend along the length of the rotatably mounted brush.

4. A surface cleaning apparatus comprising:

a) an air flow path extending from a dirty air inlet to a clean air outlet with an air treatment member and a suction motor provided in the air flow path;

b) a rotatably mounted brush associated with the dirty air inlet, the rotatably mounted brush having an axis of rotation, a length in the axial direction and a radial outer surface; and, c) a plurality of bristles extending outwardly from the radial outer surface, the bristles having a bristle length from the radial outer surface to an outer end of the bristles, wherein at least some of the bristles are encased in a sheath which extends at least 50% of the length of the bristles and terminate prior to the outer end, wherein the sheath is generally circular in cross-section in a direction transverse to a radial length of the tufts.

5. The surface cleaning apparatus of claim 1 wherein the sheath is comprised of an elastomeric material.

6. The surface cleaning apparatus of claim 1 wherein the sheath extends along at least 75% of the length of the bristles.

7. The surface cleaning apparatus of claim 1 wherein the sheath extends along at least 90% of the length of the bristles.

8. A surface cleaning apparatus comprising:

a) an air flow path extending from a dirty air inlet to a clean air outlet with an air treatment member and a suction motor provided in the air flow path;

b) a rotatably mounted brush associated with the dirty air inlet, the rotatably mounted brush having an axis of rotation, a length in the axial direction and a radial outer surface; and, c) a plurality of bristles extending outwardly from the radial outer surface, the bristles having a bristle length from the radial outer surface to an outer end of the bristles, wherein at least some of the bristles are encased in a sheath which extends along at least 75% of the length of the bristles and terminates prior to the outer end.

9. The surface cleaning apparatus of claim 1 wherein the sheath extends along at least 90% of the length of the bristles.

10. The surface cleaning apparatus of claim 4 wherein the sheath is flexible.

11. A surface cleaning apparatus comprising:

a) an air flow path extending from a dirty air inlet to a clean air outlet with an air treatment member and a suction motor provided in the air flow path; and, b) a rotatably mounted brush associated with the dirty air inlet, the rotatably mounted brush having an axis of rotation, a length in the axial direction and a radial outer surface, a plurality of tufts extending outwardly from the radial outer surface, each tuft comprising a plurality of bristles, wherein a radial inner portion of the bristles of at least some of the tufts, which radial inner portion is located outwardly from the radial outer surface of the rotatably mounted brush, are secured together to inhibit ingress of hairs, wherein the radial inner portion is at least 75% of a length of the bristles from the radial outer surface to an outer end of the bristles, wherein the radial inner portion terminates prior to the outer end.

12. The surface cleaning apparatus of claim 11 wherein the radial inner portion is flexible.

* * * * *